US009118115B2

(12) United States Patent
Alexopoulos et al.

(10) Patent No.: US 9,118,115 B2
(45) Date of Patent: Aug. 25, 2015

(54) INTERWOVEN SPIRAL ANTENNA

(75) Inventors: Nicolaos G. Alexopoulos, Irvine, CA (US); Seunghwan Yoon, Costa Mesa, CA (US)

(73) Assignee: Broadcom Corporation, Irvine, CA (US)

( * ) Notice: Subject to any disclaimer, the term of this patent is extended or adjusted under 35 U.S.C. 154(b) by 137 days.

(21) Appl. No.: 13/249,534

(22) Filed: Sep. 30, 2011

(65) Prior Publication Data

US 2013/0009837 A1 Jan. 10, 2013

Related U.S. Application Data

(60) Provisional application No. 61/504,408, filed on Jul. 5, 2011.

(51) Int. Cl.

| | |
|---|---|
| ***H01Q 1/38*** | (2006.01) |
| ***H01Q 1/36*** | (2006.01) |
| ***H01Q 9/27*** | (2006.01) |
| ***H01Q 21/24*** | (2006.01) |

(52) U.S. Cl.

CPC . *H01Q 1/36* (2013.01); *H01Q 9/27* (2013.01); *H01Q 21/24* (2013.01)

(58) Field of Classification Search

USPC ..... 343/834, 700 MS, 702, 843

See application file for complete search history.

(56) References Cited

U.S. PATENT DOCUMENTS

| | | | | |
|---|---|---|---|---|
| 4,243,993 | A * | 1/1981 | Lamberty et al. | 343/895 |
| 4,605,934 | A * | 8/1986 | Andrews | 343/895 |
| 5,313,216 | A * | 5/1994 | Wang et al. | 343/700 MS |
| 6,023,250 | A * | 2/2000 | Cronyn | 343/895 |
| 6,452,568 | B1 * | 9/2002 | Zidek | 343/895 |
| 6,859,181 | B2 * | 2/2005 | Colburn et al. | 343/725 |
| 6,906,682 | B2 * | 6/2005 | Alexopoulos et al. | 343/895 |
| 6,947,010 | B2 * | 9/2005 | Alexopoulos et al. | 343/895 |

* cited by examiner

*Primary Examiner* — Hoang V Nguyen
*Assistant Examiner* — Hai Tran
(74) *Attorney, Agent, or Firm* — Garlick & Markison; Randy W. Lacasse

(57) ABSTRACT

An interwoven spiral antenna includes a non-inverted spiral section, an inverted spiral section, and an excitation region. The non-inverted spiral section has a spiral shape and the inverted spiral section has an inverted spiral shape. The excitation region is coupled to at least one of the non-inverted spiral section and the inverted spiral section, wherein, when excited, the interwoven spiral antenna has a circular polarization.

20 Claims, 67 Drawing Sheets portable computing communication device 10 portable computing communication device 10 portable computing communication device 10 portable computing communication device 10 multiple two-arm spiral antenna 112 portable computing communication device 10 portable computing communication device 10 multiple two-arm spiral antenna 112 multiple two-arm spiral antenna 112 multiple two-arm spiral antenna 112 multiple two-arm spiral antenna 112 multiple two-arm spiral antenna 112 portable computing communication device 10 symbol-radiation pattern #1 symbol-radiation pattern #2 symbol-radiation pattern #3 symbol-radiation pattern #4 symbol-radiation pattern #5 symbol-radiation pattern #6 symbol-radiation pattern #7 symbol-radiation pattern #8 symbol-radiation pattern #9 symbol-radiation pattern #10

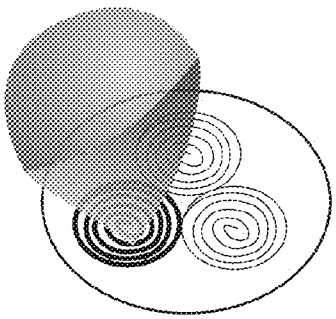
FIG. 83
port1: on, port2: off, port3: off
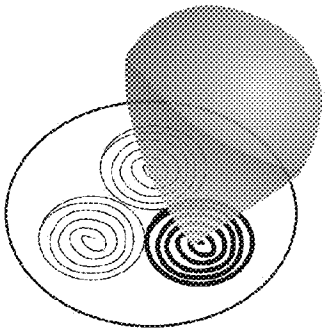
FIG. 84
port1: off, port2: on, port3: off
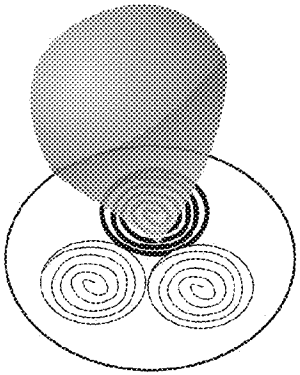
FIG. 85
port1: off, port2: off, port3: on
FIG. 86
port1: off, port2: on, port3: on
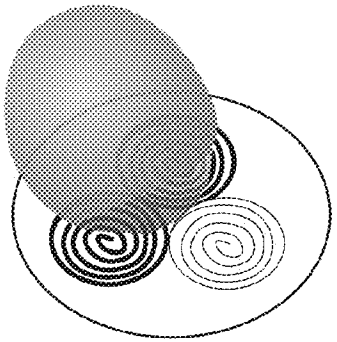
FIG. 87
port1: on, port2: off, port3: on
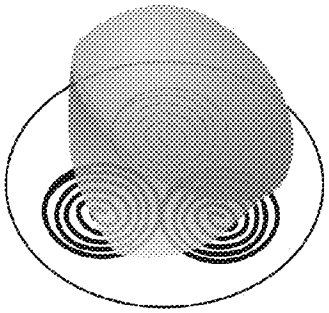
FIG. 88
port1: on, port2: on, port3: off port1: 0deg, port2: 120deg, port3: 240deg port1: on, port2: on, port3: on baseband processing module 16

| Value | Port 1 | | Port 2 | | Port 3 | |
|---|---|---|---|---|---|---|
| | On | Phase | On | Phase | On | Phase |
| 000 | 1 | 0° | 0 | 0° | 0 | 0° |
| 001 | 0 | 0° | 0 | 0° | 1 | 0° |
| 010 | 0 | 0° | 1 | 0° | 0 | 0° |
| 011 | 0 | 0° | 1 | 0° | 1 | 0° |
| 100 | 1 | 0° | 0 | 0° | 1 | 0° |
| 101 | 1 | 0° | 1 | 0° | 0 | 0° |
| 110 | 1 | 0° | 1 | 0° | 1 | 0° |
| 111 | 1 | 0° | 1 | 120° | 1 | 240° |

encode table 274 portable computing communication transmitter 220

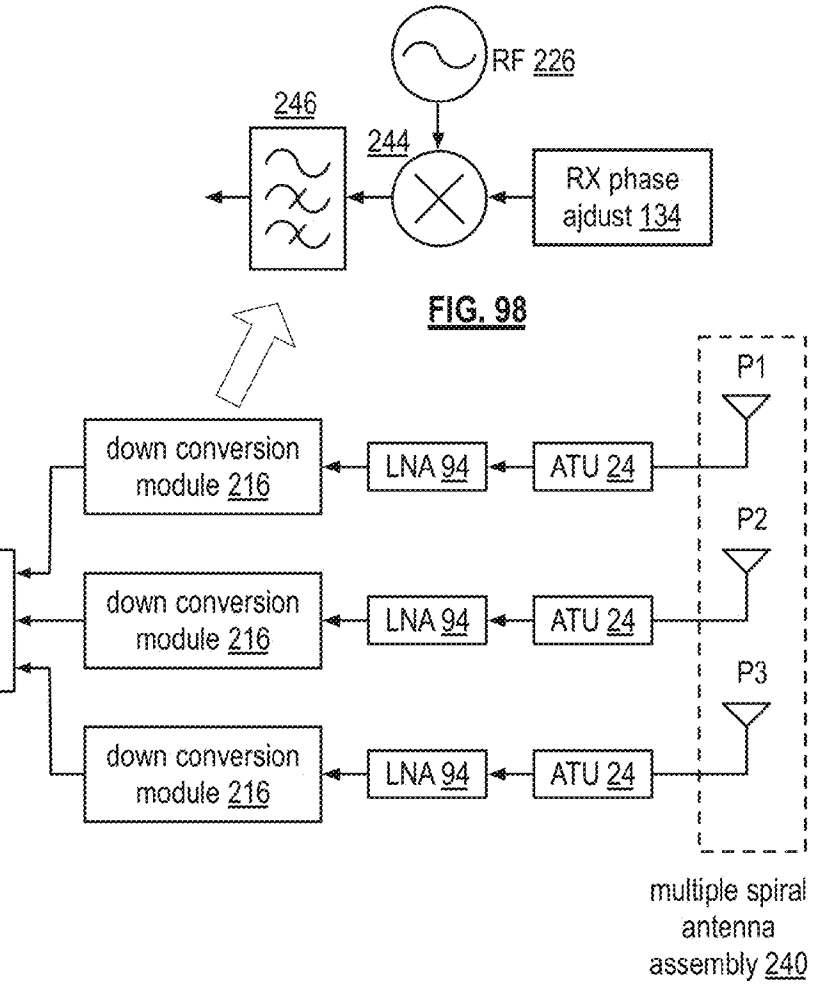
FIG. 98
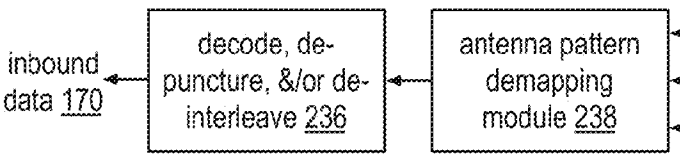
FIG. 96
portable computing communication receiver 234
| Value | Port 1 | | Port 2 | | Port 3 | |
|---|---|---|---|---|---|---|
| | On | Phase | On | Phase | On | Phase |
| 000 | 1 | 0° | 0 | 0° | 0 | 0° |
| 001 | 0 | 0° | 0 | 0° | 1 | 0° |
| 010 | 0 | 0° | 1 | 0° | 0 | 0° |
| 011 | 0 | 0° | 1 | 0° | 1 | 0° |
| 100 | 1 | 0° | 0 | 0° | 1 | 0° |
| 101 | 1 | 0° | 1 | 0° | 0 | 0° |
| 110 | 1 | 0° | 1 | 0° | 1 | 0° |
| 111 | 1 | 0° | 1 | 120° | 1 | 240° |
FIG. 97
decode table 242

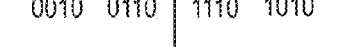
FIG. 101
constellation mapping 276
| Value | Port 1 | | Port 2 | | Port 3 | |
|---|---|---|---|---|---|---|
| | On | Phase | On | Phase | On | Phase |
| 000 | 1 | 0° | 0 | 0° | 0 | 0° |
| 001 | 0 | 0° | 0 | 0° | 1 | 0° |
| 010 | 0 | 0° | 1 | 0° | 0 | 0° |
| 011 | 0 | 0° | 1 | 0° | 1 | 0° |
| 100 | 1 | 0° | 0 | 0° | 1 | 0° |
| 101 | 1 | 0° | 1 | 0° | 0 | 0° |
| 110 | 1 | 0° | 1 | 0° | 1 | 0° |
| 111 | 1 | 0° | 1 | 120° | 1 | 240° |
FIG. 100
encode table 274
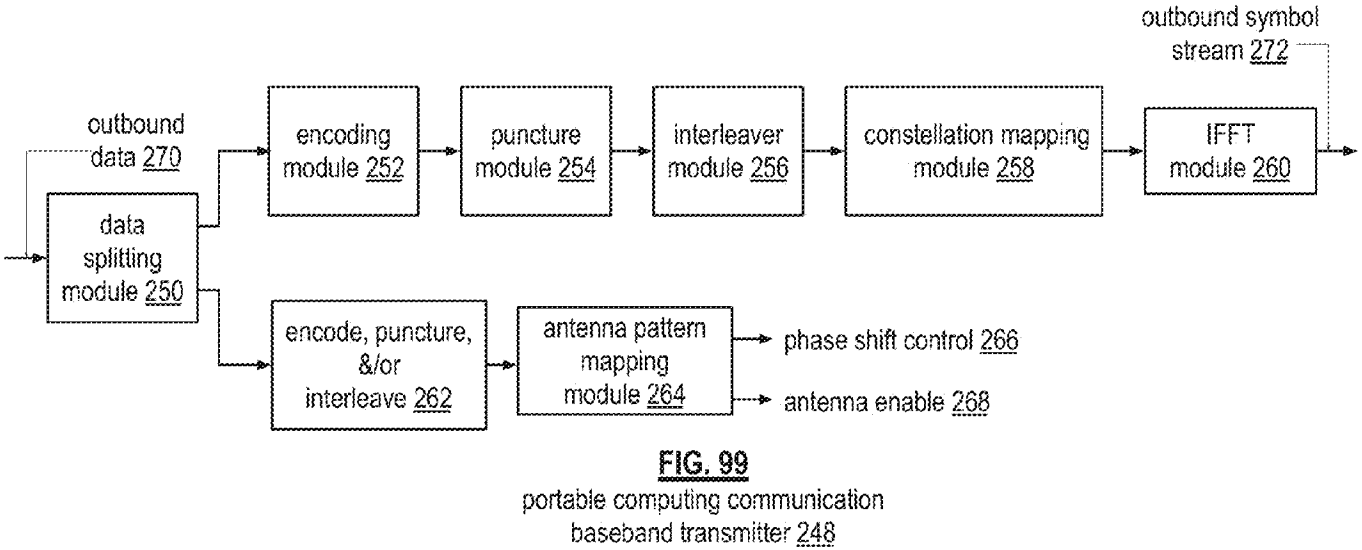
FIG. 99
portable computing communication baseband transmitter 248 portable computing communication RF transmitter 278 portable computing communication receiver 234

INTERWOVEN SPIRAL ANTENNA

CROSS REFERENCE TO RELATED PATENTS

This patent application is claiming priority under 35 USC §119(e) to a provisionally filed patent application entitled "INTERWOVEN SPIRAL ANTENNA ASSEMBLIES AND APPLICATIONS THEREOF," expired, having a provisional filing date of Jul. 5, 2011, and a provisional Ser. No. of 61/504,408, which is incorporated by reference herein.

STATEMENT REGARDING FEDERALLY SPONSORED RESEARCH OR DEVELOPMENT

NOT APPLICABLE

INCORPORATION-BY-REFERENCE OF MATERIAL SUBMITTED ON A COMPACT DISC

NOT APPLICABLE

BACKGROUND OF THE INVENTION

1. Technical Field of the Invention

This invention relates generally to wireless communications and more particularly to antennas, transmitters, and/or receivers.

2. Description of Related Art

Communication systems are known to support wireless and wire lined communications between wireless and/or wire lined communication devices. Such communication systems range from national and/or international cellular telephone systems to the Internet to point-to-point in-home wireless networks to radio frequency identification (RFID) systems to radio frequency radar systems. Each type of communication system is constructed, and hence operates, in accordance with one or more communication standards. For instance, radio frequency (RF) wireless communication systems may operate in accordance with one or more standards including, but not limited to, RFID, IEEE 802.11, Bluetooth, advanced mobile phone services (AMPS), digital AMPS, global system for mobile communications (GSM), code division multiple access (CDMA), WCDMA, local multi-point distribution systems (LMDS), multi-channel-multi-point distribution systems (MMDS), LTE, WiMAX, and/or variations thereof. As another example, infrared (IR) communication systems may operate in accordance with one or more standards including, but not limited to, IrDA (Infrared Data Association).

Depending on the type of RF wireless communication system, a wireless communication device, such as a cellular telephone, two-way radio, personal digital assistant (PDA), personal computer (PC), laptop computer, tablet computer, home entertainment equipment, RFID reader, RFID tag, radar transmitter and/or receiver, et cetera communicates directly or indirectly with other wireless communication devices. For direct communications (also known as point-to-point communications), the participating wireless communication devices tune their receivers and transmitters to the same channel or channels (e.g., one of the plurality of radio frequency (RF) carriers of the wireless communication system) and communicate over that channel(s). For indirect wireless communications, each wireless communication device communicates directly with an associated base station (e.g., for cellular services) and/or an associated access point (e.g., for an in-home or in-building wireless network) via an assigned channel. To complete a communication connection between the wireless communication devices, the associated base stations and/or associated access points communicate with each other directly, via a system controller, via the public switch telephone network, via the Internet, and/or via some other wide area network and/or local area network.

For each RF wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). As is known, the receiver is coupled to the antenna and includes a low noise amplifier, one or more intermediate frequency stages, a filtering stage, and a data recovery stage. The low noise amplifier receives inbound RF signals via the antenna and amplifies then. The one or more intermediate frequency stages mix the amplified RF signals with one or more local oscillations to convert the amplified RF signal into baseband signals or intermediate frequency (IF) signals. The filtering stage filters the baseband signals or the IF signals to attenuate unwanted out of band signals to produce filtered signals. The data recovery stage recovers raw data from the filtered signals in accordance with the particular wireless communication standard.

As is also known, the transmitter includes a data modulation stage, one or more intermediate frequency stages, and a power amplifier. The data modulation stage converts raw data into baseband signals in accordance with a particular wireless communication standard. The one or more intermediate frequency stages mix the baseband signals with one or more local oscillations to produce RF signals. The power amplifier amplifies the RF signals prior to transmission via an antenna.

Since the wireless part of a wireless communication begins and ends with the antenna, a properly designed antenna structure is an important component of wireless communication devices. As is known, the antenna structure is designed to have a desired impedance (e.g., 50 Ohms) at an operating frequency, a desired bandwidth centered at the desired operating frequency, and a desired length (e.g., ¼ wavelength of the operating frequency for a monopole antenna). As is further known, the antenna structure may include a single monopole or dipole antenna, a diversity antenna structure, the same polarization, different polarization, and/or any number of other electro-magnetic properties.

One popular antenna structure for RF transceivers is a three-dimensional in-air helix antenna, which resembles an expanded spring. The in-air helix antenna provides a magnetic omni-directional monopole antenna. Other types of three-dimensional antennas include aperture antennas of a rectangular shape, horn shaped, etc.; three-dimensional dipole antennas having a conical shape, a cylinder shape, an elliptical shape, etc.; and reflector antennas having a plane reflector, a corner reflector, or a parabolic reflector. An issue with such three-dimensional antennas is that they cannot be implemented in the substantially two-dimensional space of a substrate such as an integrated circuit (IC) and/or on the printed circuit board (PCB) supporting the IC.

Two-dimensional antennas are known to include a meandering pattern or a micro strip configuration. For efficient antenna operation, the length of an antenna should be ¼ wavelength for a monopole antenna and ½ wavelength for a dipole antenna, where the wavelength (A)=c/f, where c is the speed of light and f is frequency. For example, a ¼ wavelength antenna at 900 MHz has a total length of approximately 8.3 centimeters (i.e., $0.25*(3\times10^8$ m/s)/$(900\times10^6$ c/s)=0.25*33 cm, where m/s is meters per second and c/s is cycles per second). As another example, a ¼ wavelength antenna at 2400 MHz has a total length of approximately 3.1 cm (i.e., $0.25*(3\times10^8$ m/s)/$(2.4\times10^9$ c/s)=0.25*12.5 cm).

While two-dimensional antennas provide reasonably antenna performance for many wireless communication devices, there are issues when the wireless communication devices require full duplex operation and/or multiple input and/or multiple output (e.g., single input multiple output, multiple input multiple output, multiple input single output) operation. For instance, in a full duplex wireless communication, the wireless communication device simultaneously transmits and receives signals. For full duplex wireless communications to work reasonably well, the receiver antenna(s) must be isolated from the transmitter antenna(s) (e.g., >20 dBm). One popular mechanism is to use an isolator. Another popular mechanism is to use duplexers. While such mechanisms provide receiver antenna(s) isolation from the transmitter antenna(s), but does so at the cost of increasing the overall manufacturing costs of wireless communication devices.

BRIEF DESCRIPTION OF THE SEVERAL VIEWS OF THE DRAWING(S)

FIGS. 83-90 are diagrams of examples of various radiation representations of poly interwoven spiral antennas having various excitation patterns in accordance with the present invention;

FIG. 96 is a schematic block diagram of an embodiment of a receiver of a wireless communication device that utilizes a various excitation pattern encoding scheme in accordance with the present invention;

FIG. 97 is a diagram of an example of a decoding table for a various excitation pattern encoding scheme in accordance with the present invention;

FIG. 98 is a schematic block diagram of an embodiment of a down conversion module of a receiver of a wireless communication device that utilizes a various excitation pattern encoding scheme in accordance with the present invention;

FIG. 99 is a schematic block diagram of an embodiment of a baseband transmitter path of a wireless communication device that utilizes a various excitation pattern encoding scheme and a constellation map in accordance with the present invention;

FIG. 100 is a diagram of an example of an encoding table for a various excitation pattern encoding scheme in accordance with the present invention;

FIG. 101 is a diagram of an example of a constellation map in accordance with the present invention;

Figure 102:
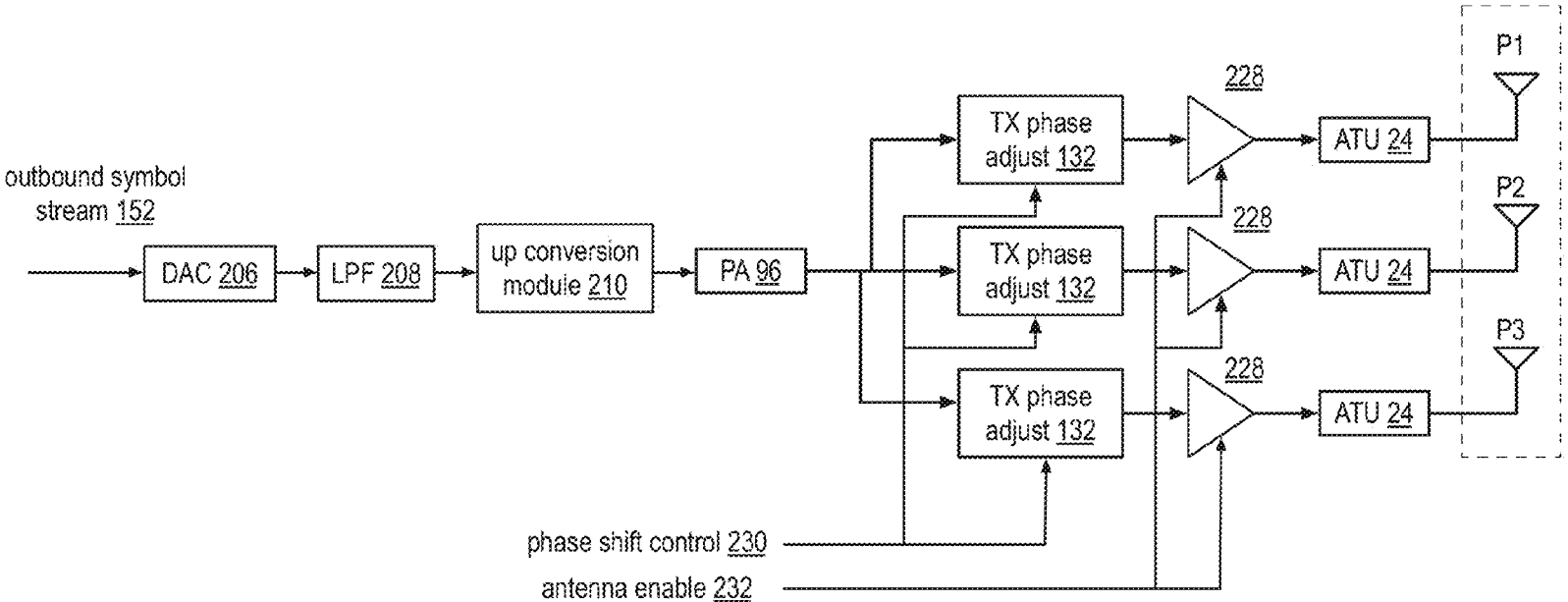
Figure 103:
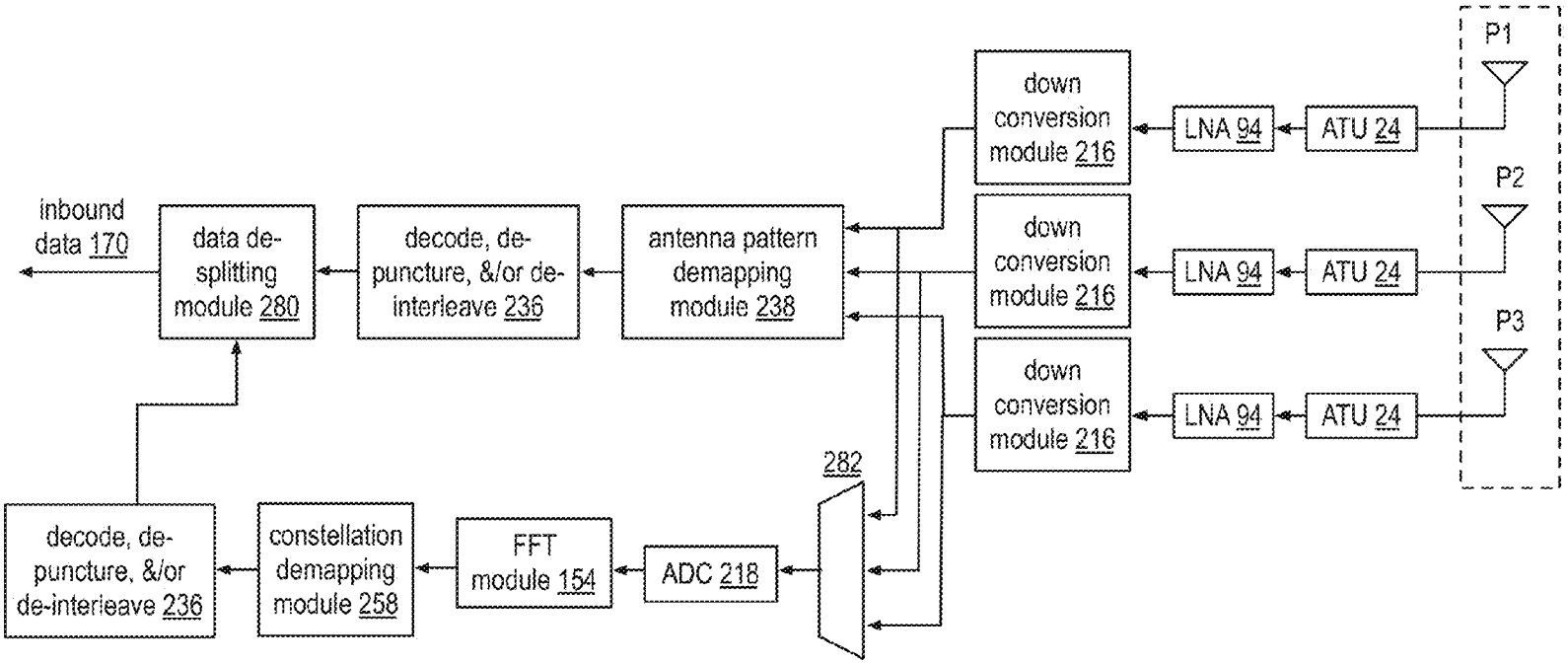

FIG. 102 is a schematic block diagram of an embodiment of an RF transmitter of a wireless communication device that utilizes a various excitation pattern encoding scheme and a constellation map in accordance with the present invention; and FIG. 103 is a schematic block diagram of an embodiment of a receiver of a wireless communication device that utilizes a various excitation pattern encoding scheme and a constellation map in accordance with the present invention.

DETAILED DESCRIPTION OF THE INVENTION

Figure 1:
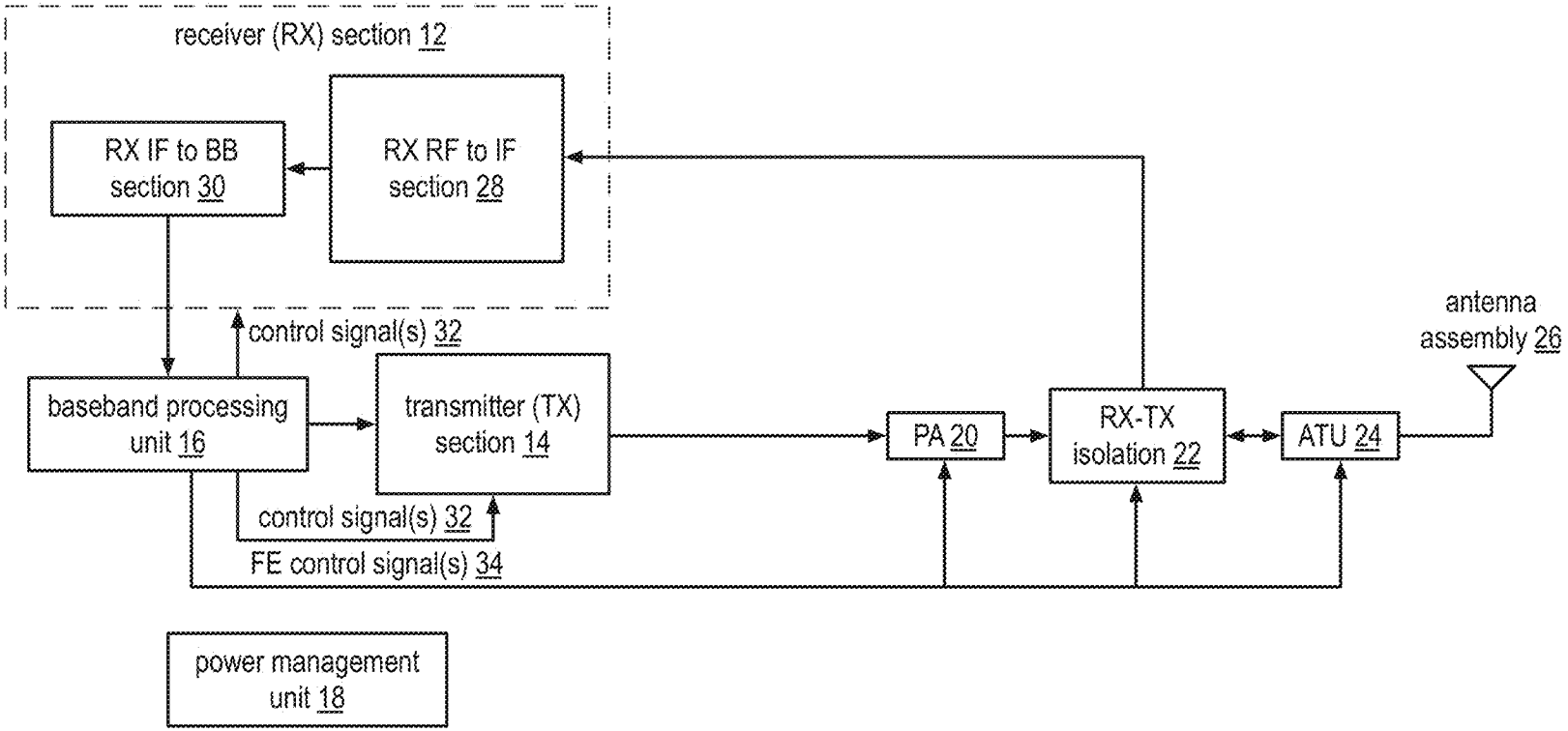
FIG. 1 is a schematic block diagram of an embodiment of a wireless communication device in accordance with the present invention.

FIG. 1 is a schematic block diagram of an embodiment of a wireless communication device 10 that includes a receiver section 12, a transmitter section 14, a baseband processing module 16, a power management unit 18, a power amplifier (PA) 20, an RX-TX isolation module 22, an antenna tuning unit (ATU) 24, and an antenna assembly 26, which may be implemented as described in one or more of the following figures. The receiver section 12 may be a direct conversion receiver or it may be a super-heterodyne receiver, which includes a radio frequency (RF) to intermediate frequency (IF) conversion section 28 and an IF to baseband (BB) section 30. The wireless communication device 10 may be any device that can be carried by a person, can be at least partially powered by a battery, includes a radio transceiver (e.g., radio frequency (RF) and/or millimeter wave (MMW)) and performs one or more software applications. For example, the wireless communication device 10 may be a cellular telephone, a laptop computer, a personal digital assistant, a video game console, a video game player, a personal entertainment unit, a tablet computer, etc.

In an example embodiment, the receiver section 12, the transmitter section 14, the baseband processing module 16 and the power management unit 18 may be implemented as a system on a chip (SOC). The power amplifier 20, the RX-TX isolation module 22, and the ATU 24 may be implemented within a front end module (FEM). The FEM may include multiple paths of Pas 20, RX-TX isolation modules 22, and ATUs 24. For example, the FEM may include one path for 2G (second generation) cellular telephone service, another path for 3G or 4G (third generation or fourth generation) cellular telephone service, and a third path for wireless local area network (WLAN) service. Of course there are a multitude of other example combinations of paths within the FEM to support one or more wireless communication standards (e.g., IEEE 802.11, Bluetooth, global system for mobile communications (GSM), code division multiple access (CDMA), radio frequency identification (RFID), Enhanced Data rates for GSM Evolution (EDGE), General Packet Radio Service (GPRS), WCDMA, high-speed downlink packet access (HSDPA), high-speed uplink packet access (HSUPA), LTE (Long Term Evolution), WiMAX (worldwide interoperability for microwave access), and/or variations thereof).

In an example of single frequency band operation, the baseband processing unit 16, or module, performs one or more functions of the wireless communication device 10 regarding transmission of data. In this instance, the processing module receives outbound data (e.g., voice, text, audio, video, graphics, etc.) and converts it into one or more outbound symbol streams in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.). Such a conversion includes one or more of: scrambling, puncturing, encoding, interleaving, constellation mapping, modulation, frequency spreading, frequency hopping, beamforming, space-time-block encoding, space-frequency-block encoding, frequency to time domain conversion, and/or digital baseband to intermediate frequency conversion. Note that the baseband processing unit 16 converts the outbound data into a single outbound symbol stream for Single Input Single Output (SISO) communications and/or for Multiple Input Single Output (MISO) communications and converts the outbound data into multiple outbound symbol streams for Single Input Multiple Output (SIMO) and Multiple Input Multiple Output (MIMO) communications.

The baseband processing unit 16 provides the one or more outbound symbol streams to the transmitter section 14, which converts the outbound symbol stream(s) into one or more outbound RF signals (e.g., signals in one or more frequency bands 800 MHz, 1800 MHz, 1900 MHz, 2000 MHz, 2.4 GHz, 5 GHz, 60 GHz, etc.). The transmitter section 14 may include at least one up-conversion module, at least one frequency translated bandpass filter (FTBPF), and an output module; which may be configured as a direct conversion topology (e.g., direct conversion of baseband or near baseband symbol streams to RF signals) or as a super heterodyne topology (e.g., convert baseband or near baseband symbol streams into IF signals and then convert the IF signals into RF signals).

For a direction conversion, the transmitter section 14 may have a Cartesian-based topology, a polar-based topology, or a hybrid polar-Cartesian-based topology. In a Cartesian-based topology, the transmitter section 14 mixes in-phase and quadrature components (e.g., $A_I(t)\cos(\omega_{BB}(t)+\phi_I(t))$ and $A_Q(t)\cos(\omega_{BB}(t)+\phi_Q(t))$, respectively) of the one or more outbound symbol streams with in-phase and quadrature components (e.g., $\cos(\omega_{RF}(t))$ and $\sin(\omega_{RF}(t))$, respectively) of one or more transmit local oscillations (TX LO) to produce mixed signals. If included, the FTBPF filters the mixed signals and the output module conditions (e.g., common mode filtering and/or differential to single-ended conversion) them to produce one or more outbound up-converted signals (e.g., $A(t)\cos(\omega_{BB}(t)+\phi(t)+\omega_{RF}(t))$). A power amplifier driver (PAD) module amplifies the outbound up-converted signal(s) to produce a pre-PA (power amplified) outbound RF signal(s).

In a phase polar-based topology, the transmitter section 14 includes an oscillator that produces an oscillation (e.g., $\cos(\omega_{RF}(t))$ that is adjusted based on the phase information (e.g., $+/-\Delta\phi$ [phase shift] and/or $\phi t$ [phase modulation]) of the outbound symbol stream(s). The resulting adjusted oscillation (e.g., $\cos(\omega_{RF}(t)+/-\Delta\phi)$ or $\cos(\omega_{RF}(t)+\phi(t)$ may be further adjusted by amplitude information (e.g., A(t) [amplitude modulation]) of the outbound symbol stream(s) to produce one or more up-converted signals (e.g., $A(t)\cos(\omega_{RF}(t)+\phi(t)$ or $A(t)\cos(\omega_{RF}(t)+/-\Delta\phi)$). If included, the FTBPF filters the one or more up-converted signals and the output module conditions (e.g., common mode filtering and/or differential to single-ended conversion) them. A power amplifier driver (PAD) module then amplifies the outbound up-converted signal(s) to produce a pre-PA (power amplified) outbound RF signal(s).

In a frequency polar-based topology, the transmitter section 14 includes an oscillator that produces an oscillation (e.g., $\cos(\omega_{RF}(t))$ this is adjusted based on the frequency information (e.g., $+/-\Delta f$ [frequency shift] and/or f(t)) [frequency modulation]) of the outbound symbol stream(s). The resulting adjusted oscillation (e.g., $\cos(\omega_{RF}(t)+/-\Delta f)$ or $\cos(\omega_{RF}(t)+f(t))$ may be further adjusted by amplitude information (e.g., A(t) [amplitude modulation]) of the outbound symbol stream(s) to produce one or more up-converted signals (e.g., $A(t)\cos(\omega_{RF}(t)+f(t))$ or $A(t)\cos(\omega_{RF}(t)+/-\Delta f)$). If included, the FTBPF filters the one or more up-converted signals and the output module conditions (e.g., common mode filtering and/or differential to single-ended conversion) them. A power amplifier driver (PAD) module then amplifies the outbound up-converted signal(s) to produce a pre-PA (power amplified) outbound RF signal(s).

In a hybrid polar-Cartesian-based topology, the transmitter section 14 separates the phase information (e.g., $\cos(\omega_{BB}(t)+/-\Delta\phi)$ or $\cos(\omega_{BB}(t)+\phi(t)$ and the amplitude information (e.g., A(t)) of the outbound symbol stream(s). The transmitter section 14 mixes in-phase and quadrature components (e.g., $\cos(\omega_{BB}(t)+\phi_I(t))$ and $\cos(\omega_{BB}(t)+\phi_Q(t))$, respectively) of the one or more outbound symbol streams with in-phase and quadrature components (e.g., $\cos(\omega_{RF}(t))$ and $\sin(\omega_{RF}(t))$, respectively) of one or more transmit local oscillations (TX LO) to produce mixed signals. If included, the FTBPF filters the mixed signals and the output module conditions (e.g., common mode filtering and/or differential to single-ended conversion) them to produce one or more outbound up-converted signals (e.g., $A(t)\cos(\omega_{BB}(t)+\phi(t))+\omega_{RF}(t)))$. A power amplifier driver (PAD) module amplifies the normalized outbound up-converted signal(s) and injects the amplitude information (e.g., A(t)) into the normalized outbound up-converted signal(s) to produce a pre-PA (power amplified) outbound RF signal(s) (e.g., $A(t)\cos(\omega_{RF}(t)+\phi(t))$).

For a super heterodyne topology, the transmitter section 14 includes a baseband (BB) to intermediate frequency (IF) section and an IF to a radio frequency (RF section). The BB to IF section may be of a polar-based topology, a Cartesian-based topology, a hybrid polar-Cartesian-based topology, or a mixing stage to up-convert the outbound symbol stream(s). In the polar-based topology, the Cartesian-based topology, and/or the hybrid polar-Cartesian-based topology, the BB to IF section generates an IF signal(s) (e.g., $A(t)\cos(\omega_{IF}(t)+\phi(t))$) and the IF to RF section includes a mixing stage, a filtering stage and the power amplifier driver (PAD) to produce the pre-PA outbound RF signal(s).

When the BB to IF section includes a mixing stage, the IF to RF section may have a polar-based topology, a Cartesian-based topology, or a hybrid polar-Cartesian-based topology. In this instance, the BB to IF section converts the outbound symbol stream(s) (e.g., $A(t)\cos((\omega_{BB}(t)+\phi(t)))$ into intermediate frequency symbol stream(s) (e.g., $A(t)(\omega_{IF}(t)+\phi(t))$. The IF to RF section converts the IF symbol stream(s) into the pre-PA outbound RF signal(s).

The transmitter section 14 outputs the pre-PA outbound RF signal(s) to a power amplifier module (PA) 20 of the front-end module (FEM). The PA 20 includes one or more power amplifiers coupled in series and/or in parallel to amplify the pre-PA outbound RF signal(s) to produce an outbound RF signal(s). Note that parameters (e.g., gain, linearity, bandwidth, efficiency, noise, output dynamic range, slew rate, rise rate, settling time, overshoot, stability factor, etc.) of the PA 20 may be adjusted based on control signals 32 received from the baseband processing unit 16 and/or another processing module of the wireless communication device 10. For instance, as transmission conditions change (e.g., channel response changes, distance between TX unit 14 and RX unit 12 changes, antenna properties change, etc.), the processing resources (e.g., the BB processing unit 16 and/or the processing module) of the SOC monitors the transmission condition changes and adjusts the properties of the PA 20 to optimize performance. Such a determination may not be made in isolation; for example, it is done in light to other parameters of the front-end module that may be adjusted (e.g., the ATU 24, the RX-TX isolation module 22) to optimize transmission and reception of the RF signals.

The RX-TX isolation module 22 (which may be a duplexer, a circulator, or transformer balun, or other device that provides isolation between a TX signal and an RX signal using a common antenna) attenuates the outbound RF signal(s). The RX-TX isolation module 22 may adjusts it attenuation of the outbound RF signal(s) (i.e., the TX signal) based on control signals 32 received from the baseband processing unit 16 and/or the processing module of the SOC. For example, when the transmission power is relatively low, the RX-TX isolation module 22 may be adjusted to reduce its attenuation of the TX signal.

The antenna tuning unit (ATU) 24 is tuned to provide a desired impedance that substantially matches that of the antenna assembly 26. As tuned, the ATU 22 provides the attenuated TX signal from the RX-TX isolation module 22 to the antenna assembly 26 for transmission. Note that the ATU 24 may be continually or periodically adjusted to track impedance changes of the antenna assembly 26. For example, the baseband processing unit 16 and/or the processing module may detect a change in the impedance of the antenna assembly 26 and, based on the detected change, provide control signals to the ATU 24 such that it changes it impedance accordingly.

The antenna assembly 26 also receives one or more inbound RF signals, which are provided to the ATU 24. The ATU 24 provides the inbound RF signal(s) to the RX-TX isolation module 22, which routes the signal(s) to the receiver (RX) RF to IF section 28. The RX RF to IF section 28 converts the inbound RF signal(s) (e.g., $A(t) \cos(\omega_{RF}(t)+\phi(t))$) into an inbound IF signal (e.g., $A_I(t) \cos(\omega_{IF}(t)+\phi_I(t))$ and $A_Q(t) \cos(\omega_{IF}(t)+\phi_Q(t))$).

The RX IF to BB section 30 converts the inbound IF signal into one or more inbound symbol streams (e.g., $A(t) \cos((\omega_{BB}(t)+\phi(t)))$. In this instance, the RX IF to BB section 30 includes a mixing section and a combining & filtering section. The mixing section mixes the inbound IF signal(s) with a second local oscillation (e.g., LO2=IF−BB, where BB may range from 0 Hz to a few MHz) to produce I and Q mixed signals. The combining & filtering section combines (e.g., adds the mixed signals together—which includes a sum component and a difference component) and then filters the combined signal to substantially attenuate the sum component and pass, substantially unattenuated, the difference component as the inbound symbol stream(s).

The baseband processing unit 16 converts the inbound symbol stream(s) into inbound data (e.g., voice, text, audio, video, graphics, etc.) in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.). Such a conversion may include one or more of: digital intermediate frequency to baseband conversion, time to frequency domain conversion, space-time-block decoding, space-frequency-block decoding, demodulation, frequency spread decoding, frequency hopping decoding, beamforming decoding, constellation demapping, deinterleaving, decoding, depuncturing, and/or descrambling. Note that the processing module converts a single inbound symbol stream into the inbound data for Single Input Single Output (SISO) communications and/or for Multiple Input Single Output (MISO) communications and converts the multiple inbound symbol streams into the inbound data for Single Input Multiple Output (SIMO) and Multiple Input Multiple Output (MIMO) communications.

The power management unit 18 may be integrated into the SOC to perform a variety of functions. Such functions include monitoring power connections and battery charges, charging a battery when necessary, controlling power to the other components of the SOC, generating supply voltages, shutting down unnecessary SOC modules, controlling sleep modes of the SOC modules, and/or providing a real-time clock. To facilitate the generation of power supply voltages, the power management unit 18 may includes one or more switch-mode power supplies and/or one or more linear regulators.

In another example of operation, the processing module, which may be the baseband processing module or another processing module, determines an operational mode based on type of antenna assembly. For example, the processing module determines the type of antenna assembly (e.g., number of antenna units (e.g., interwoven spiral antennas), configuration of the antenna units (e.g., functioning as single antennas or as a multiple antenna unit antenna), the excitation points of the antenna units (e.g., a center excitation point of the single interwoven spiral antenna, differential excitation points of the single interwoven spiral antenna, dipole excitation points of the single interwoven spiral antenna, one or more end of spiral excitation points of the single interwoven spiral antenna, a center excitation point of the poly interwoven spiral antenna, differential excitation points of the poly interwoven spiral antenna, and dipole excitation points of the poly interwoven spiral antenna), excitation point options (e.g., an approximately zero degree phase shift excitation, a phase shifted excitation in a range between approximately zero degrees and approximately ninety degrees, and/or a plurality of phase shifted excitations), and/or operable characteristics of the antenna assembly).

Additionally, or in the alternative, the processing module may determine the operation mode based on the number of frequency bands to support the wireless communication(s), whether the antenna assembly will be shared for transmit and receive communication or whether the antenna assembly will include separate transmit and receive antenna assemblies, MIMO operation, diversity operation, and/or whether the antenna assembly will support multiple concurrent communications (e.g., communication sharing). The processing module may determine the operational mode in isolation or it may negotiation the operation mode with a target wireless communication device.

The processing module then generates one or more control signals in accordance with the operational mode. The processing module may also generate an antenna assembly configuration in accordance with the operational mode. The control signals may include one or more of a frequency band control signal (e.g., selection of a frequency band or bands), an antenna sharing control signal (e.g., whether the antenna is shared for transmit and receive), an antenna coupling control signal (e.g., the types of excitation points of the antenna assembly), an antenna excitation control signal (e.g., selection of an excitation option), and a communication sharing control signal (e.g., whether the antenna assembly is shared for multiple communications on different frequency bands).

The transmitter section converts one or more outbound symbol streams into one or more outbound wireless signals in accordance with the one or more control signals. The antenna assembly, in accordance with the one or more control signals transmits the one or more outbound wireless signals. The antenna assembly also receives the one or more inbound wireless signals and provides them to the receiver section. The receiver section converts one or more inbound wireless signals into one or more inbound symbol streams in accordance with the one or more control signals.

The antenna assembly may include an antenna structure and an antenna interface module. The antenna structure may include a single interwoven spiral antenna that includes a non-inverted spiral section, an inverted spiral section, and one or more excitation points. Alternatively, the antenna structure may include a poly interwoven spiral antenna that includes a plurality of the single interwoven spiral antennas coupled together by a plurality of connections and one or more excitation points coupled to the plurality of single interwoven spiral antennas. As yet another alternative, the antenna structure may include a plurality of the single interwoven spiral antennas. As a further alternative, the antenna structure may include a plurality of poly interwoven spiral antennas. As a further example, the antenna structure may include a combination of antenna structures.

Figure 2:
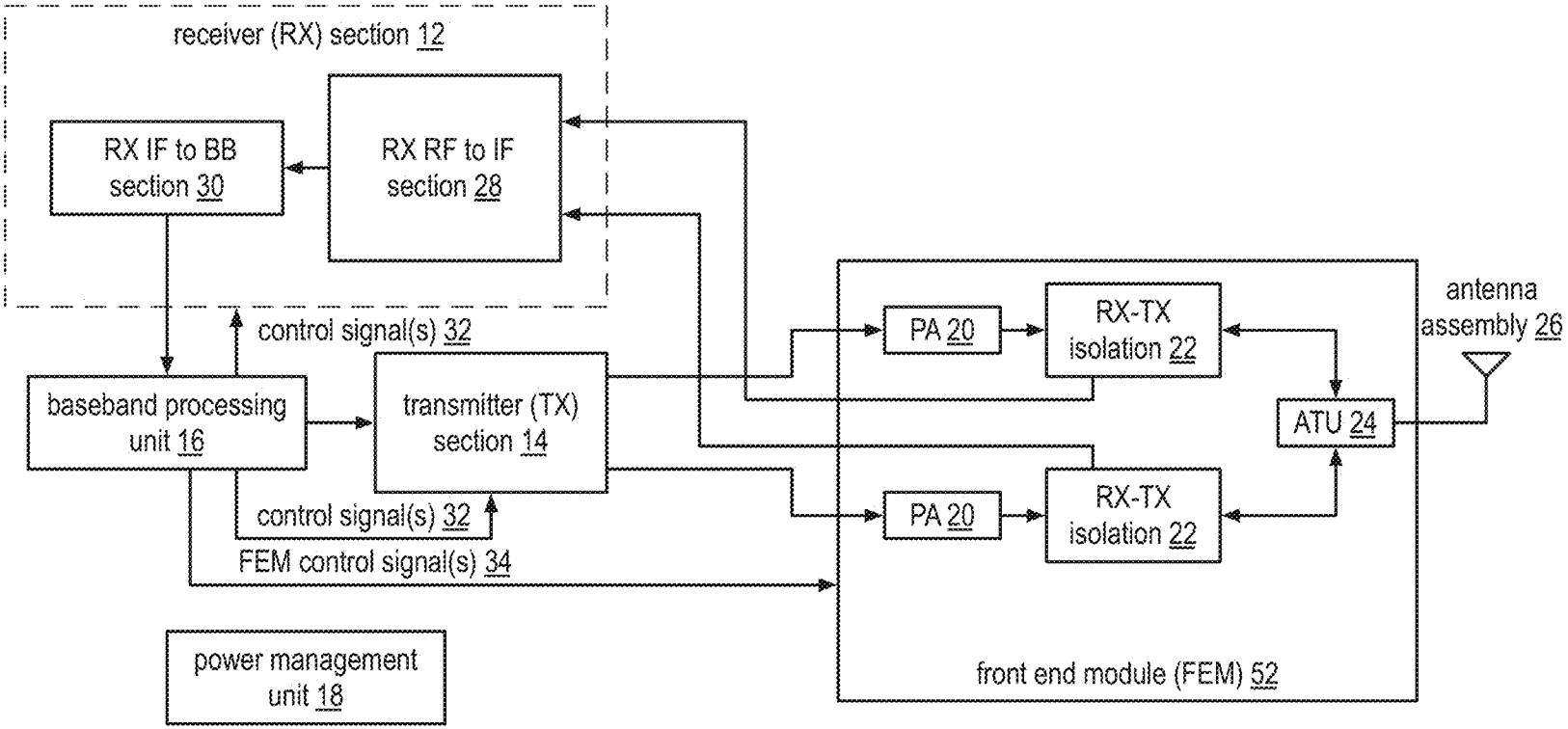
FIG. 2 is a schematic block diagram of another embodiment of a wireless communication device in accordance with the present invention.

FIG. 2 is a schematic block diagram of another embodiment of a wireless communication device 10 that is operable in multiple frequency bands and includes a multiple frequency receiver section 12, a multiple band transmitter section 14, a baseband processing module 16, a power management unit 18, power amplifiers (PA) 20, RX-TX isolation modules 22, one or more antenna tuning units (ATU) 24, and a shared antenna assembly 26, which may be implemented as described in one or more of the following figures and has a bandwidth that spans the multiple frequency bands or is tunable for a given frequency band. The multiple frequency band receiver section 12 may include one or more direct conversion receivers and/or it may include one or more super-heterodyne receivers. The wireless communication device 10 may be a cellular telephone, a laptop computer, a personal digital assistant, a video game console, a video game player, a personal entertainment unit, a tablet computer, etc.

In an example embodiment, the receiver section 12, the transmitter section 14, the baseband processing unit 16 and the power management unit 18 may be implemented as a system on a chip (SOC). The power amplifiers 20, the RX-TX isolation modules 22, and the ATUs 24 may be implemented within a front end module (FEM) 52. The FEM 52 includes multiple paths of Pas 20, RX-TX isolation modules 22, and ATUs 24; one for each frequency band of operation. For example, the FEM 52 may include one path for 2G (second generation) cellular telephone service, another path for 3G or 4G (third generation or fourth generation) cellular telephone service, and a third path for wireless local area network (WLAN) service. Of course there are a multitude of other example combinations of paths within the FEM 52 to support one or more wireless communication standards (e.g., IEEE 802.11, Bluetooth, global system for mobile communications (GSM), code division multiple access (CDMA), radio frequency identification (RFID), Enhanced Data rates for GSM Evolution (EDGE), General Packet Radio Service (GPRS), WCDMA, high-speed downlink packet access (HSDPA), high-speed uplink packet access (HSUPA), LTE (Long Term Evolution), WiMAX (worldwide interoperability for microwave access), and/or variations thereof).

In an example of one of the multiple frequency bands of operation, the baseband processing unit 16, or module, performs one or more functions of the wireless communication device 10 regarding transmission of data. In this instance, the baseband processing module 16 receives outbound data (e.g., voice, text, audio, video, graphics, etc.) and converts it into one or more outbound symbol streams in accordance with one or more wireless communication standards as discussed with reference to FIG. 1.

The baseband processing unit 16 provides the one or more outbound symbol streams to the transmitter section 14, which converts the outbound symbol stream(s) into one or more outbound RF signals (e.g., signals in one or more frequency bands 800 MHz, 1800 MHz, 1900 MHz, 2000 MHz, 2.4 GHz, 5 GHz, 60 GHz, etc.). The transmitter section 14 includes two outputs: one for a first frequency band and the other for a second frequency band. For the given frequency band, the transmitter section 14 may include at least one up-conversion module, at least one frequency translated bandpass filter (FT-BPF), and an output module; which may be configured as a direct conversion topology (e.g., direct conversion of baseband or near baseband symbol streams to RF signals) or as a super heterodyne topology (e.g., convert baseband or near baseband symbol streams into IF signals and then convert the IF signals into RF signals).

The transmitter section 14 outputs the pre-PA outbound RF signal(s) to one of the power amplifier modules (PA) 20. The PA 20 includes one or more power amplifiers coupled in series and/or in parallel to amplify the pre-PA outbound RF signal(s) to produce an outbound RF signal(s). Note that parameters (e.g., gain, linearity, bandwidth, efficiency, noise, output dynamic range, slew rate, rise rate, settling time, overshoot, stability factor, etc.) of the PA 20 may be adjusted based on control signals 32 received from the baseband processing unit 16 and/or another processing module of the wireless communication device 10.

The corresponding RX-TX isolation module 22 attenuates the outbound RF signal(s). The RX-TX isolation module 22 may adjust it attenuation of the outbound RF signal(s) (i.e., the TX signal) based on control signals 32 received from the baseband processing unit 16 and/or the processing module of the SOC. For example, when the transmission power is relatively low, the RX-TX isolation module 22 may be adjusted to reduce its attenuation of the TX signal.

The corresponding antenna tuning unit (ATU) 24 is tuned to provide a desired impedance that substantially matches that of the antenna assembly 26. As tuned, the ATU 24 provides the attenuated TX signal from the RX-TX isolation module 22 to the antenna assembly 26 for transmission. Note that the ATU 24 may be continually or periodically adjusted to track impedance changes of the antenna assembly 26. For example, the baseband processing unit 16 and/or the processing module may detect a change in the impedance of the antenna assembly 26 and, based on the detected change, provide control signals 32 to the ATU 24 such that it changes it impedance accordingly.

The antenna assembly 26, which may be tuned to the current frequency band of operation or has a sufficient bandwidth to operate in multiple frequency bands, transmits the outbound RF signal(s). Within the current frequency band, the antenna assembly 26 also receives one or more inbound RF signals and provides them to the corresponding ATU 24.

The corresponding ATU 24 provides the inbound RF signal(s) to the corresponding RX-TX isolation module 22, which routes the signal(s) to the receiver (RX) RF to IF section 28. The RX RF to IF section 28 converts the inbound RF signal(s) (e.g., $A(t)\cos(\omega_{RF}(t)+\phi(t))$) into an inbound IF signal (e.g., $A_I(t)\cos(\omega_{IF}(t)+\phi_I(t))$ and $A_Q(t)\cos(\phi_{IF}(t)+\phi_Q(t))$).

The RX IF to BB section 30 converts the inbound IF signal into one or more inbound symbol streams as discussed with reference to FIG. 1. The baseband processing unit 16 converts the inbound symbol stream(s) into inbound data (e.g., voice, text, audio, video, graphics, etc.) in accordance with one or more wireless communication standards as described with reference to FIG. 1.

For another frequency band, the wireless communication device 10 operates similarly to the previous discussion, but within the other frequency band. In this instance, the antenna assembly 26 may be tuned to the other frequency band or it may have a bandwidth that includes the first frequency band and the other frequency band.

Figure 3:
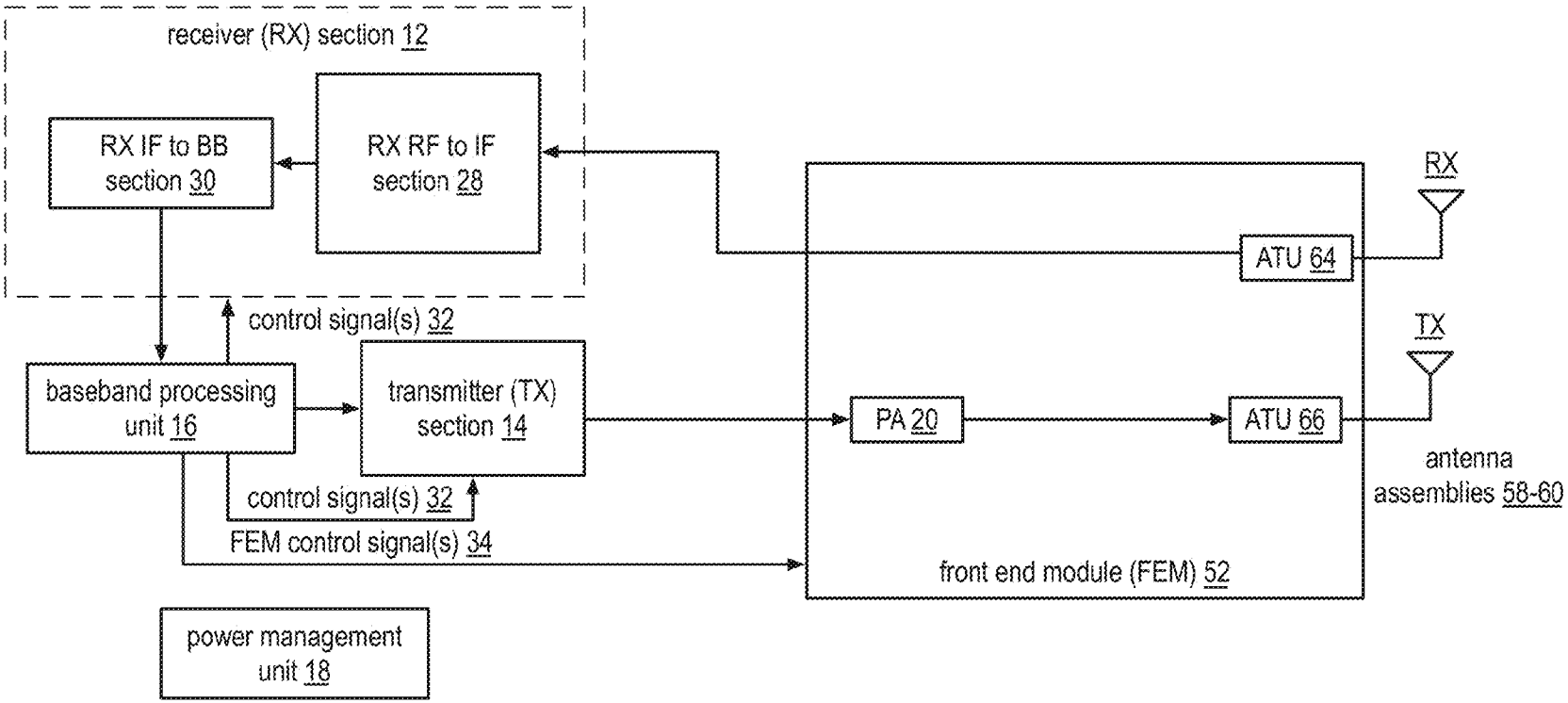
FIG. 3 is a schematic block diagram of another embodiment of a wireless communication device in accordance with the present invention.

FIG. 3 is a schematic block diagram of another embodiment of a wireless communication device 10 that includes a receiver section 12, a transmitter section 14, a baseband processing module 16, a power management unit 18, a power amplifier (PA) 20, two antenna tuning units (ATU) 64-66, a transmit antenna assembly 58, and a receiver antenna assembly 60. Each of the antenna assemblies 58-60 may be implemented as described in one or more of the following figures and has a bandwidth that spans the desired frequency band of operation or is tunable to the desired frequency band. The band receiver section may 12 include a direct conversion receiver and/or it may include a super-heterodyne receiver. The wireless communication device 10 may be a cellular telephone, a laptop computer, a personal digital assistant, a video game console, a video game player, a personal entertainment unit, a tablet computer, etc.

In an example embodiment, the receiver section 12, the transmitter section 14, the baseband processing unit 16 and the power management unit 18 may be implemented as a system on a chip (SOC). The power amplifiers 20 and the ATUs 64-66 may be implemented within a front end module (FEM) 52. The FEM 52 includes a transmit path and a receive path.

In an example of operation, the baseband processing unit 16, or module, performs one or more functions of the wireless communication device 10 regarding transmission of data. In this instance, the baseband processing module 16 receives outbound data (e.g., voice, text, audio, video, graphics, etc.) and converts it into one or more outbound symbol streams in accordance with one or more wireless communication standards as discussed with reference to FIG. 1.

The baseband processing unit 16 provides the one or more outbound symbol streams to the transmitter section 14, which converts the outbound symbol stream(s) into one or more outbound RF signals (e.g., signals in one or more frequency bands 800 MHz, 1800 MHz, 1900 MHz, 2000 MHz, 2.4 GHz, 5 GHz, 60 GHz, etc.). The transmitter section 14 may include at least one up-conversion module, at least one frequency translated bandpass filter (FTBPF), and an output module; which may be configured as a direct conversion topology (e.g., direct conversion of baseband or near baseband symbol streams to RF signals) or as a super heterodyne topology (e.g., convert baseband or near baseband symbol streams into IF signals and then convert the IF signals into RF signals).

The transmitter section 14 outputs a pre-PA outbound RF signal(s) to the power amplifier module (PA) 20. The PA 20 includes one or more power amplifiers coupled in series and/or in parallel to amplify the pre-PA outbound RF signal(s) to produce an outbound RF signal(s). Note that parameters (e.g., gain, linearity, bandwidth, efficiency, noise, output dynamic range, slew rate, rise rate, settling time, overshoot, stability factor, etc.) of the PA 20 may be adjusted based on control signals 32 received from the baseband processing unit 16 and/or another processing module of the wireless communication device 10.

The corresponding antenna tuning unit (ATU) 64-66 is tuned to provide a desired impedance that substantially matches that of the transmit (TX) antenna assembly 58. For example, the ATU 66 provides a continually or periodically adjusted impedance to substantially match impedance changes of the TX antenna assembly 58 based on one or more control signals 32. The baseband processing unit 16 and/or the processing module generates the one or more control signals 32 by detecting a change in the impedance of the TX antenna assembly 58. The TX antenna assembly 58, which may be tuned to the current frequency band of operation or has a sufficient bandwidth to operate in multiple frequency bands, transmits the outbound RF signal(s).

The RX 12 receives one or more inbound RF signals and provides them to the corresponding ATU 64-66. The corresponding ATU 64-66 provides a continually or periodically adjusted impedance to substantially match impedance changes of the TX antenna assembly 58 based on one or more control signals 32. In addition, the ATU 64 provides the inbound RF signal(s) to the receiver (RX) RF to IF section 28. The RX RF to IF section 28 converts the inbound RF signal(s) (e.g., $A(t)\cos(\omega_{RF}(t)+\phi(t))$) into an inbound IF signal (e.g., $A_I(t)\cos(\omega_{IF}(t)+\phi_I(t))$ and $A_Q(t)\cos(\omega_{IF}(t)+\phi_Q(t))$).

The RX IF to BB section 30 converts the inbound IF signal into one or more inbound symbol streams as discussed with reference to FIG. 1. The baseband processing unit 16 converts the inbound symbol stream(s) into inbound data (e.g., voice, text, audio, video, graphics, etc.) in accordance with one or more wireless communication standards as described with reference to FIG. 1.

Figure 4:
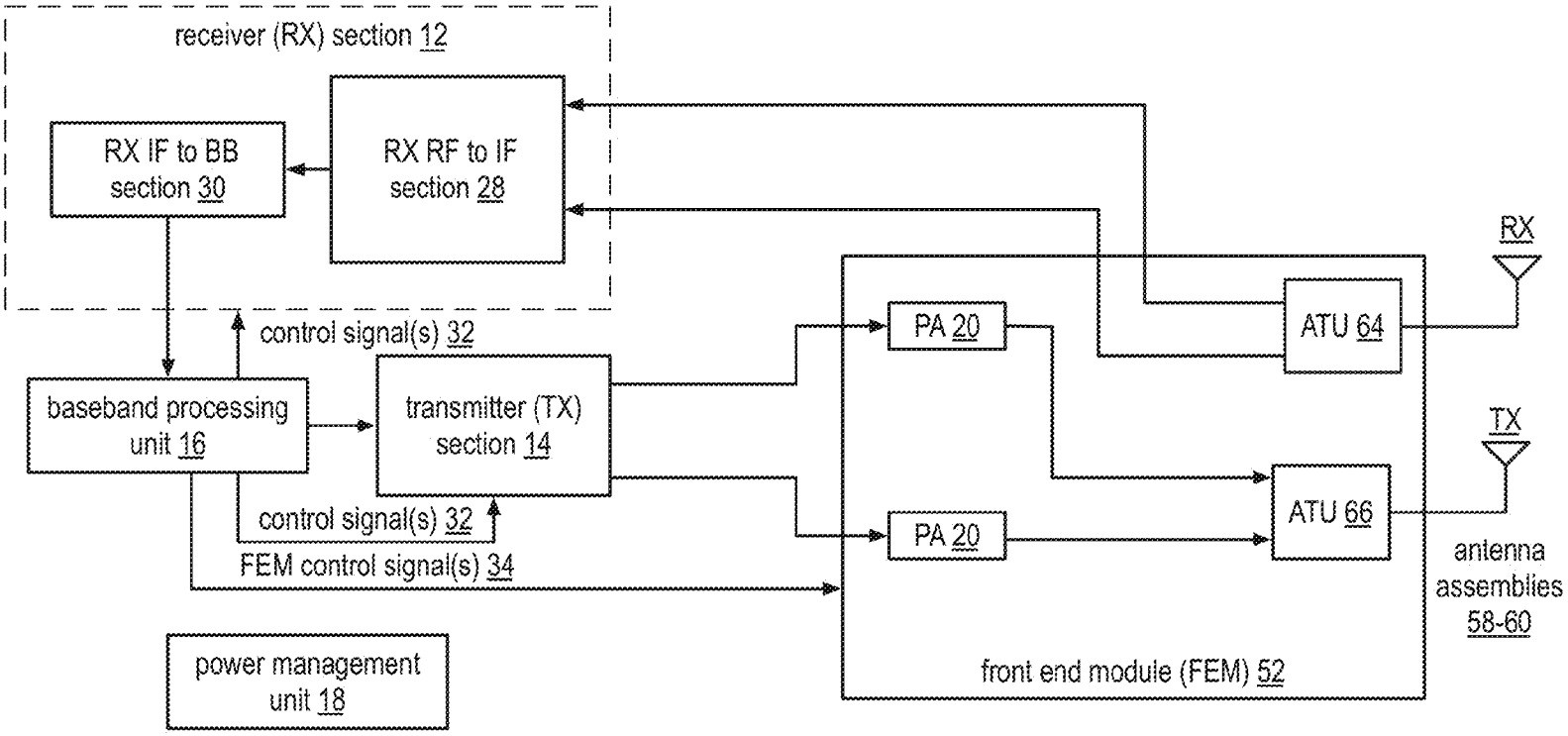
FIG. 4 is a schematic block diagram of another embodiment of a wireless communication device in accordance with the present invention.

FIG. 4 is a schematic block diagram of another embodiment of a wireless communication device 10 that is operable in multiple frequency bands and includes a multiple frequency receiver section 12, a multiple band transmitter section 14, a baseband processing module 16, a power management unit 18, power amplifiers (PA) 20, an RX antenna tuning unit (ATU) 64, a transmit ATU 66, a TX antenna assembly 58, and an RX antenna assembly 60. Each of the RX and TX antenna assemblies 58-60 may be implemented as described in one or more of the following figures and has a bandwidth that spans the multiple frequency bands or is tunable for a given frequency band. The multiple frequency band receiver section 12 may include one or more direct conversion receivers and/or it may include one or more super-heterodyne receivers. The wireless communication device 10 may be a cellular telephone, a laptop computer, a personal digital assistant, a video game console, a video game player, a personal entertainment unit, a tablet computer, etc.

In an example embodiment, the receiver section 12, the transmitter section 14, the baseband processing unit 16 and the power management unit 18 may be implemented as a system on a chip (SOC). The front end module (FEM) 52 includes multiple transmit paths of Pas 20, and ATU 64-66 (e.g., one for each frequency band of operation) and multiple receive paths (e.g., one for each frequency band of operation). For example, the FEM 52 may include a transmit path and receive path for 2G (second generation) cellular telephone service, another transmit path and receive path for 3G or 4G (third generation or fourth generation) cellular telephone service, and yet another a transmit path and receive path for wireless local area network (WLAN) service. Of course there are a multitude of other example combinations of paths within the FEM 52 to support one or more wireless communication standards (e.g., IEEE 802.11, Bluetooth, global system for mobile communications (GSM), code division multiple access (CDMA), radio frequency identification (RFID), Enhanced Data rates for GSM Evolution (EDGE), General Packet Radio Service (GPRS), WCDMA, high-speed downlink packet access (HSDPA), high-speed uplink packet access (HSUPA), LTE (Long Term Evolution), WiMAX (worldwide interoperability for microwave access), and/or variations thereof).

In an example of one of the multiple frequency bands of operation, the baseband processing unit 16, or module, performs one or more functions of the wireless communication device 10 regarding transmission of data. In this instance, the baseband processing module 16 receives outbound data (e.g., voice, text, audio, video, graphics, etc.) and converts it into one or more outbound symbol streams in accordance with one or more wireless communication standards as discussed with reference to FIG. 1.

The baseband processing unit 16 provides the one or more outbound symbol streams to the transmitter section 14, which converts the outbound symbol stream(s) into one or more outbound RF signals (e.g., signals in one or more frequency bands 800 MHz, 1800 MHz, 1900 MHz, 2000 MHz, 2.4 GHz, 5 GHz, 60 GHz, etc.). The transmitter section 14 includes two or more outputs (e.g., one for a first frequency band and the other for a second frequency band).

The transmitter section 14 outputs a pre-PA outbound RF signal(s) to one of the power amplifier modules (PA) 20. The PA 20 includes one or more power amplifiers coupled in series and/or in parallel to amplify the pre-PA outbound RF signal(s) to produce an outbound RF signal(s). Note that parameters (e.g., gain, linearity, bandwidth, efficiency, noise, output dynamic range, slew rate, rise rate, settling time, overshoot, stability factor, etc.) of the PA 20 may be adjusted based on control signals received from the baseband processing unit 16 and/or another processing module of the wireless communication device 10.

The TX antenna tuning unit (ATU) 66 is tuned to provide a desired impedance that substantially matches that of the TX antenna assembly 58. Note that the ATU 66 may be continually or periodically adjusted to track impedance changes of the antenna assembly 58. The TX antenna assembly 58, which may be tuned to the current frequency band of operation or has a sufficient bandwidth to operate in multiple frequency bands, transmits the outbound RF signal(s).

The RX antenna assembly 60 receives one or more inbound RF signals and provides them to the corresponding ATU 64. The RX ATU 64 provides a substantially matched impedance to that of the RX antenna assembly 60 outputs the inbound RF signal(s) to the receiver (RX) RF to IF section 28. The RX RF to IF section 28 converts the inbound RF signal(s) (e.g., $A(t) \cos(\omega_{RF}(t)+\phi(t))$) into an inbound IF signal (e.g., $A_I(t) \cos(\omega_{IF}(t)+\phi_I(t))$ and $A_Q(t) \cos(\omega_{IF}(t)+\phi_Q(t))$).

The RX IF to BB section 30 converts the inbound IF signal into one or more inbound symbol streams as discussed with reference to FIG. 1. The baseband processing unit 16 converts the inbound symbol stream(s) into inbound data (e.g., voice, text, audio, video, graphics, etc.) in accordance with one or more wireless communication standards as described with reference to FIG. 1.

For another frequency band, the wireless communication device 10 operates similarly to the previous discussion, but within another frequency band. In this instance, each of the antenna assemblies 58-60 may be tuned to the other frequency band or it may have a bandwidth that spans multiple frequency bands.

Figure 5:
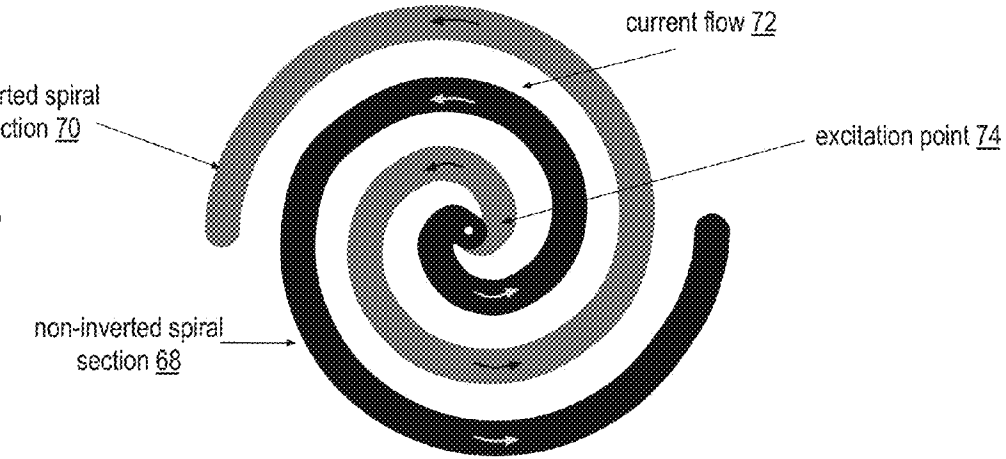
FIG. 5 is a diagram of an embodiment of an interwoven spiral antenna in accordance with the present invention.
Figure 18:
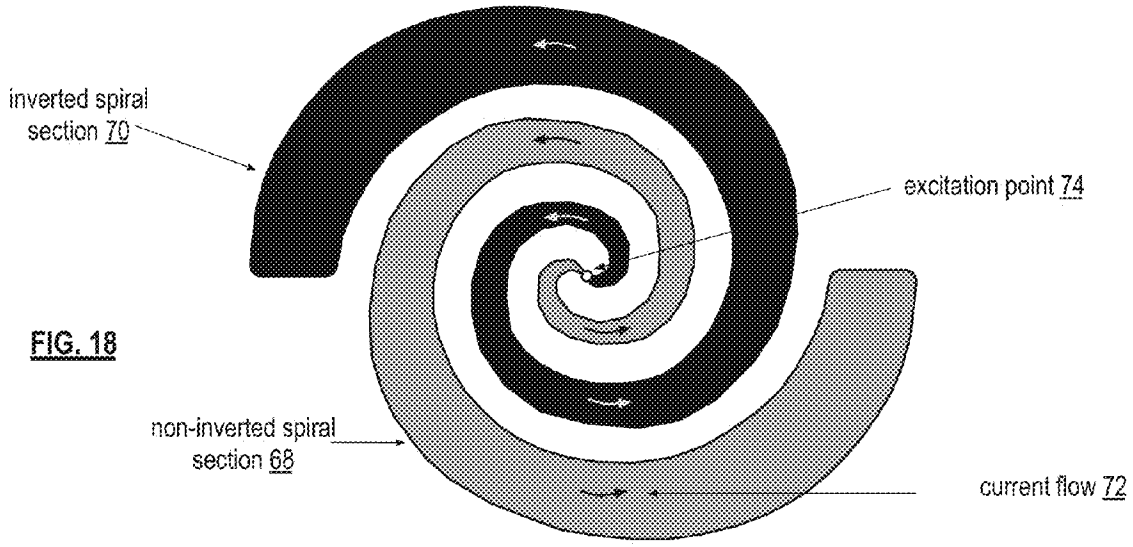
FIG. 18 is a diagram of another embodiment of an interwoven spiral antenna in accordance with the present invention.

FIG. 5 is a diagram of an embodiment of an interwoven spiral antenna that may be used in one or more of the antennas assemblies of the wireless communication devices discussed with reference to one or more of FIGS. 1-5. The interwoven spiral antenna includes a non-inverted spiral section 68 having a spiral shape, an inverted spiral section 70 having an inverted spiral shape, and an excitation region (e.g., an excitation point or multiple points). Collectively, the non-inverted spiral section 68 and the inverted spiral section 70 may form a Celtic spiral (which may include 3 interwoven spirals), an Archimedean spiral, and/or a Celtic logarithmic spiral (an example of which is shown in FIG. 18). In this example, the antenna includes an excitation region (e.g., a point) 74 at the connection point of the two spiral sections and a return connection, which may be ground, another AC ground, or another reference potential.

Various properties of the interwoven spiral antenna define its operational characteristics. For instance, the dimensions of the excitation region (e.g., establishes the upper cutoff region of the bandwidth) and the circumference of the interwoven spiral antenna (e.g., establishes the lower cutoff region of the bandwidth) define the bandwidth of the interwoven spiral antenna. The trace width, distance between traces, length of each spiral section, distance to a ground plane, and/or use of an artificial magnetic conductor plane affect the quality factor, radiation pattern, impedance (which is fairly constant over the bandwidth), gain, and/or other characteristics of the antenna.

In an example of monopole operation, an outbound RF signal is applied to the excitation point 74 of the interwoven spiral antenna. This generates an electric field and causes a current 72 to flow through the interwoven spiral antenna from the excitation point 74 to the interconnection of the spiral sections. The current 72 generates a magnetic field such that, in combination with the electric field, the antenna has a circular polarization, which may be inverted by changing the direction of current flow 72. For instance, the pattern of the interwoven spiral may be flipped 180 degrees to change the current flow 72 direction. This enables one interwoven spiral antenna to be used for transmission of RF signals and another interwoven spiral antenna with opposite circular polarity to be used for reception of RF signals. Return energy of the interwoven spiral antenna is via a return connection (e.g., a ground plane, a reference potential, AC ground, and/or an artificial magnetic conductor).

In such an embodiment, a small footprint and wideband antenna that has a relatively constant gain throughout the band pass region is achievable. For example, the interwoven spiral antenna (e.g., a Celtic spiral antenna and/or an Archimedean spiral antenna) may be printed on a metal layer of a printed circuit board (e.g., FR-4 substrate with a relative permittivity $\epsilon r=4.40$, dissipation factor $\tan \delta=0.02$, and thickness of 2.0 mm). For a frequency band of 2 GHz, each spiral section of this example antenna includes two turns and has a radius of 8 mm; the width of spiral line and gap between adjacent lines are chosen to be 1 mm and 2.25 mm, respectively.

In another example embodiment, the interwoven spiral antenna may be implemented on one or more layers of a substrate and second interwoven spiral antenna may be implemented on another one or more layers of the substrate. The first interwoven spiral antenna provides a first leg of an antenna assembly and the second interwoven spiral antenna provides a second leg of the antenna assembly. The two interwoven spirals are aligned from a major surface perspective of the substrate such that the magnetic fields of the two antenna legs are additive. In furtherance of this example, the first interwoven spiral antenna provides a first leg of a dipole antenna and the second interwoven spiral antenna provides a second leg of the dipole antenna. In still furtherance of this example, the first interwoven spiral antenna functions as previously described with reference to the present figure and the second interwoven spiral antenna provides a return path.

Figure 6:
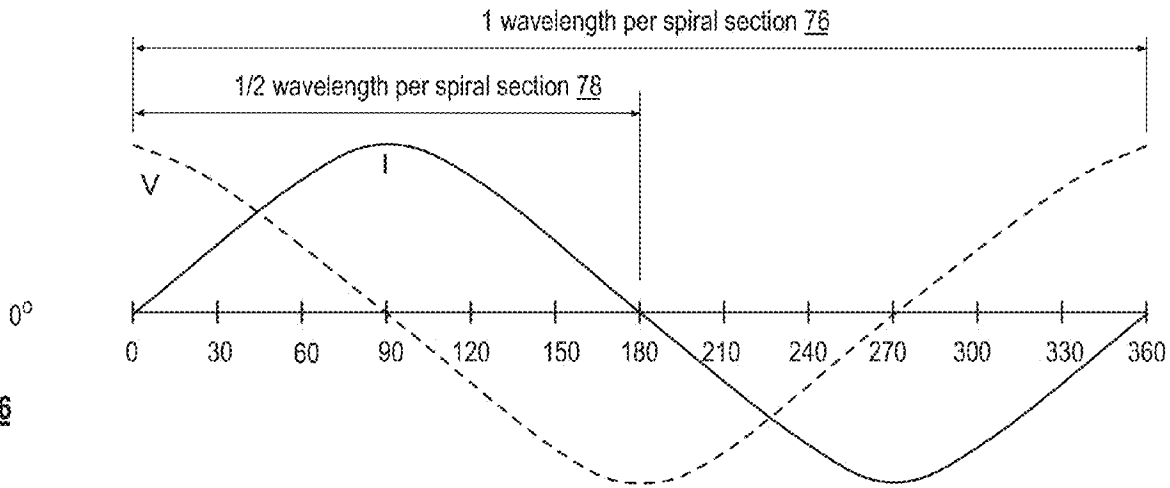
FIG. 6 is a diagram of an example of a current waveform and a voltage waveform of an interwoven spiral antenna in accordance with the present invention.

FIG. 6 is a diagram of an example of a current waveform and a voltage waveform of an interwoven spiral antenna of FIG. 5. The current waveform has zero crossings at 0 degrees, at 180 degrees, and at 360 degrees. The voltage waveform has zero crossings at 90 degrees and 270 degrees. As is further shown, the length of one of the spiral sections may be one-half wavelength 78 or a full wavelength 76. As such, with any of the wavelengths, the current at the ends of the spirals is approximately zero, while the voltage is approximately at its largest magnitude. In general, the length of each of the non-inverting spiral section and the inverted spiral section may be m*one-half wavelength, where m is an integer greater than or equal to one.

If the length of each spiral section is one-quarter wavelength, then the excitation point may be excited with a 90 degree phase shifted signal. In this manner, the antenna exhibits the current and voltage waveforms from 0 to 180 degrees and/or exhibits the current and voltage waveforms from 180 to 360 degrees.

Figure 7:
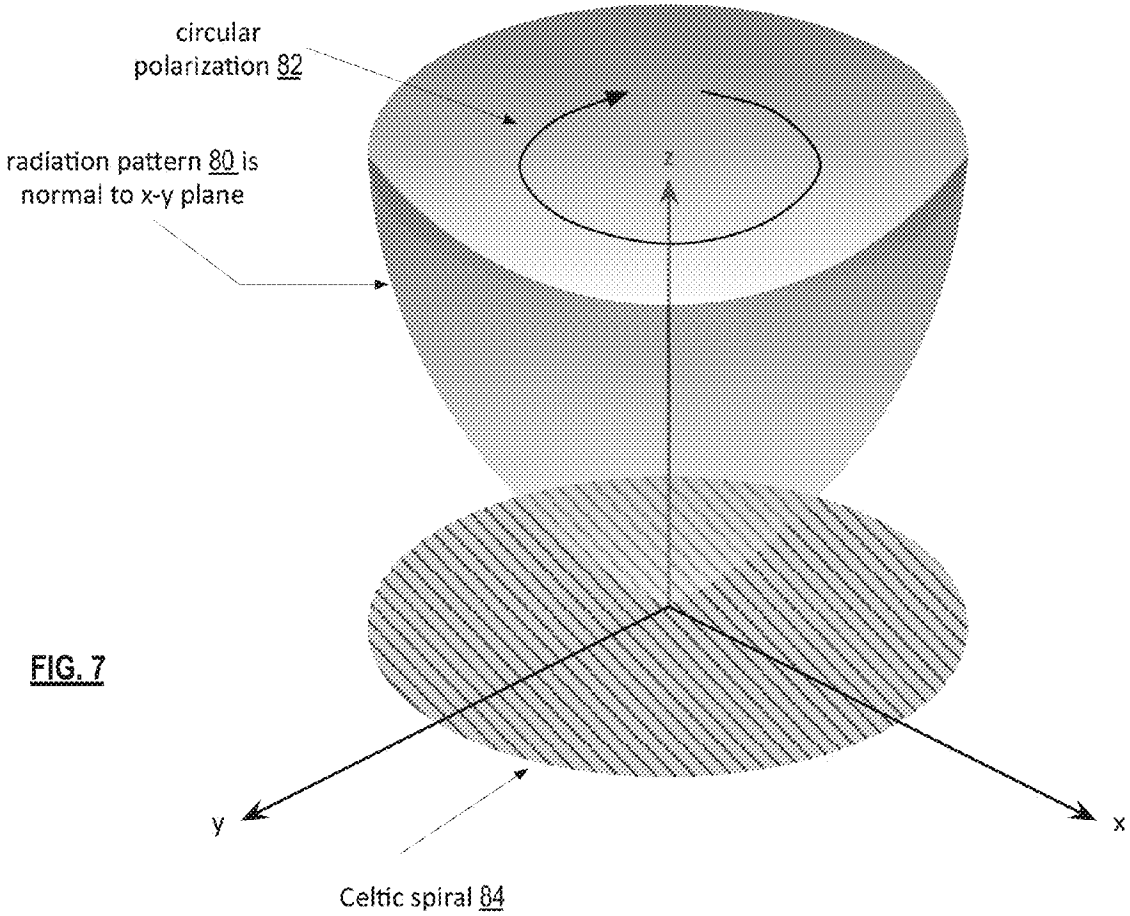
FIG. 7 is a diagram of an example of a radiation pattern of an interwoven spiral antenna in accordance with the present invention.

FIG. 7 is a diagram of an example of a radiation pattern 80 of an interwoven spiral antenna being excited with a non-phase shifted signal (e.g., zero degree excitation). In this example, the radiation pattern is substantially perpendicular to the interwoven spiral antenna (e.g., a Celtic spiral 84) and includes a circular polarization 82, which may be clock-wise or counter clock-wise.

If the return path of the antenna is through a ground and/or an artificial magnetic conductor, the radiation pattern 80 primarily includes the one radiation lobe as shown. If, however, the return path of the antenna is through some other means (e.g., another interwoven spiral or a return connection), a second radiation lobe may be present that is perpendicular the surface of the antenna, but in the opposite direction as the one presently illustrated.

Figure 8:
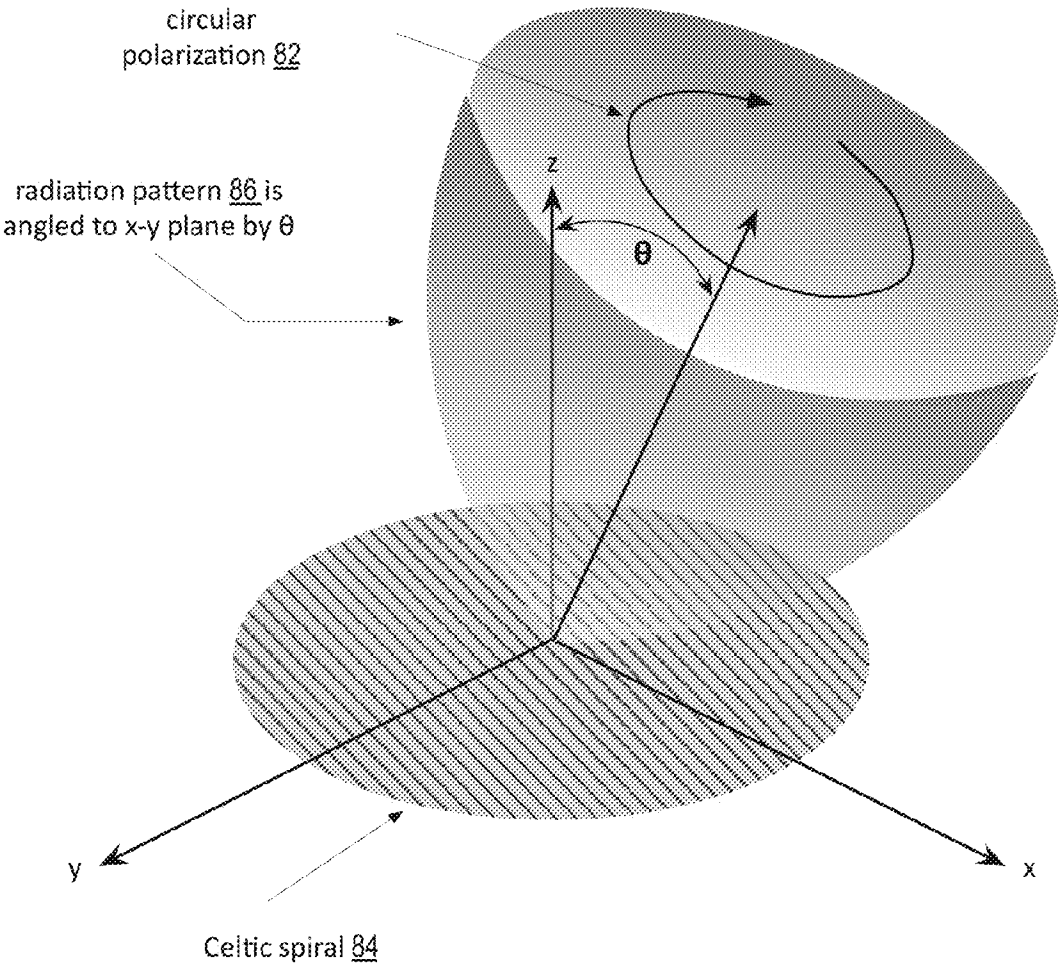
FIG. 8 is a diagram of another example of a radiation pattern of an interwoven spiral antenna in accordance with the present invention.

FIG. 8 is a diagram of another example of a radiation pattern 86 of an interwoven spiral antenna being excited with phase shifted signal (e.g., non-zero degree excitation). In this example, the radiation pattern 86 is offset from perpendicular to the interwoven spiral antenna (e.g., interwoven spiral 84) by the phase of the excitation. The radiation pattern 86 still includes a circular polarization 82, which may be clock-wise or counter clock-wise.

If the return path of the antenna is through a ground and/or an artificial magnetic conductor, the radiation pattern primarily includes the one radiation lobe as shown. If, however, the return path of the antenna is through some other means (e.g., another interwoven spiral or a return connection), a second radiation lobe may be present that is offset from perpendicular by the excitation angle with respect to the surface of the antenna, but in the opposite direction as the one presently illustrated.

Figure 9:
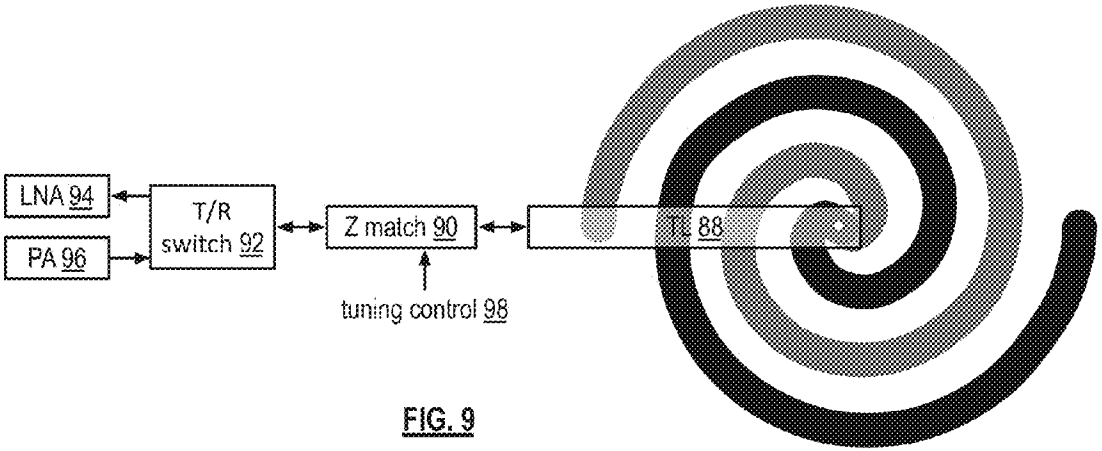
FIG. 9 is a schematic block diagram of an embodiment of circuitry coupled to an interwoven spiral antenna in accordance with the present invention.

FIG. 9 is a schematic block diagram of an embodiment of circuitry coupled to an interwoven spiral antenna for single frequency band operation. The circuitry includes a transmission line (TL) 88, an impedance matching circuit (Z) 90, a transmit/receive switch 92, a low noise amplifier (LNA) 94, and a power amplifier (PA) 96.

In an example of operation, the power amplifier 96 provides an outbound RF signal to the T/R switch 92, which may be implemented as the T/R isolation module previously discussed or it may be an RF switch. The T/R switch 92 provides the outbound RF signal to the Z matching circuit 90 (e.g., all or a portion of the ATU, or an impedance matching circuit of tunable capacitors, resistors, and/or inductors). The Z matching circuit 90 provides the outbound RF signal via the transmission line 88 to the antenna for transmission of the outbound RF signal.

In another example of operation, the antenna receives an inbound RF signals and provides to the Z impedance matching circuit 90 via the transmission line 88. The Z impedance matching circuit 90 provides the inbound RF signal to the T/R switch 92, which routes the signal to the low noise amplifier 94.

Figure 10:
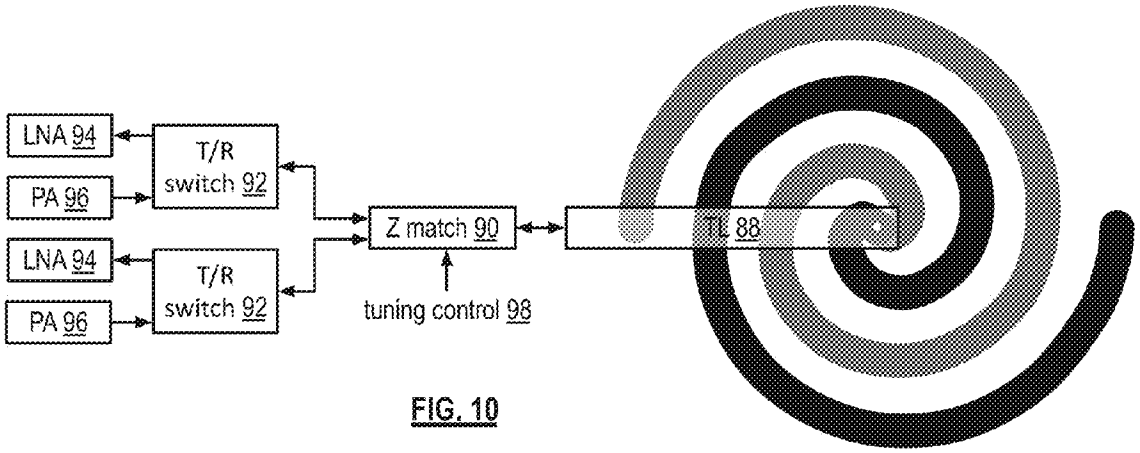
FIG. 10 is a schematic block diagram of another embodiment of circuitry coupled to an interwoven spiral antenna in accordance with the present invention.

FIG. 10 is a schematic block diagram of another embodiment of circuitry coupled to an interwoven spiral antenna for multiple frequency band operation. The circuitry includes a transmission line (TL) 88, an impedance matching circuit (Z) 90, a plurality of transmit/receive switches 92, a plurality of low noise amplifier (LNA) 94, and a plurality of power amplifier (PA) 96.

In an example of operation within a first frequency band, a first power amplifier 96 provides a first outbound RF signal to a first T/R switch 92, which may be implemented as the first T/R isolation module previously discussed or it may be an RF switch. The T/R switch 92 provides the outbound RF signal to the Z matching circuit 90 (e.g., all or a portion of the ATU, or an impedance matching circuit of tunable capacitors, resistors, and/or inductors), which is tuned for the first frequency band of operation. The Z matching circuit 90 provides the outbound RF signal via the transmission line 88 to the antenna for transmission of the outbound RF signal.

In another example of operation within the first frequency band, the antenna receives an inbound RF signals and provides to the Z impedance matching circuit 90 via the transmission line 88. The Z impedance matching circuit 90 provides the inbound RF signal to the first T/R switch 92, which routes the signal to a first low noise amplifier 94.

In an example of operation within a second frequency band, a second power amplifier 96 provides a second outbound RF signal to a second T/R switch 92, which may be implemented as the T/R isolation module previously discussed or it may be an RF switch. The second T/R switch 92 provides the outbound RF signal to the Z matching circuit 90, which is tuned for the second frequency band of operation. The Z matching circuit 90 provides the outbound RF signal via the transmission line 88 to the antenna for transmission of the outbound RF signal.

In another example of operation within the second frequency band, the antenna receives an inbound RF signals and provides to the Z impedance matching circuit 90 via the transmission line 88. The Z impedance matching circuit 90 provides the inbound RF signal to the second T/R switch 92, which routes the signal to a second low noise amplifier 94.

Figure 11:
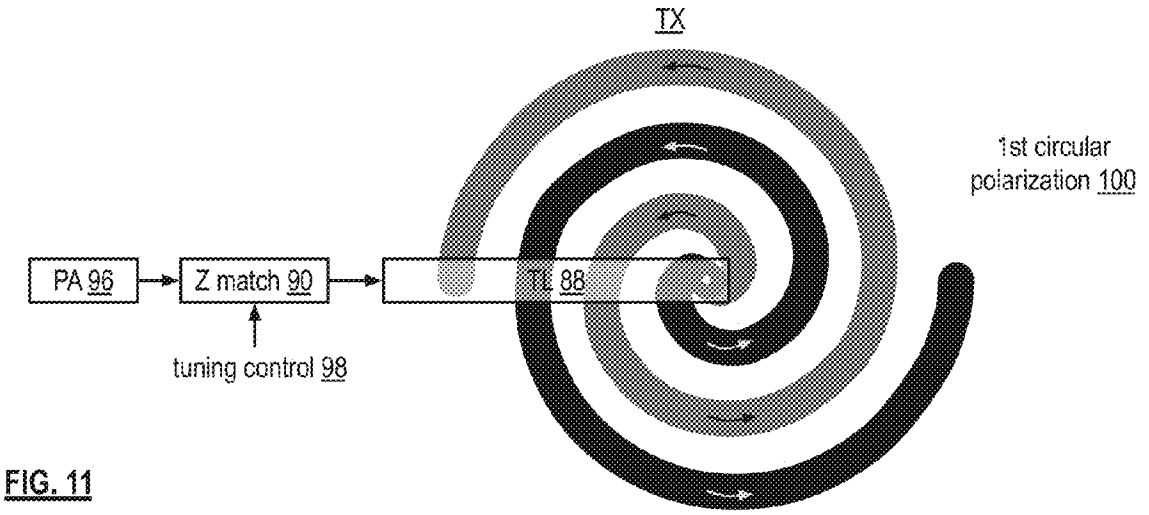
FIG. 11 is a schematic block diagram of an embodiment of circuitry coupled to an interwoven spiral antenna having a first circular polarization in accordance with the present invention.

FIG. 11 is a schematic block diagram of an embodiment of circuitry coupled to an interwoven spiral antenna having a first circular polarization 100 for transmitting outbound RF signals. The circuitry includes a transmission line (TL) 88, an impedance matching circuit (Z) 90, a transmit/receive switch, and a power amplifier (PA) 96.

In an example of operation, the power amplifier 96 provides an outbound RF signal to the Z matching circuit 90 (e.g., all or a portion of the ATU, or an impedance matching circuit of tunable capacitors, resistors, and/or inductors). The Z matching circuit 90 provides the outbound RF signal via the transmission line 88 to the antenna for transmission of the outbound RF signal.

Figure 12:
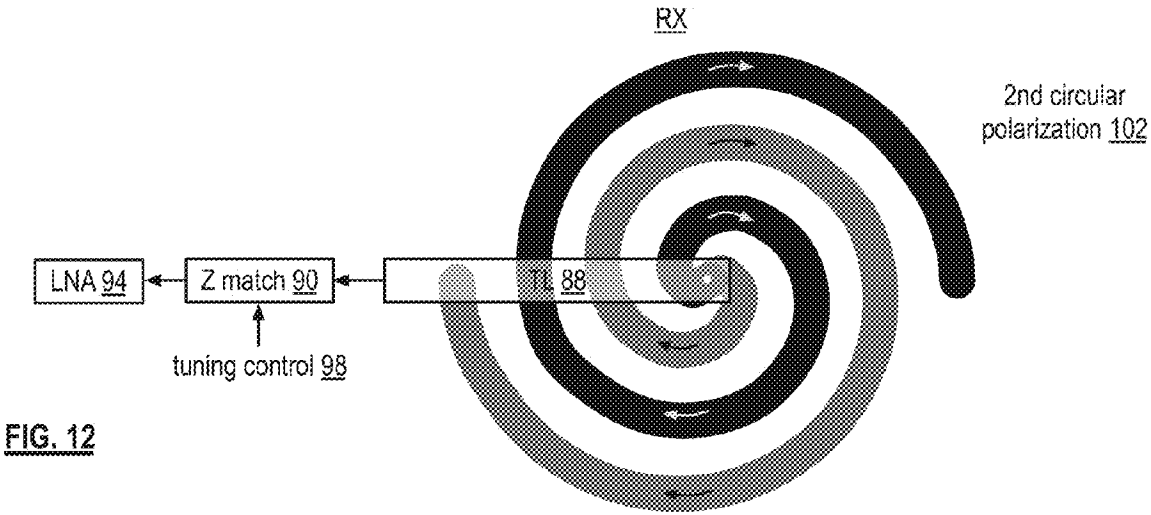
FIG. 12 is a schematic block diagram of an embodiment of circuitry coupled to an interwoven spiral antenna having a second circular polarization in accordance with the present invention.

FIG. 12 is a schematic block diagram of an embodiment of circuitry coupled to an interwoven spiral antenna having a second circular polarization 102 for receiving inbound RF signals. The circuitry includes a transmission line (TL) 88, an impedance matching circuit (Z) 90, a transmit/receive switch, and a low noise amplifier (LNA) 94. In an example of operation, the antenna receives an inbound RF signals and provides it to the Z impedance matching circuit 90 via the transmission line 88. The Z impedance matching circuit 90 provides the inbound RF signal to low noise amplifier 94.

The antenna circuits of FIGS. 11 and 12 may be used in a wireless communication device that offers concurrent transmission and reception of RF signals. The antenna circuits may be for a single frequency band of operation or multiple frequency bands of operation. For example, the antenna circuit of FIG. 11 may be used for transmission of RF signals within a wireless communication device and the antenna circuit of FIG. 12 used to receive RF signals within the wireless communication device.

Figure 13:
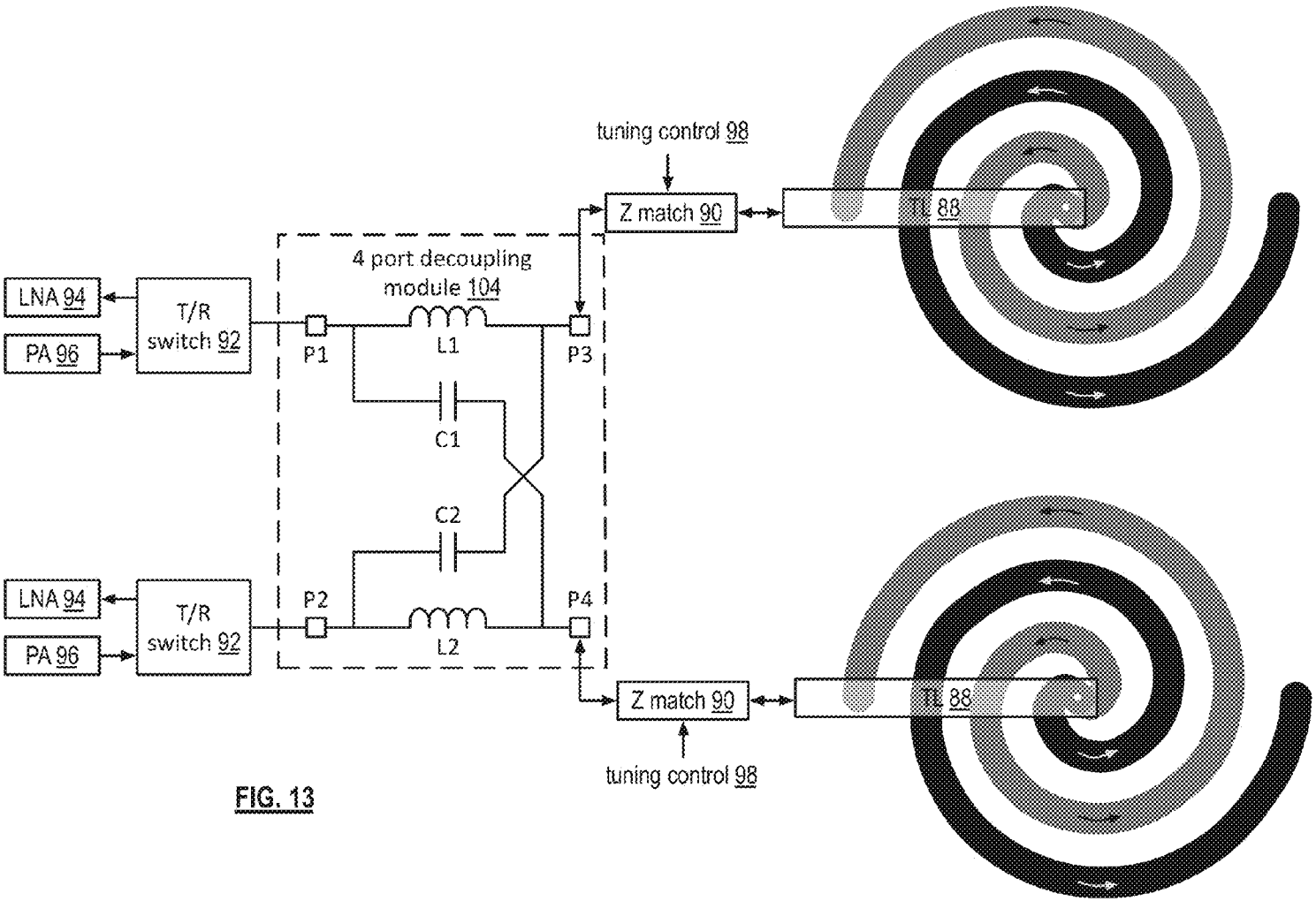
FIG. 13 is a schematic block diagram of an embodiment of circuitry coupled to poly interwoven spiral antennas in accordance with the present invention.

FIG. 13 is a schematic block diagram of an embodiment of circuitry coupled to poly interwoven spiral antennas. Each of the interwoven spiral antennas may be used to transceive RF signals within a given frequency band. Further, multiple antennas may be concurrently active to transceive RF signals in different frequency bands. The circuitry includes impedance matching circuits (Z) 90, a four port decoupling module 104, T/R switches 92, power amplifiers 96, and low noise amplifiers 94.

In this embodiment, the four port decoupling module 104 provides isolation between the concurrent multiple frequency band RF signal transceiving. The other components function as previously described.

Figure 14:
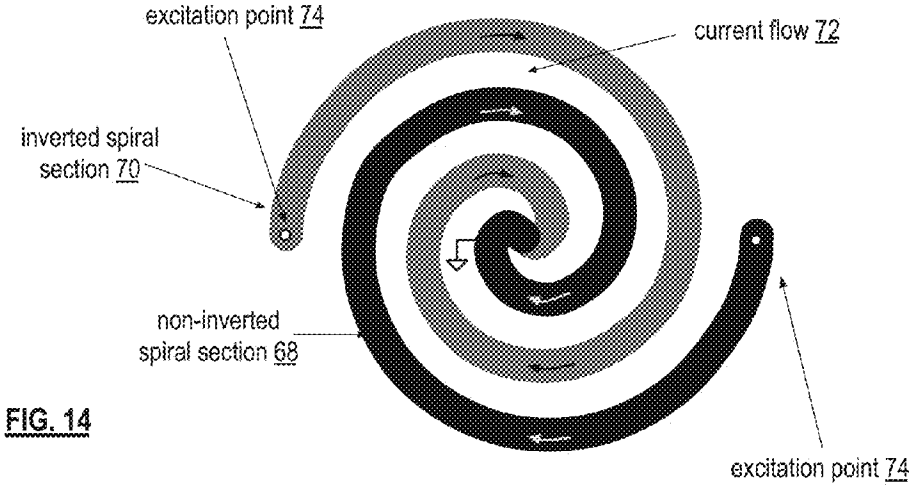
FIG. 14 is a diagram of another embodiment of an interwoven spiral antenna in accordance with the present invention.

FIG. 14 is a diagram of another embodiment of an interwoven spiral antenna that may be used in one or more of the antennas assemblies of the wireless communication devices discussed with reference to one or more of FIGS. 1-4. The interwoven spiral antenna includes a non-inverted spiral section 68 and an inverted spiral section 70. Collectively, the non-inverted spiral section 68 and the inverted spiral section 70 may form a Celtic spiral and/or an Archimedean spiral. In this example, the antenna includes two excitation points 74 at the end of the spiral sections and an AC ground connection at the connection point of the two spiral sections. As previously mentioned, the properties of the interwoven spiral antenna define its operational characteristics.

In an example of operation, an outbound RF signal is applied to the excitation points 74 of the interwoven spiral antenna. For example, if the outbound RF signal is a differential signal, then positive leg of the RF signal is applied to one of the excitation points 74 and the negative leg of the RF signal is applied to the other excitation point 74. Alternatively, if the outbound RF signal is a single ended signal, then the outbound RF signal is applied to both excitation points 74.

Current 72 flows through the interwoven spiral antenna from the excitation points 74 to the interconnection of the spiral sections. This generates an electric field and causes a current 72 to flow through the interwoven spiral antenna from the excitation points 74 to the interconnection of the spiral sections. The current 72 generates a magnetic field such that, in combination with the electric field, the antenna has a second circular polarization. Note that the interwoven spiral antenna (e.g., a Celtic spiral antenna and/or an Archimedean spiral antenna) may be printed on one or more metal layers of a printed circuit board, an integrated circuit (IC) packet substrate, or an IC die.

Figure 15:
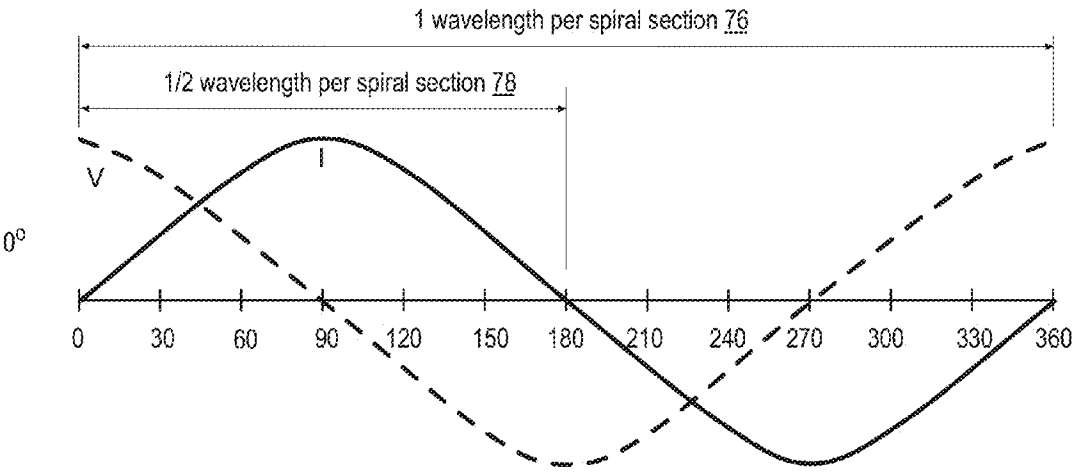
FIG. 15 is a diagram of an example of a current waveform and a voltage waveform of an interwoven spiral antenna of FIG. 20 in accordance with the present invention.

FIG. 15 is a diagram of an example of a current waveform and a voltage waveform of an interwoven spiral antenna of FIG. 14. The current waveform has zero crossings at 0 degrees, at 180 degrees, and at 360 degrees. The voltage waveform has zero crossings at 90 degrees and 270 degrees. As is further shown, the length of one of the spiral sections may be one-half wavelength 78 or a full wavelength 76. As such, with any of the wavelengths, the current at the ends of the spirals is approximately zero, while the voltage is approximately at its largest magnitude.

Figure 16:
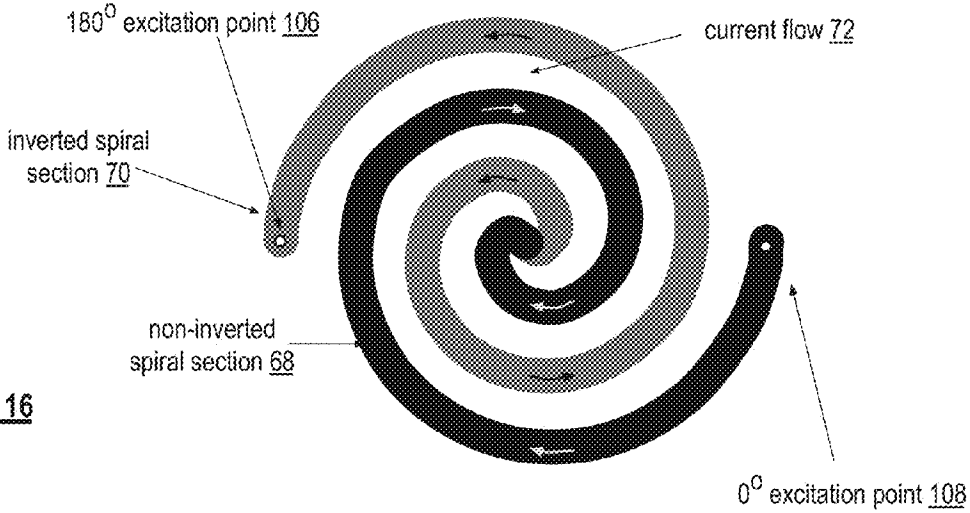
FIG. 16 is a diagram of another embodiment of an interwoven spiral antenna in accordance with the present invention.

FIG. 16 is a diagram of another embodiment of an interwoven spiral antenna that may be used in one or more of the antennas assemblies of the wireless communication devices discussed with reference to one or more of FIGS. 1-4. The interwoven spiral antenna includes a non-inverted spiral section 68 and an inverted spiral section 70. Collectively, the non-inverted spiral section 68 and the inverted spiral section 70 may form a Celtic spiral and/or an Archimedean spiral. In this example, the antenna includes two excitation points 106-108 at the end of the spiral sections. As previously mentioned, the properties of the interwoven spiral antenna define its operational characteristics.

In an example of operation, an outbound RF signal is applied to the excitation points of the interwoven spiral antenna. For example, if the outbound RF signal is a differential signal, then positive leg of the RF signal is applied to one of the excitation points and the negative leg of the RF signal is applied to the other excitation point.

Current flows through the interwoven spiral antenna from the excitation points 106-108 to the interconnection of the spiral sections. This generates an electric field and causes a current 72 to flow through the interwoven spiral antenna from the excitation points 106-108 to the interconnection of the spiral sections. The current 72 generates a magnetic field such that, in combination with the electric field, the antenna has a circular polarization. Note that the interwoven spiral antenna (e.g., a Celtic spiral antenna and/or an Archimedean spiral antenna) may be printed on one or more metal layers of a printed circuit board, an integrated circuit (IC) packet substrate, or an IC die.

Figure 17:
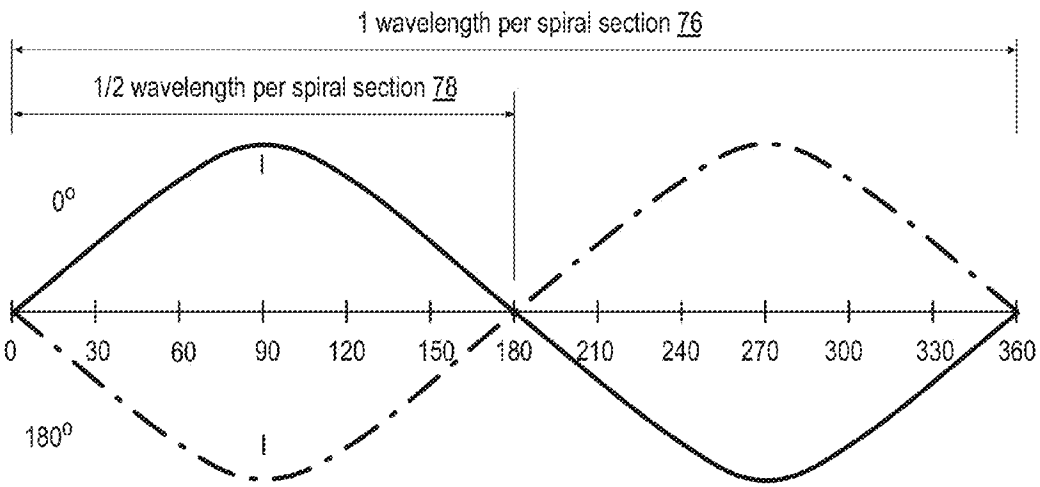
FIG. 17 is a diagram of an example of a current waveform and a voltage waveform of an interwoven spiral antenna of FIG. 16 in accordance with the present invention.

FIG. 17 is a diagram of an example of a current waveform of an interwoven spiral antenna of FIG. 16. The current waveform includes a positive leg and a negative leg, which is represented by the dashed line. Both current waveforms have zero crossings at 0 degrees, at 180 degrees, and at 360 degrees. As is further shown, the length of one of the spiral sections may be one-half wavelength 78 or a full wavelength 76. As such, with any of the wavelengths, the current at the ends of the spirals and at the center is approximately zero, while the voltage is approximately at its largest magnitude.

FIG. 18 is a diagram of another embodiment of an interwoven spiral antenna that may be used in one or more of the antennas assemblies of the wireless communication devices discussed with reference to one or more of FIGS. 1-4. The interwoven spiral antenna includes a non-inverted spiral section 68 and an inverted spiral section 70. Each of the spiral sections has a logarithmic Celtic spiral pattern to provide a logarithmic Celtic spiral antenna, which may have one or more excitation points 74 (e.g., one at the center connection of the two spiral sections, at the end of the spiral sections, etc.). The logarithmic Celtic spiral pattern may be based on the following equations:

$$r=r_0e^{af}$$

$$r_0=\text{inner radius}$$

$$a=\ln(\text{expansion ratio})/2p$$

Various properties of the interwoven spiral antenna define its operational characteristics. For instance, the dimensions of the excitation region (e.g., establishes the upper cutoff region of the bandwidth) and the circumference of the interwoven spiral antenna (e.g., establishes the lower cutoff region of the bandwidth) define the bandwidth of the interwoven spiral antenna. The increasing trace width (with respect to the center), the distance between traces (fixed or varying), the length of each spiral section, the distance to a ground plane, and/or use of an artificial magnetic conductor plane affect the quality factor, radiation pattern, impedance (which is fairly constant over the bandwidth), gain, and/or other characteristics of the antenna. Note that the interwoven spiral antenna may be printed on one or more metal layers of a printed circuit board, an integrated circuit (IC) packet substrate, or an IC die.

In an example of operation, an outbound RF signal is applied to a center excitation point 74 of the interwoven spiral antenna. This generates an electric field and causes a current to flow through the interwoven spiral antenna from the excitation points 74 to the interconnection of the spiral sections. The current 72 generates a magnetic field such that, in combination with the electric field, the antenna has a circular polarization. Return energy of the interwoven spiral antenna is via a ground plane, a return interwoven logarithmic Celtic spiral on another layer, and/or an artificial magnetic conductor.

In another example embodiment, the interwoven spiral antenna may be implemented on one or more layers of a substrate and second interwoven spiral antenna may be implemented on another one or more layers of the substrate. The first interwoven spiral antenna provides a first leg of an antenna assembly and the second interwoven spiral antenna provides a second leg of the antenna assembly. The two interwoven spirals are aligned from a major surface perspective of the substrate such that the magnetic fields of the two antenna legs are additive. In furtherance of this example, the first interwoven spiral antenna provides a first leg of a dipole antenna and the second interwoven spiral antenna provides a second leg of the dipole antenna. In still furtherance of this example, the first interwoven spiral antenna functions as previously described with reference to the present figure and the second interwoven spiral antenna provides a return path.

In an example of operation, an outbound RF signal is applied to the excitation points 74 of the interwoven spiral antenna. For example, if the outbound RF signal is a differential signal, then a positive leg of the RF signal is applied to one of the excitation points 74 and a negative leg of the RF signal is applied to the other excitation point 74. This generates an electric field and causes a current 72 to flow through the interwoven spiral antenna from the excitation points 74 to the interconnection of the spiral sections. The current 72 generates a magnetic field such that, in combination with the electric field, the antenna has a circular polarization.

Figure 19:
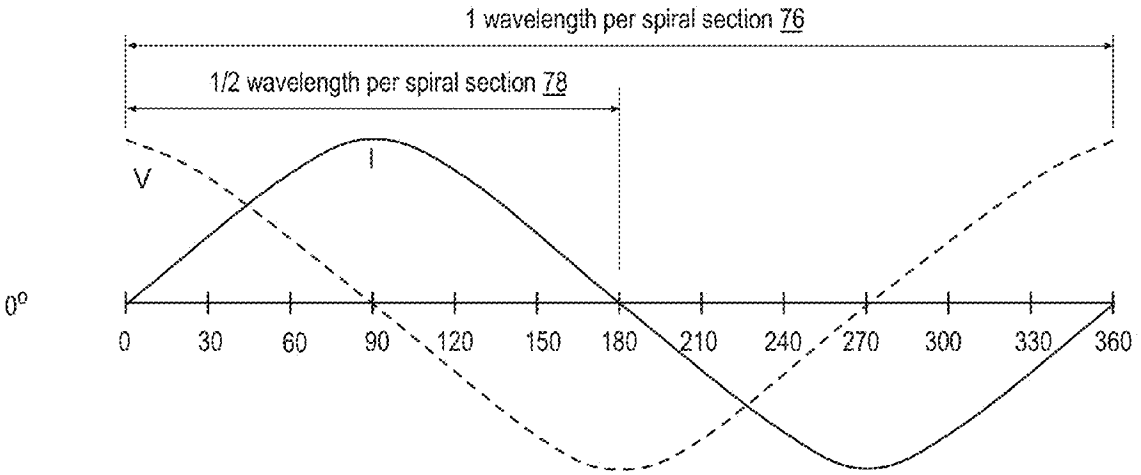
FIG. 19 is a diagram of an example of a current waveform and a voltage waveform of an interwoven spiral antenna of FIG. 18 in accordance with the present invention.

FIG. 19 is a diagram of an example of a current waveform and a voltage waveform of an interwoven spiral antenna of FIG. 18. The current waveform has zero crossings at 0 degrees, at 180 degrees, and at 360 degrees. The voltage waveform has zero crossings at 90 degrees and 270 degrees. As is further shown, the length of one of the spiral sections may be one-half wavelength 78 or a full wavelength 76. As such, with a half wavelength 78 or a full wavelength 76, the current at the ends of the spirals is approximately zero, while the voltage is approximately at its largest magnitude.

Figure 20:
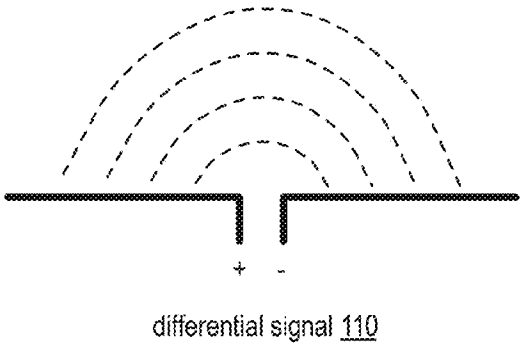
FIG. 20 is a schematic diagram of an embodiment of a dipole interwoven spiral antenna in accordance with the present invention.

FIG. 20 is a schematic diagram of an embodiment of a dipole interwoven spiral antenna that transmits a differential signal 110. In this example diagram, the positive leg of the differential signal 110 is coupled to one arm of the dipole antenna and the negative leg of the differential signal 110 is coupled to the other arm of the dipole antenna. Electromagnetic signals (e.g., an electrical field and/or a magnetic field) are radiated from the dipole antenna as shown.

Figure 21:
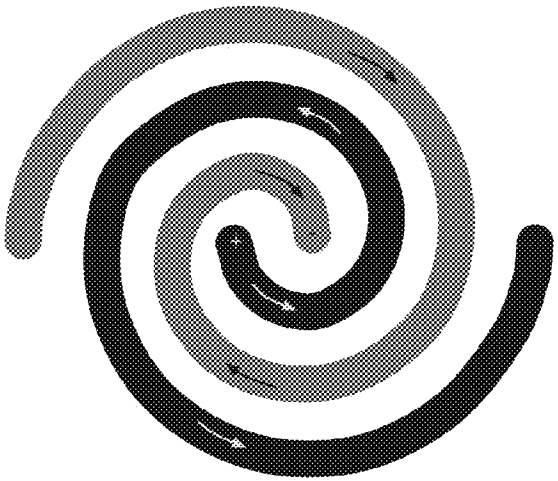
FIG. 21 is a diagram of an embodiment of a dipole interwoven spiral antenna with a first excitation in accordance with the present invention.

FIG. 21 is a diagram of an embodiment of a dipole interwoven spiral antenna that may be used in one or more of the antennas assemblies of the wireless communication devices discussed with reference to one or more of FIGS. 1-4. The interwoven spiral antenna includes a non-inverted spiral section and an inverted spiral section having a first orientation with respect to a major surface of the substrate. Collectively, the non-inverted spiral section and the inverted spiral section may form a Celtic spiral, a logarithmic Celtic spiral, and/or an Archimedean spiral. In this example, the antenna includes two excitation points at the center point of each of the spiral sections to provide a first excitation. As previously mentioned, the properties of the interwoven spiral antenna define its operational characteristics.

In an example of operation, a differential outbound RF signal is applied to the excitation points of the interwoven spiral antenna. For example, a positive leg of the RF signal is applied to one of the excitation points (e.g., +excitation point) and the negative leg of the RF signal is applied to the other excitation point (e.g., −excitation point). This generates an electric field and causes a current to flow through the interwoven spiral antenna from the excitation points to the interconnection of the spiral sections. The current generates a magnetic field such that, in combination with the electric field, the antenna has a first circular polarization. Note that the interwoven spiral antenna (e.g., a Celtic spiral antenna, logarithmic Celtic spiral, and/or an Archimedean spiral antenna) may be printed on one or more metal layers of a printed circuit board, an integrated circuit (IC) packet substrate, or an IC die.

Figure 22:
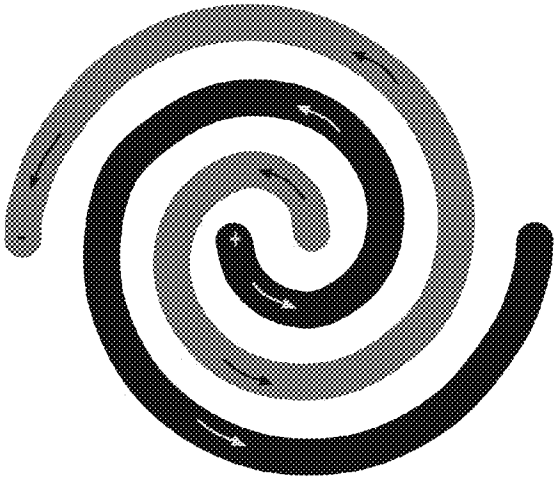
FIG. 22 is a diagram of an embodiment of a dipole interwoven spiral antenna with a second excitation in accordance with the present invention.

FIG. 22 is a diagram of an embodiment of a dipole interwoven spiral antenna that may be used in one or more of the antennas assemblies of the wireless communication devices discussed with reference to one or more of FIGS. 1-4. The interwoven spiral antenna includes a non-inverted spiral section and an inverted spiral section having a second orientation with respect to a major surface of the substrate. Collectively, the non-inverted spiral section and the inverted spiral section may form a Celtic spiral, a logarithmic Celtic spiral, and/or an Archimedean spiral. In this example, the antenna includes two excitation points at the center point of each of the spiral sections to provide a second excitation. As previously mentioned, the properties of the interwoven spiral antenna define its operational characteristics.

In an example of operation, a differential outbound RF signal is applied to the excitation points of the interwoven spiral antenna. For example, a positive leg of the RF signal is applied to one of the excitation points (e.g., +excitation point) and the negative leg of the RF signal is applied to the other excitation point (e.g., −excitation point). This generates an electric field and causes a current to flow through the interwoven spiral antenna from the excitation points to the interconnection of the spiral sections. The current generates a magnetic field such that, in combination with the electric field, the antenna has a second circular polarization. Note that the interwoven spiral antenna (e.g., a Celtic spiral antenna, logarithmic Celtic spiral, and/or an Archimedean spiral antenna) may be printed on one or more metal layers of a printed circuit board, an integrated circuit (IC) packet substrate, or an IC die.

Figure 23:
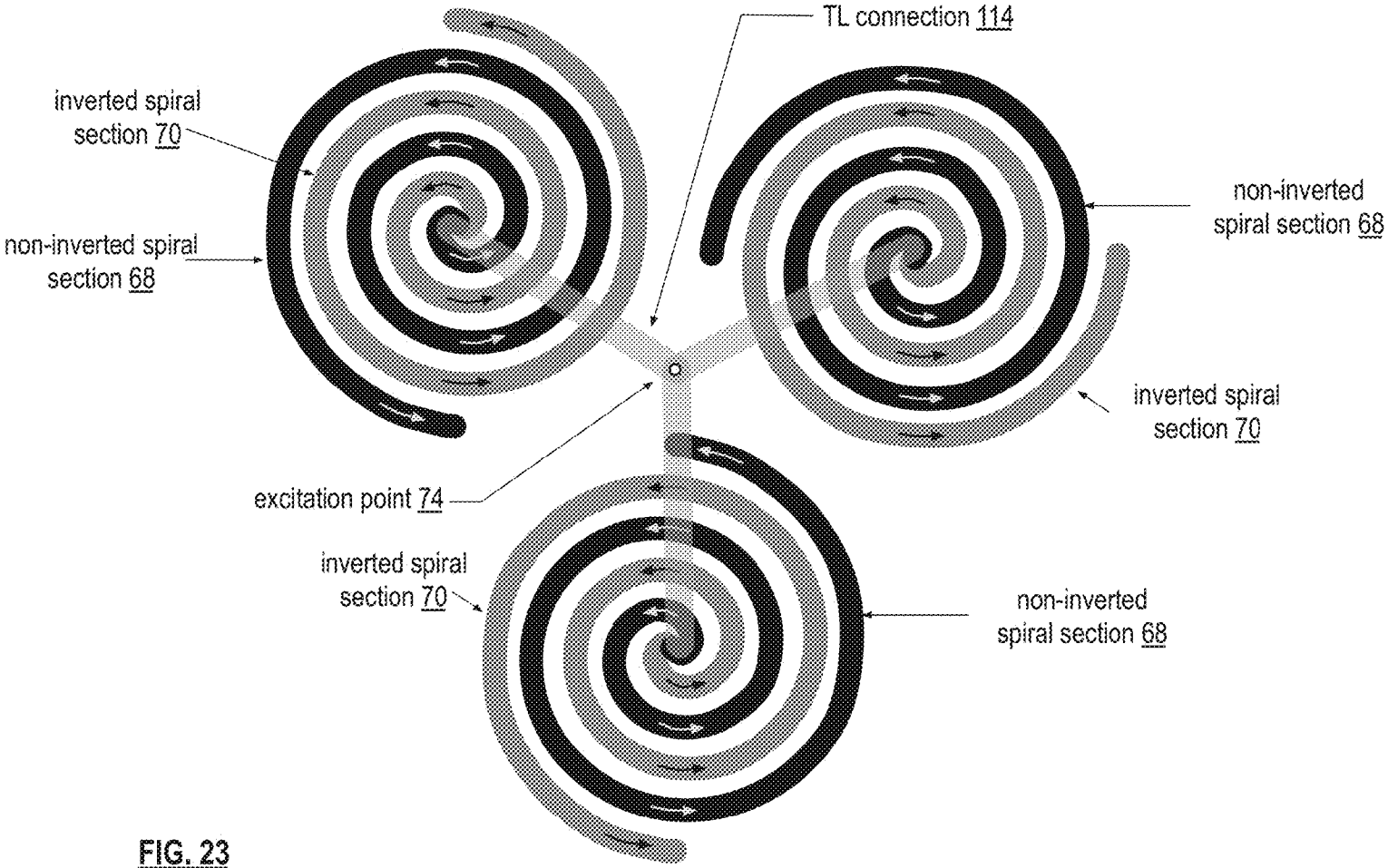
FIG. 23 is a diagram of an embodiment of a single excitation point antenna assembly that includes a plurality of interwoven spiral antennas in accordance with the present invention.

FIG. 23 is a diagram of an embodiment of a single excitation point antenna assembly that may be used in one or more of the antennas assemblies of the wireless communication devices discussed with reference to one or more of FIGS. 1-4. The single excitation point antenna assembly includes a plurality of interwoven spiral antennas (e.g., three in this example) coupled to a common excitation point 74 via transmission lines (TL) or spoke excitation connections 114. Each of the interwoven spiral antennas includes a non-inverted spiral section 68 and an inverted spiral section 70. Collectively, the non-inverted spiral section 68 and the inverted spiral section 70 may form a Celtic spiral, a logarithmic Celtic spiral, and/or an Archimedean spiral. In this example, the antenna includes an excitation point 74 at common connection point of the interwoven spiral antennas.

Various properties of each of the interwoven spiral antenna define the antenna assembly's operational characteristics. For instance, the dimensions of the excitation region (e.g., establishes the upper cutoff region of the bandwidth) and the circumference of the interwoven spiral antenna (e.g., establishes the lower cutoff region of the bandwidth) define the bandwidth of the interwoven spiral antenna. The trace width, distance between traces, length of each spiral section, distance to a ground plane, and/or use of an artificial magnetic conductor plane affect the quality factor, radiation pattern, impedance (which is fairly constant over the bandwidth), gain, and/or other characteristics of the antenna. Each of the spoke excitation connections may have a length approximately equal to m*one-half wavelength, where m is an integer greater than or equal to one.

In an example of operation, an outbound RF signal is applied to the excitation point 74 of the interwoven spiral antenna assembly. This generates an electric field and causes a current 72 to flow through each of the interwoven spiral antenna from it centered excitation point 74 to the ends of the spiral sections. The current generates a magnetic field such that, in combination with the electric field, the antenna assembly has a circular polarization, which may be inverted by changing the direction of current flow 72. For instance, the pattern of each of the interwoven spiral may be flipped 180 degrees to change the current flow 72 direction. This enables one interwoven spiral antenna assembly to be used for transmission of RF signals and another interwoven spiral antenna assembly with opposite circular polarity to be used for reception of RF signals. Return energy of the interwoven spiral antenna is via a ground plane, another antennas assembly on another layer of a substrate, and/or an artificial magnetic conductor.

In such an embodiment, a small footprint and wideband antenna that has a relatively constant gain throughout the band pass region is achievable. For example, the interwoven spiral antenna assembly may be printed on one or more metal layers of a printed circuit board (e.g., FR-4 substrate with a relative permittivity $\epsilon r$=4.40, dissipation factor tan $\delta$=0.02, and thickness of 2.0 mm) and the connections may be on one or more other layers. For a frequency band of 2 GHz, each spiral section of the antenna assembly includes two turns and has a radius of 8 mm; the width of spiral line and gap between adjacent lines are chosen to be 1 mm and 2.25 mm, respectively.

In another example embodiment, the interwoven spiral antenna assembly may be implemented on one or more layers of a substrate and second interwoven spiral antenna assembly may be implemented on another one or more layers of the substrate. The first interwoven spiral antenna assembly provides a first leg of an antenna assembly and the second interwoven spiral antenna assembly provides a second leg of the antenna assembly. The two interwoven spiral antenna assemblies are aligned from a major surface perspective of the substrate such that the magnetic fields of the two antenna assemblies are additive. In furtherance of this example, the first interwoven spiral antenna assembly provides a first leg of a dipole antenna and the second interwoven spiral antenna assembly provides a second leg of the dipole antenna. In still furtherance of this example, the first interwoven spiral antenna assembly functions as previously described with reference to the present figure and the second interwoven spiral antenna assembly provides a return path.

Figure 24:
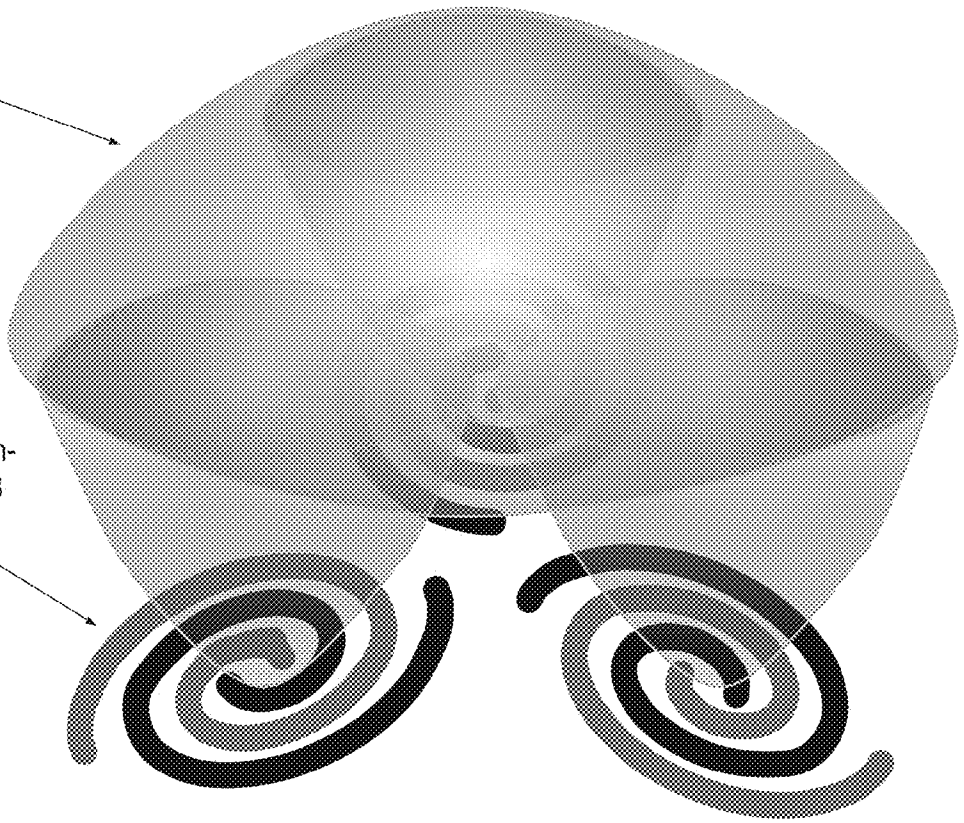
FIG. 24 is a diagram of an example of a radiation pattern of the antenna assembly of FIG. 23 in accordance with the present invention.

FIG. 24 is a diagram of an example of a radiation pattern 116 of the antenna assembly of FIG. 23. For this radiation pattern 116, the interwoven spiral antenna assembly is excited with a non-phase shifted signal (e.g., zero degree excitation). As such, the radiation pattern for each spiral is substantially perpendicular to the interwoven spiral antenna 118 (e.g., a Celtic spiral) and includes a circular polarization, which may be clock-wise or counter clock-wise. The radiation patterns of each of the spirals combine to produce a radiation pattern 116 for the antenna assembly.

If the return path of the antenna is through a ground and/or an artificial magnetic conductor, the radiation pattern 116 primarily includes the radiation lobe as shown. If, however, the return path of the antenna is through some other means (e.g., another interwoven spiral or a return connection), a second radiation lobe may be present that is perpendicular the surface of the antenna, but in the opposite direction as the one presently illustrated.

Figure 25:
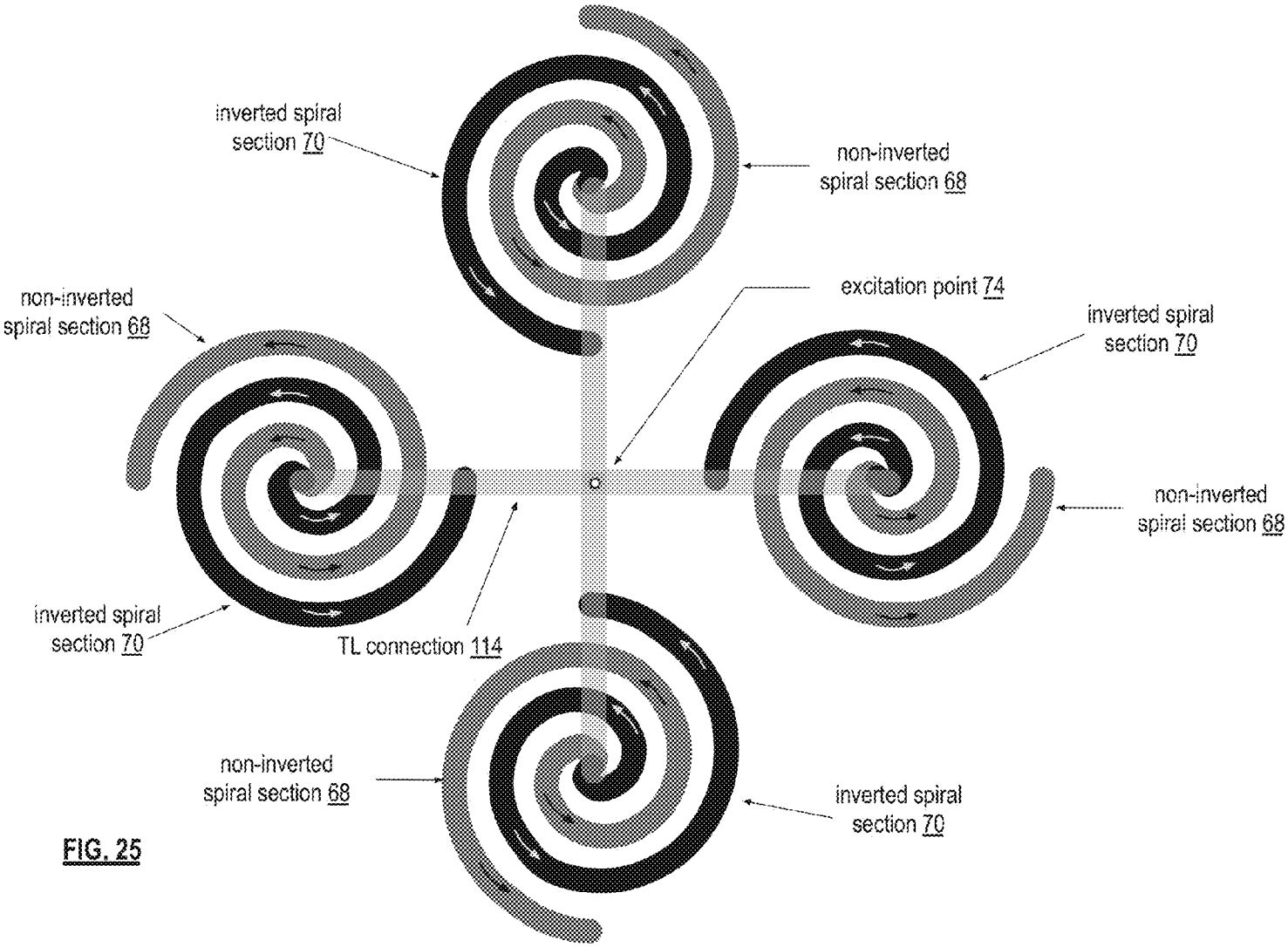
FIG. 25 is a diagram of another embodiment of a single excitation point antenna assembly that includes a plurality of interwoven spiral antennas in accordance with the present invention.

FIG. 25 is a diagram of another embodiment of a single excitation point antenna assembly that may be used in one or more of the antennas assemblies of the wireless communication devices discussed with reference to one or more of FIGS. 1-4. The single excitation point antenna assembly includes a plurality of interwoven spiral antennas (e.g., four is this example) coupled to a common excitation point 74 via transmission lines (TL) 114. Each of the interwoven spiral antennas includes a non-inverted spiral section 68 and an inverted spiral section 70. Collectively, the non-inverted spiral section 68 and the inverted spiral section 70 form a Celtic spiral, a logarithmic Celtic spiral, and/or an Archimedean spiral. In this example, the antenna assembly includes an excitation point 74 at common connection point of the interwoven spiral antennas. As previously mentioned, various properties of each of the interwoven spiral antenna define the antenna assembly's operational characteristics.

In an example of operation, an outbound RF signal is applied to the excitation point 74 of the interwoven spiral antenna assembly. This generates an electric field and causes a current to flow through each of the interwoven spiral antenna from it centered excitation point 74 to the ends of the spiral sections. The current generates a magnetic field such that, in combination with the electric field, the antenna assembly has a circular polarization, which may be inverted by changing the direction of current flow.

In another example embodiment, the interwoven spiral antenna assembly may be implemented on one or more layers of a substrate and second interwoven spiral antenna assembly may be implemented on another one or more layers of the substrate. The first interwoven spiral antenna assembly provides a first leg of an antenna assembly and the second interwoven spiral antenna assembly provides a second leg of the antenna assembly. The two interwoven spiral antenna assemblies are aligned from a major surface perspective of the substrate such that the magnetic fields of the two antenna assemblies are additive. In furtherance of this example, the first interwoven spiral antenna assembly provides a first leg of a dipole antenna and the second interwoven spiral antenna assembly provides a second leg of the dipole antenna. In still furtherance of this example, the first interwoven spiral antenna assembly functions as previously described with reference to the present figure and the second interwoven spiral antenna assembly provides a return path.

Figure 26:
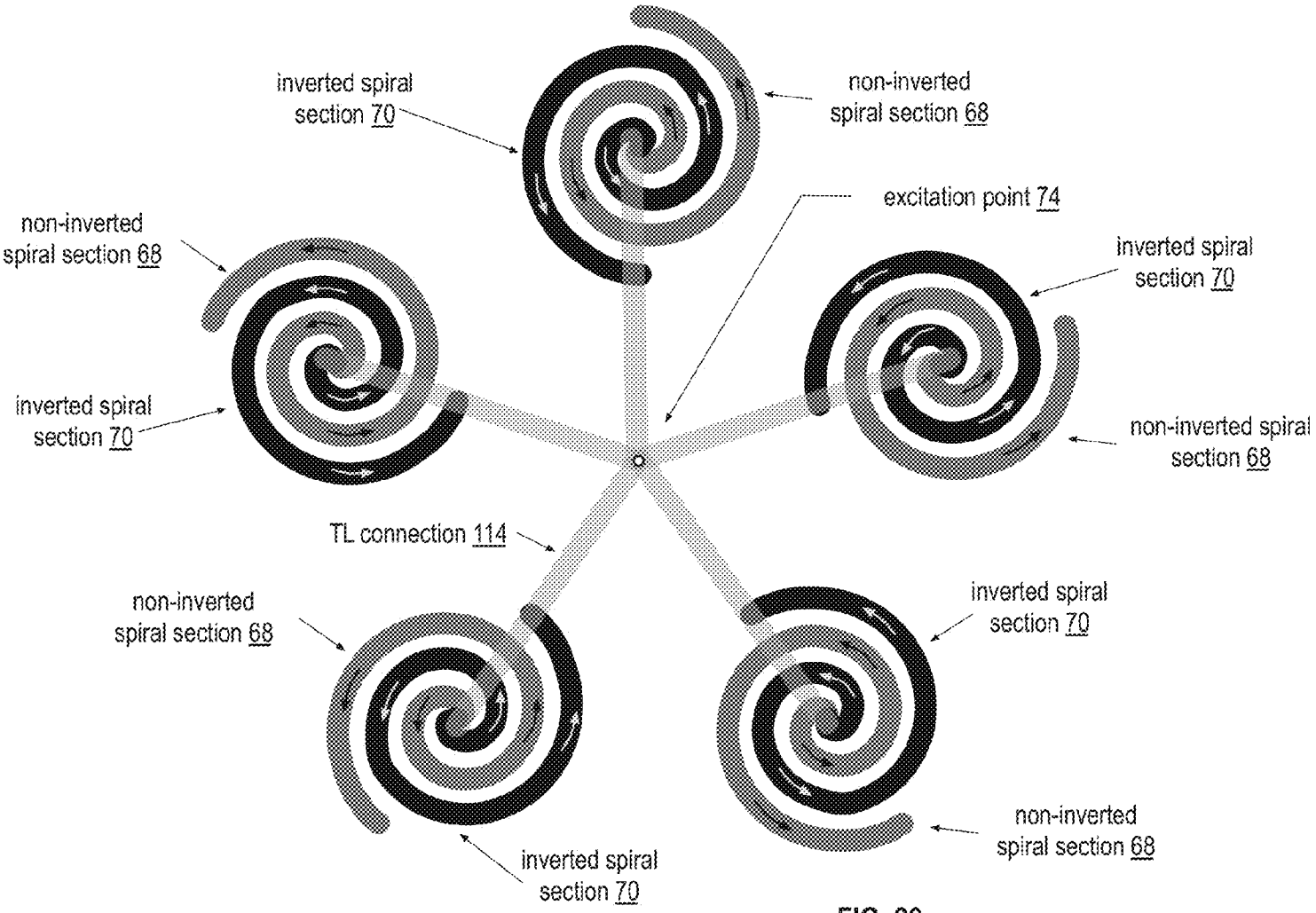
FIG. 26 is a diagram of another embodiment of a single excitation point antenna assembly that includes a plurality of interwoven spiral antennas in accordance with the present invention.

FIG. 26 is a diagram of another embodiment of a single excitation point antenna assembly that may be used in one or more of the antennas assemblies of the wireless communication devices discussed with reference to one or more of FIGS. 1-4. The single excitation point antenna assembly includes a plurality of interwoven spiral antennas (e.g., five is this example) coupled to a common excitation point 74 via transmission lines (TL) 114. Each of the interwoven spiral antennas includes a non-inverted spiral section 68 and an inverted spiral section 70. Collectively, the non-inverted spiral section 68 and the inverted spiral section 70 form a portion of Celtic spiral, a logarithmic Celtic spiral, and/or an Archimedean spiral. In this example, the antenna assembly includes an excitation point 74 at common connection point of the interwoven spiral antennas. As previously mentioned, various properties of each of the interwoven spiral antenna define the antenna assembly's operational characteristics.

In an example of operation, an outbound RF signal is applied to the excitation point 74 of the interwoven spiral antenna assembly. This generates an electric field and causes a current to flow through each of the interwoven spiral antenna from it centered excitation point 74 to the ends of the spiral sections. The current generates a magnetic field such that, in combination with the electric field, the antenna assembly has a circular polarization, which may be inverted by changing the direction of current flow.

In another example embodiment, the interwoven spiral antenna assembly may be implemented on one or more layers of a substrate and second interwoven spiral antenna assembly may be implemented on another one or more layers of the substrate. The first interwoven spiral antenna assembly provides a first leg of an antenna assembly and the second interwoven spiral antenna assembly provides a second leg of the antenna assembly. The two interwoven spiral antenna assemblies are aligned from a major surface perspective of the substrate such that the magnetic fields of the two antenna assemblies are additive. In furtherance of this example, the first interwoven spiral antenna assembly provides a first leg of a dipole antenna and the second interwoven spiral antenna assembly provides a second leg of the dipole antenna. In still furtherance of this example, the first interwoven spiral antenna assembly functions as previously described with reference to the present figure and the second interwoven spiral antenna assembly provides a return path.

Figure 27:
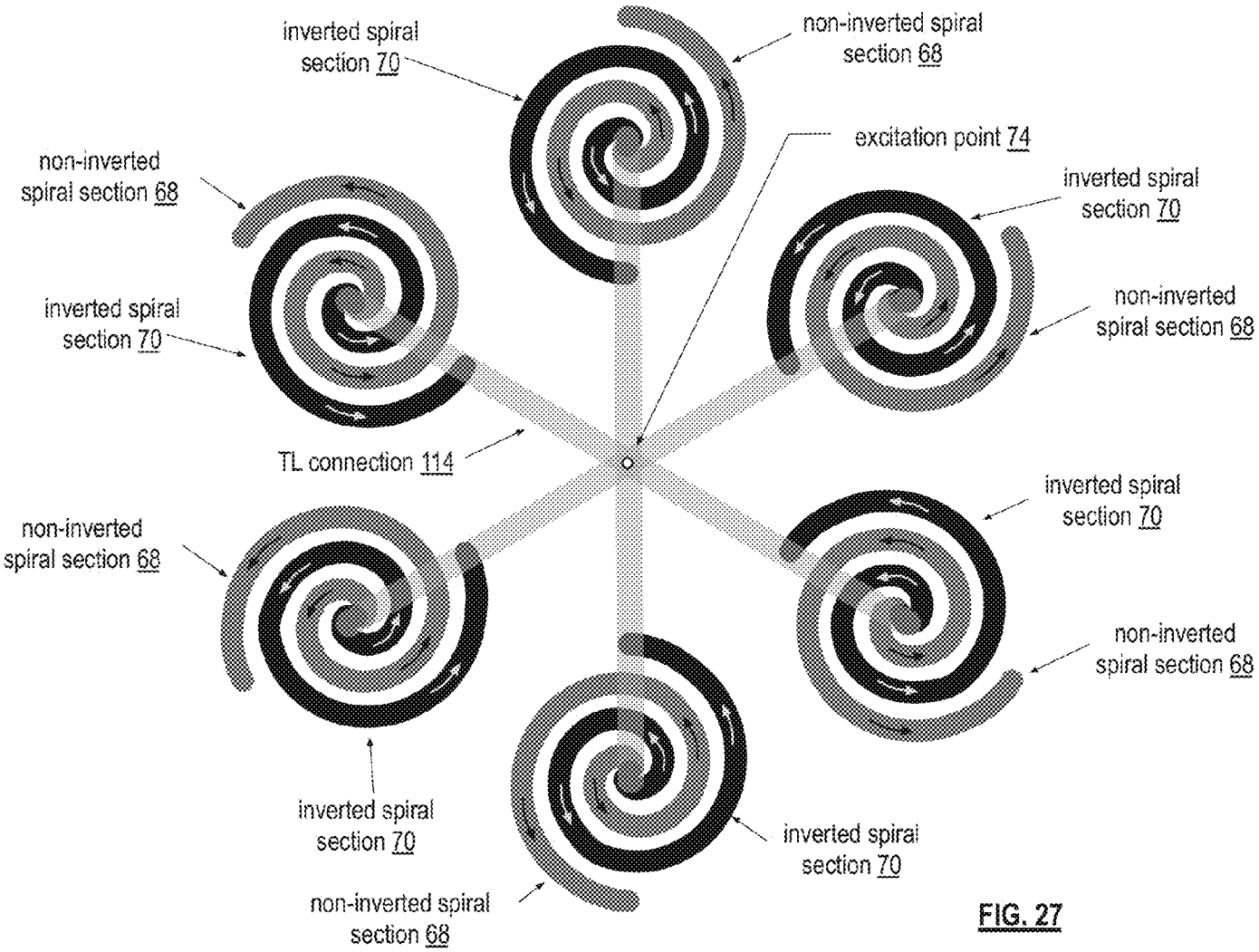
FIG. 27 is a diagram of another embodiment of a single excitation point antenna assembly that includes a plurality of interwoven spiral antennas in accordance with the present invention.

FIG. 27 is a diagram of another embodiment of a single excitation point antenna assembly that may be used in one or more of the antennas assemblies of the wireless communication devices discussed with reference to one or more of FIGS. 1-4. The single excitation point antenna assembly includes a plurality of interwoven spiral antennas (e.g., six is this example) coupled to a common excitation point 74 via transmission lines (TL) 114. Each of the interwoven spiral antennas includes a non-inverted spiral section 68 and an inverted spiral section 70. Collectively, the non-inverted spiral section 68 and the inverted spiral section 70 form a portion of a Celtic spiral, a logarithmic Celtic spiral, and/or an Archimedean spiral. In this example, the antenna assembly includes an excitation point 74 at common connection point of the interwoven spiral antennas. As previously mentioned, various properties of each of the interwoven spiral antenna define the antenna assembly's operational characteristics.

In an example of operation, an outbound RF signal is applied to the excitation point 74 of the interwoven spiral antenna assembly. This generates an electric field and causes a current to flow through each of the interwoven spiral antenna from it centered excitation point 74 to the ends of the spiral sections. The current generates a magnetic field such that, in combination with the electric field, the antenna assembly has a circular polarization, which may be inverted by changing the direction of current flow.

In another example embodiment, the interwoven spiral antenna assembly may be implemented on one or more layers of a substrate and second interwoven spiral antenna assembly may be implemented on another one or more layers of the substrate. The first interwoven spiral antenna assembly provides a first leg of an antenna assembly and the second interwoven spiral antenna assembly provides a second leg of the antenna assembly. The two interwoven spiral antenna assemblies are aligned from a major surface perspective of the substrate such that the magnetic fields of the two antenna assemblies are additive. In furtherance of this example, the first interwoven spiral antenna assembly provides a first leg of a dipole antenna and the second interwoven spiral antenna assembly provides a second leg of the dipole antenna. In still furtherance of this example, the first interwoven spiral antenna assembly functions as previously described with reference to the present figure and the second interwoven spiral antenna assembly provides a return path.

The antenna assemblies of FIGS. 25-27 will have a similar shaped radiation pattern as the antenna assembly of FIG. 23 and as shown in FIG. 25. Each of the antenna assemblies of FIG. 25-27, however, will have a different radiation footprint than the antenna assembly of FIG. 23 due to the increased number of spirals in the assembly. Further, each of the antenna assemblies of FIGS. 25-27 may have an increased gain than the antenna assembly of FIG. 23 due to the increased number of spirals.

Figure 28:
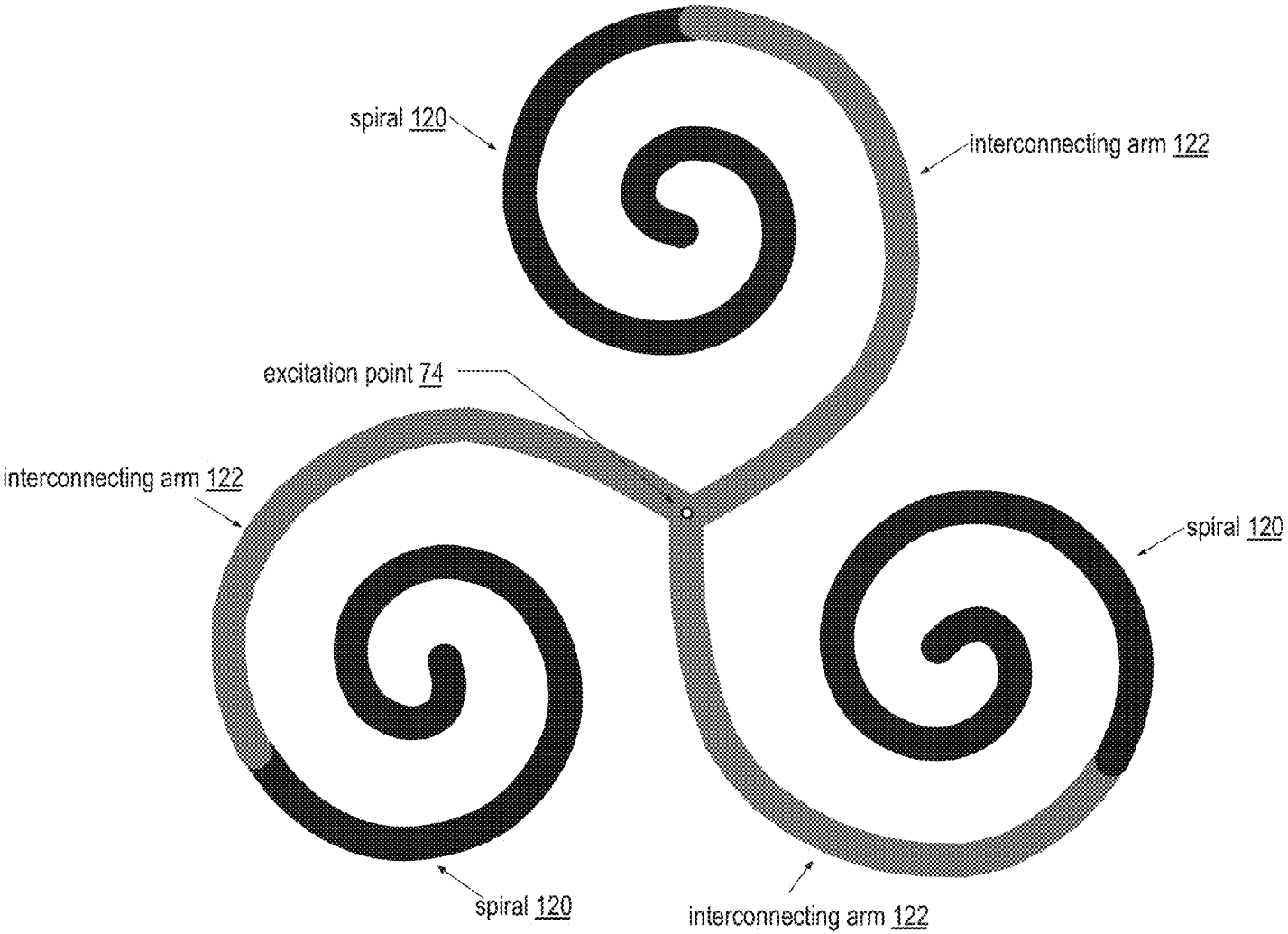
FIG. 28 is a diagram of an embodiment of a single excitation point antenna assembly that includes a plurality of spiral antenna components in accordance with the present invention.

FIG. 28 is a diagram of an embodiment of a single excitation point antenna assembly that may be used in one or more of the antennas assemblies of the wireless communication devices discussed with reference to one or more of FIGS. 1-4. The single excitation point antenna assembly includes a plurality of spiral antennas 120 (e.g., three is this example, but could be more) coupled to a common excitation point 74 (e.g., a hub connection point) via interconnecting arms 122. Each of the spiral antennas 120 includes a spiral shape that may be a portion of a Celtic spiral, a logarithmic Celtic spiral, and/or an Archimedean spiral. The excitation point 74 of the antenna assembly is at common connection point of the interconnecting arms 122.

Various properties of each of the spiral sections 120 and the interconnecting arms 122 define the antenna assembly's operational characteristics. For instance, the dimensions of the excitation region (e.g., establishes the upper cutoff region of the bandwidth) and the circumference of the interwoven spiral antenna (e.g., establishes the lower cutoff region of the bandwidth) define the bandwidth of the spiral antenna. The trace width, distance between traces, length of each spiral section 120, length of the interconnecting arms 122, distance to a ground plane, and/or use of an artificial magnetic conductor plane affect the quality factor, radiation pattern, impedance (which is fairly constant over the bandwidth), gain, and/or other characteristics of the antenna.

In an example of operation, an outbound RF signal is applied to the excitation point 74 of the spiral antenna assembly. This generates an electric field and causes a current to flow through each of the interconnecting arms 122 and the corresponding spiral antenna 120. The current generates a magnetic field such that, in combination with the electric field, the antenna assembly has a circular polarization, which may be inverted by changing the direction of current flow.

In another example embodiment, the spiral antenna assembly may be implemented on one or more layers of a substrate and second spiral antenna assembly may be implemented on another one or more layers of the substrate. The first spiral antenna assembly provides a first leg of an antenna assembly and the second spiral antenna assembly provides a second leg of the antenna assembly. The two spiral antenna assemblies are aligned from a major surface perspective of the substrate such that the magnetic fields of the two antenna assemblies are additive. In furtherance of this example, the first spiral antenna assembly provides a first leg of a dipole antenna and the second spiral antenna assembly provides a second leg of the dipole antenna. In still furtherance of this example, the first spiral antenna assembly functions as previously described with reference to the present figure and the second spiral antenna assembly provides a return path.

Figure 29:
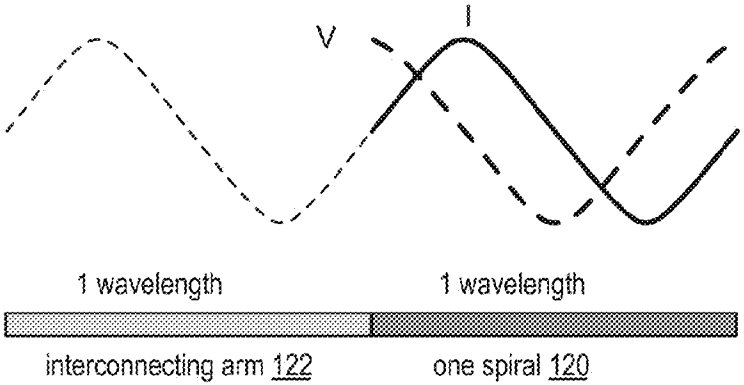
FIG. 29 is a diagram of an example of a current waveform and a voltage waveform of the antenna assembly of FIG. 28 in accordance with the present invention.

FIG. 29 is a diagram of an example of a current waveform and a voltage waveform of the antenna assembly of FIG. 28. In this example, each of the interconnecting arms 122 and each of the spirals 120 has a length corresponding to one wavelength of a center frequency (or other frequency) of a desired frequency band. The current waveform for the interconnecting arm 122 and the spiral 120 has zero crossings at 0 degrees, at 180 degrees, and at 360 degrees. The voltage waveform for the interconnecting arm 122 and the spiral 120 has zero crossings at 90 degrees and 270 degrees. With the ATU providing a substantially matched impedance, the antenna assembly radiates an electromagnetic signal in accordance with the current and voltage waveforms.

Figure 30:
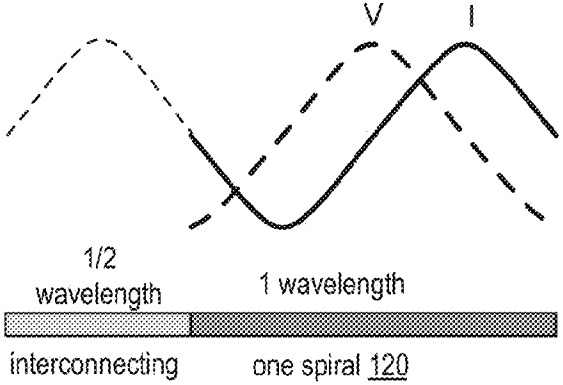
FIG. 30 is a diagram of another example of a current waveform and a voltage waveform of the antenna assembly of FIG. 28 in accordance with the present invention.

FIG. 30 is a diagram of another example of a current waveform and a voltage waveform of the antenna assembly of FIG. 28. In this example, the interconnecting arm 122 has a length of one-half wavelength and the spiral 120 has a length corresponding to one wavelength of a center frequency (or other frequency) of a desired frequency band. The current waveform for the interconnecting arm 122 has zero crossings at 0 degrees and at 180 degrees. The current waveform for the spiral 120 has zero crossings at 0 degrees, at 180 degrees, and at 360 degrees. The voltage waveform for the interconnecting arm 122 has a zero crossing at 90 degrees. The voltage waveform for the spiral 120 has zero crossings at 90 degrees and 270 degrees. With the ATU providing a substantially matched impedance, the antenna assembly radiates an electromagnetic signal in accordance with the current and voltage waveforms.

Figure 31:
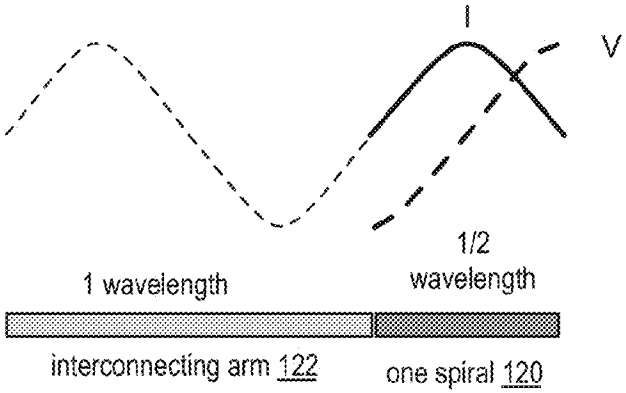
FIG. 31 is a diagram of another example of a current waveform and a voltage waveform of the antenna assembly of FIG. 28 in accordance with the present invention.

FIG. 31 is a diagram of another example of a current waveform and a voltage waveform of the antenna assembly of FIG. 28. In this example, the interconnecting arm 122 has a length of one-wavelength and the spiral 120 has a length of one-half wavelength of a center frequency (or other frequency) of a desired frequency band. The current waveform for the spiral 120 has zero crossings at 0 degrees and at 180 degrees. The current waveform for the interconnecting arm 122 has zero crossings at 0 degrees, at 180 degrees, and at 360 degrees. The voltage waveform for the spiral 120 has a zero crossing at 90 degrees. The voltage waveform for the interconnecting arm 122 has zero crossings at 90 degrees and 270 degrees. With the ATU providing a substantially matched impedance, the antenna assembly radiates an electromagnetic signal in accordance with the current and voltage waveforms.

Figure 32:
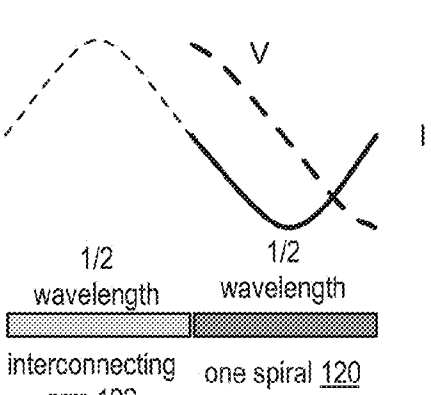
FIG. 32 is a diagram of another example of a current waveform and a voltage waveform of the antenna assembly of FIG. 28 in accordance with the present invention.

FIG. 32 is a diagram of another example of a current waveform and a voltage waveform of the antenna assembly of FIG. 28. In this example, each of the interconnecting arms 122 and each of the spirals 120 has a length corresponding to one-half wavelength of a center frequency (or other frequency) of a desired frequency band. The current waveform for the interconnecting arm 122 and the spiral 120 has zero crossings at 0 degrees and at 180 degrees. The voltage waveform for the interconnecting arm 122 and the spiral 120 has a zero crossing at 90 degrees. With the ATU providing a substantially matched impedance, the antenna assembly radiates an electromagnetic signal in accordance with the current and voltage waveforms.

Figure 33:
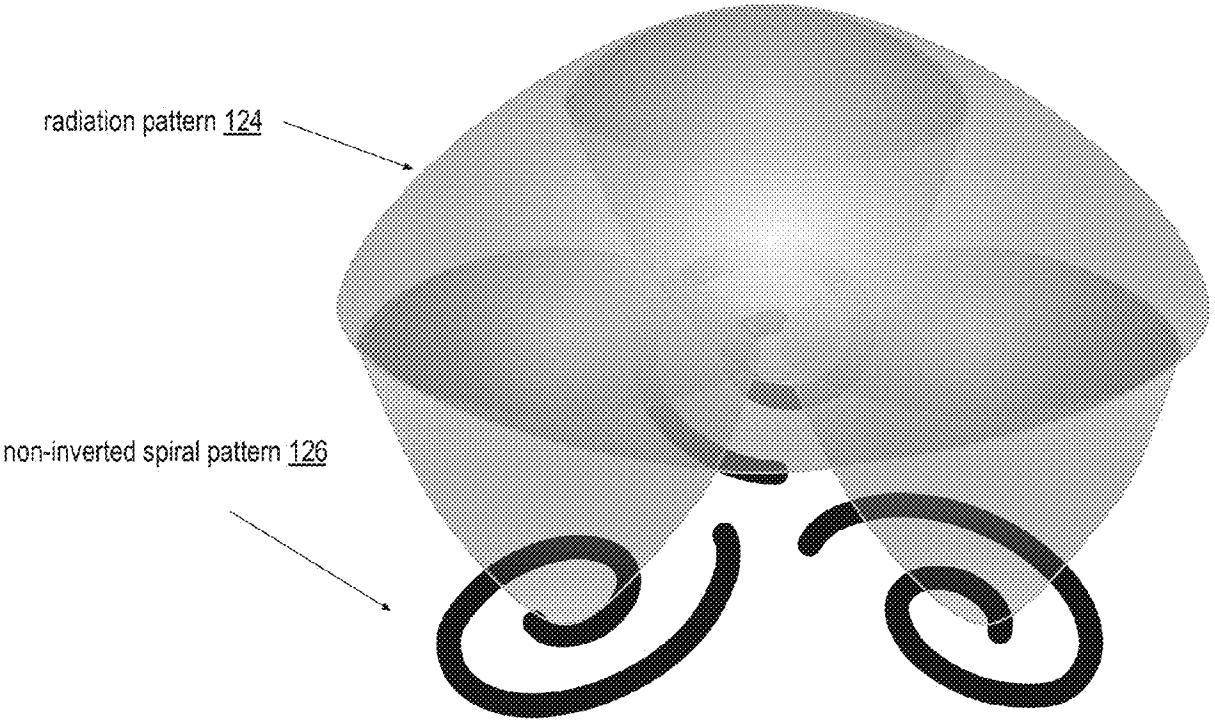
FIG. 33 is a diagram of an example of a radiation pattern of the antenna assembly of FIG. 28 in accordance with the present invention.

FIG. 33 is a diagram of an example of a radiation pattern 124 of the antenna assembly of FIG. 28. For this radiation pattern 124, the spiral antenna assembly is excited with a non-phase shifted signal (e.g., zero degree excitation). As such, the radiation pattern for each spiral is substantially perpendicular to the interwoven spiral antenna 126 (e.g., a Celtic spiral) and includes a circular polarization, which may be clock-wise or counter clock-wise. The radiation patterns of each of the spirals combine to produce a radiation pattern 124 for the antenna assembly.

If the return path of the antenna is through a ground and/or an artificial magnetic conductor, the radiation pattern 124 primarily includes the radiation lobe as shown. If, however, the return path of the antenna is through some other means (e.g., another interwoven spiral or a return connection), a second radiation lobe may be present that is perpendicular the surface of the antenna, but in the opposite direction as the one presently illustrated.

Figure 34:
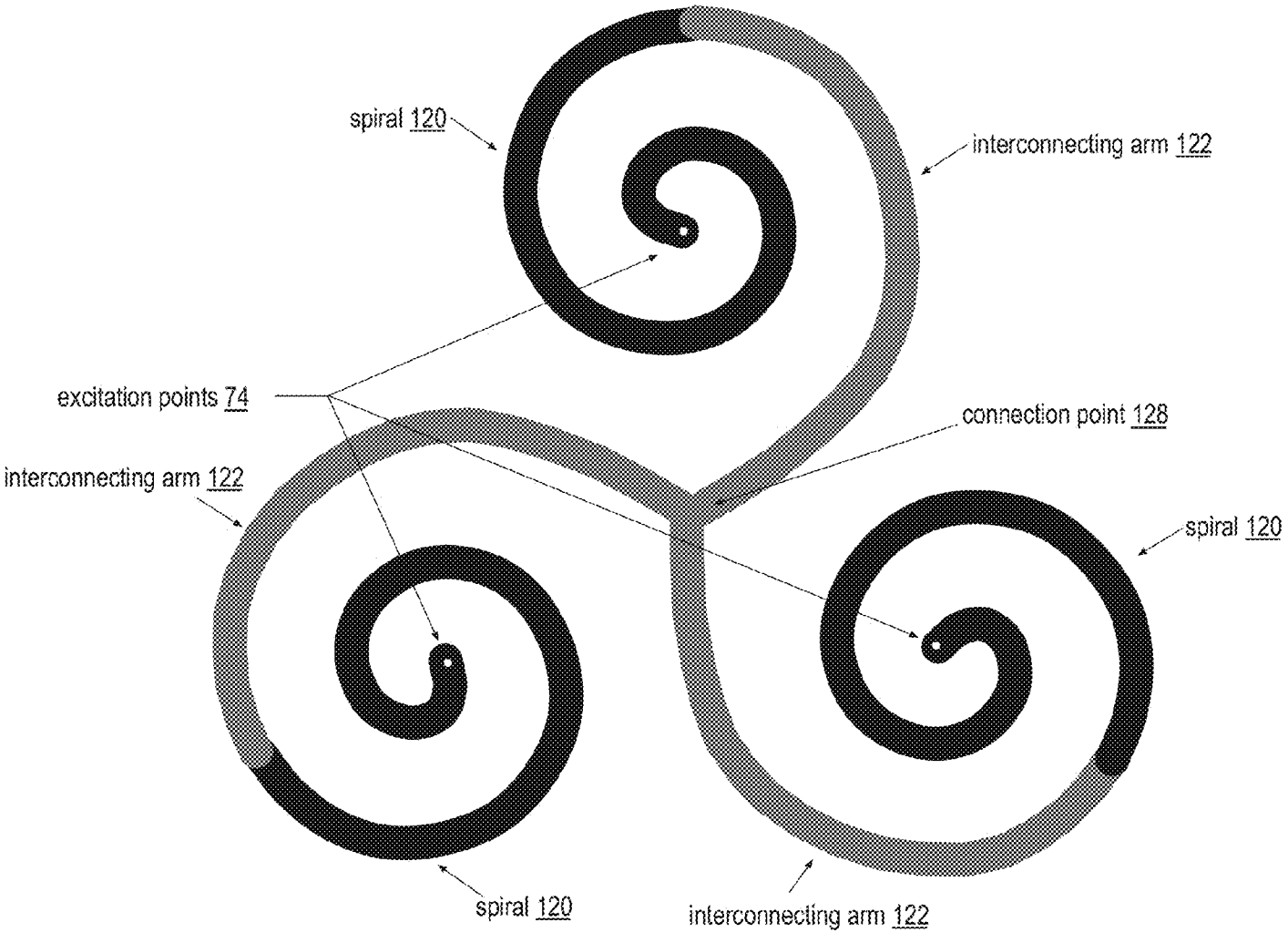
FIG. 34 is a diagram of an embodiment of a multiple excitation point antenna assembly that includes a plurality of spiral antenna components in accordance with the present invention.

FIG. 34 is a diagram of an embodiment of a multiple excitation point antenna assembly that may be used in one or more of the antennas assemblies of the wireless communication devices discussed with reference to one or more of FIGS. 1-4. The multiple excitation point antenna assembly includes a plurality of spiral antennas 120 (e.g., three is this example, but could be more) coupled together via interconnecting arms 122 at a hub connection point. Each of the spiral antennas 120 includes a spiral shape that may be a portion of a Celtic spiral, a logarithmic Celtic spiral, and/or an Archimedean spiral. The excitation points 74 are at the center of each of the spirals 120 and may be excited with the same phase of a signal or different phases (e.g., 0 degrees, 120 degrees, and 240 degrees) of the signal. As previously discussed, various properties of each of the spiral sections 120 and the interconnecting arms 122 define the antenna assembly's operational characteristics.

In an example of operation, an outbound RF signal is applied to the excitation points 74 of the spiral antenna assembly. This generates an electric field and causes a current to flow through each of the interconnecting arms 122 and the corresponding spiral antenna 120. The current generates a magnetic field such that, in combination with the electric field, the antenna assembly has a circular polarization, which may be inverted by changing the direction of current flow.

In another example embodiment, the spiral antenna assembly may be implemented on one or more layers of a substrate and second spiral antenna assembly may be implemented on another one or more layers of the substrate. The first spiral antenna assembly provides a first leg of an antenna assembly and the second spiral antenna assembly provides a second leg of the antenna assembly. The two spiral antenna assemblies are aligned from a major surface perspective of the substrate such that the magnetic fields of the two antenna assemblies are additive. In furtherance of this example, the first spiral antenna assembly provides a first leg of a dipole antenna and the second spiral antenna assembly provides a second leg of the dipole antenna. In still furtherance of this example, the first spiral antenna assembly functions as previously described with reference to the present figure and the second spiral antenna assembly provides a return path.

Figure 35:
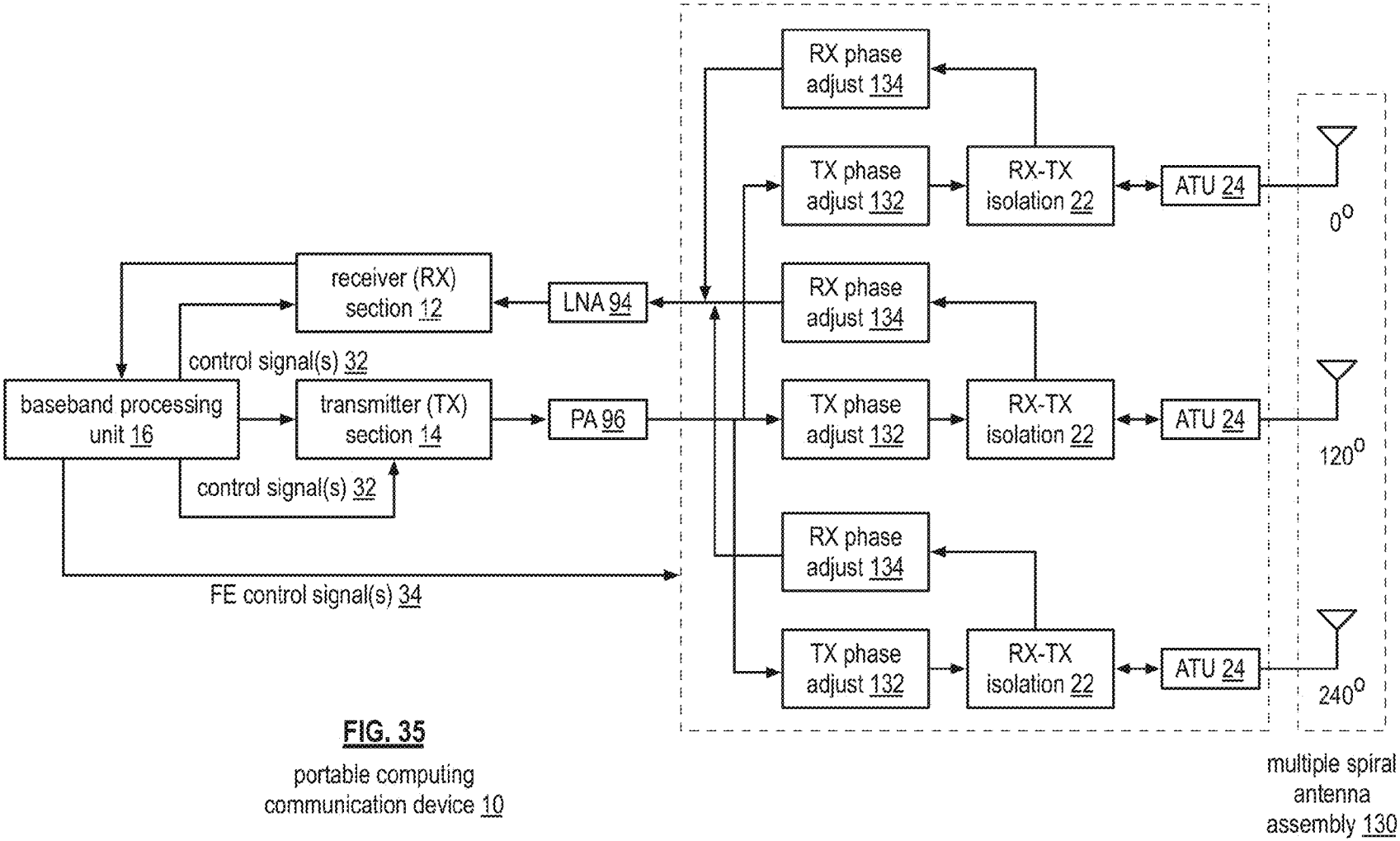
FIG. 35 is a schematic block diagram of another embodiment of a wireless communication device in accordance with the present invention.

FIG. 35 is a schematic block diagram of another embodiment of a wireless communication device 10 that includes a receiver section 12, a transmitter section 14, a baseband processing module 16, a power management unit, a power amplifier (PA) 96 (which may be part of the transmitter section), a low noise amplifier 94 (which may be part of the receiver section), a front end antenna interface module, and an antenna assembly 130. The front end antenna interface module includes a plurality of antenna tuning units (ATU) 24, a plurality of RX-TX isolation modules 22, a plurality of transmit phase adjust modules 132, and a plurality of receive adjust phase modules 134. The antenna assembly 130 includes a plurality of interwoven spiral antennas that are coupled together via one or more connection traces. While 3 sets of circuitry is shown in the front-end module and the antenna assembly 130, the wireless communication device 10 may include more or less than three sets of circuitry.

The receiver section 12 may be a direct conversion receiver or it may be a super-heterodyne receiver, which includes a radio frequency (RF) to intermediate frequency (IF) conversion section and an IF to baseband (BB) section. The wireless communication device 10 may be any device that can be carried by a person, can be at least partially powered by a battery, includes a radio transceiver (e.g., radio frequency (RF) and/or millimeter wave (MMW)) and performs one or more software applications. For example, the wireless communication device 10 may be a cellular telephone, a laptop computer, a personal digital assistant, a video game console, a video game player, a personal entertainment unit, a tablet computer, etc.

In an example embodiment, the receiver section 12, the LNA 94, the transmitter section 14, the baseband processing unit 16 and the power management unit are implemented as a system on a chip (SOC). The power amplifier 96, the transmit phase adjust modules 132, the receive phase adjust modules 134, the RX-TX isolation modules 22, and the ATUs 24 may be implemented within a separate IC. The wireless communication device 10 may support 2G (second generation) cellular telephone service, 3G or 4G (third generation or fourth generation) cellular telephone service, and a wireless local area network (WLAN) service simultaneously or sequentially. The wireless communication device 10 may further support one or more wireless communication standards (e.g., IEEE 802.11, Bluetooth, global system for mobile communications (GSM), code division multiple access (CDMA), radio frequency identification (RFID), Enhanced Data rates for GSM Evolution (EDGE), General Packet Radio Service (GPRS), WCDMA, high-speed downlink packet access (HSDPA), high-speed uplink packet access (HSUPA), LTE (Long Term Evolution), WiMAX (worldwide interoperability for microwave access), and/or variations thereof).

In an example of single frequency band operation, the baseband processing unit 16, or module, performs one or more functions of the wireless communication device 10 regarding transmission of data. In this instance, the processing module receives outbound data (e.g., voice, text, audio, video, graphics, etc.) and converts it into one or more outbound symbol streams in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.).

The baseband processing unit 16 provides the one or more outbound symbol streams to the transmitter section 14 and provides front end (FE) control signals 34 to the front end antenna interface module. The transmitter section 14 converts the outbound symbol stream(s) into one or more pre-PA outbound RF signals (e.g., signals in one or more frequency bands 800 MHz, 1800 MHz, 1900 MHz, 2000 MHz, 2.4 GHz, 5 GHz, 60 GHz, etc.). The transceiver section 14 may include at least one up-conversion module, at least one frequency translated bandpass filter (FTBPF), and an output module; which may be configured as a direct conversion topology (e.g., direct conversion of baseband or near baseband symbol streams to RF signals) or as a super heterodyne topology (e.g., convert baseband or near baseband symbol streams into IF signals and then convert the IF signals into RF signals).

The transmitter section 14 outputs the pre-PA outbound RF signal(s) to a power amplifier module (PA) 96. The PA 96 includes one or more power amplifiers coupled in series and/or in parallel to amplify the pre-PA outbound RF signal(s) to produce an outbound RF signal(s). Note that parameters (e.g., gain, linearity, bandwidth, efficiency, noise, output dynamic range, slew rate, rise rate, settling time, overshoot, stability factor, etc.) of the PA 96 may be adjusted based on control signals 32 received from the baseband processing unit 16 and/or another processing module of the wireless communication device 10. The PA 96 outputs the outbound RF signal(s) to the transmit phase adjust modules 132.

Each of the transmit phase adjust modules 132 adds a phase shift to the outbound RF signal(s). For instance, a first transmit phase adjust module 132 adds a 0° phase shift, a second transmit phase adjust module adds a 120° phase shift, and a third transmit phase adjust module adds a 0° phase shift (e.g., $A(t)\cos(\omega_{RF}(t)+\phi(t))+0°$), $A(t)\cos(\omega_{RF}(t)+\phi(t))+120°$), and $A(t)\cos(\omega_{RF}(t)+\phi(t))+240°$)). To achieve the phase shift, each of the transmit phase adjust modules 132 includes one or more of a programmable delay line, a programmable RF mixing module, etc. The baseband processing module 16 generates one or more control signals 32 to program the phase shift amount for at least some of the transmit phase adjust modules 132.

Each of the RX-TX isolation modules 134 (each of which may be a duplexer, a circulator, or transformer balun, or other device that provides isolation between a TX signal and an RX signal using a common antenna) attenuates the outbound RF signal(s). Each of the RX-TX isolation modules 22 adjusts it attenuation of the outbound RF signal(s) (i.e., the TX signal) based on control signals 32 received from the baseband processing unit 16 and/or the processing module. For example, when the transmission power is relatively low, each of the RX-TX isolation modules 22 reduces its attenuation of the TX signal in accordance with the control signal 32.

Each of the antenna tuning units (ATUs) 24 is tuned to provide a desired impedance that substantially matches that of the corresponding antenna. As tuned, the ATU 24 provides the attenuated TX signal from the RX-TX isolation module 22 to the antenna for transmission. Note that the ATU 24 may be continually or periodically adjusted to track impedance changes of the corresponding antenna. For example, the baseband processing unit 16 and/or the processing module may detect a change in the impedance of the corresponding antenna and, based on the detected change, provide control signals 32 to the ATU 24 such that it changes it impedance accordingly.

Each of the antennas transmits the corresponding outbound RF signal it receives from the corresponding ATU 24. With each antenna being part of the antenna assembly 130, having an interwoven spiral pattern, and interconnected to each other, the antenna assembly 130 provides a focus radiation pattern for transmitting the outbound RF signals.

The antenna assembly 130 also receives one or more inbound RF signals, which are provided to the corresponding ATUs 24. Each of the ATUs 24 provides the inbound RF signal(s) to the corresponding RX-TX isolation module 22, which routes the signal(s) to the corresponding receive phase adjust modules 134. Each of the receive phase adjust modules 134 subtracts a phase shift from the received inbound RF signal. For instance, a first receive phase shift module 134 subtracts a 0° phase shift, a second receive phase shift module subtracts a 120° phase shift, and a third receive phase shift module subtracts a 240° phase shift. To achieve the phase shift, each of the receive phase adjust modules 134 includes one or more of a programmable delay line, a programmable RF mixing module, etc. The baseband processing module 16 generates one or more control signals 32 to program the phase shift amount for at least some of the receive phase adjust modules 134.

Each of the receive phase adjust modules 134 provides its respective inbound RF signal to the receiver section 12, which combines the inbound RF signals or selects one of them. If the receiver section 12 includes a super heterodyne topology, the RX RF to IF section converts the inbound RF signal(s) (e.g., $A(t)\cos(\omega_{RF}(t)+\phi(t))$) into an inbound IF signal (e.g., $A_I(t)\cos(\omega_{IF}(t)+\phi_I(t))$ and $A_Q(t)\cos(\omega_{IF}(t)+\phi_Q(t))$). The RX IF to BB section converts the inbound IF signal into one or more inbound symbol streams (e.g., $A(t)\cos((\omega_{BB}(t)+\phi(t))$).

The baseband processing unit 16 converts the inbound symbol stream(s) into inbound data (e.g., voice, text, audio, video, graphics, etc.) in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.).

The power management unit may be integrated into the SOC to perform a variety of functions. Such functions include monitoring power connections and battery charges, charging a battery when necessary, controlling power to the other components of the SOC, generating supply voltages, shutting down unnecessary SOC modules, controlling sleep modes of the SOC modules, and/or providing a real-time clock. To facilitate the generation of power supply voltages, the power management unit may includes one or more switch-mode power supplies and/or one or more linear regulators.

Figure 36:
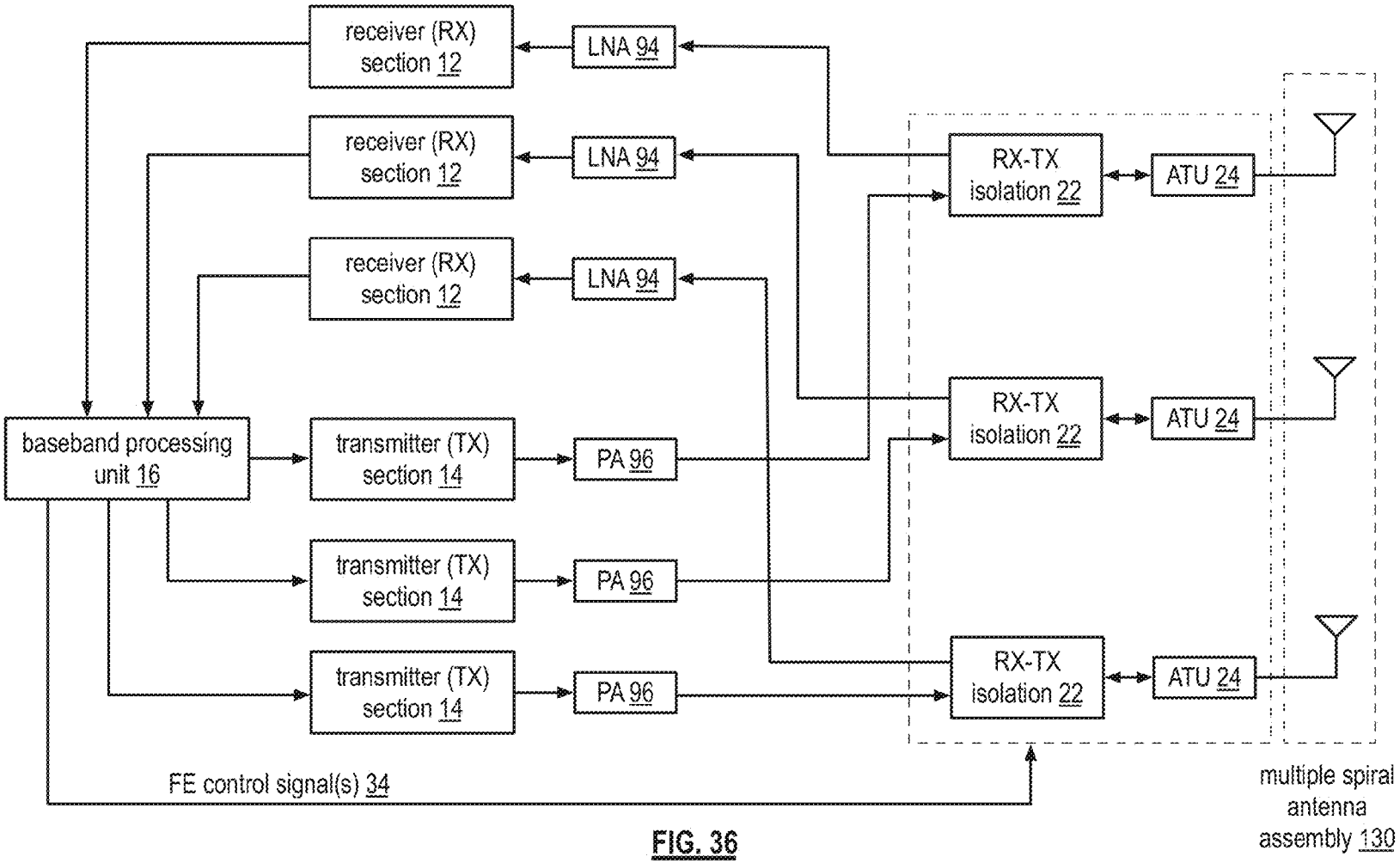
FIG. 36 is a schematic block diagram of another embodiment of a wireless communication device in accordance with the present invention.

FIG. 36 is a schematic block diagram of another embodiment of a MIMO (multiple input multiple output) wireless communication device 10 that includes a receiver section 12, a transmitter section 14, a baseband processing module 16, a power management unit, a plurality of power amplifiers (PA) 96, a plurality of low noise amplifiers (LNA) 94, a front end module, and an antenna assembly. The front end module includes a plurality of antenna tuning units (ATU) 24 and a plurality of RX-TX isolation modules 22. The antenna assembly 130 includes a plurality of interwoven spiral antennas that are coupled together via one or more connection traces. While 3 sets of circuitry is shown in the front-end module and the antenna assembly 130, the wireless communication device 10 may include more than three sets of circuitry.

In an example of operation, the baseband processing module 16 generates a plurality of outbound symbol streams from outbound data in accordance with a MIMO communication protocol. For instance, the baseband processing module 16 performs at least some of forward error correction (FEC) encoding, puncturing, separating the punctured encoded data into multiple encoded data streams, interleaving of the multiple encoded data streams, constellation mapping each of the interleaved multiple encoded data streams, space and/or time MIMO block encoding, and inverse fast Fourier transform (IFFT) to produce the plurality of outbound symbol streams. The baseband processing module 16 generating the plurality of outbound symbol streams will be discussed in greater detail with reference to FIG. 37.

Each of the transmitter sections 14 (which may have a direct conversion topology or a super heterodyne topology) converts its respective outbound symbol stream into a pre-PA outbound RF signal. Each of the power amplifiers (PA) 96 includes one or more power amplifiers coupled in series and/or in parallel to amplify the pre-PA outbound RF signal to produce an outbound RF signal. Each of the PA outputs its outbound RF signal to a corresponding RX-TX isolation module 22.

Each of the RX-TX isolation modules 22 (each of which may be a duplexer, a circulator, or transformer balun, or other device that provides isolation between a TX signal and an RX signal using a common antenna) attenuates the corresponding outbound RF signal. Each of the RX-TX isolation modules 22 adjusts it attenuation of the outbound RF signal based on control signals 34 received from the baseband processing unit 16 and/or the processing module. For example, when the transmission power is relatively low, each of the RX-TX isolation modules 22 reduces its attenuation of the TX signal in accordance with the control signal 34.

Each of the antenna tuning units (ATUs) 24 is tuned to provide a desired impedance that substantially matches that of the corresponding antenna. As tuned, the ATU 24 provides the attenuated TX signal from the RX-TX isolation module 22 to the antenna for transmission.

Each of the antennas transmits the corresponding outbound RF signal it receives from the corresponding ATU 24. With each antenna being part of the antenna assembly 130, having an interwoven spiral pattern, and interconnected to each other, the antenna assembly 130 provides a desired radiation pattern for transmitting of the outbound RF signals in accordance with the MIMO communication protocol.

Each of the antennas of the antenna assembly 130 receives an inbound RF signal, which it provides to its corresponding ATUs 24. Each of the ATUs 24 provides the inbound RF signal(s) to the corresponding RX-TX isolation module 22, which routes the signal(s) to a corresponding receiver section 12. If each receiver section 12 includes a super heterodyne topology, the RX RF to IF section converts the inbound RF signal into an inbound IF signal. The RX IF to BB section converts the inbound IF signal into an inbound symbol streams.

The baseband processing unit 16 converts each of the inbound symbol streams into inbound data (e.g., voice, text, audio, video, graphics, etc.). For instance, the baseband processing module 16 performs a fast Fourier transform (FFT) on each of the plurality of inbound symbol streams to produce a plurality of analog domain inbound symbol streams. The baseband processing module 16 then space and/or time MIMO block decodes the plurality of analog domain inbound symbol streams to produce a MIMO decoded inbound symbol streams. The baseband processing module 16 then constellation demaps each of the MIMO decoded inbound system streams to produce demapped inbound signals. The baseband processing module 16 then de-interleaves the demapped inbound signals to produce de-interleaved signals. The baseband processing module 16 then combines the de-interleaved signals to produce a combined signal. The processing module then de-punctures and FEC decodes the combined signal to produce the inbound data. The baseband processing module 16 converting the plurality of inbound symbol streams into inbound data will be discussed in greater detail with reference to FIG. 38.

The power management unit may be integrated into the SOC to perform a variety of functions. Such functions include monitoring power connections and battery charges, charging a battery when necessary, controlling power to the other components of the SOC, generating supply voltages, shutting down unnecessary SOC modules, controlling sleep modes of the SOC modules, and/or providing a real-time clock. To facilitate the generation of power supply voltages, the power management unit may includes one or more switch-mode power supplies and/or one or more linear regulators.

Figure 37:
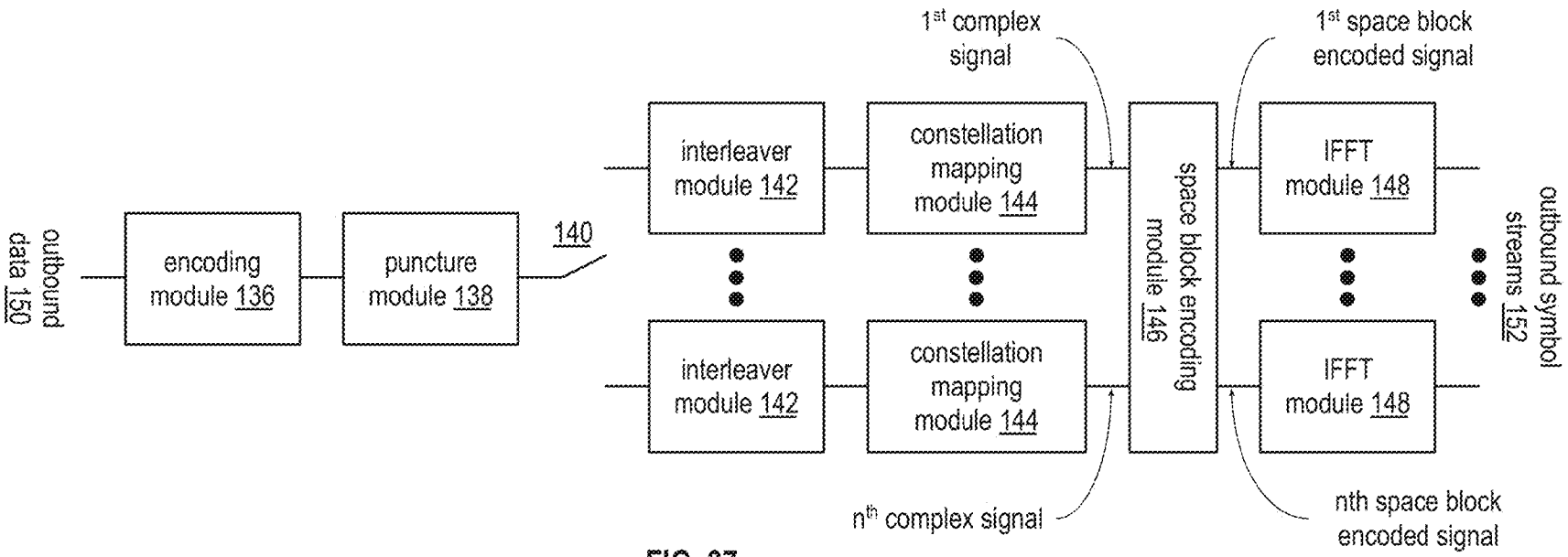
FIG. 37 is a schematic block diagram of an embodiment of baseband transmit path processing for a MIMO wireless communication device in accordance with the present invention.

FIG. 37 is a schematic block diagram of an embodiment of the baseband transmit path processing for a MIMO wireless communication device. The baseband processing module includes an encoding module 136, a puncture module 138, a switch 140, an interleaving module 142, which may include a plurality of interleaver modules or an interleaver and a switching module, a plurality of constellation encoding modules 144, a space-time and/or space-frequency block encoding module 146, and a plurality of inverse fast Fourier transform (IFFT) modules 148 for converting the outbound data 150 into the outbound symbol stream 152. Note that the baseband MIMO transmit processing may include two or more of each of the interleaver modules 142, the constellation mapping modules 144, and the IFFT modules 148 depending on the number of transmit paths. Further note that the encoding module 136, puncture module 138, the interleaver modules 142, the constellation mapping modules 144, and the IFFT modules 148 may be function in accordance with one or more wireless communication standards.

In an example of operation, the encoding module 136 is operably coupled to convert outbound data 150 into encoded data in accordance with one or more wireless communication standards. The puncture module 138 punctures the encoded data to produce punctured encoded data. The plurality of interleaver modules 142 is operably coupled to interleave the punctured encoded data into a plurality of interleaved streams of data. The plurality of constellation mapping modules 144 is operably coupled to map the plurality of interleaved streams of data into a plurality of streams of data symbols, wherein each data symbol of the stream of data symbols includes one or more complex signal. The space-time and/or space-frequency block encoding module 146 is operably coupled to encode a plurality of complex signals (e.g., at least two complex signals) into a plurality of space-time and/or space-frequency block encoded signals. The plurality of IFFT modules 148 is operably coupled to convert the plurality of space-time and/or space-frequency block encoded signals into a plurality of outbound symbol streams 152.

Figure 38:
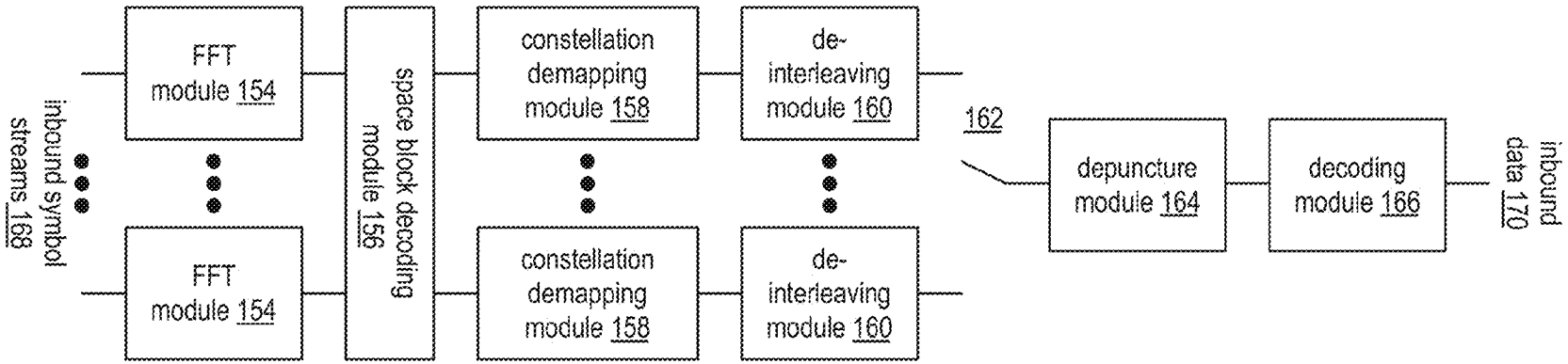
FIG. 38 is a schematic block diagram of an embodiment of baseband receive path processing for a MIMO wireless communication device in accordance with the present invention.

FIG. 38 is a schematic block diagram of an embodiment of the baseband receive path processing for a MIMO wireless communication device. The baseband processing module includes a plurality of fast Fourier transform (FFT) modules 154, a space-time and/or space-frequency block decoding module 156, a plurality of constellation demapping modules 158, a plurality of deinterleaving modules 160, a switch 162, a depuncture module 164, and a decoding module 166 for converting a plurality of inbound symbol streams 168 into inbound data 170. Note that the baseband receive processing may include two or more of each of the deinterleaving modules 160, the constellation demapping modules 158, and the FFT modules 154. Further note that the decoding module 166, depuncture module 164, the deinterleaving modules 160, the constellation decoding modules 158, and the FFT modules 154 may be function in accordance with one or more wireless communication standards.

In an example of operation, a plurality of FFT modules 154 is operably coupled to convert a plurality of inbound symbol streams 168 into a plurality of streams of space-time and/or space-frequency block encoded symbols. The space-time and/or space-frequency block decoding module 156 is operably coupled to decode the plurality of streams of space-time and/or space-frequency block encoded symbols to produce a plurality of streams of data symbols. The plurality of constellation demapping modules 158 is operably coupled to demap the plurality of streams of data symbols into a plurality of interleaved streams of data. The plurality of deinterleaving modules 160 is operably coupled to deinterleave the plurality of interleaved streams of data into encoded data. The decoding module 166 is operably coupled to convert the encoded data into inbound data 170. Note that the space-time and/or space-frequency block decoding module 156 performs an inverse function of the space-time and/or space-frequency block coding module of FIG. 37.

Figure 39:
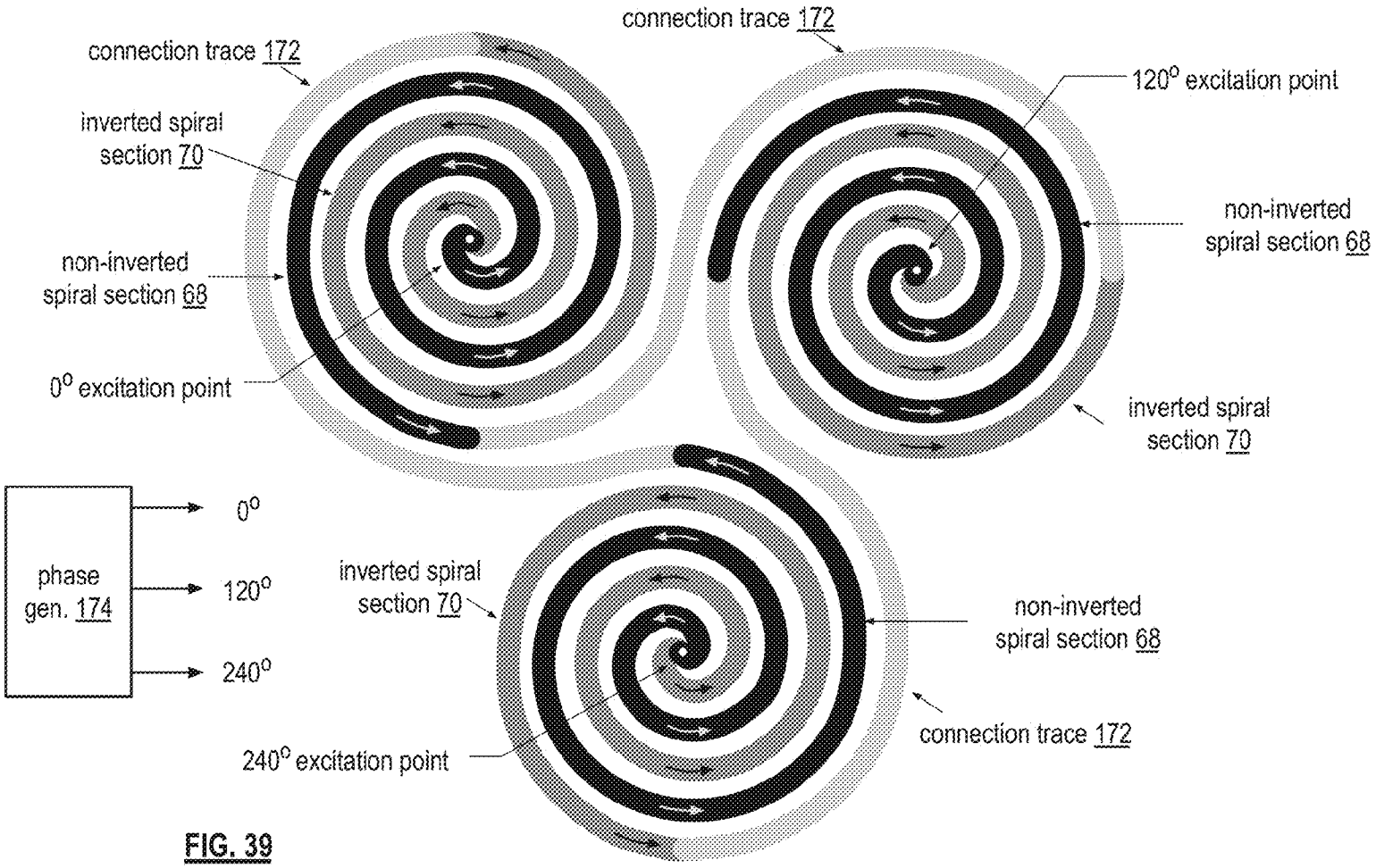
FIG. 39 is a diagram of an embodiment of a multiple excitation point antenna assembly that includes a plurality of interwoven spiral antennas in accordance with the present invention.

FIG. 39 is a diagram of an embodiment of a multiple excitation point antenna assembly that may be used in one or more of the antennas assemblies of the wireless communication devices discussed with reference to one or more of FIGS. 35-36. The antenna assembly includes a plurality of interwoven spiral antennas and a plurality of connection traces 172. Each of the interwoven spiral antennas includes a non-inverted spiral section 68, an inverted spiral section 70, and an excitation point. Collectively, the non-inverted spiral section 68 and the inverted spiral section 70 form a portion of a Celtic spiral, a logarithmic Celtic spiral, Archimedean spiral and/or some other spiral pattern. The excitation point for each interwoven spiral is approximately located at an inner connection point of the inverted spiral 70 and the non-inverted spiral 68.

The antenna assembly is operably coupled to a phase generation module 174 that provides phase shifting of the antennas' excitation points. For instance, for an outbound RF signal, the phase generation module 174 includes a plurality of transmit phase adjust modules (or like type components) to provide multiple phase representations of the outbound RF signal (e.g., 0°, 120°, and 240° for this example embodiment). For an inbound RF signal, the phase generation module includes a plurality of receive phase adjust modules (or like type components) to provide multiple phase representations of the inbound RF signal (e.g., 0°, 120°, and 240° for this example embodiment).

Various properties of the interwoven spiral antennas and the connection traces 172 define the antenna assembly's operational characteristics. For instance, the dimensions of the excitation region (e.g., establishes the upper cutoff region of the bandwidth) and the circumference of the interwoven spiral antenna (e.g., establishes the lower cutoff region of the bandwidth) define the bandwidth of the interwoven spiral antenna. The trace width, distance between connection traces 172, length of each spiral section, distance to a ground plane, trace width and length of each of the connection traces 172, and/or use of an artificial magnetic conductor plane affect the quality factor, radiation pattern, impedance (which is fairly constant over the bandwidth), gain, and/or other characteristics of the antenna assembly.

In an example of operation, an outbound RF signal is applied to the excitation point of each of the interwoven spiral antennas. For instance, a first interwoven spiral antenna receives a 0° phase shifted representation of the outbound RF signal; a second interwoven spiral antenna receives a 120° phase shifted representation of the outbound RF signal; and a third interwoven spiral antenna receives a 240° phase shifted representation of the outbound RF signal. The phase shifted excitation of the interwoven spiral antennas generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow. For instance, the pattern of the interwoven spirals may be flipped 180 degrees to change the current flow direction. This enables one antenna assembly to be used for transmission of RF signals and another antenna assembly with opposite circular polarity to be used for reception of RF signals.

In another example of operation, the antenna assembly receives an inbound RF signal as an electromagnetic signal, which induces a current to flow and produces a voltage within the antenna assembly. The phase generation module 174 is coupled to the excitation points of the interwoven spiral antennas and provides phase shifted representations of the inbound RF signal to receiver section of a wireless communication device. For instance, the phase generator 174 provides a 0° phase shifted representation of the inbound RF signal from a first interwoven spiral antenna; provides a 120° phase shifted representation of the inbound RF signal from a second interwoven spiral antenna; and provides a 240° phase shifted representation of the inbound RF signal from a third interwoven spiral antenna.

In an example embodiment, the antenna assembly may be implemented on one or more layers of a substrate and second antenna assembly may be implemented on another one or more layers of the substrate. The first antenna assembly provides a first leg of a composite antenna assembly and the second antenna assembly provides a second leg of the composite antenna assembly. The two antenna assemblies are aligned from a major surface perspective of the substrate such that the magnetic fields of the two antenna assemblies are additive. In furtherance of this example, the first antenna assembly provides a first leg of a dipole antenna and the second antenna assembly provides a second leg of the dipole antenna. In still furtherance of this example, the first antenna assembly function as a monopole antenna and the second antenna assembly provides a return path. Alternatively, the return path may be through a ground plane, an artificial magnetic conductor, and/or another type of return connection.

Figure 40:
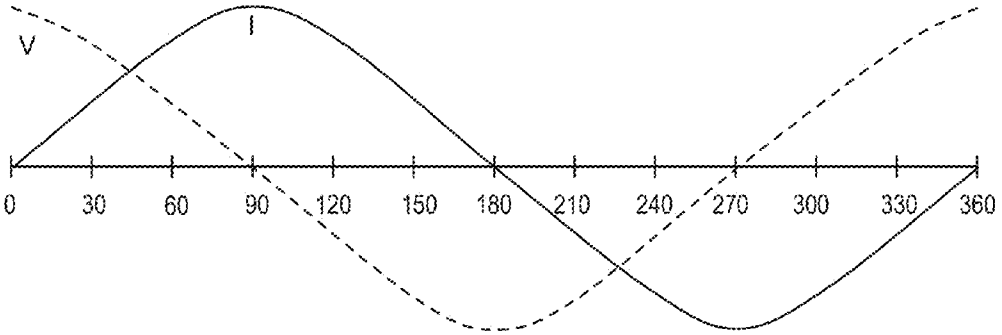
FIG. 40 is a diagram of an example of a current waveform and a voltage waveform of the antenna assembly of FIG. 39 with respect to a first excitation point in accordance with the present invention.

FIG. 40 is a diagram of an example of a current waveform and a voltage waveform of a first interwoven spiral antenna of the antenna assembly of FIG. 39, where the first interwoven spiral antenna has a 0° phase shifted excitation. The current waveform has zero crossings at 0 degrees, at 180 degrees, and at 360 degrees. The voltage waveform has zero crossings at 90 degrees and 270 degrees. As previously mentioned, the length of one of the spiral sections may be one-half wavelength or a full wavelength. As such, with a half wavelength or a full wavelength, the current at the ends of the spirals is approximately zero, while the voltage is approximately at its largest magnitude. The current and voltage waveforms continue through the connection traces to adjacent interwoven spiral antennas as will be discussed in greater detail with reference to FIG. 43.

Figure 41:
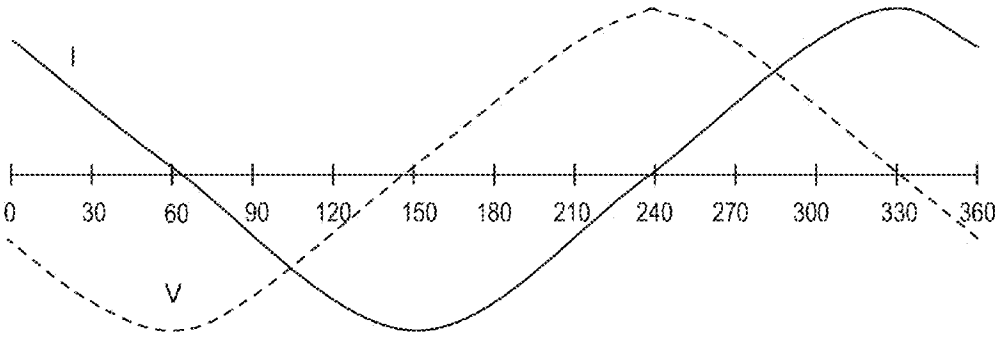
FIG. 41 is a diagram of an example of a current waveform and a voltage waveform of the antenna assembly of FIG. 39 with respect to a second excitation point in accordance with the present invention.

FIG. 41 is a diagram of an example of a current waveform and a voltage waveform of a second interwoven spiral antenna of the antenna assembly of FIG. 39, where the second interwoven spiral antenna has a 120° phase shifted excitation. The current waveform has zero crossings at 60 degrees and at 240 degrees. The voltage waveform has zero crossings at 150 degrees and 330 degrees. As previously mentioned, the length of one of the spiral sections may be one-half wavelength or a full wavelength. As such, with a half wavelength or a full wavelength, the current at the ends of the spirals is approximately zero with respect to the phase shifted signal, but is not zero with respect to the excitation of the first interwoven spiral antenna. Similarly, the voltage is approximately at its largest magnitude with respect to the phase shifted signal, but is not at its maximum magnitude with respect to the excitation of the first interwoven antenna. The current and voltage waveforms for the second interwoven spiral antenna continue through the connection traces to adjacent interwoven spiral antennas as will be discussed in greater detail with reference to FIG. 43.

Figure 42:
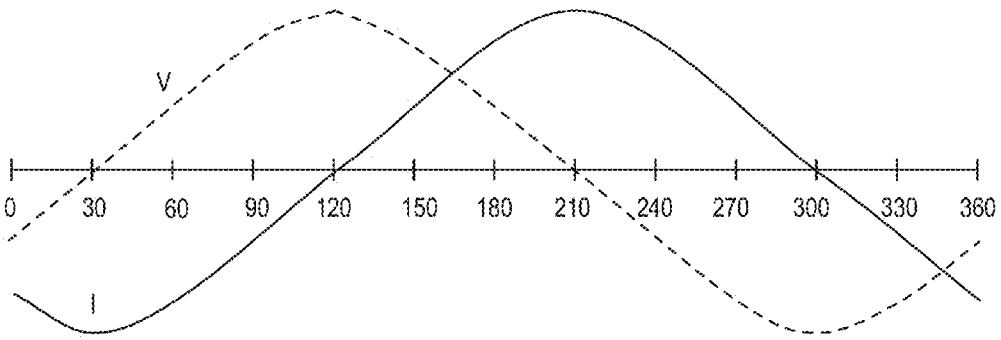
FIG. 42 is a diagram of an example of a current waveform and a voltage waveform of the antenna assembly of FIG. 39 with respect to a third excitation point in accordance with the present invention.

FIG. 42 is a diagram of an example of a current waveform and a voltage waveform of a third interwoven spiral antenna of the antenna assembly of FIG. 39, where the third interwoven spiral antenna has a 120° phase shifted excitation. The current waveform has zero crossings at 120 degrees and at 300 degrees. The voltage waveform has zero crossings at 30 degrees and 210 degrees. As previously mentioned, the length of one of the spiral sections may be one-half wavelength or a full wavelength. As such, with a half wavelength or a full wavelength, the current at the ends of the spirals is approximately zero with respect to the phase shifted signal, but is not zero with respect to the excitation of the first interwoven spiral antenna. Similarly, the voltage is approximately at its largest magnitude with respect to the phase shifted signal, but is not at its maximum magnitude with respect to the excitation of the first interwoven antenna. The current and voltage waveforms for the second interwoven spiral antenna continue through the connection traces to adjacent interwoven spiral antennas as will be discussed in greater detail with reference to FIG. 43.

Figure 43:
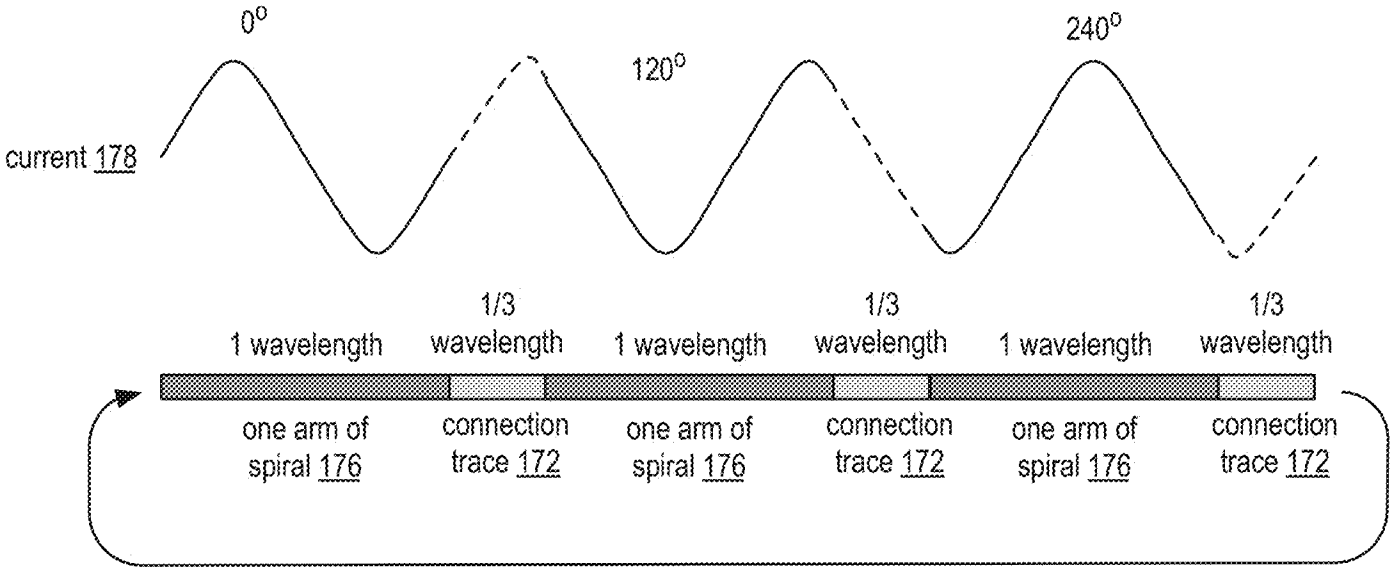
FIG. 43 is a diagram of an example of a current waveform traversing interwoven spinal antennas and connection traces of the antenna assembly of FIG. 39 in accordance with the present invention.
Figure 45:
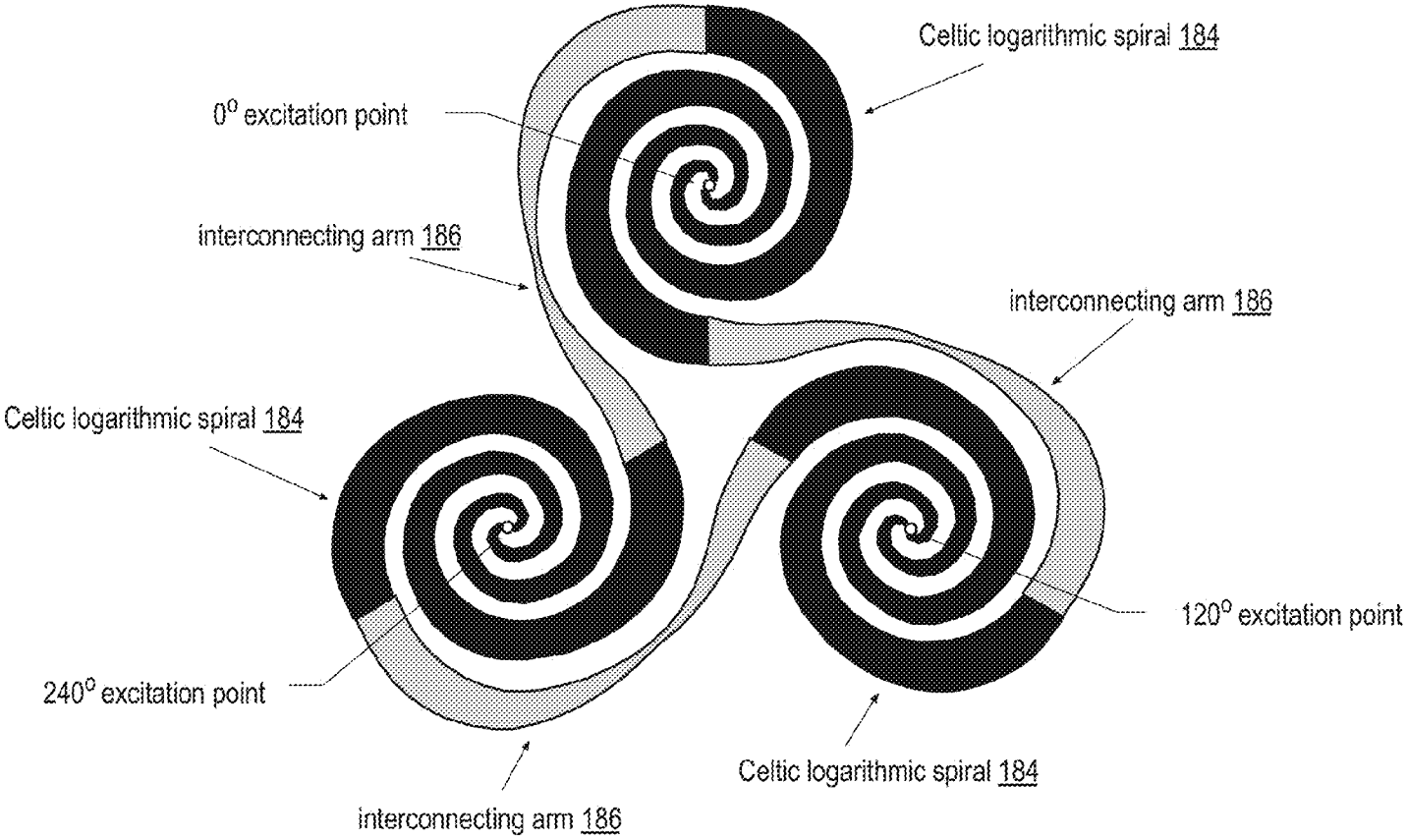
FIG. 45 is a diagram of another embodiment of a multiple excitation point antenna assembly that includes a plurality of interwoven spiral antennas in accordance with the present invention.

FIG. 43 is a diagram of an example of a current waveform traversing interwoven spinal antennas and connection traces 172 of the antenna assembly of FIG. 45. In this example, each of the interwoven spiral antenna sections 176 (e.g., the inverted spiral or the non-inverted spiral) has a length corresponding to one wavelength and each of the connection traces 172 has a length of one-third wavelength. Current 178 through each antenna and connection is aligned such that the waveform experiences minimal to no transients as current 178 traverses the antenna assembly. In this manner, each interwoven spiral antenna functions in a complimentary manner with respect to the other interwoven spiral antennas to produce a desired circular polarized radiation pattern.

Figure 44:
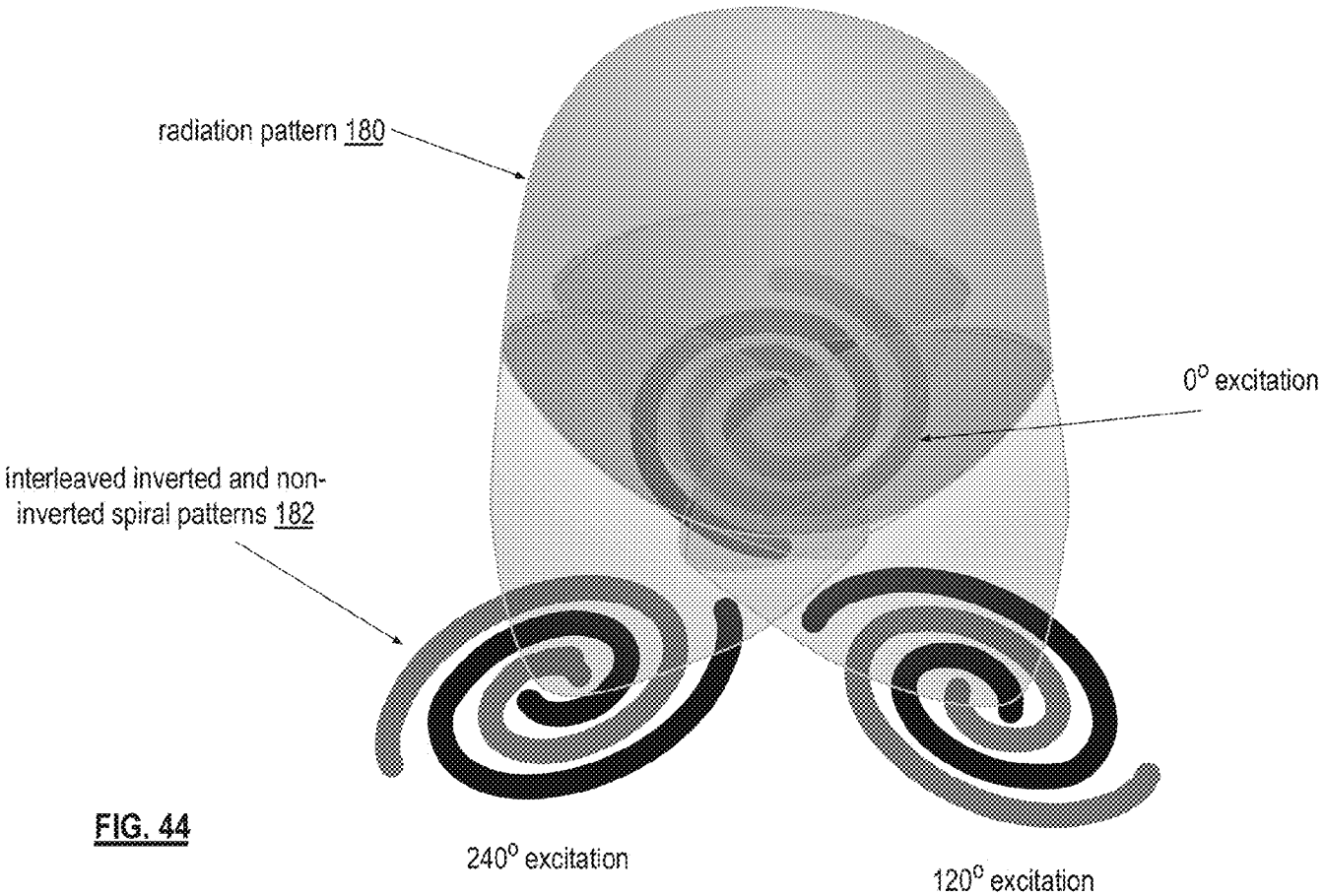
FIG. 44 is a diagram of an example of a radiation pattern of the antenna assembly of FIG. 39 in accordance with the present invention.

FIG. 44 is a diagram of an example of a radiation pattern 180 of the antenna assembly of FIG. 39, where the first interwoven spiral antenna has a 0° excitation; the second interwoven spiral antenna has a 120° excitation; and the third interwoven spiral antenna has a 240° excitation. Each of the interwoven spiral antennas has an individual radiation pattern offset from normal of the antenna assembly by a phase corresponding to the phase of its excitation. The radiation patterns of the individual interwoven spiral antennas are additive to produce the radiation pattern 180 for the antenna assembly.

For example, the first interwoven spiral antenna has a zero degree excitation and has radiation pattern that is substantially perpendicular to the interwoven spiral antenna 182 and includes a circular polarization, which may be clock-wise or counter clock-wise. If the return path of the antenna assembly is through a ground and/or an artificial magnetic conductor, the radiation pattern of the first interwoven spiral antenna primarily includes one radiation lobe as shown. If, however, the return path of the antenna is through some other means (e.g., another interwoven spiral or a return connection), a second radiation lobe may be present that is perpendicular the surface of the antenna, but in the opposite direction as the one presently illustrated.

Continuing with the example, the second interwoven spiral antenna has a 120° excitation and has a radiation pattern that is offset from perpendicular to the interwoven spiral antenna 182 (e.g., a Celtic spiral) by a phase corresponding to the phase of the excitation (e.g., the same degree of offset or a fraction thereof). The radiation pattern includes a circular polarization, which may be clock-wise or counter clock-wise. If the return path of the antenna assembly is through a ground and/or an artificial magnetic conductor, the radiation pattern primarily includes one radiation lobe as shown. If, however, the return path of the antenna assembly is through some other means (e.g., another interwoven spiral or a return connection), a second radiation lobe may be present that is offset from perpendicular by the excitation angle with respect to the surface of the antenna, but in the opposite direction as the one presently illustrated.

In furtherance of the example, the third interwoven spiral antenna has a 240° excitation and has a radiation pattern that is offset from perpendicular to the interwoven spiral antenna 182 by a phase corresponding to the phase of the excitation. The radiation pattern includes a circular polarization, which may be clock-wise or counter clock-wise. If the return path of the antenna assembly is through a ground and/or an artificial magnetic conductor, the radiation pattern primarily includes one radiation lobe as shown. If, however, the return path of the antenna assembly is through some other means (e.g., another interwoven spiral or a return connection), a second radiation lobe may be present that is offset from perpendicular by the excitation angle with respect to the surface of the antenna, but in the opposite direction as the one presently illustrated.

The combination of radiation patterns of the interwoven spirals provides a directional radiation pattern 180 having a circular polarization. Accordingly, the antenna assembly radiates outbound RF signals with greater energy in the common regions of the radiation patterns of the individual interwoven spiral antennas. Similarly, the antenna assembly receives inbound RF signals with a greater signal to noise and/or a greater signal to interference ratio when the inbound RF signals are received in the common regions versus on the edges of the composite radiation pattern 180.

Figure 46:
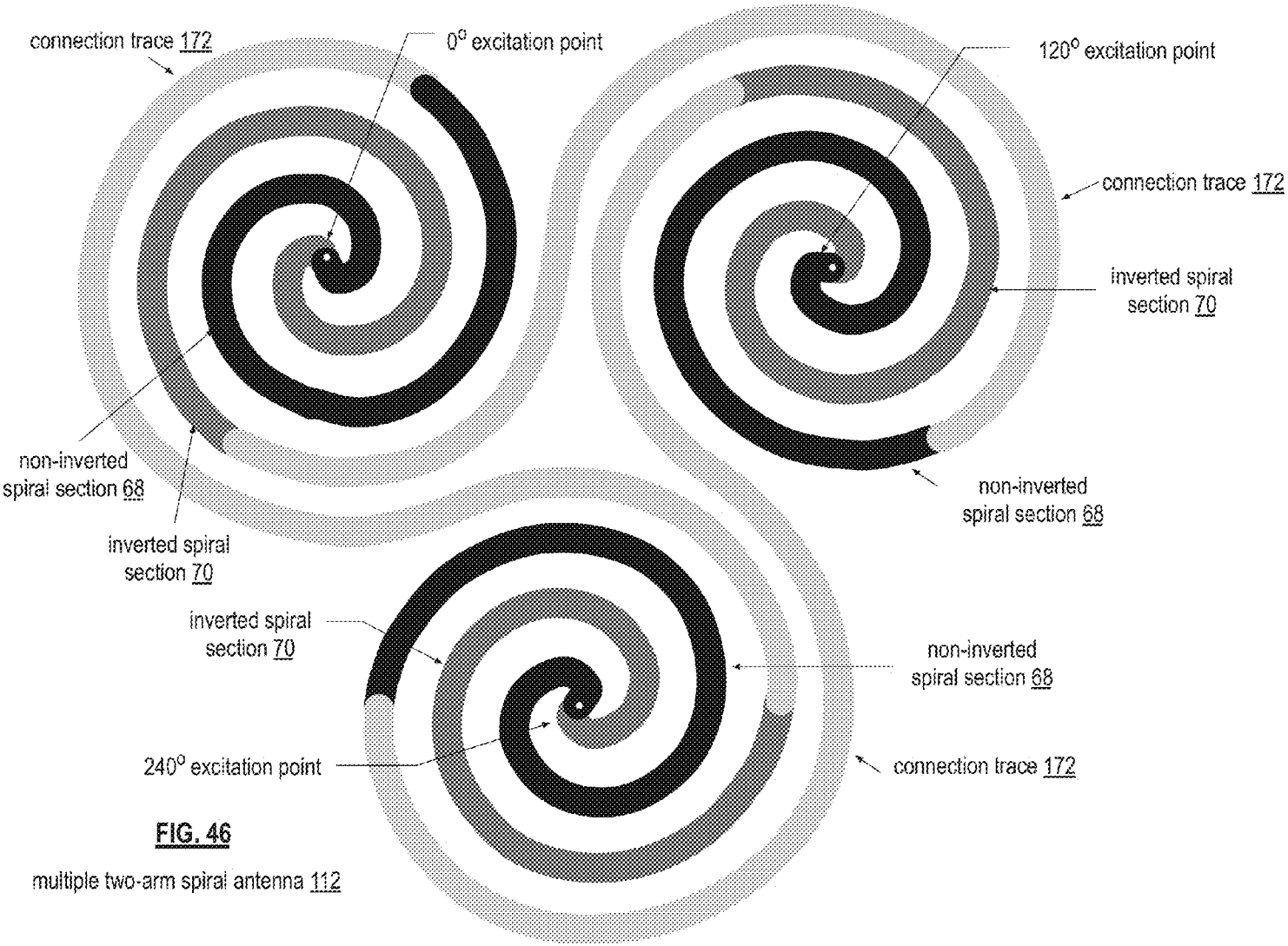
FIG. 46 is a diagram of another embodiment of a multiple excitation point antenna assembly that includes a plurality of interwoven spiral antennas in accordance with the present invention.

FIG. 46 is a diagram of another embodiment of a multiple excitation point antenna assembly that may be used in one or more of the antennas assemblies of the wireless communication devices discussed with reference to one or more of FIGS. 35-36. The antenna assembly includes a plurality of Celtic logarithmic spiral antennas 184 and a plurality of connection traces. Each of the Celtic logarithmic antennas 184 includes an excitation point. The excitation point for each Celtic logarithmic spiral antenna 184 is approximately located at the center of the antenna.

The antenna assembly is operably coupled to a phase generation module that provides phase shifting of the antennas' excitation points. For instance, for an outbound RF signal, the phase generation module includes a plurality of transmit phase adjust modules (or like type components) to provide multiple phase representations of the outbound RF signal (e.g., 0°, 120°, and 240° for this example embodiment). For an inbound RF signal, the phase generation module includes a plurality of receive phase adjust modules (or like type components) to provide multiple phase representations of the inbound RF signal (e.g., 0°, 120°, and 240° for this example embodiment).

Various properties of the Celtic logarithmic antennas 184 and the connection traces define the antenna assembly's operational characteristics. For instance, the dimensions of the excitation region (e.g., establishes the upper cutoff region of the bandwidth) and the circumference of the Celtic logarithmic antenna 184 (e.g., establishes the lower cutoff region of the bandwidth) define the bandwidth of the interwoven spiral antenna. The trace width, distance between traces, length of each spiral section, distance to a ground plane, trace width and length of each of the connection traces, and/or use of an artificial magnetic conductor plane affect the quality factor, radiation pattern, impedance (which is fairly constant over the bandwidth), gain, and/or other characteristics of the antenna assembly.

In an example of operation, an outbound RF signal is applied to the excitation point of each of the Celtic logarithmic antennas 184. For instance, a first Celtic logarithmic antenna 184 receives a 0° phase shifted representation of the outbound RF signal; a second Celtic logarithmic antenna 184 receives a 120° phase shifted representation of the outbound RF signal; and a third Celtic logarithmic antenna 184 receives a 240° phase shifted representation of the outbound RF signal. The phase shifted excitation of the Celtic logarithmic antennas 184 generates an electric field and causes a current to flow through the antenna assembly from the excitation point of each of Celtic logarithmic antennas 184 to the connection traces. The current generates a magnetic field such that, in combination with the electric field, the antenna assembly has a circular polarization radiation pattern.

In another example of operation, the antenna assembly receives an inbound RF signal as an electromagnetic signal, which induces a current to flow and produces a voltage within the antenna assembly. The phase generation module is coupled to the excitation points of the Celtic logarithmic antennas 184 and provides phase shifted representations of the inbound RF signal to receiver section of a wireless communication device. For instance, the phase generator provides a 0° phase shifted representation of the inbound RF signal from a first Celtic logarithmic antenna 184; provides a 120° phase shifted representation of the inbound RF signal from a second Celtic logarithmic antenna 184; and provides a 240° phase shifted representation of the inbound RF signal from a third Celtic logarithmic antenna 184.

In an example embodiment, the antenna assembly may be implemented on one or more layers of a substrate and second antenna assembly may be implemented on another one or more layers of the substrate. The first antenna assembly provides a first leg of a composite antenna assembly and the second antenna assembly provides a second leg of the composite antenna assembly. The two antenna assemblies are aligned from a major surface perspective of the substrate such that the magnetic fields of the two antenna assemblies are additive. In furtherance of this example, the first antenna assembly provides a first leg of a dipole antenna and the second antenna assembly provides a second leg of the dipole antenna. In still furtherance of this example, the first antenna assembly function as a monopole antenna and the second antenna assembly provides a return path. Alternatively, the return path may be through a ground plane, an artificial magnetic conductor, and/or another type of return connection.

FIG. 46 is a diagram of another embodiment of a multiple excitation point antenna assembly that may be used in one or more of the antennas assemblies of the wireless communication devices discussed with reference to one or more of FIGS. 41-42. The antenna assembly includes a plurality of interwoven spiral antennas and a plurality of connection traces 172. Each of the interwoven spiral antennas includes a non-inverted spiral section 68, an inverted spiral section 70, and an excitation point. Collectively, the non-inverted spiral section 68 and the inverted spiral section 70 form a portion of a Celtic spiral, a logarithmic Celtic spiral, Archimedean spiral and/or some other spiral pattern. The excitation point for each interwoven spiral is approximately located at the inner connection point of the inverted spiral 70 and the non-inverted spiral 68. The antenna assembly is operably coupled to a phase generation module that provides phase shifting of the antennas' excitation points as previously discussed. Note that various properties of the interwoven spiral antennas and the connection traces 172 define the antenna assembly's operational characteristics as previously discussed.

The present antenna assembly functions similarly to the antenna assembly of FIG. 39, except that the orientation of the interwoven spirals is different and the connection traces 172 are 1⅓ wavelengths in length. With this configuration and for outbound RF signals, the phase shifted excitation of the interwoven spiral antennas generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow.

For inbound RF signals, the antenna assembly receives an inbound RF signal as an electromagnetic signal, which induces a current to flow, and produces a voltage, within the antenna assembly. The phase generation module is coupled to the excitation points of the interwoven spiral antennas and provides phase shifted representations of the inbound RF signal to receiver section of a wireless communication device.

Figure 47:
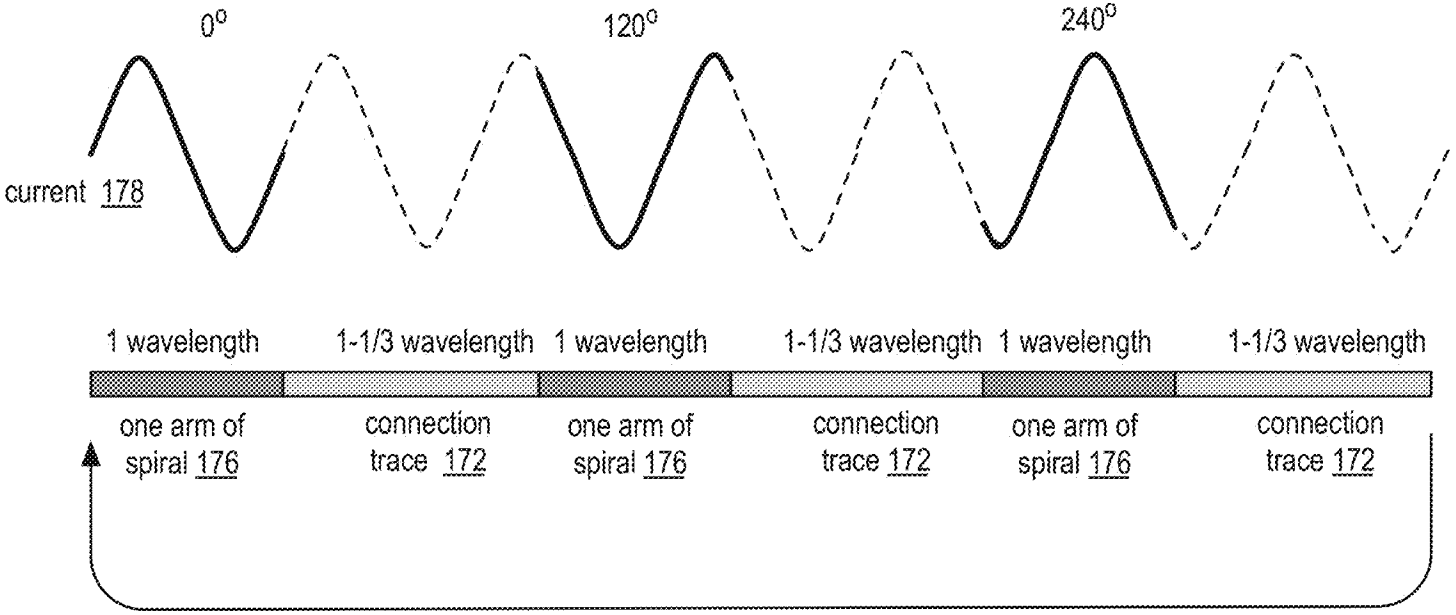
FIG. 47 is a diagram of an example of a current waveform traversing interwoven spinal antennas and connection traces of the antenna assembly of FIG. 46 in accordance with the present invention.

FIG. 47 is a diagram of an example of a current waveform traversing interwoven spinal antennas and connection traces 172 of the antenna assembly of FIG. 46. In this example, each of the interwoven spiral antenna sections 176 (e.g., the inverted spiral or the non-inverted spiral) has a length corresponding to one wavelength and each of the connection traces 172 has a length of one & one-third wavelengths. Current 178 through each antenna 176 and the connection traces 172 is aligned such that the waveform experiences minimal to no transients as current 178 traverses the antenna assembly. In this manner, each interwoven spiral antenna functions in a complimentary manner with respect to the other interwoven spiral antennas to produce a desired circular polarized radiation pattern.

Figure 48:
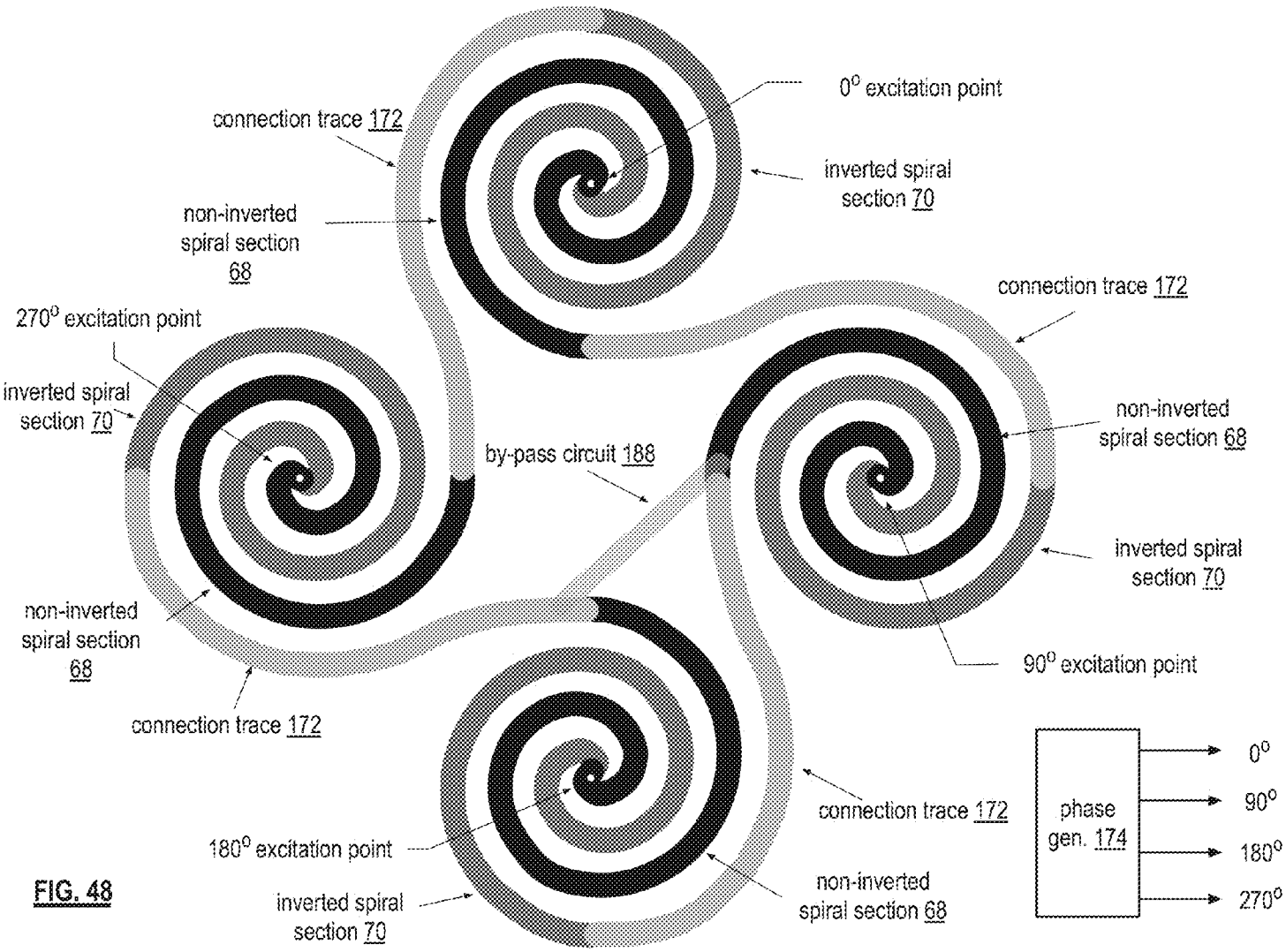
FIG. 48 is a diagram of another embodiment of a multiple excitation point antenna assembly that includes a plurality of interwoven spiral antennas in accordance with the present invention.
Figure 49:
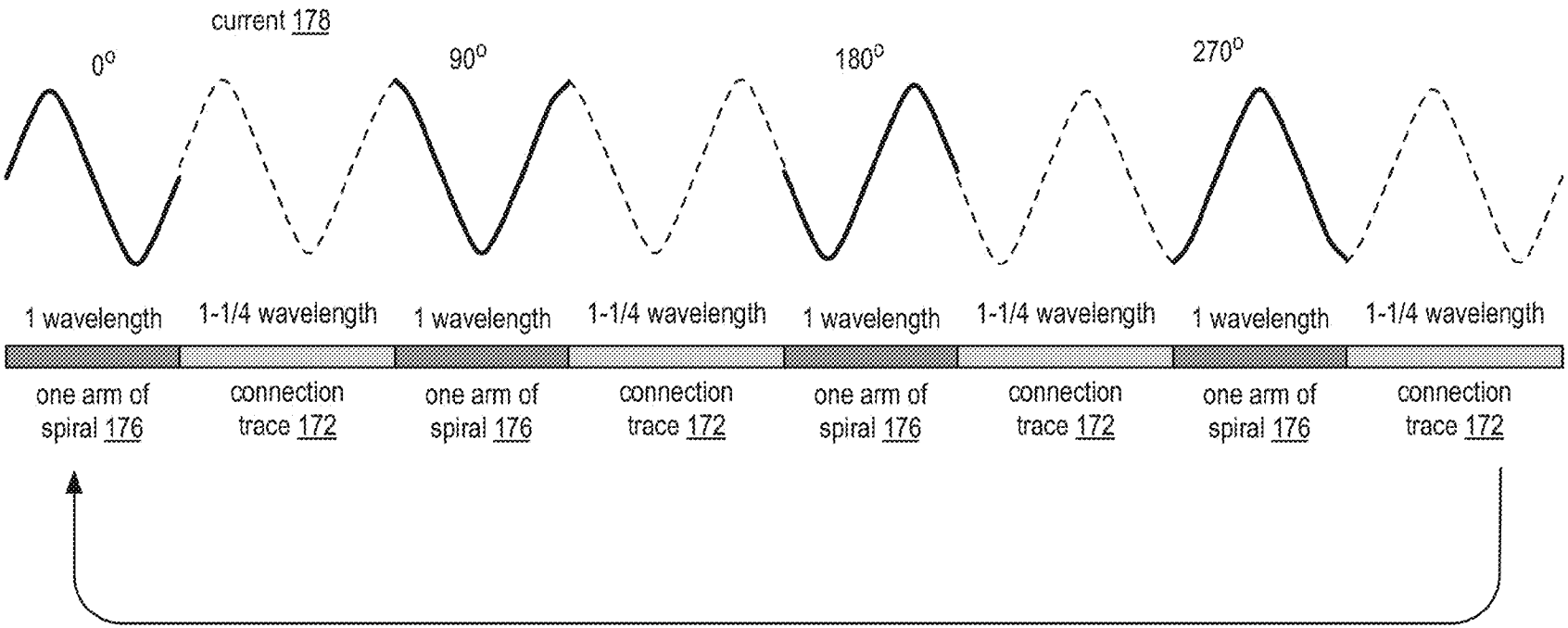
FIG. 49 is a diagram of an example of a current waveform traversing interwoven spinal antennas and connection traces of the antenna assembly of FIG. 48 in accordance with the present invention.

FIG. 48 is a diagram of another embodiment of a multiple excitation point antenna assembly that may be used in one or more of the antennas assemblies of the wireless communication devices discussed with reference to one or more of FIGS. 35-36. The antenna assembly includes a plurality of interwoven spiral antennas (e.g., four) and a plurality of connection traces 172 (e.g., four). Each of the interwoven spiral antennas includes a non-inverted spiral section 68, an inverted spiral section 70, and an excitation point. Collectively, the non-inverted spiral section 68 and the inverted spiral section 70 form a portion of a Celtic spiral, a logarithmic Celtic spiral, Archimedean spiral and/or some other spiral pattern. The excitation point for each interwoven spiral is approximately located at the inner connection point of the inverted spiral 70 and the non-inverted spiral 68.

The antenna assembly may further include a by-pass circuit trace 188 that includes a trace, or a tunable connection trace (e.g., adjustable effective length), and corresponding switching circuit (e.g., RF switches, transistors, etc.). When activated (i.e., the switching circuit couples the by-pass circuit trace 188 to two of the interwoven spirals and/or the corresponding connection trace 172) the by-pass circuit trace 188 effectively bypasses one of the interwoven spiral antennas such that the antenna assembly has three active interwoven spiral antennas and operates as previously discussed with reference to FIG. 45. When not activated, the by-pass trace 188 is open such that the antenna assembly has four active interwoven spiral antennas that function as subsequently discussed. Note that the baseband processing module or other processing module generates one or more control signals to activate or de-activate the by-pass trace and corresponding switching circuit.

The antenna assembly is operably coupled to a phase generation module 174 that provides phase shifting of the antennas' excitation points. For instance, for an outbound RF signal, the phase generation module 174 includes a plurality of transmit phase adjust modules (or like type components) to provide multiple phase representations of the outbound RF signal (e.g., 0°, 90°, 180°, and 270° for this example embodiment). For an inbound RF signal, the phase generation module 174 includes a plurality of receive phase adjust modules (or like type components) to provide multiple phase representations of the inbound RF signal (e.g., 0°, 120°, and 240° for this example embodiment).

Various properties of the interwoven spiral antennas and the connection traces 172 define the antenna assembly's operational characteristics. For instance, the dimensions of the excitation region (e.g., establishes the upper cutoff region of the bandwidth) and the circumference of the interwoven spiral antenna (e.g., establishes the lower cutoff region of the bandwidth) define the bandwidth of the interwoven spiral antenna. The trace width, distance between traces, length of each spiral section, distance to a ground plane, trace width and length of each of the connection traces 172, and/or use of an artificial magnetic conductor plane affect the quality factor, radiation pattern, impedance (which is fairly constant over the bandwidth), gain, and/or other characteristics of the antenna assembly.

In an example of operation, an outbound RF signal is applied to the excitation point of each of the interwoven spiral antennas. For instance, a first interwoven spiral antenna receives a 0° phase shifted representation of the outbound RF signal; a second interwoven spiral antenna receives a 90° phase shifted representation of the outbound RF signal; and a third interwoven spiral antenna receives a 180° phase shifted representation of the outbound RF signal, and a fourth interwoven spiral antenna receives a 270° phase shifted representation of the outbound RF signal. The phase shifted excitation of the interwoven spiral antennas generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow.

In another example of operation, the antenna assembly receives an inbound RF signal as an electromagnetic signal, which induces a current to flow and produces a voltage within the antenna assembly. The phase generation module 174 is coupled to the excitation points of the interwoven spiral antennas and provides phase shifted representations of the inbound RF signal to receiver section of a wireless communication device. For instance, the phase generator 174 provides a 0° phase shifted representation of the inbound RF signal from a first interwoven spiral antenna; provides a 90° phase shifted representation of the inbound RF signal from a second interwoven spiral antenna; provides a 180° phase shifted representation of the inbound RF signal from a third interwoven spiral antenna, and provides a 270° phase shifted representation of the inbound RF signal from a fourth interwoven spiral antenna.

In an example embodiment, the antenna assembly may be implemented on one or more layers of a substrate and second antenna assembly may be implemented on another one or more layers of the substrate. The first antenna assembly provides a first leg of a composite antenna assembly and the second antenna assembly provides a second leg of the composite antenna assembly. The two antenna assemblies are aligned from a major surface perspective of the substrate such that the magnetic fields of the two antenna assemblies are additive. In furtherance of this example, the first antenna assembly provides a first leg of a dipole antenna and the second antenna assembly provides a second leg of the dipole antenna. In still furtherance of this example, the first antenna assembly function as a monopole antenna and the second antenna assembly provides a return path. Alternatively, the return path may be through a ground plane, an artificial magnetic conductor, and/or another type of return connection.

FIG. 48 is a diagram of an example of a current waveform traversing interwoven spinal antennas 176 and connection traces 172 of the antenna assembly of FIG. 48. In this example, each of the interwoven spiral antenna sections 176 (e.g., the inverted spiral or the non-inverted spiral) has a length corresponding to one wavelength and each of the connection traces 172 has a length of one & one-quarter wavelengths. Current through each antenna and connection is aligned such that the waveform experiences minimal to no transients as current 178 traverses the antenna assembly. In this manner, each interwoven spiral antenna 176 functions in a complimentary manner with respect to the other interwoven spiral antennas to produce a desired circular polarized radiation pattern.

Figure 50:
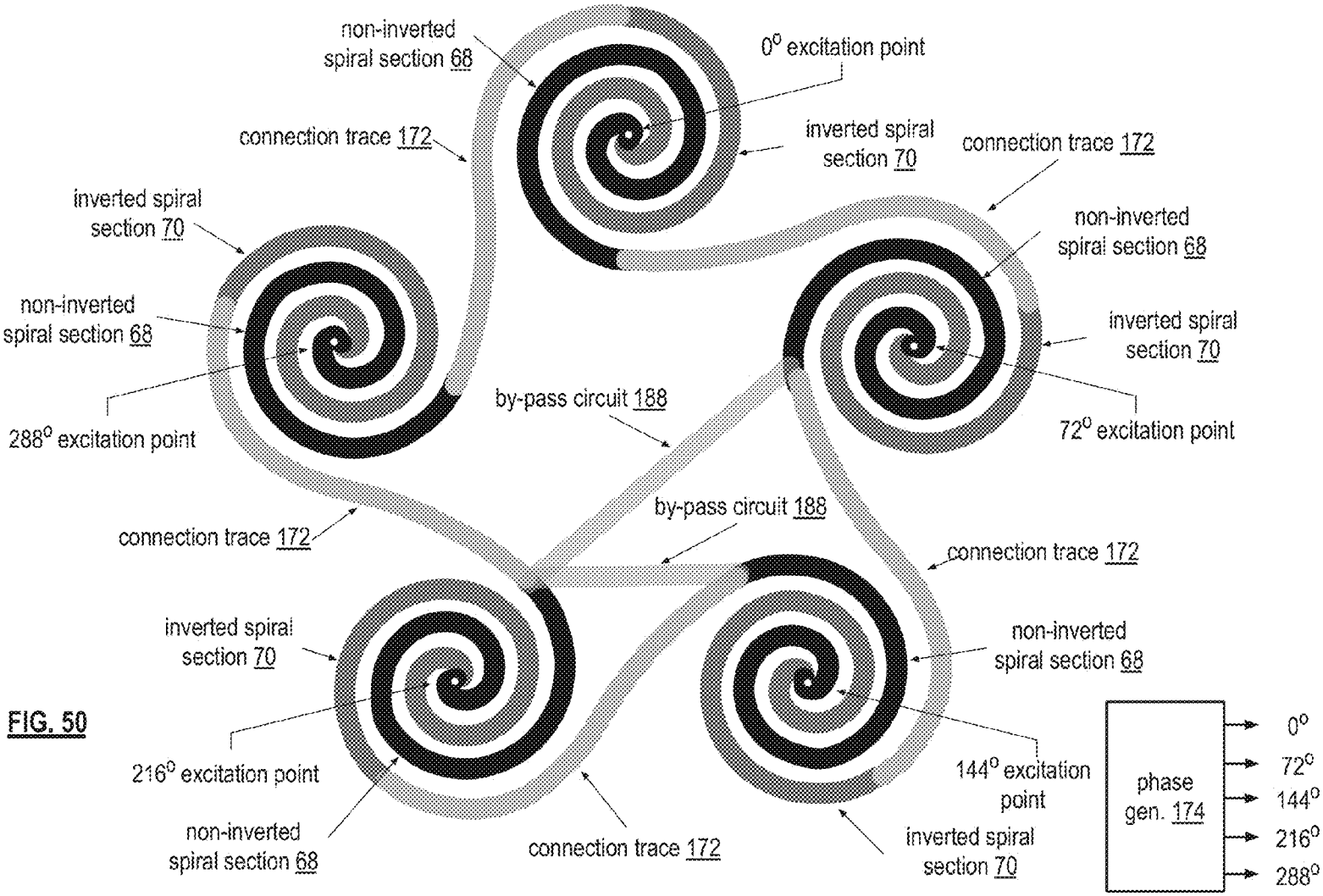
FIG. 50 is a diagram of another embodiment of a multiple excitation point antenna assembly that includes a plurality of interwoven spiral antennas in accordance with the present invention.

FIG. 50 is a diagram of another embodiment of a multiple excitation point antenna assembly that may be used in one or more of the antennas assemblies of the wireless communication devices discussed with reference to one or more of FIGS. 35-36. The antenna assembly includes a plurality of interwoven spiral antennas (e.g., five in this example) and a plurality of connection traces 172 (e.g., five in this example). Each of the interwoven spiral antennas includes a non-inverted spiral section 68, an inverted spiral section 70, and an excitation point. Collectively, the non-inverted spiral section 68 and the inverted spiral section 70 form a Celtic spiral, a logarithmic Celtic spiral, Archimedean spiral and/or some other spiral pattern. The excitation point for each interwoven spiral is approximately located at the inner connection point of the inverted spiral 70 and the non-inverted spiral 68.

The antenna assembly may further include multiple by-pass circuit traces 188, each of which including a connection trace, or tunable connection trace, and corresponding switching circuits (e.g., RF switches, transistors, etc.). When a first by-pass circuit trace 188 is activated, the first by-pass circuit trace 188 effectively bypasses two of the interwoven spiral antennas such that the antenna assembly has three active interwoven spiral antennas and operates as previously discussed with reference to FIG. 39. When a second by-pass circuit trace 188 is activated, the second by-pass circuit trace 188 effectively bypasses one of the interwoven spiral antennas such that the antenna assembly has four active interwoven spiral antennas and operates as previously discussed with reference to FIG. 48. When both by-pass circuit traces 188 are not activated, the by-pass circuit traces 188 are open such that the antenna assembly has five active interwoven spiral antennas that function as subsequently discussed. Note that the baseband processing module or other processing module generates one or more control signals to activate or de-activate the by-pass circuit traces 188 and corresponding switching circuits.

The antenna assembly is operably coupled to a phase generation module 174 that provides phase shifting of the antennas' excitation points. For instance, for an outbound RF signal, the phase generation module 174 includes a plurality of transmit phase adjust modules (or like type components) to provide multiple phase representations of the outbound RF signal (e.g., 0°, 72°, 144°, 216°, and 288° for this example embodiment). For an inbound RF signal, the phase generation module 174 includes a plurality of receive phase adjust modules (or like type components) to provide multiple phase representations of the inbound RF signal (e.g., 0°, 72°, 144°, 216°, and 288° for this example embodiment). Note that various properties of the interwoven spiral antennas and the connection traces 172 define the antenna assembly's operational characteristics as previously discussed.

In an example of operation, an outbound RF signal is applied to the excitation point of each of the interwoven spiral antennas. For instance, a first interwoven spiral antenna receives a 0° phase shifted representation of the outbound RF signal; a second interwoven spiral antenna receives a 72° phase shifted representation of the outbound RF signal; and a third interwoven spiral antenna receives a 144° phase shifted representation of the outbound RF signal, a fourth interwoven spiral antenna receives a 216° phase shifted representation of the outbound RF signal, and a fifth interwoven spiral antenna receives a 288° phase shifted representation of the outbound RF signal. The phase shifted excitation of the interwoven spiral antennas generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow.

In another example of operation, the antenna assembly receives an inbound RF signal as an electromagnetic signal, which induces a current to flow and produces a voltage within the antenna assembly. The phase generation module 174 is coupled to the excitation points of the interwoven spiral antennas and provides phase shifted representations of the inbound RF signal to receiver section of a wireless communication device. For instance, the phase generator 174 provides a 0° phase shifted representation of the inbound RF signal from a first interwoven spiral antenna; provides a 72° phase shifted representation of the inbound RF signal from a second interwoven spiral antenna; provides a 144° phase shifted representation of the inbound RF signal from a third interwoven spiral antenna, provides a 216° phase shifted representation of the inbound RF signal from a fourth interwoven spiral antenna, and provides a 288° phase shifted representation of the inbound RF signal from a fifth interwoven spiral antenna.

In an example embodiment, the antenna assembly may be implemented on one or more layers of a substrate and second antenna assembly may be implemented on another one or more layers of the substrate. The first antenna assembly provides a first leg of a composite antenna assembly and the second antenna assembly provides a second leg of the composite antenna assembly. The two antenna assemblies are aligned from a major surface perspective of the substrate such that the magnetic fields of the two antenna assemblies are additive. In furtherance of this example, the first antenna assembly provides a first leg of a dipole antenna and the second antenna assembly provides a second leg of the dipole antenna. In still furtherance of this example, the first antenna assembly function as a monopole antenna and the second antenna assembly provides a return path. Alternatively, the return path may be through a ground plane, an artificial magnetic conductor, and/or another type of return connection.

Figure 51:
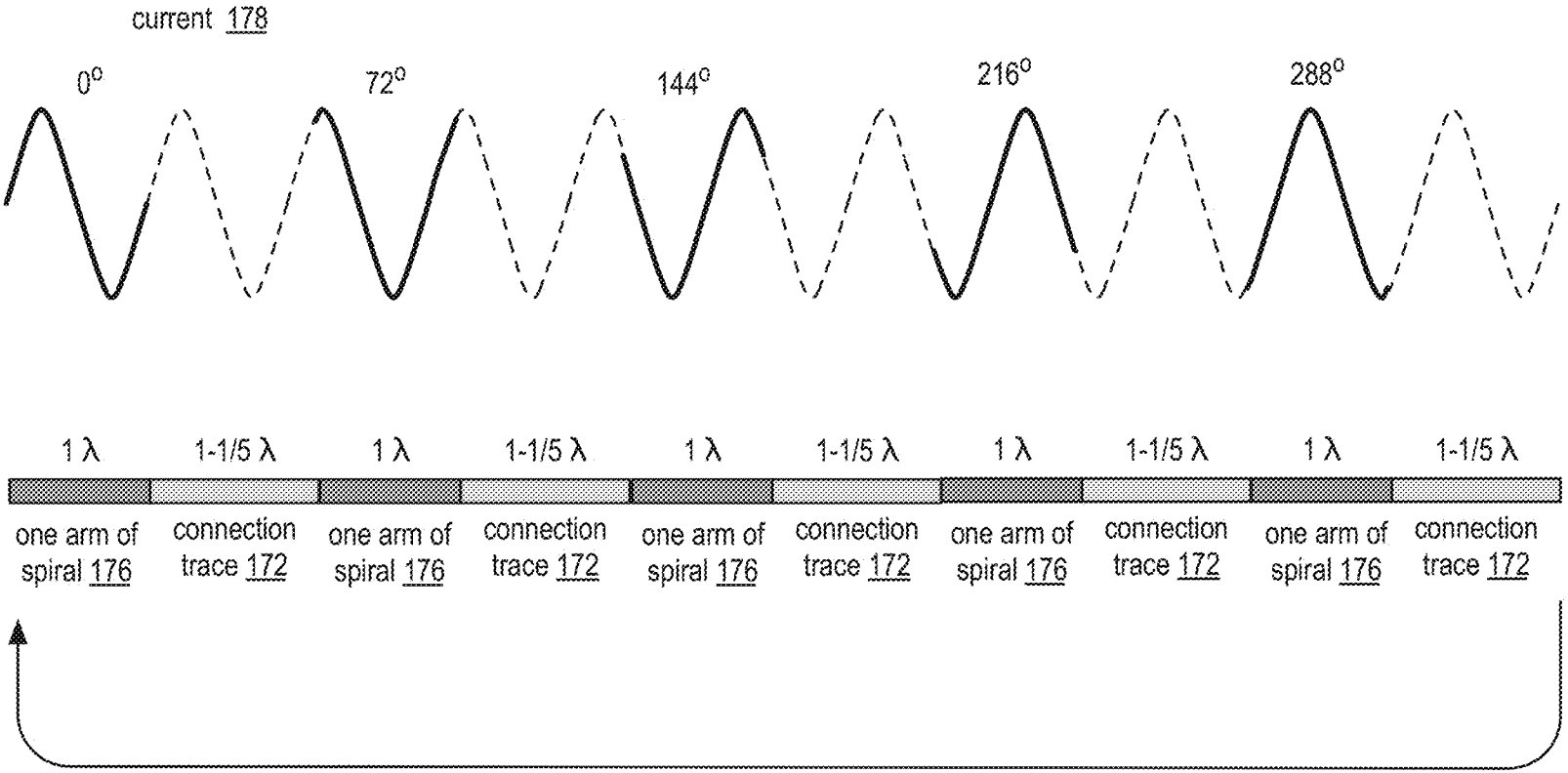
FIG. 51 is a diagram of an example of a current waveform traversing interwoven spinal antennas and connection traces of the antenna assembly of FIG. 50 in accordance with the present invention.

FIG. 51 is a diagram of an example of a current waveform traversing interwoven spinal antennas 176 and connection traces 172 of the antenna assembly of FIG. 50. In this example, each of the interwoven spiral antenna sections 176 (e.g., the inverted spiral or the non-inverted spiral) has a length corresponding to one wavelength and each of the connection traces 172 has a length of one & one-fifth wavelengths. Current through each antenna and connection is aligned such that the waveform experiences minimal to no transients as current 178 traverses the antenna assembly. In this manner, each interwoven spiral antenna 176 functions in a complimentary manner with respect to the other interwoven spiral antennas 176 to produce a desired circular polarized radiation pattern.

Figure 52:
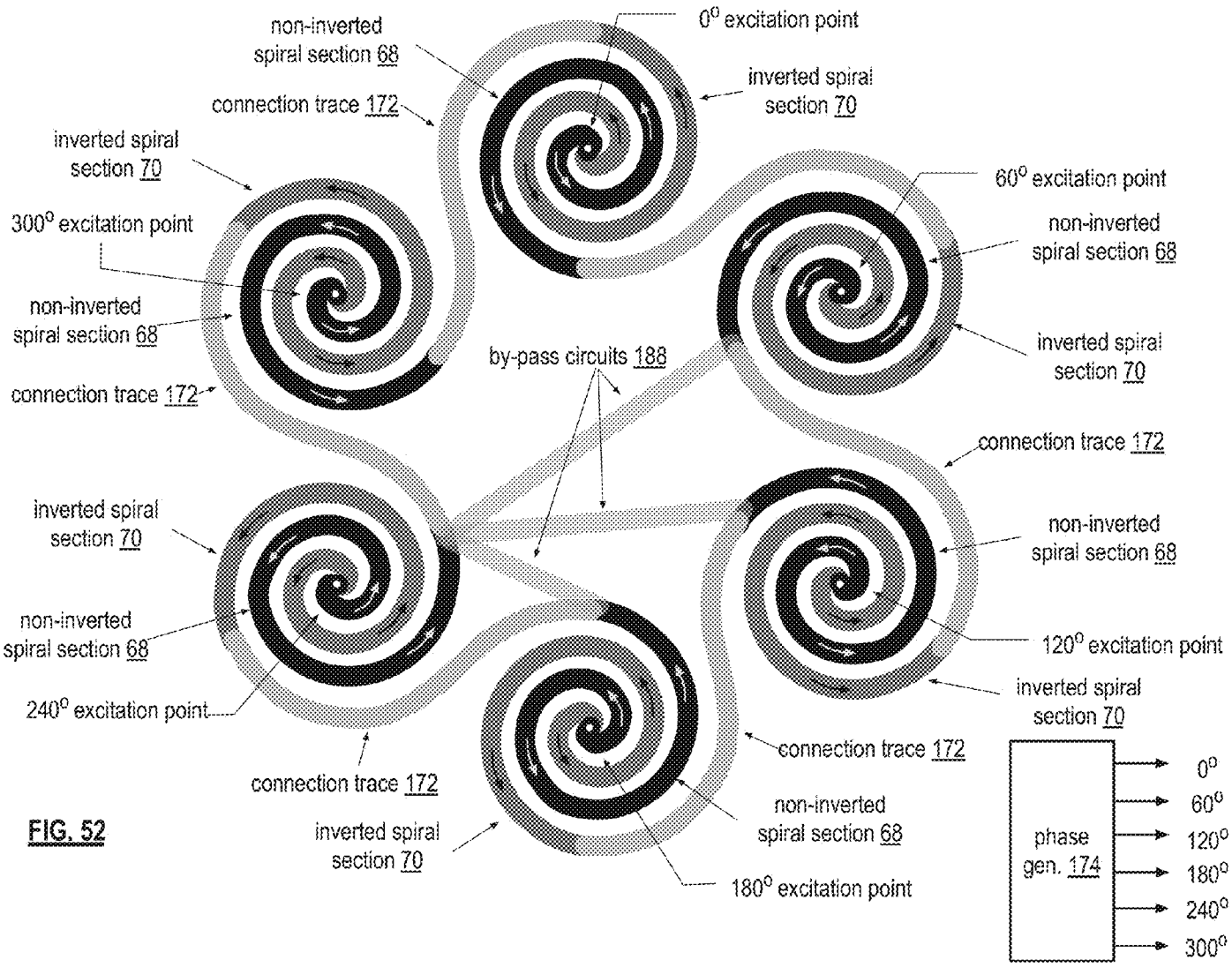
FIG. 52 is a diagram of another embodiment of a multiple excitation point antenna assembly that includes a plurality of interwoven spiral antennas in accordance with the present invention.

FIG. 52 is a diagram of another embodiment of a multiple excitation point antenna assembly that may be used in one or more of the antennas assemblies of the wireless communication devices discussed with reference to one or more of FIGS. 35-36. The antenna assembly includes a plurality of interwoven spiral antennas (e.g., six in this example) and a plurality of connection traces 172 (e.g., six in this example) configured in a geometric pattern (e.g., circle, hexagon, star, etc.). Each of the interwoven spiral antennas includes a non-inverted spiral section 68, an inverted spiral section 70, and an excitation point. Collectively, the non-inverted spiral section 68 and the inverted spiral section 70 form a Celtic spiral, a logarithmic Celtic spiral, Archimedean spiral and/or some other spiral pattern. The excitation point for each interwoven spiral is approximately located at the inner connection point of the inverted spiral 70 and the non-inverted spiral 68.

The antenna assembly may further include multiple by-pass circuits, 188, each of which includes a connection trace, or tunable connection trace, and corresponding switching circuits (e.g., RF switches, transistors, etc.). When a first by-pass circuit 188 is activated, the first by-pass trace 188 effectively bypasses three of the interwoven spiral antennas such that the antenna assembly has three active interwoven spiral antennas and operates as previously discussed with reference to FIG. 39. When a second by-pass circuit trace 188 is activated, the second by-pass circuit trace 188 effectively bypasses two of the interwoven spiral antennas such that the antenna assembly has four active interwoven spiral antennas and operates as previously discussed with reference to FIG. 39. When a third by-pass circuit trace 188 is activated, the third by-pass trace effectively bypasses one of the interwoven spiral antennas such that the antenna assembly has five active interwoven spiral antennas and operates as previously discussed with reference to FIG. 50. When the by-pass circuit traces 188 are not activated, the by-pass circuit traces 188 are open such that the antenna assembly has six active interwoven spiral antennas that function as subsequently discussed. Note that the baseband processing module or other processing module generates one or more control signals to activate or de-activate the by-pass circuit traces 188 and their corresponding switching circuits. Further note that the processing module may generate control signals such that a first set of the interwoven spiral antenna units forms a first programmed poly interwoven spiral antenna assembly and a second set of interwoven spiral antenna units forms a second programmed multiple interwoven spiral assembly.

The antenna assembly is operably coupled to a phase generation module 174 that provides phase shifting of the antennas' excitation points. For instance, for an outbound RF signal, the phase generation module 174 includes a plurality of transmit phase adjust modules (or like type components) to provide multiple phase representations of the outbound RF signal (e.g., 0°, 60°, 120°, 180°, 240°, and 300° for this example embodiment). For an inbound RF signal, the phase generation module 174 includes a plurality of receive phase adjust modules (or like type components) to provide multiple phase representations of the inbound RF signal (e.g., 0°, 60°, 120°, 180°, 240°, and 300° for this example embodiment). Note that various properties of the interwoven spiral antennas and the connection traces 172 define the antenna assembly's operational characteristics as previously discussed.

In an example of operation, an outbound RF signal is applied to the excitation point of each of the interwoven spiral antennas. For instance, a first interwoven spiral antenna receives a 0° phase shifted representation of the outbound RF signal; a second interwoven spiral antenna receives a 60° phase shifted representation of the outbound RF signal; and a third interwoven spiral antenna receives a 120° phase shifted representation of the outbound RF signal, a fourth interwoven spiral antenna receives a 180° phase shifted representation of the outbound RF signal, a fifth interwoven spiral antenna receives a 240° phase shifted representation of the outbound RF signal, and a sixth interwoven spiral antenna receives a 300° phase shifted representation of the outbound RF signal. The phase shifted excitation of the interwoven spiral antennas generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow.

In another example of operation, the antenna assembly receives an inbound RF signal as an electromagnetic signal, which induces a current to flow and produces a voltage within the antenna assembly. The phase generation module 174 is coupled to the excitation points of the interwoven spiral antennas and provides phase shifted representations of the inbound RF signal to the receiver section of a wireless communication device. For instance, the phase generator 174 provides a 0° phase shifted representation of the inbound RF signal from a first interwoven spiral antenna; provides a 60° phase shifted representation of the inbound RF signal from a second interwoven spiral antenna; provides a 120° phase shifted representation of the inbound RF signal from a third interwoven spiral antenna, provides a 180° phase shifted representation of the inbound RF signal from a fourth interwoven spiral antenna, and provides a 240° phase shifted representation of the inbound RF signal from a fifth interwoven spiral antenna, and provides a 300° phase shifted representation of the inbound RF signal from a sixth interwoven spiral antenna.

In an example embodiment, the antenna assembly may be implemented on one or more layers of a substrate and second antenna assembly may be implemented on another one or more layers of the substrate. The first antenna assembly provides a first leg of a composite antenna assembly and the second antenna assembly provides a second leg of the composite antenna assembly. The two antenna assemblies are aligned from a major surface perspective of the substrate such that the magnetic fields of the two antenna assemblies are additive. In furtherance of this example, the first antenna assembly provides a first leg of a dipole antenna and the second antenna assembly provides a second leg of the dipole antenna. In still furtherance of this example, the first antenna assembly function as a monopole antenna and the second antenna assembly provides a return path. Alternatively, the return path may be through a ground plane, an artificial magnetic conductor, and/or another type of return connection.

Figure 53:
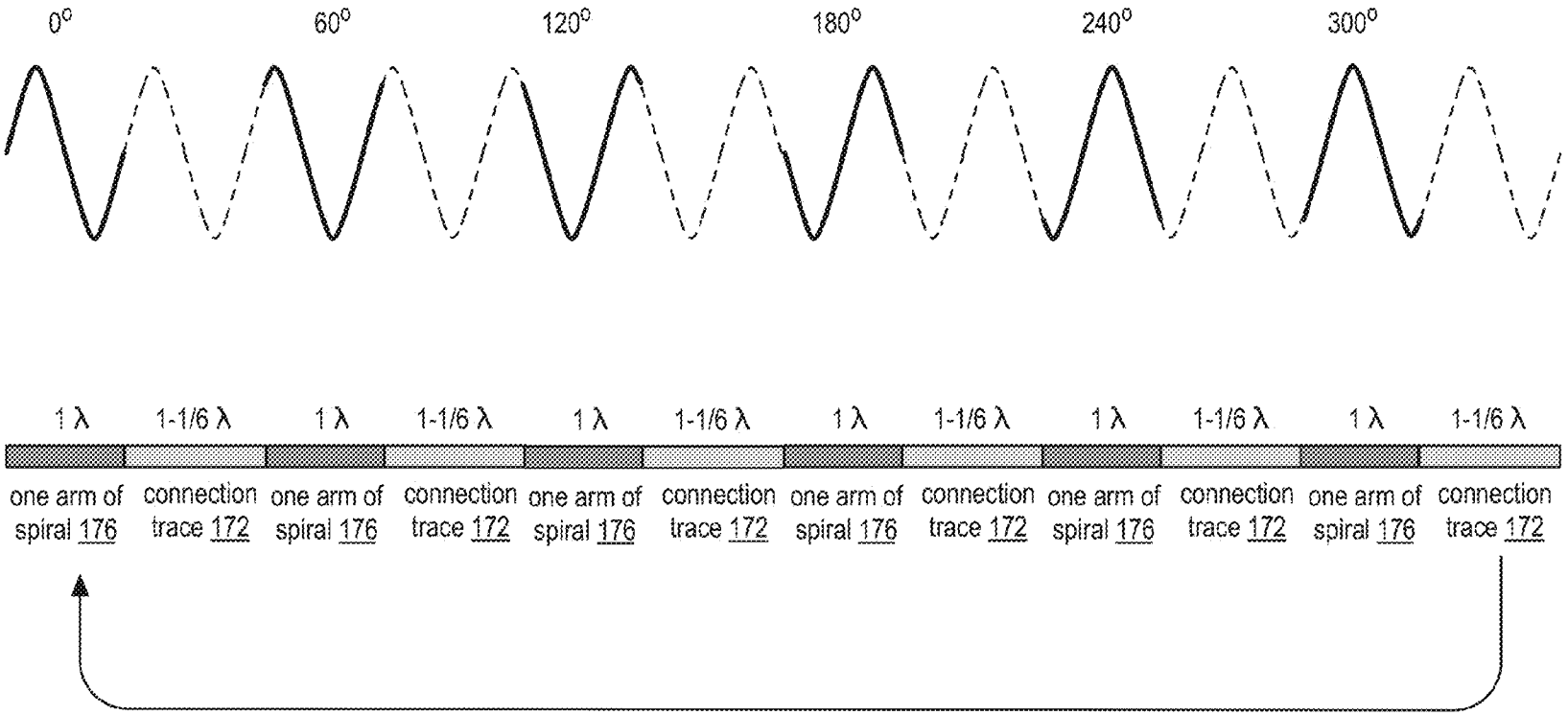
FIG. 53 is a diagram of an example of a current waveform traversing interwoven spinal antennas and connection traces of the antenna assembly of FIG. 50 in accordance with the present invention.
Figure 56:
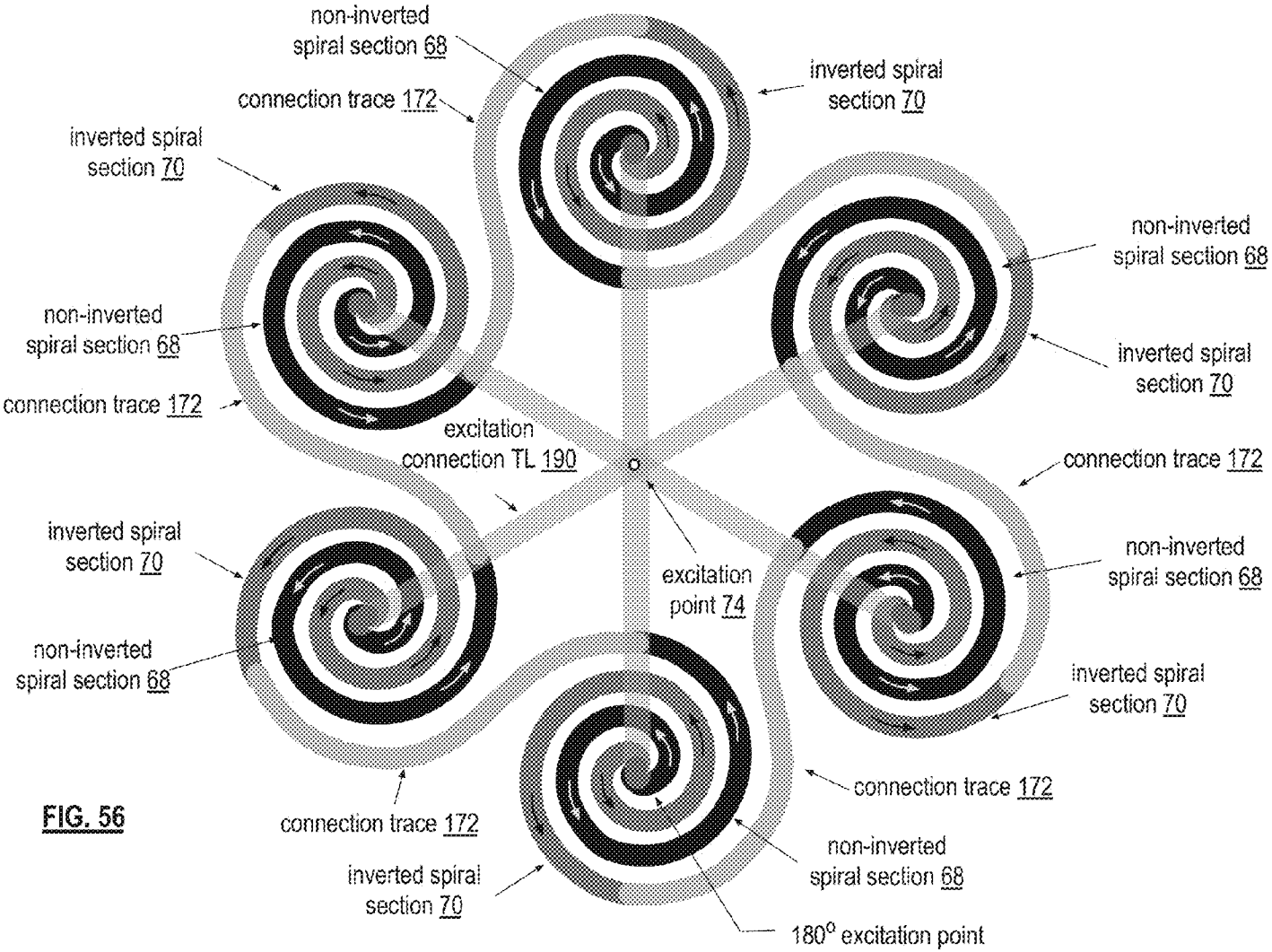
FIG. 56 is a diagram of another embodiment of a single excitation point antenna assembly that includes a plurality of interwoven spiral antennas in accordance with the present invention.

FIG. 53 is a diagram of an example of a current waveform traversing interwoven spinal antennas 176 and connection traces 172 of the antenna assembly of FIG. 56. In this example, each of the interwoven spiral antenna sections 176 (e.g., the inverted spiral or the non-inverted spiral) has a length corresponding to one wavelength and each of the connection traces 172 has a length of one & one-sixth wavelengths. Current through each antenna 176 and connection traces 172 is aligned such that the waveform experiences minimal to no transients as current traverses the antenna assembly. In this manner, each interwoven spiral antenna functions in a complimentary manner with respect to the other interwoven spiral antennas to produce a desired circular polarized radiation pattern.

Figure 54:
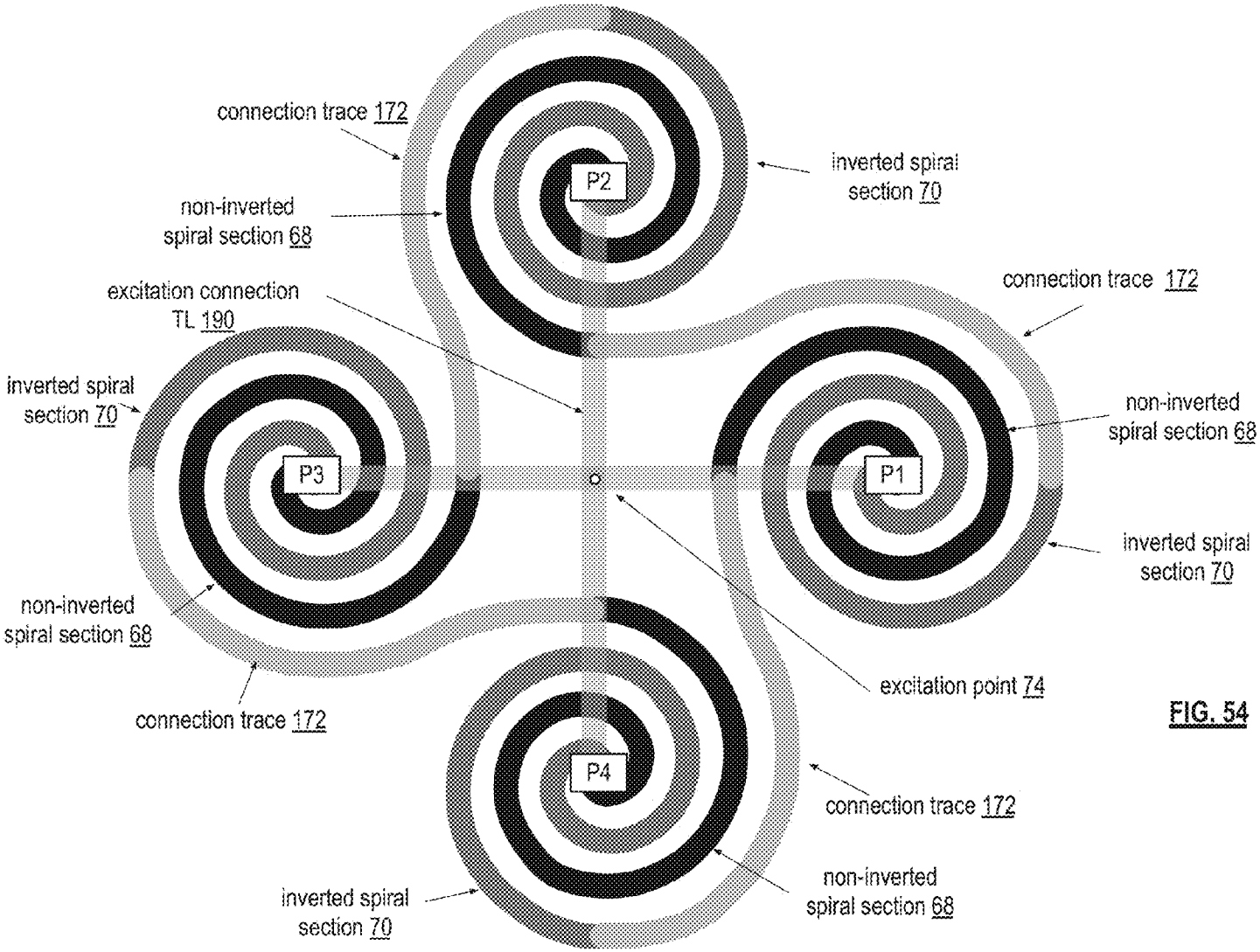
FIG. 54 is a diagram of another embodiment of a single excitation point antenna assembly that includes a plurality of interwoven spiral antennas in accordance with the present invention.
Figure 55:
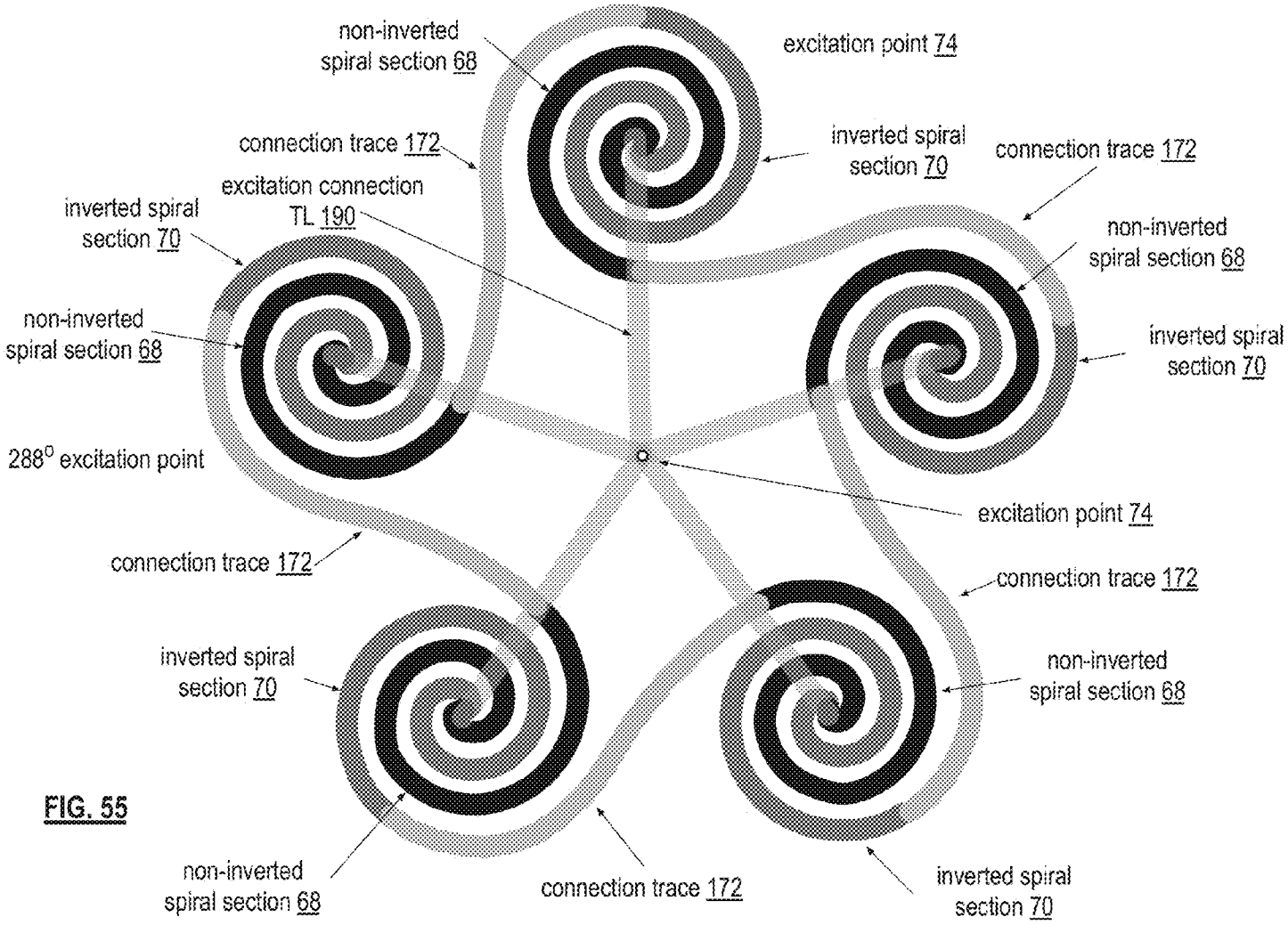
FIG. 55 is a diagram of another embodiment of a single excitation point antenna assembly that includes a plurality of interwoven spiral antennas in accordance with the present invention.

FIG. 54 is a diagram of another embodiment of a single excitation point antenna assembly that may be used in one or more of the antennas assemblies of the wireless communication devices discussed with reference to one or more of FIGS. 1-4 and 35-36. The antenna assembly includes an excitation point 74, a plurality of interwoven spiral antennas (e.g., four), excitation connection transmission lines (TL) 190, a plurality of ports (e.g., four), and a plurality of connection traces, or arms, (e.g., four) 172. Each of the ports includes one or more inductors, one or more capacitors, and/or one or more impedances. Each of the interwoven spiral antennas includes a non-inverted spiral section 68, an inverted spiral section 70, and an excitation point. Collectively, the non-inverted spiral section 68 and the inverted spiral section 70 form a Celtic spiral, a logarithmic Celtic spiral, Archimedean spiral and/or some other spiral pattern. The excitation point for each interwoven spiral is approximately located at the inner connection point of the inverted spiral 70 and the non-inverted spiral 68 and is coupled to the excitation point 74 via one of the excitation connection TLs 190.

Various properties of the interwoven spiral antennas, the excitation connection transmission lines (TL) 190, and the connection traces 172 define the antenna assembly's operational characteristics. For instance, the dimensions of the excitation region (e.g., establishes the upper cutoff region of the bandwidth) and the circumference of the interwoven spiral antennas (e.g., establishes the lower cutoff region of the bandwidth) define the bandwidth of the interwoven spiral antenna. The trace width, distance between traces, length of each spiral section, distance to a ground plane, trace width and length of each of the connection traces 172, trace width and length of each of the excitation connection TLs 190, and/or use of an artificial magnetic conductor plane affect the quality factor, radiation pattern, impedance (which is fairly constant over the bandwidth), gain, and/or other characteristics of the antenna assembly. Each of the interconnection arm may have a length approximately equal to (n*x+1)/n, where n equals a number of the plurality of interwoven spiral antenna units and x is an integer greater than or equal to 0.

In an example of operation, an outbound RF signal is applied to the excitation point 74 of the antenna assembly, which is provided to the excitation points of each of the interwoven spiral antennas via the excitation connection transmission lines 190 and the corresponding ports. The excitation of the interwoven spiral antennas generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow. Note that excitation connection transmission lines 190 may include one or more variable inductors, one or more variable capacitors, and/or one or more variable impedances for tuning the transmission line. Further note that each of the ports may include one or more variable inductors, one or more variable capacitors, and/or one or more variable impedances for tuning the ports.

In another example of operation, each of the interwoven spiral antennas receives an inbound RF signal as an electromagnetic signal, which induces a current to flow and produces a voltage within each of the interwoven spiral antennas. The current flows, and the corresponding voltage propagates, through the interwoven spiral antennas, the connection traces 172 and the excitation connection TL 190 to the common excitation point 74. The antenna assembly provides the inbound RF signal to the receiver section of a wireless communication device via the excitation point 74.

FIG. 56 is a diagram of another embodiment of a single excitation point antenna assembly that may be used in one or more of the antennas assemblies of the wireless communication devices discussed with reference to one or more of FIGS. 1-4 and 35-36. The antenna assembly includes an excitation point 74, a plurality of interwoven spiral antennas (e.g., five), excitation connection transmission lines (TL) 190, a plurality of ports (e.g., five), and a plurality of connection traces (e.g., five) 172. Each of the ports includes one or more inductors, one or more capacitors, and/or one or more impedances.

Each of the interwoven spiral antennas includes a non-inverted spiral section 68, an inverted spiral section 70, and an excitation point. Collectively, the non-inverted spiral section 68 and the inverted spiral section 70 form a Celtic spiral, a logarithmic Celtic spiral, Archimedean spiral and/or some other spiral pattern. The excitation point for each interwoven spiral is approximately located at the inner connection point of the inverted spiral 70 and the non-inverted spiral 68 and is coupled to the excitation point 74 via one of the excitation connection TLs 190. Various properties of the interwoven spiral antennas, the excitation connection transmission lines (TL) 190, and the connection traces 172 define the antenna assembly's operational characteristics as previously discussed with reference to FIG. 54.

In an example of operation, an outbound RF signal is applied to the excitation point 74 of the antenna assembly, which is provided to the excitation points of each of the interwoven spiral antennas via the excitation connection transmission lines 190 and the corresponding ports. The excitation of the interwoven spiral antennas generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow. Note that excitation connection transmission lines 190 may include one or more variable inductors, one or more variable capacitors, and/or one or more variable impedances for tuning the transmission line. Further note that each of the ports may include one or more variable inductors, one or more variable capacitors, and/or one or more variable impedances for tuning the ports.

In another example of operation, each of the interwoven spiral antennas receives an inbound RF signal as an electromagnetic signal, which induces a current to flow and produces a voltage within each of the interwoven spiral antennas. The current flows, and the corresponding voltage propagates, through the interwoven spiral antennas, the connection traces 172 and the excitation connection TL 190 to the common excitation point 74. The antenna assembly provides the inbound RF signal to the receiver section of a wireless communication device via the excitation point 74.

FIG. 56 is a diagram of another embodiment of a single excitation point antenna assembly that may be used in one or more of the antennas assemblies of the wireless communication devices discussed with reference to one or more of FIGS. 1-4 and 35-36. The antenna assembly includes an excitation point 74, a plurality of interwoven spiral antennas (e.g., six), excitation connection transmission lines (TL) 190, a plurality of ports (e.g., six), and a plurality of connection traces (e.g., six) 172. Each of the ports includes one or more inductors, one or more capacitors, and/or one or more impedances.

Each of the interwoven spiral antennas includes a non-inverted spiral section 68, an inverted spiral section 70, and an excitation point. Collectively, the non-inverted spiral section 68 and the inverted spiral section 70 form a Celtic spiral, a logarithmic Celtic spiral, Archimedean spiral and/or some other spiral pattern. The excitation point for each interwoven spiral is approximately located at the inner connection point of the inverted spiral 70 and the non-inverted spiral 68 and is coupled to the excitation point 74 via one of the excitation connection TLs 190. Various properties of the interwoven spiral antennas, the excitation connection transmission lines (TL) 190, and the connection traces 172 define the antenna assembly's operational characteristics as previously discussed with reference to FIG. 54.

In an example of operation, an outbound RF signal is applied to the excitation point 74 of the antenna assembly, which is provided to the excitation points of each of the interwoven spiral antennas via the excitation connection transmission lines 190 and the corresponding ports. The excitation of the interwoven spiral antennas generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow.

Note that excitation connection transmission lines 190 may include one or more variable inductors, one or more variable capacitors, and/or one or more variable impedances for tuning the transmission line. Further note that each of the ports may include one or more variable inductors, one or more variable capacitors, and/or one or more variable impedances for tuning the ports.

In another example of operation, each of the interwoven spiral antennas receives an inbound RF signal as an electromagnetic signal, which induces a current to flow and produces a voltage within each of the interwoven spiral antennas. The current flows, and the corresponding voltage propagates, through the interwoven spiral antennas, the connection traces 172 and the excitation connection TL 190 to the common excitation point 74. The antenna assembly provides the inbound RF signal to the receiver section of a wireless communication device via the excitation point 74.

Figure 57:
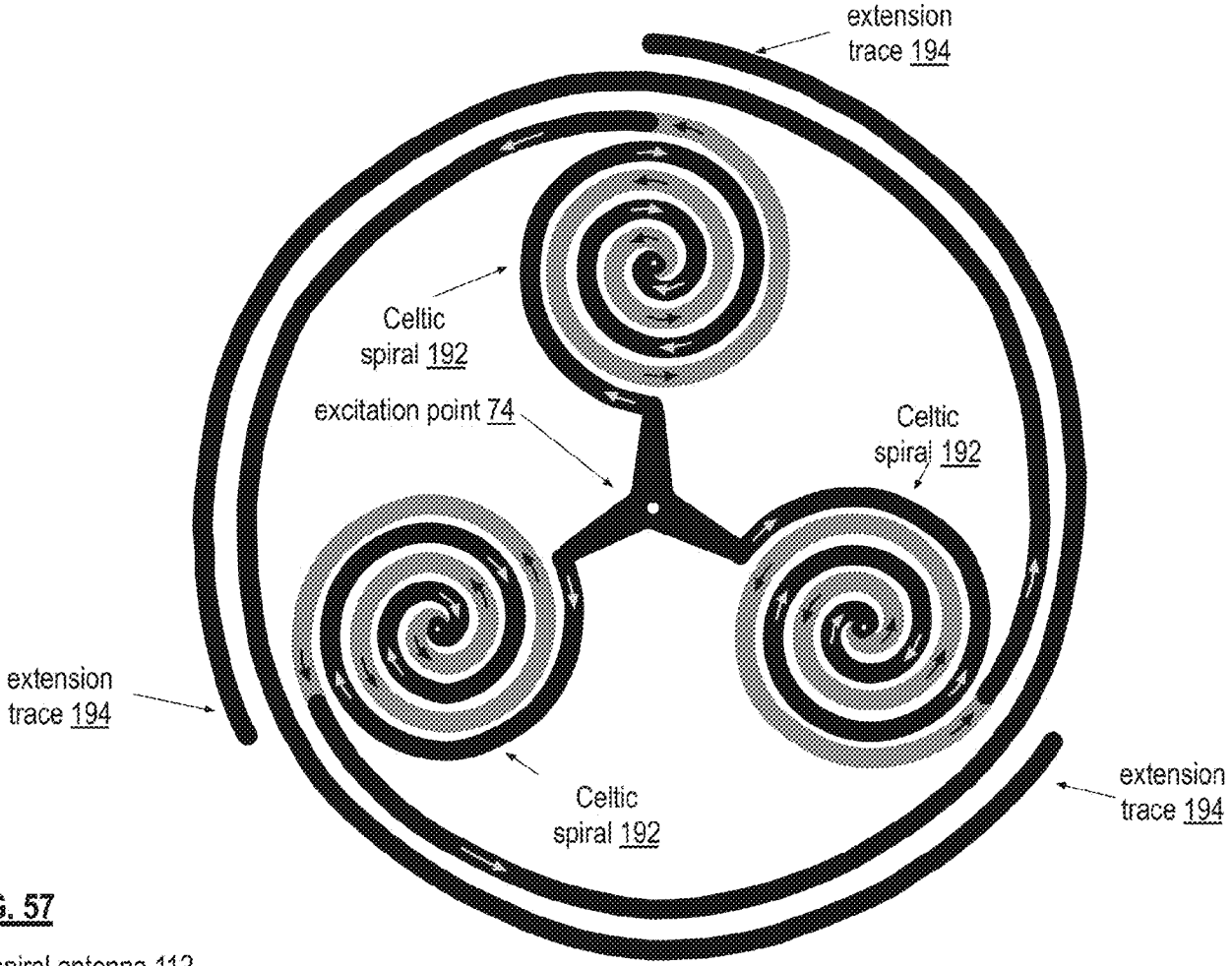
FIG. 57 is a diagram of another embodiment of a single excitation point antenna assembly that includes a plurality of interwoven spiral antennas and extension traces in accordance with the present invention.

FIG. 57 is a diagram of another embodiment of a single excitation point antenna assembly that may be used in one or more of the antennas assemblies of the wireless communication devices discussed with reference to one or more of FIGS. 1-4 and 35-36. The antenna assembly includes an excitation point 74 (e.g., a hub connection point), a plurality of interwoven spiral antennas 192 (e.g., three shown but could include more), a plurality of connection traces to the excitation point 74 (e.g., three shown bout could include more), and a plurality of extension traces 194 (e.g., three shown bout could include more). Each of the interwoven spiral antennas 192 includes a non-inverted spiral section, an inverted spiral section, and an excitation point. Collectively, the non-inverted spiral section and the inverted spiral section form a Celtic spiral, a logarithmic Celtic spiral, Archimedean spiral and/or some other spiral pattern. The excitation point for each interwoven spiral 192 is approximately located at the inner connection point of the inverted spiral and the non-inverted spiral and is coupled to the excitation point via one of the connection traces.

The present antenna assembly will produce a radiation pattern that is a combination of the radiation patterns of each of the individual spiral antennas 192 and the extension traces 194. For instance, with the antenna assembly being excited with a non-phase shifted signal (e.g., zero degree excitation), the radiation pattern of the spiral antennas 192 will be similar to the radiation pattern presented in FIG. 24. The radiation pattern created by the extension traces 194 will be based on their length and the length of the interwoven spiral antennas 192. For example, if the length of one of the spirals of an interwoven spiral antenna 192 and a corresponding extension trace 194 are each one-half wavelength, then the extension trace 194 will have a radiation pattern similar to a monopole antenna. The radiation pattern may be varied in accordance with the various properties of the interwoven spiral antennas 192, the connection traces, and the extension traces 194.

Various properties of the interwoven spiral antennas 192, the extension traces 194, and the connection traces define the antenna assembly's operational characteristics. For instance, the dimensions of the excitation region (e.g., establishes the upper cutoff region of the bandwidth) and the circumference of the interwoven spiral antennas 192 (e.g., establishes the lower cutoff region of the bandwidth) define the bandwidth of the interwoven spiral antenna 192. The trace width, distance between traces, length of each spiral section, distance to a ground plane, trace width and length of each of the connection traces, trace width and length of each of the extension traces 194 (e.g., one-half wavelength, one wavelength, etc.), and/or use of an artificial magnetic conductor plane affect the quality factor, radiation pattern, impedance (which is fairly constant over the bandwidth), gain, and/or other characteristics of the antenna assembly.

In an example of operation, an outbound RF signal is applied to the excitation point 74 of the antenna assembly, which is provided to the excitation points of each of the interwoven spiral antennas 192 via the connection traces. The excitation of the interwoven spiral antennas 192 generates an electric field and causes a current to flow through the antenna assembly from the excitation point of each of the interwoven spiral antennas to the extension traces 194. The current generates a magnetic field such that, in combination with the electric field, the antenna assembly has a circular polarization, which may be inverted by changing the direction of current flow.

In another example of operation, each of the interwoven spiral antennas 192 and extension traces 194 receive an inbound RF signal as an electromagnetic signal, which induces a current to flow and produces a voltage within each of the interwoven spiral antennas 192. The current flows, and the corresponding voltage propagates, through the extension traces 194, the interwoven spiral antennas 192, and the connection traces to the common excitation point 74. The antenna assembly provides the inbound RF signal to the receiver section of a wireless communication device via the excitation point 74.

If the return path of the antenna is through a ground and/or an artificial magnetic conductor, the radiation pattern primarily includes the radiation lobe as shown. If, however, the return path of the antenna is through some other means (e.g., another interwoven spiral 192 or a return connection), a second radiation lobe may be present that is perpendicular the surface of the antenna, but in the opposite direction as the one presently illustrated.

Figure 58:
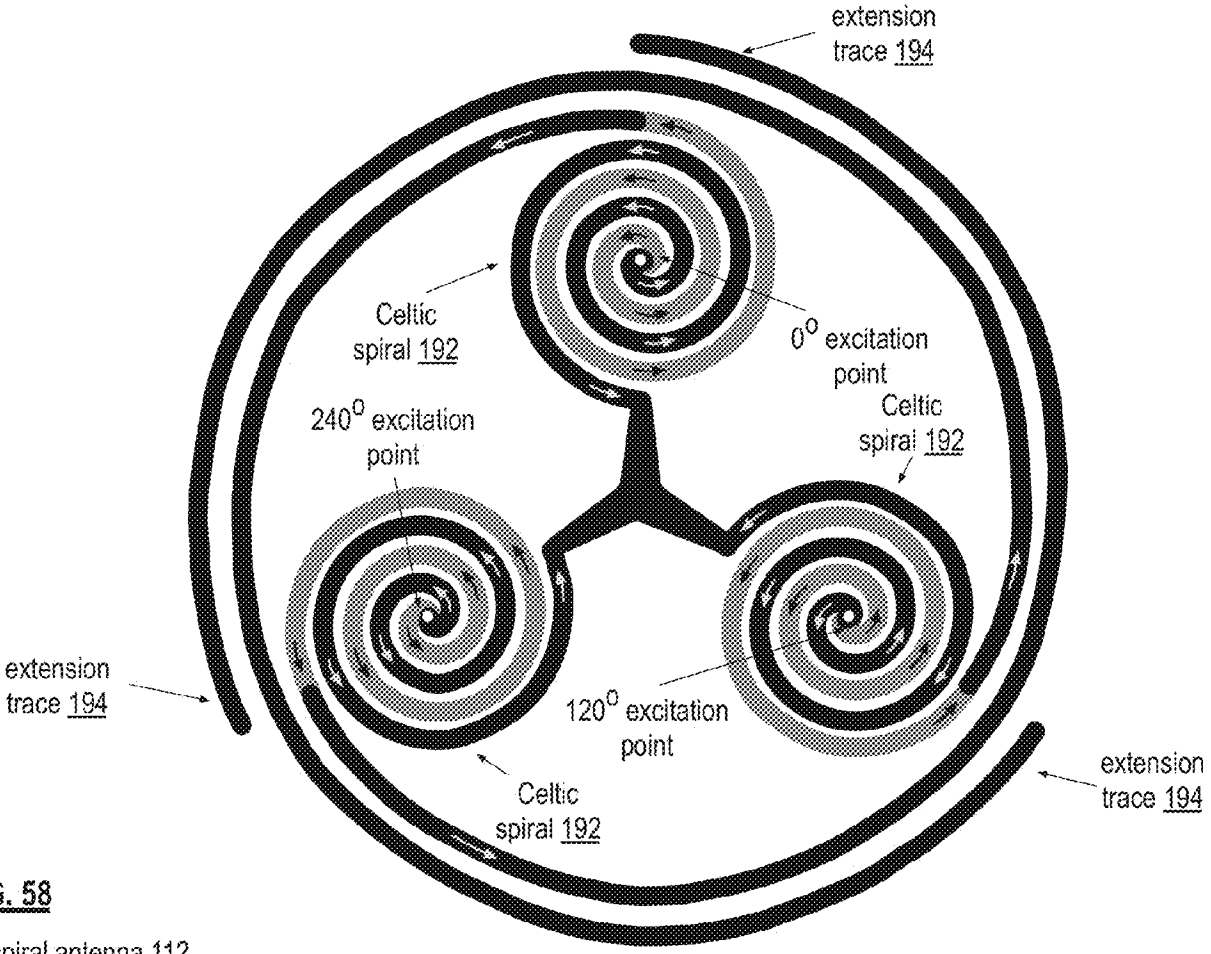
FIG. 58 is a diagram of another embodiment of a multiple excitation point antenna assembly that includes a plurality of interwoven spiral antennas and extension traces in accordance with the present invention.

FIG. 58 is a diagram of another embodiment of a multiple excitation point antenna assembly that may be used in one or more of the antennas assemblies of the wireless communication devices discussed with reference to one or more of FIGS. 1-4 and 35-36. The antenna assembly includes a plurality of interwoven spiral antennas 192 (e.g., three shown but could include more), a plurality of excitation points at a center of the interwoven spiral antennas 192, a plurality of connection traces coupling the interwoven spiral antennas 192 together, and a plurality of extension traces 194 (e.g., three shown bout could include more). Each of the interwoven spiral antennas 192 includes a non-inverted spiral section, an inverted spiral section, and an excitation point. Collectively, the non-inverted spiral section and the inverted spiral section form a Celtic spiral, a logarithmic Celtic spiral, Archimedean spiral and/or some other spiral pattern.

The present antenna assembly will produce a radiation pattern that is a combination of the radiation patterns of each of the individual spiral antennas 192 and the extension traces 194. For instance, with each interwoven spiral assembly being excited with a different phase shifted signal (e.g., 0°, 120°, and 240°), the radiation pattern of the spiral antennas 192 will be similar to the radiation pattern presented in FIG. 44. The radiation pattern created by the extension traces 194 will be based on their length and the length of the interwoven spiral antennas 192. For example, if the length of one of the spirals of an interwoven spiral antenna 192 and a corresponding extension trace 194 are each one-half wavelength, then the extension trace 194 will have a radiation pattern similar to a monopole antenna. The radiation pattern may be varied in accordance with the various properties (which have been previously discussed) of the interwoven spiral antennas 192, the connection traces, and the extension traces 194.

In an example of operation, an outbound RF signal is applied to the excitation point of each of the interwoven spiral antennas 192. For instance, a first interwoven spiral antenna 192 receives a 0° phase shifted representation of the outbound RF signal; a second interwoven spiral antenna 192 receives a 120° phase shifted representation of the outbound RF signal; and a third interwoven spiral antenna 192 receives a 240° phase shifted representation of the outbound RF signal. The phase shifted excitation of the interwoven spiral antennas 192 generates an electric field and causes a current to flow through the antenna assembly from the excitation point of each of the interwoven spiral antennas 192 to the connection traces and to the extension traces 194. The current generates a magnetic field such that, in combination with the electric field, the antenna assembly has a circular polarization, which may be inverted by changing the direction of current flow.

In another example of operation, the antenna assembly receives an inbound RF signal as an electromagnetic signal, which induces a current to flow and produces a voltage within the antenna assembly. The phase generation module is coupled to the excitation points of the interwoven spiral antennas 192 and provides phase shifted representations of the inbound RF signal to receiver section of a wireless communication device. For instance, the phase generator provides a 0° phase shifted representation of the inbound RF signal from a first interwoven spiral antenna 192; provides a 120° phase shifted representation of the inbound RF signal from a second interwoven spiral antenna 192; and provides a 240° phase shifted representation of the inbound RF signal from a third interwoven spiral antenna 192.

Figure 59:
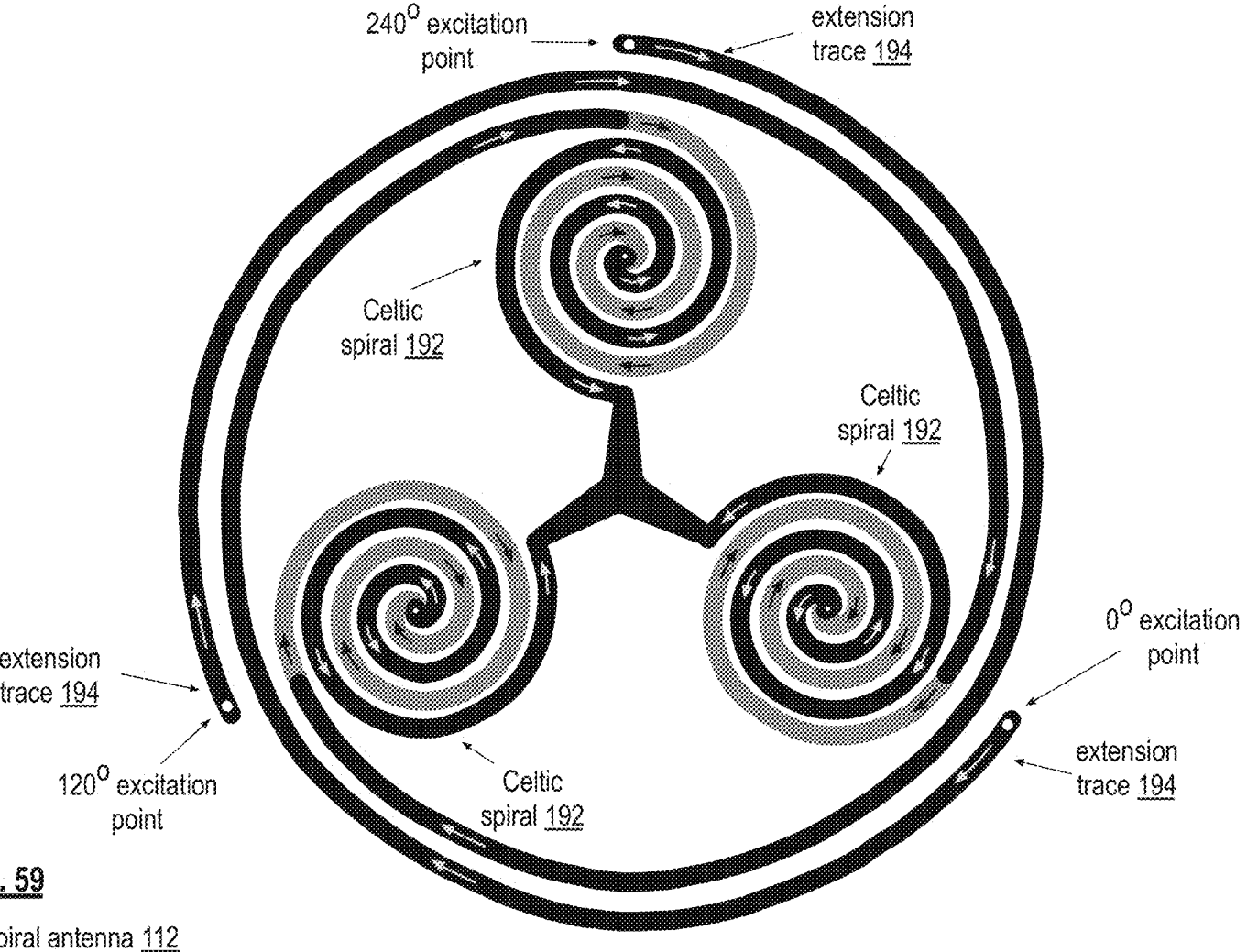
FIG. 59 is a diagram of another embodiment of a multiple excitation point antenna assembly that includes a plurality of interwoven spiral antennas and extension traces in accordance with the present invention.

FIG. 59 is a diagram of another embodiment of a multiple excitation point antenna assembly that may be used in one or more of the antennas assemblies of the wireless communication devices discussed with reference to one or more of FIGS. 1-4 and 35-36. The antenna assembly includes a plurality of interwoven spiral antennas 192 (e.g., three shown but could include more), a plurality of excitation points at the ends of the extension traces 194, a plurality of connection traces coupling the interwoven spiral antennas 192 together at a hub connection point, and a plurality of extension traces 194 (e.g., three shown bout could include more). Each of the interwoven spiral antennas 192 includes a non-inverted spiral section, an inverted spiral section, and an excitation point. Collectively, the non-inverted spiral section and the inverted spiral section form a Celtic spiral, a logarithmic Celtic spiral, Archimedean spiral and/or some other spiral pattern.

The present antenna assembly will produce a radiation pattern that is a combination of the radiation patterns of each of the individual spiral antennas 192 and the extension traces 194. For instance, with each excitation point being excited with a different phase shifted signal (e.g., 0°, 120°, and 240°), the radiation pattern of the spiral antennas 192 will be similar to the radiation pattern presented in FIG. 44. The radiation pattern created by the extension traces 194 will be based on their length and the length of the interwoven spiral antennas 192. For example, if the length of one of the spirals of an interwoven spiral antenna 192 and a corresponding extension trace 194 are each one-half wavelength, then the extension trace 194 will have a radiation pattern similar to a monopole antenna. The radiation pattern may be varied in accordance with the various properties (which have been previously discussed) of the interwoven spiral antennas 192, the connection traces, and the extension traces 194.

In an example of operation, an outbound RF signal is applied to the excitation point of each of the connection traces. For instance, a first connection trace receives a 0° phase shifted representation of the outbound RF signal; a second connection trace receives a 120° phase shifted representation of the outbound RF signal; and a third connection trace receives a 240° phase shifted representation of the outbound RF signal. The phase shifted excitation of the excitation traces generates an electric field and causes a current to flow through the antenna assembly from the excitation point, through the extension traces 194 and then to the interwoven spiral antennas 192. The current generates a magnetic field such that, in combination with the electric field, the antenna assembly has a circular polarization, which may be inverted by changing the direction of current flow.

In another example of operation, the antenna assembly receives an inbound RF signal as an electromagnetic signal, which induces a current to flow and produces a voltage within the antenna assembly. The phase generation module is coupled to the excitation points of the extension traces 194 and provides phase shifted representations of the inbound RF signal to receiver section of a wireless communication device. For instance, the phase generator provides a 0° phase shifted representation of the inbound RF signal from a first connection trace; provides a 120° phase shifted representation of the inbound RF signal from a second connection trace; and provides a 240° phase shifted representation of the inbound RF signal from a third connection trace.

Figure 60:
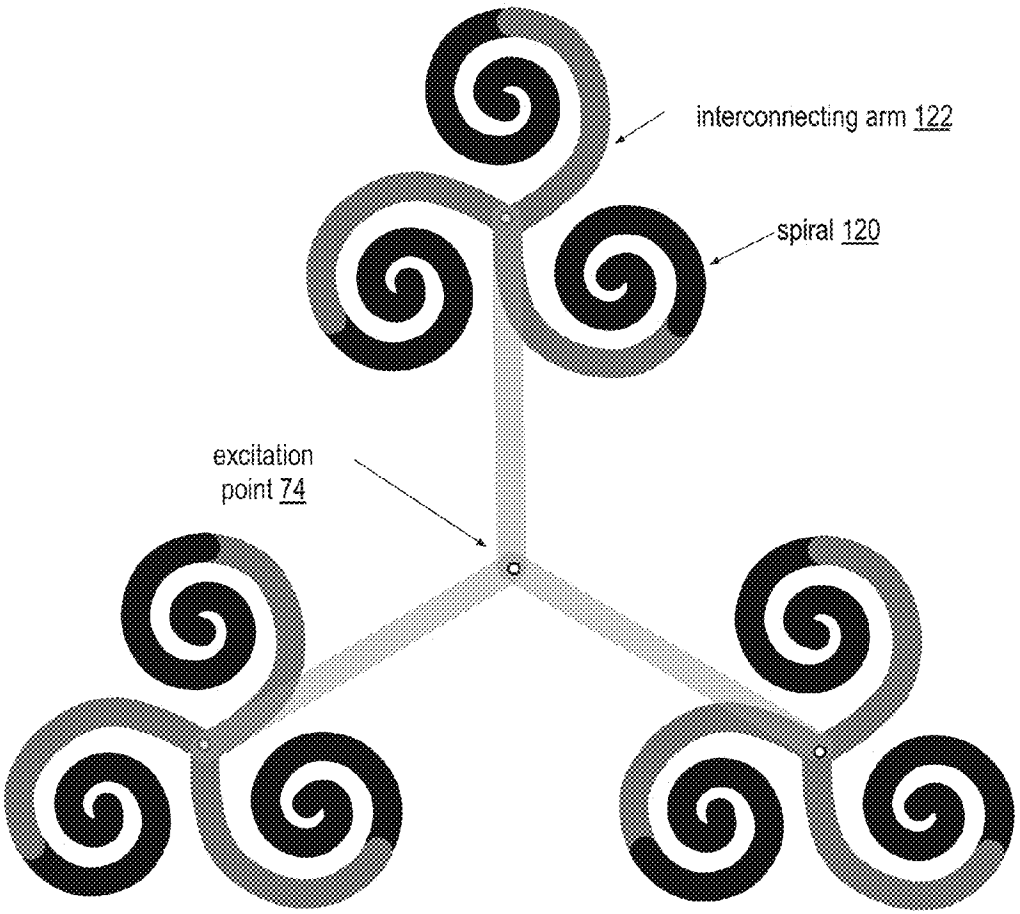
FIG. 60 is a diagram of another embodiment of a single excitation point antenna assembly that includes a plurality of spiral antennas in accordance with the present invention.

FIG. 60 is a diagram of another embodiment of a single excitation point antenna assembly that that may be used in one or more of the antennas assemblies of the wireless communication devices discussed with reference to one or more of FIGS. 1-4 and 35-36. The antenna assembly includes a plurality of interconnected spiral assemblies (three shown but could be more), a plurality of connection traces (three shown but could be more), and a common excitation point 74. An interconnected spiral assembly includes a plurality of spiral sections 120 (e.g., three or more) and a plurality of interconnecting arms 122. Each spiral section 120 of an interconnected spiral assembly includes a spiral shape that may be a portion of a Celtic spiral, a logarithmic Celtic spiral, and/or an Archimedean spiral.

Various properties of each of the spiral sections 120, the interconnecting arms 122, and the connection traces define the antenna assembly's operational characteristics. For instance, the dimensions of the excitation region 74 (e.g., establishes the upper cutoff region of the bandwidth) and the circumference of the spiral antennas (e.g., establishes the lower cutoff region of the bandwidth) define the bandwidth of the spiral antenna. The trace width, distance between traces, length of each spiral section 120, length of the interconnecting arms 122, length of the connection traces, distance to a ground plane, and/or use of an artificial magnetic conductor plane affect the quality factor, radiation pattern, impedance (which is fairly constant over the bandwidth), gain, and/or other characteristics of the antenna.

In an example of operation, an outbound RF signal is applied to the excitation point 74 of the antenna assembly. This generates an electric field and causes a current to flow through the connection traces to each of the interconnected antennas assemblies. Within an interconnected antenna assembly, current flows from the interconnecting arms 122 to the corresponding spiral antenna. The current generates a magnetic field such that, in combination with the electric field, the antenna assembly has a circular polarization, which may be inverted by changing the direction of current flow.

In another example of operation, each of the interconnected spiral assemblies receives an inbound RF signal as an electromagnetic signal, which induces a current to flow and produces a voltage within each of the interconnected spiral assemblies. The current flows, and the corresponding voltage propagates, through the spiral antennas, the interconnecting arms 122, and the connection traces to the common excitation point 74. The antenna assembly provides the inbound RF signal to the receiver section of a wireless communication device via the excitation point 74.

Figure 61:
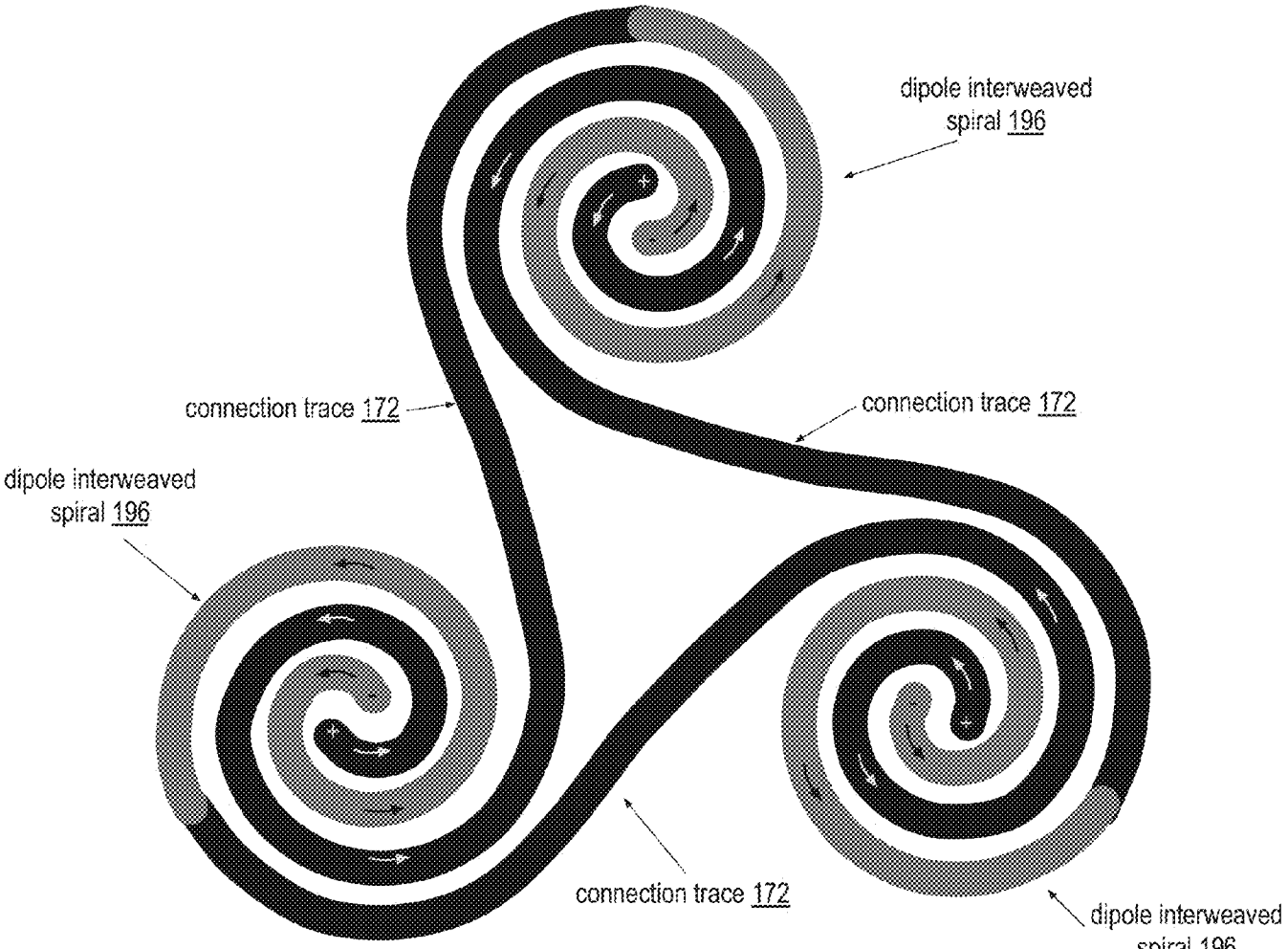
FIG. 61 is a diagram of another embodiment of an antenna assembly that includes a plurality of dipole interwoven spiral antennas in accordance with the present invention.

FIG. 61 is a diagram of another embodiment of an antenna assembly that may be used in one or more of the antennas assemblies of the wireless communication devices discussed with reference to one or more of FIGS. 1-4 and 35-36. The antenna assembly includes a plurality of dipole interwoven spiral antennas 196 (three shown, but could be more) and a plurality of connection traces 172 (three shown, but could be more). Each of the interwoven spiral antennas 196 includes a non-inverted spiral section, an inverted spiral section, a positive (+) excitation point, and a negative (−) excitation point. Collectively, the non-inverted spiral section and the inverted spiral section form a Celtic spiral, a logarithmic Celtic spiral, Archimedean spiral and/or some other spiral pattern. The excitation points are approximately located at the inner end of each of the inverted spiral and the non-inverted spiral.

Each interwoven spiral antenna 196 may be excited with the same phase of a signal or each may be excited with a different phase of a signal. When the antenna assembly is operable for different phases of a signal, it is operably coupled to a phase generation module that provides phase shifting of the antennas' excitation points. For instance, for an outbound RF signal, the phase generation module includes a plurality of transmit phase adjust modules (or like type components) to provide multiple phase representations of the outbound RF signal (e.g., 0°, 120°, and 240°). For an inbound RF signal, the phase generation module includes a plurality of receive phase adjust modules (or like type components) to provide multiple phase representations of the inbound RF signal (e.g., 0°, 120°, and 240°).

Various properties of the interwoven spiral antennas 196 and the connection traces 172 define the antenna assembly's operational characteristics. For instance, the dimensions of the excitation region (e.g., establishes the upper cutoff region of the bandwidth) and the circumference of the interwoven spiral antenna 196 (e.g., establishes the lower cutoff region of the bandwidth) define the bandwidth of the interwoven spiral antenna 196. The trace width, distance between traces, length of each spiral section, distance to a ground plane, trace width and length of each of the connection traces 172, and/or use of an artificial magnetic conductor plane affect the quality factor, radiation pattern, impedance (which is fairly constant over the bandwidth), gain, and/or other characteristics of the antenna assembly.

In an example of operation, the same differential outbound RF signal is applied to the excitation points (e.g., + an −) of each of the interwoven spiral antennas 196. The excitation of the interwoven spiral antennas 196 generates an electric field and causes a current to flow through the antenna assembly from the excitation point of each of the interwoven spiral antennas 196 to the connection traces 172. The current generates a magnetic field such that, in combination with the electric field, the antenna assembly has a circular polarization.

In another example of operation, different phases of a differential outbound RF signal are applied to the excitation points of each of the interwoven spiral antennas 196. For instance, a first interwoven spiral antenna 196 receives a 0° phase shifted representation of the outbound RF signal; a second interwoven spiral antenna 196 receives a 120° phase shifted representation of the outbound RF signal; and a third interwoven spiral antenna 196 receives a 240° phase shifted representation of the outbound RF signal. The phase shifted excitation of the interwoven spiral antennas 196 generates an electric field and causes a current to flow through the antenna assembly from the excitation point of each of the interwoven spiral antennas to the connection traces 172. The current generates a magnetic field such that, in combination with the electric field, the antenna assembly has a circular polarization, which may be inverted by changing the direction of current flow. For instance, the polarity of the excitation points may be reversed.

In yet another example of operation, the antenna assembly receives an inbound RF signal as an electromagnetic signal, which induces a current to flow and produces a voltage within the antenna assembly. The phase generation module is coupled to the excitation points of the interwoven spiral antennas 196 and provides phase shifted representations of the inbound RF signal to receiver section of a wireless communication device. For instance, the phase generator provides a 0° phase shifted representation of the inbound RF signal from a first interwoven spiral antenna 196; provides a 120° phase shifted representation of the inbound RF signal from a second interwoven spiral antenna 196; and provides a 240° phase shifted representation of the inbound RF signal from a third interwoven spiral antenna 196.

Figure 62:
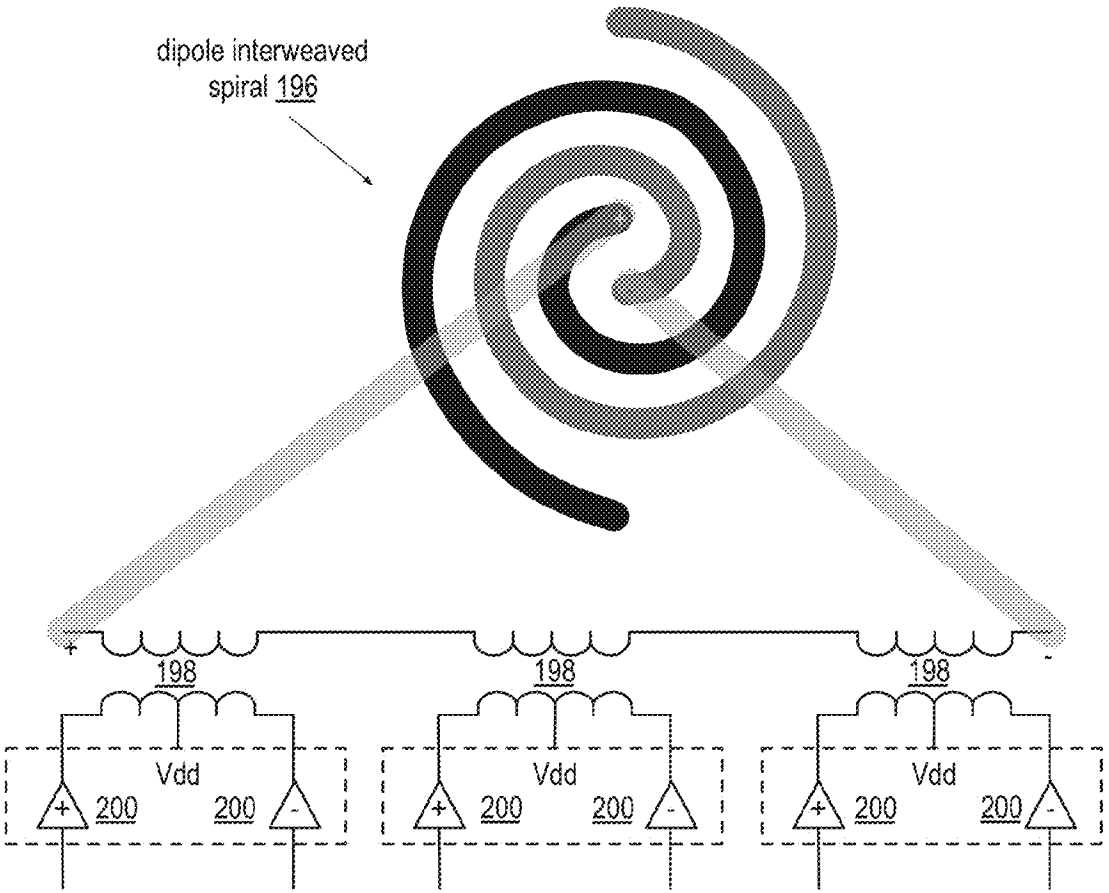
FIG. 62 is a schematic block diagram of an embodiment of circuitry coupled to a dipole interwoven spiral antenna in accordance with the present invention.

FIG. 62 is a schematic block diagram of an embodiment of circuitry coupled to a dipole interwoven spiral antenna 196. The circuitry includes a plurality of transformers 198 and a plurality of amplifiers 200. Each transformer 198 includes a primary winding with a center tap and a secondary winding. One leg of the primary winding is coupled to an amplifier 200 that amplifies a positive leg of a differential signal, the center tap is coupled to a reference voltage (e.g., Vdd), and the other leg is coupled to an amplifier 200 that amplifies a negative leg of the differential signal. The secondary windings of the transformers 198 are coupled in series and the series combination is coupled to the excitation points of the interwoven spiral antenna 196.

In an example of operation, a differential outbound RF signal is amplified by the amplifiers 200, which drive their corresponding transformers 198. Depending on the turns ratio of the transformers 198 (e.g., one-to-one, or greater than one-to-one), each transformer 198 generates a representation of the amplified outbound RF signal at its secondary winding. The representation of the amplified outbound RF signals are added together due to the series connection and applied to the excitation points of the interwoven spiral antenna 196. In this manner, a relatively small magnitude outbound RF signal (e.g., less than a few volts) may be converted to a higher magnitude outbound RF signal (e.g., greater than 5 volts) using CMOS power amplifiers on chip. Note that more or less than three transformers 198 and associated amplifiers 200 may be used to drive the interwoven spiral antenna 196. Further note that each interwoven spiral antenna 196 of an antenna assembly may be coupled to its own drive circuitry (e.g., transformer 198 and associated amplifiers 200).

Figure 63:
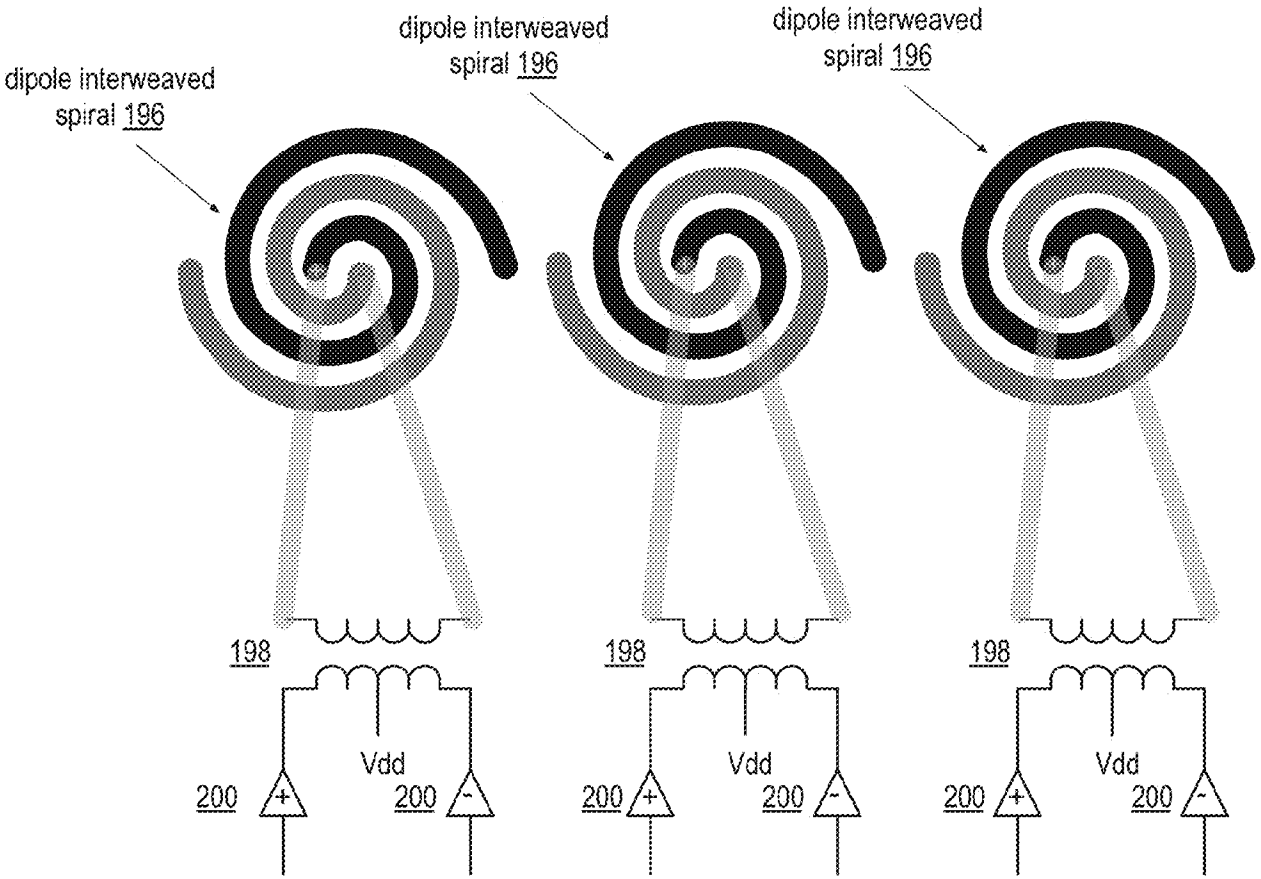
FIG. 63 is a schematic block diagram of an embodiment of circuitry coupled to multiple dipole interwoven spiral antennas in accordance with the present invention.

FIG. 63 is a schematic block diagram of an embodiment of circuits coupled to multiple dipole interwoven spiral antennas 196. Each circuit includes a transformer 198 and a pair of amplifiers 200. Each transformer 198 includes a primary winding with a center tap and a secondary winding. One leg of the primary winding is coupled to an amplifier 200 that amplifies a positive leg of a differential signal, the center tap is coupled to a reference voltage (e.g., Vdd), and the other leg is coupled to an amplifier 200 that amplifies a negative leg of the differential signal. The secondary winding is coupled to the excitation points of the associated interwoven spiral antenna 196.

In an example of operation, a differential outbound RF signal is amplified by the amplifiers 200, which drive their corresponding transformers 198. Depending on the turns ratio of the transformers 198 (e.g., one-to-one, or greater than one-to-one), each transformer generates a representation of the amplified outbound RF signal at its secondary winding, which is applied to the excitation points of the associated interwoven spiral antenna 196. In this manner, a relatively small magnitude outbound RF signal (e.g., less than a few volts) may be converted to a higher magnitude outbound RF signal (e.g., greater than a few volts) using CMOS power amplifiers on chip.

Figure 64:
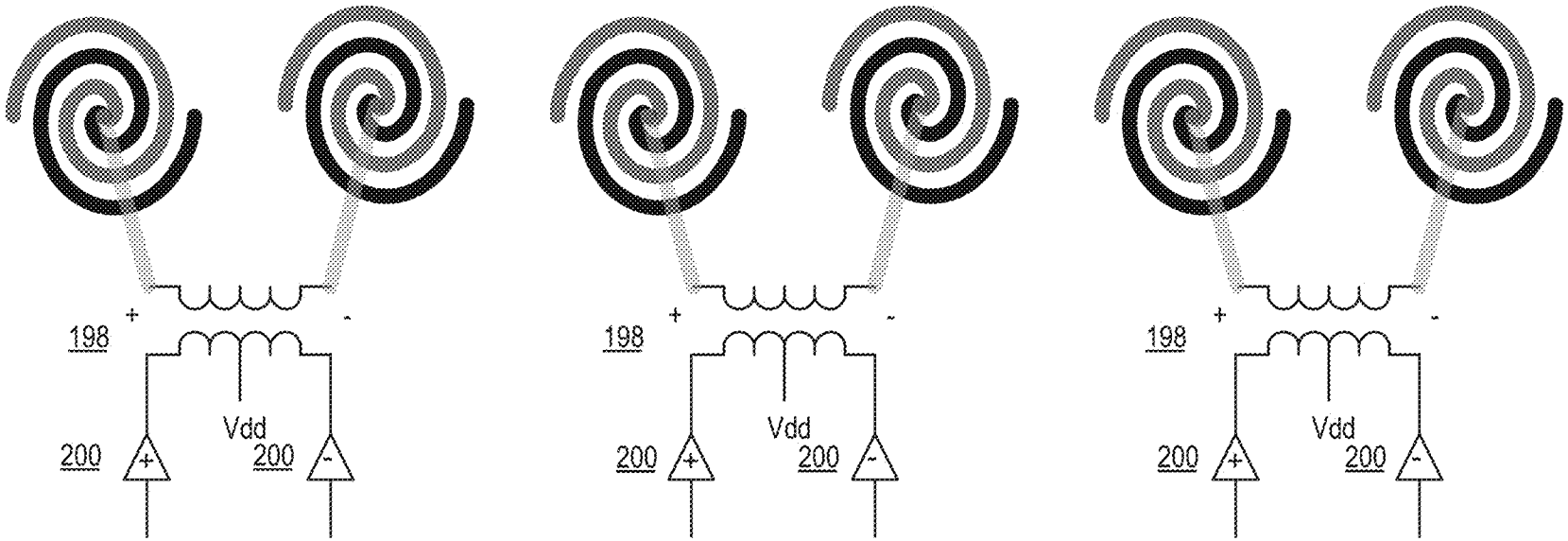
FIG. 64 is a schematic block diagram of another embodiment of circuitry coupled to multiple dipole interwoven spiral antennas in accordance with the present invention.

FIG. 64 is a schematic block diagram of another embodiment of circuits coupled to multiple dipole antennas. Each dipole antenna includes a positive interwoven spiral antenna and a negative interwoven spiral antenna, where an inverted and a non-inverted spiral sections of each interwoven spiral antenna are coupled together at the center of the interwoven spiral antenna to provide an excitation point. Each circuit includes a transformer 198 and a pair of amplifiers 200. Each transformer 198 includes a primary winding with a center tap and a secondary winding. One leg of the primary winding is coupled to an amplifier 200 that amplifies a positive leg of a differential signal, the center tap is coupled to a reference voltage (e.g., Vdd), and the other leg is coupled to an amplifier 200 that amplifies a negative leg of the differential signal. The secondary winding is coupled to the excitation points of the associated interwoven spiral antenna.

In an example of operation, a differential outbound RF signal (e.g., the same phase or different phases) is amplified by the amplifiers 200, which drive their corresponding transformers 198. Depending on the turns ratio of the transformers 198 (e.g., one-to-one, or greater than one-to-one), each transformer 198 generates a representation of the amplified outbound RF signal at its secondary winding, which is applied to the excitation points of the positive and negative interwoven spiral antennas. In this manner, a relatively small magnitude outbound RF signal (e.g., less than a few volts) may be converted to a higher magnitude outbound RF signal (e.g., greater than a few volts) using CMOS power amplifiers on chip.

Figure 65:
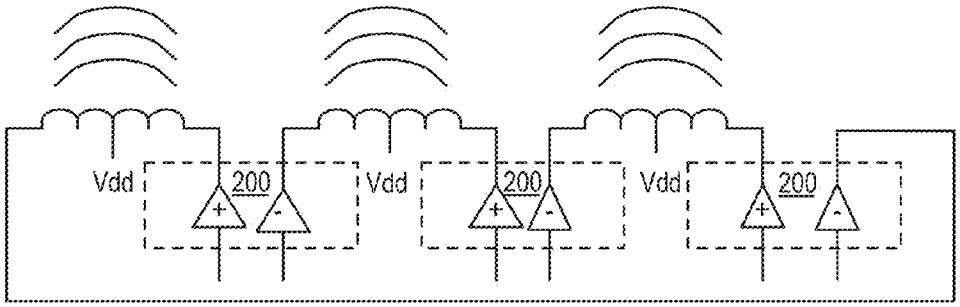
FIG. 65 is a schematic block diagram of another embodiment of circuitry coupled to poly interwoven spiral antennas in accordance with the present invention.

FIG. 65 is a schematic block diagram of another embodiment of circuits coupled to an antenna assembly that includes multiple antennas and connection traces. Each antenna includes a positive excitation point, a negative excitation point, and a center tap. Each circuit includes a pair of amplifiers 200 operable to amplify a differential signal. The antennas are interconnected as shown.

In an example of operation, a differential outbound RF signal (e.g., the same phase or different phases) is amplified by the amplifiers 200, which drive one leg of one antenna and another leg of another antenna. In this manner, the antennas are effectively coupled in series such that their electromagnetic fields are added to increase transmit power. As such, a relatively small magnitude outbound RF signal (e.g., less than a few volts) may be converted to a higher magnitude outbound RF signal (e.g., greater than a few volts) using CMOS power amplifiers on chip.

Figure 66:
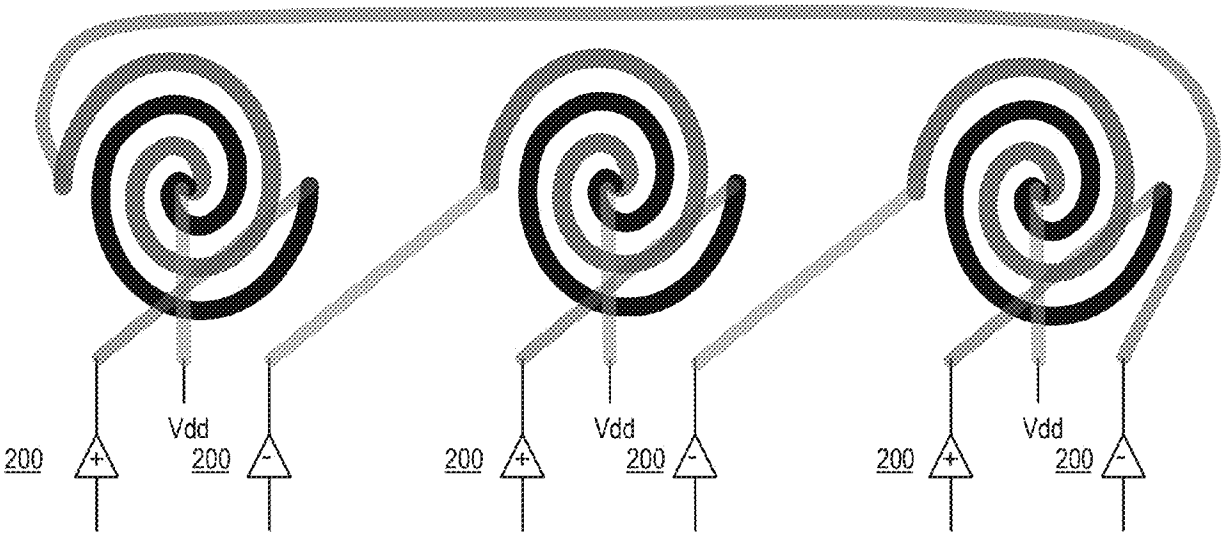
FIG. 66 is a schematic block diagram of another embodiment of circuitry coupled to poly interwoven spiral antennas in accordance with the present invention.

FIG. 66 is a schematic block diagram of another embodiment of circuits coupled to an antenna assembly that includes poly interwoven spiral antennas and connection traces. Each interwoven spiral antenna includes an inverted spiral and a non-inverted spiral, which are coupled together at the center of the interwoven spiral antenna to provide a center tap. The outer end of the inverted spiral section includes a positive excitation point and the outer end of the non-inverted spiral section includes a negative excitation point. Each circuit includes a pair of amplifiers 200 operable to amplify a differential signal. Note that the connection traces may be one or more other layers of the substrate supporting the antenna assembly, may be part of the transmission line coupled to the antenna assembly, and/or may be a transmission line.

In an example of operation, a differential outbound RF signal (e.g., the same phase or different phases) is amplified by the amplifiers 200, which drive one leg of one antenna and another leg of another antenna. In this manner, the antennas are effectively coupled in series such that their electromagnetic fields are added to increase transmit power. As such, a relatively small magnitude outbound RF signal (e.g., less than a few volts) may be converted to a higher magnitude outbound RF signal (e.g., greater than a few volts) using CMOS power amplifiers on chip.

Figure 67:
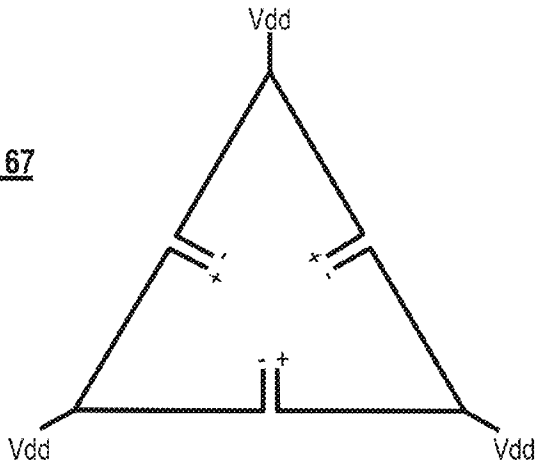
FIG. 67 is a schematic block diagram of another embodiment of an antenna assembly that includes multiple dipole interwoven spiral antennas in accordance with the present invention.

FIG. 67 is a schematic block diagram of another embodiment of an antenna assembly that includes multiple dipole antennas. As shown, the end of a positive antenna section of one dipole antenna is coupled to the end of a negative antenna section of another dipole antenna and to a voltage reference. The length of each positive and negative section may be one-quarter wavelength or one-half wavelength.

In an example of operation, a differential outbound RF signal (e.g., the same phase or different phases) is applied (e.g., through a differential power amplifier or a pair of amplifiers) to the positive and negative excitation points of each of the dipole antennas, which causes a current to flow and generates a voltage waveform. Assuming that the voltage reference is a supply voltage, the current through each positive and negative antenna section flows from the voltage reference to the excitation points, which creates a corresponding magmatic field and an electric field in accordance with the voltage waveform. In this manner, the antennas are effectively coupled in parallel to transmit outbound signals and to receive inbound signals.

Figure 68:
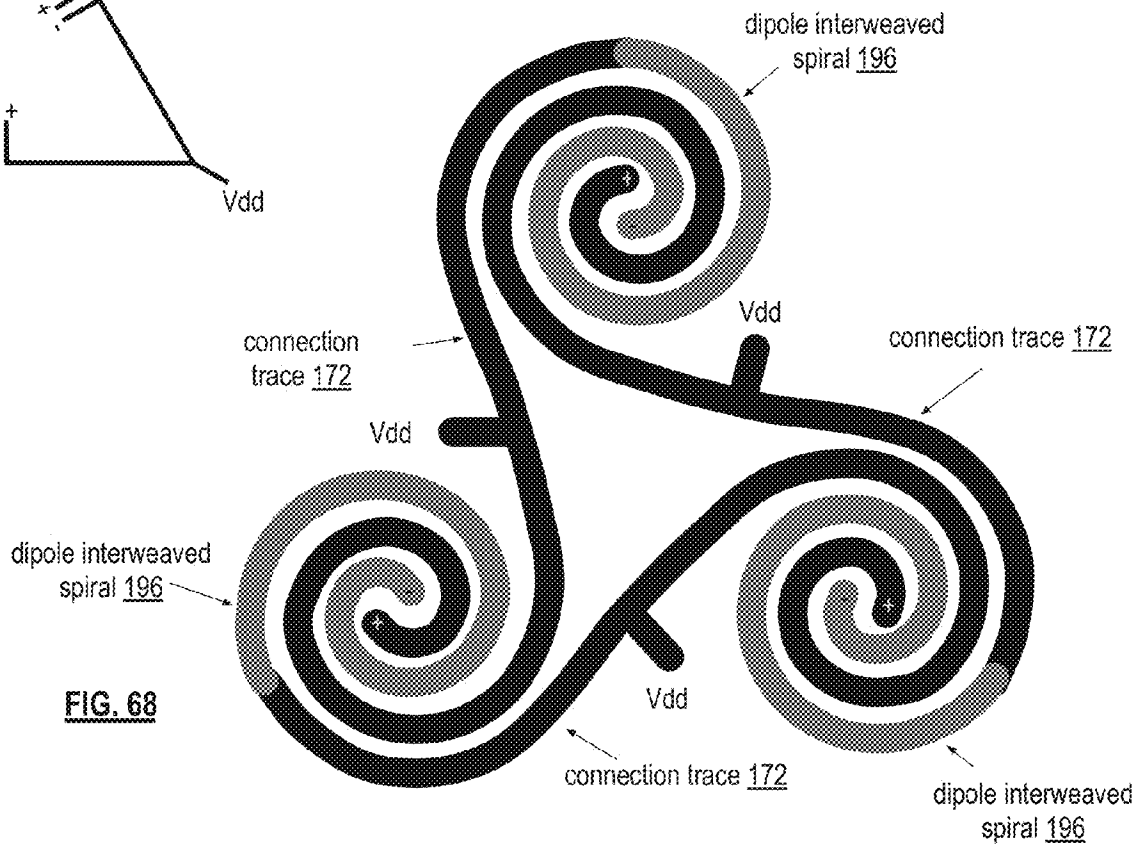
FIG. 68 is a diagram of another embodiment of an antenna assembly that includes multiple dipole interwoven spiral antennas in accordance with the present invention.

FIG. 68 is a diagram of another embodiment of an antenna assembly that includes multiple dipole interwoven spiral antennas 196 and connection traces 172. Each interwoven spiral antenna 196 includes an inverted spiral and a non-inverted spiral that provide the positive and negative sections of a dipole antenna. The length of each inverted spiral and non-inverted spiral section may be one-quarter wavelength or one-half wavelength.

In an example of operation, a differential outbound RF signal (e.g., the same phase or different phases) is applied (e.g., through a differential power amplifier or a pair of amplifiers) to the inverted and non-inverted excitation points of each of the dipole interwoven spiral antennas 196, which causes a current to flow and generates a voltage waveform. Assuming that the voltage reference is a supply voltage, the current through each inverted and non-inverted antenna section flows from the voltage reference to the excitation points, which creates a corresponding magmatic field and an electric field in accordance with the voltage waveform. In this manner, the antennas are effectively coupled in parallel to transmit outbound signals and to receive inbound signals.

Figure 69:
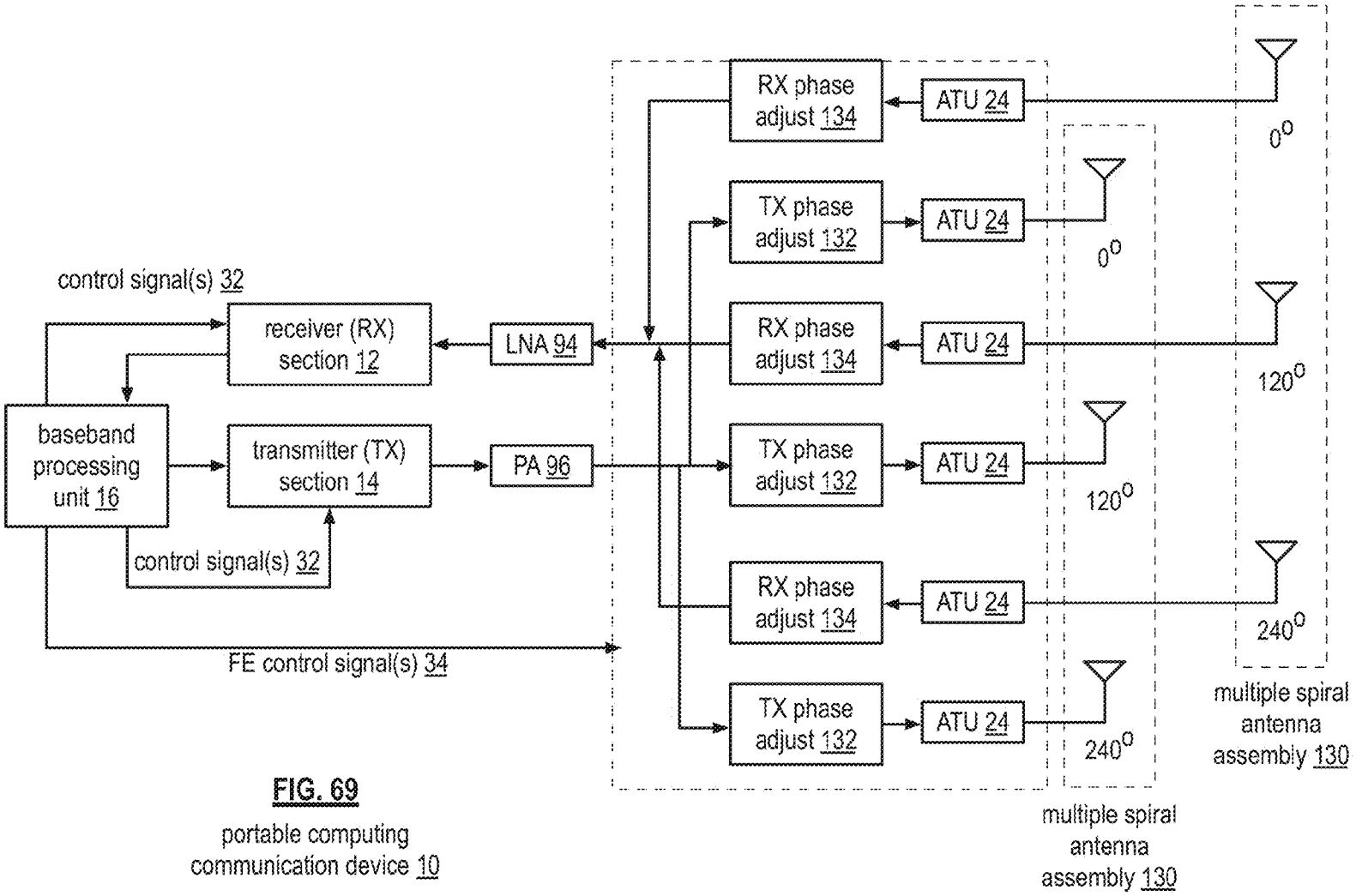
FIG. 69 is a schematic block diagram of another embodiment of a wireless communication device in accordance with the present invention.

FIG. 69 is a schematic block diagram of another embodiment of a wireless communication device 10 that includes a receiver section 12, a transmitter section 14, a baseband processing module 16, a power management unit (optional and not shown), a power amplifier (PA) 96 (which may be part of the transmit section), a low noise amplifier 94 (which may be part of the receive section), a front end module, a transmit antenna assembly, and a receive antenna assembly. The wireless communication device 10 may be any device that can be carried by a person, can be at least partially powered by a battery, includes a radio transceiver (e.g., radio frequency (RF) and/or millimeter wave (MMW)) and performs one or more software applications. For example, the wireless communication device 10 may be a cellular telephone, a laptop computer, a personal digital assistant, a video game console, a video game player, a personal entertainment unit, a tablet computer, etc.

The wireless communication device 10 may support 2G (second generation) cellular telephone service, 3G or 4G (third generation or fourth generation) cellular telephone service, and a wireless local area network (WLAN) service simultaneously or sequentially. The wireless communication device 10 may further support one or more wireless communication standards (e.g., IEEE 802.11, Bluetooth, global system for mobile communications (GSM), code division multiple access (CDMA), radio frequency identification (RFID), Enhanced Data rates for GSM Evolution (EDGE), General Packet Radio Service (GPRS), WCDMA, high-speed downlink packet access (HSDPA), high-speed uplink packet access (HSUPA), LTE (Long Term Evolution), WiMAX (worldwide interoperability for microwave access), and/or variations thereof).

The front end antenna interface module includes a plurality of antenna tuning units (ATU) 24, a plurality of transmit phase adjust modules 132, and a plurality of receive adjust phase modules 134. Each of the antenna assemblies includes a plurality of interwoven spiral antennas 130 that are coupled together via one or more connection traces. While 3 sets of circuitry is shown in the front-end module and the antenna assemblies, the wireless communication device 10 may include more than three sets of circuitry. Each of the receiver section 12 and transmitter section 14 may have a direct conversion topology or a super-heterodyne topology.

In an example embodiment, the receiver section 12, the LNA 94, the transmitter section 14, the baseband processing unit 16 and the power management unit (if included) are implemented as a system on a chip (SOC). The power amplifier 96, the transmit phase adjust modules 132, the receive phase adjust modules 134, and the ATUs 24 may be implemented on a separate IC.

In an example of operation, the baseband processing unit 16, or module, performs one or more functions of the wireless communication device 10 regarding transmission of data. In this instance, the processing module receives outbound data (e.g., voice, text, audio, video, graphics, etc.) and converts it into one or more outbound symbol streams in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.).

The baseband processing unit 16 provides the one or more outbound symbol streams to the transmitter section 14 and provides front end (FE) control signals 34 to the front end module. The transmitter section 14 converts the outbound symbol stream(s) into one or more pre-PA outbound RF signals (e.g., signals in one or more frequency bands 800 MHz, 1800 MHz, 1900 MHz, 2000 MHz, 2.4 GHz, 5 GHz, 60 GHz, etc.).

The transmitter section 14 outputs the pre-PA outbound RF signal(s) to a power amplifier module (PA) 96. The PA 96 includes one or more power amplifiers coupled in series and/or in parallel to amplify the pre-PA outbound RF signal(s) to produce an outbound RF signal(s). Note that parameters (e.g., gain, linearity, bandwidth, efficiency, noise, output dynamic range, slew rate, rise rate, settling time, overshoot, stability factor, etc.) of the PA 96 may be adjusted based on control signals 32 received from the baseband processing unit 16 and/or another processing module of the wireless communication device 10. The PA 96 outputs the outbound RF signal(s) to the transmit phase adjust modules 132.

Each of the transmit phase adjust modules 132 adds a phase shift to the outbound RF signal(s). For instance, a first transmit phase adjust module 132 adds a 0° phase shift, a second transmit phase adjust module 132 adds a 120° phase shift, and a third transmit phase adjust module 132 adds a 0° phase shift (e.g., $A(t)\cos(\omega_{RF}(t)+\phi(t))+0°$), $A(t)\cos(\omega_{RF}(t)+\phi(t))+120°$), and $A(t)\cos(\omega_{RF}(t)+\phi(t))+240°$)). To achieve the phase shift, each of the transmit phase adjust modules 132 includes one or more of a programmable delay line, a programmable RF mixing module, etc. The baseband processing module 16 generates one or more control signals 32 to program the phase shift amount for at least some of the transmit phase adjust modules 132.

Each of the antenna tuning units (ATUs) 24 is tuned to provide a desired impedance that substantially matches that of the corresponding antenna of the antenna assembly 130. As tuned, the ATU 24 provides the amplified TX signal to the antenna for transmission. Note that the ATU 24 may be continually or periodically adjusted to track impedance changes of the corresponding antenna. For example, the baseband processing unit 16 and/or the processing module may detect a change in the impedance of the corresponding antenna and, based on the detected change, provide control signals 32 to the ATU 24 such that it changes it impedance accordingly.

Each of the antennas transmits the corresponding outbound RF signal it receives from the corresponding ATU 24. With each antenna being part of the antenna assembly 130, having an interwoven spiral pattern, and interconnected to each other, the antenna assembly 130 provides a focus radiation pattern for transmitting the outbound RF signals.

The receive antenna assembly 130 receives one or more inbound RF signals, which are provided to the corresponding ATUs 24. Each of the ATUs 24 provides the inbound RF signal(s) to the corresponding the corresponding receive phase adjust modules 134. Each of the receive phase adjust modules 134 subtracts a phase shift from the received inbound RF signal. For instance, a first receive phase shift module 134 subtracts a 0° phase shift, a second receive phase shift module 134 subtracts a 120° phase shift, and a third receive phase shift module 134 subtracts a 240° phase shift. To achieve the phase shift, each of the receive phase adjust modules 134 includes one or more of a programmable delay line, a programmable RF mixing module, etc. The baseband processing module 16 generates one or more control signals 32 to program the phase shift amount for at least some of the receive phase adjust modules 134.

Each of the receive phase adjust modules 134 provides its respective inbound RF signal to the receiver section 12, which combines the inbound RF signals or selects one of them. The receiver section 12 converts the combined or selected inbound RF signal into one or more inbound symbol streams. The baseband processing unit 16 converts the inbound symbol stream(s) into inbound data (e.g., voice, text, audio, video, graphics, etc.) in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.).

Figure 70:
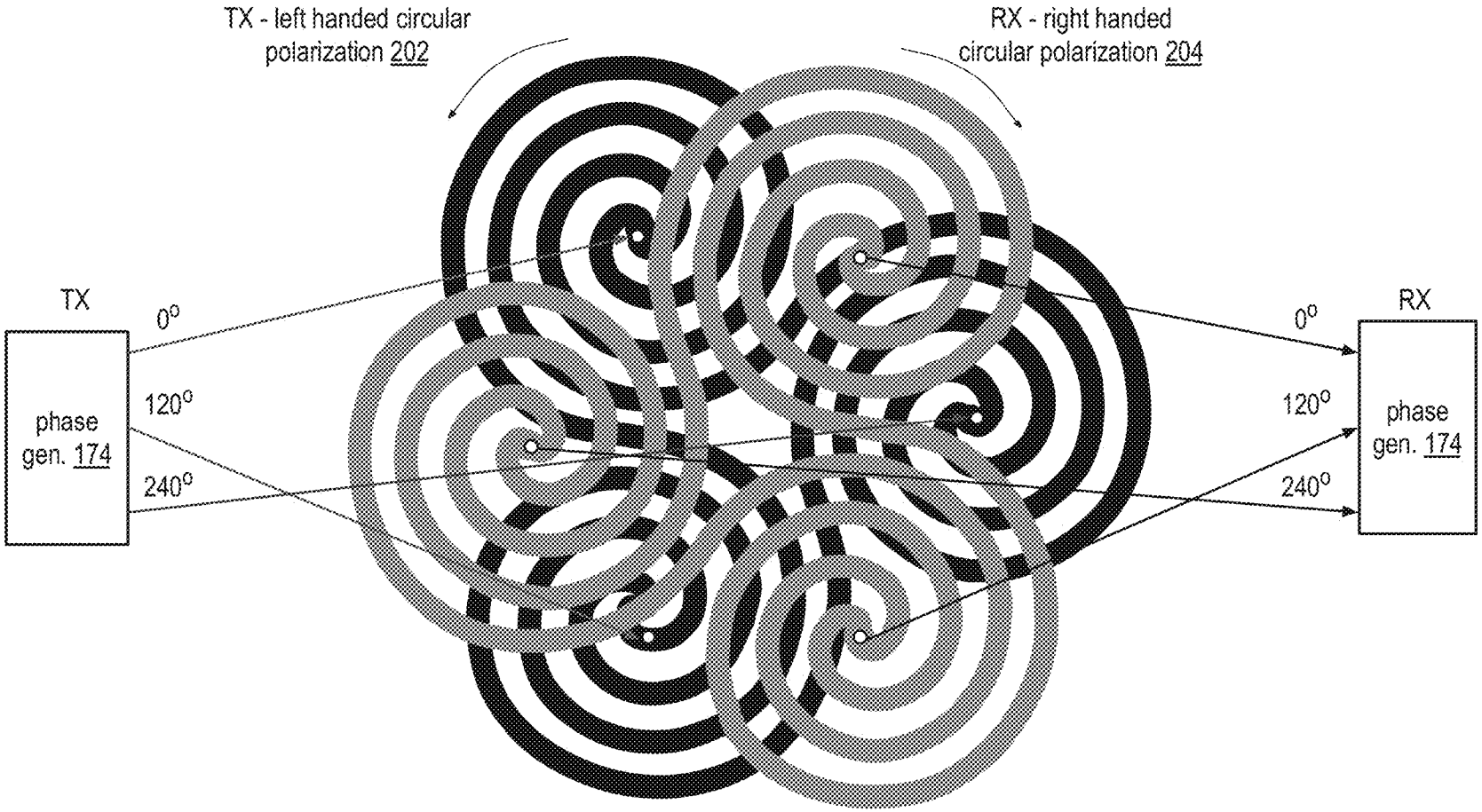
FIG. 70 is a diagram of an embodiment of transmit and receive antenna assemblies, each of which includes multiple dipole interwoven spiral antennas in accordance with the present invention.

FIG. 70 is a diagram of an embodiment of a transmit antenna assembly and receive antenna assembly that may be used in the wireless communication device of FIG. 69. Each antenna assembly includes poly interwoven spiral antennas that may be configured and operate as discussed with reference to FIGS. 39-44, FIG. 45, FIGS. 46-47, FIGS. 48-49, FIGS. 50-51, FIGS. 52-53, FIG. 58, FIG. 59, FIG. 61, FIG. 63, FIG. 64, FIGS. 65-66, and/or FIGS. 67-68.

The receive antenna assembly may be implemented on one layer of a substrate and the transmit antenna assembly may be implemented on another layer of the substrate. In the present example, the receive antenna assembly is on an outer layer of the substrate with respect to the layer supporting the transmit antenna assembly. Further, from a major surface perspective, the transmit antenna assembly is a minor image of the receive antenna assembly and substantially overlapped by the receive antenna assembly. In this manner, the transmit antenna assembly may have a left handed circular polarization 202 and the receive antenna assembly may have a right handed circular polarization 204. Note that such a configuration provides a favorable return loss and gain for frequencies within the bandwidth of the antenna in comparison to a conventional dipole antenna.

Figure 71:
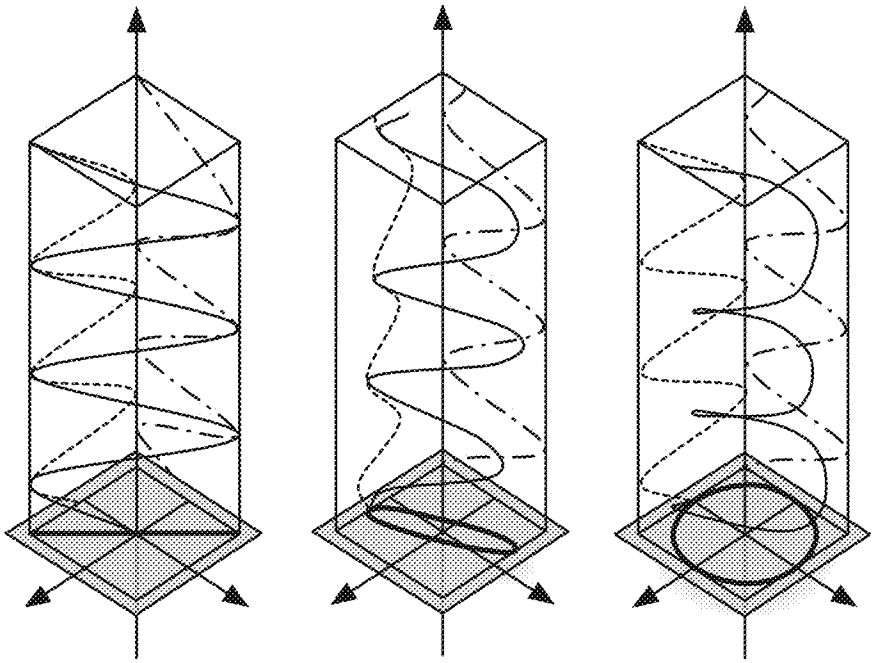
FIG. 71 is a diagram of an example of various radiation representations of poly interwoven spiral antennas having various excitation signals in accordance with the present invention.
Figure 73:
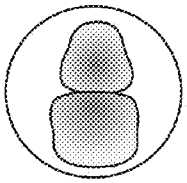
FIGS. 73-82 are diagrams of other examples of various radiation representations of poly interwoven spiral antennas having various excitation signals in accordance with the present invention.
Figure 74:
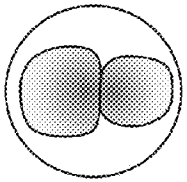
Figure 75:
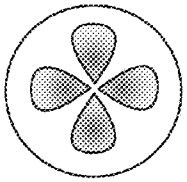
Figure 76:
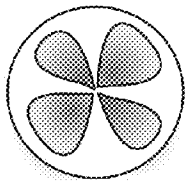
Figure 77:
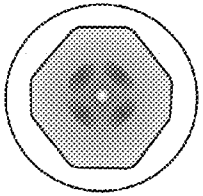
Figure 78:
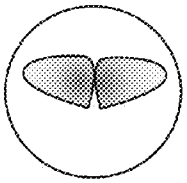
Figure 79:
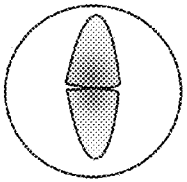
Figure 80:
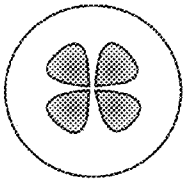
Figure 81:
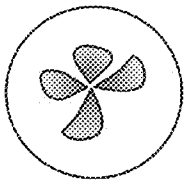
Figure 82:
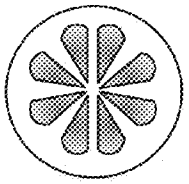

FIG. 71 illustrates a graphical representation several polarization states (e.g., linear polarization, elliptical polarization, and circular polarization) that may be used in a variety of combinations by a poly interwoven spiral antenna (e.g., two or more interwoven spirals) to produce one or more of a plurality of polarization patterns (e.g., up to an infinite number of patterns). With the ability to create a plurality of polarization states using a poly interwoven spiral antenna, a wireless communication device may improve MIMO performance, improve diversity performance, and/or utilize a polarization-based coding scheme (which will be described in greater detail with reference to FIGS. 72-82 and 91-93).

With respect to improved MIMO performance and/or diversity performance, a wireless communication device using a poly interwoven spiral antenna can create polarization states (e.g., linear vertical, linear horizontal, right-hand circular polarization, left-hand circular) that are orthogonal to each other. This allows for uncorrelated receiving and transmitting modes that maximize the diversity gain of the wireless communication device. For example, a wireless communication device using N poly interwoven spiral antennas can attain a substantially equivalent performance as wireless communication device using an array of M conventional antennas, where M>N. Thus, the poly interwoven spiral antenna is more compact, is less expensive, and consumes less power than conventional antennas.

Figure 72:
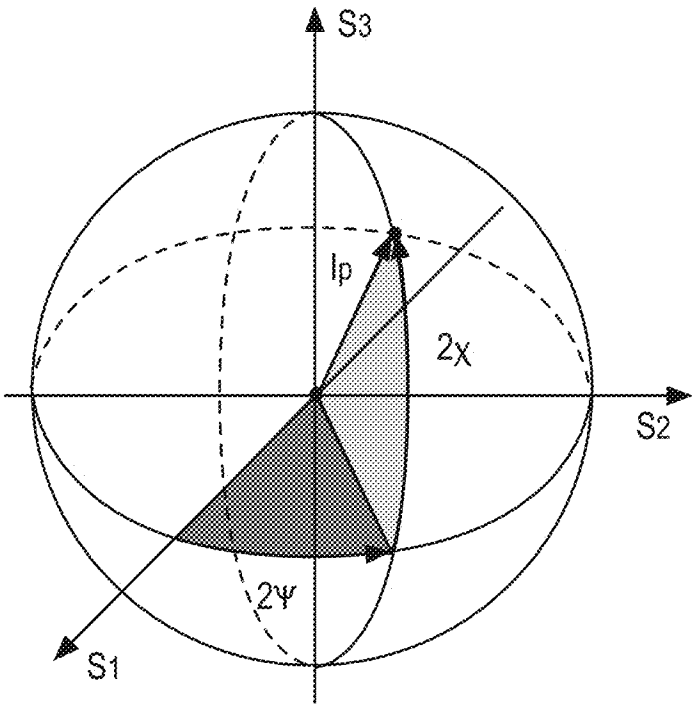
FIG. 72 is a diagram of example of a Poincare sphere in accordance with the present invention.

FIG. 72 illustrates a Poincare sphere that provides a coordinate system of (Ip, $2\chi$, $2\Psi$), which may be the basis to create various signals to excite a poly interwoven spiral antenna to produce a various polarization states. For instance, a signal may be represented as $Ip(t)*\cos((\omega_{RF}(t)+2\chi(t)+2\Psi(t)$. As such, by varying Ip(t), $2\chi(t)$, and/or $2\Psi(t)$ different polarization states can be achieved, varying from a linear polarization on the surface of the antenna assembly (as shown in the left diagram of FIG. 71), elliptical polarization at the surface of the antenna assembly (as shown in the middle diagram of FIG. 71), and/or circular polarization at the surface of the antenna assembly (as shown in the right diagram of FIG. 71). In the present FIG. 72, each polarization state corresponds to a different symbol of a constellation map that corresponds to a data value.

FIGS. 73-82 are diagrams of examples of various polarization states of a poly interwoven spiral antenna having various excitation signals that are express as Poincare sphere coordinates. Note that other coordinate systems (e.g., Cartesian, polar, etc.) may be used to express signals for radiation pattern encoded. Further note that more than three antennas may be used in the antenna assembly to achieve a greater variety of antenna patterns.

In the present FIGS. 73-82, each polarization state corresponds to a different symbol of a constellation map that corresponds to a data value. For instance, the first symbol-radiation pattern of FIG. 73 may be achieved by providing a first set of coefficients to three signals driving the three interwoven spirals of an antenna assembly. In particular, the first signal may be expressed as $Ip_1(t)*\cos((\omega_{RF}(t)+2\chi_1(t)+2\Psi_1(t))$, the second signal as $Ip_2(t)*\cos((\omega_{RF}(t)+2\chi_2(t)+2\Psi_2(t))$, and the third signal as $Ip_3(t)*\cos((\omega_{RF}(t)+2\chi_3(t)+2\Psi_3(t)$. The combination of $Ip_1$, $2\chi_1$, $2\Psi_1$; $Ip_2$, $2\chi_2$, $2\Psi_2$; and $Ip_3$, $2\chi_3$, $2\Psi_3$ map to a particular symbol in a constellation map. Another combination of $Ip_1$, $2\chi_1$, $2\Psi_1$; $Ip_2$, $2\chi_2$, $2\Psi_2$; and $Ip_3$, $2\chi_3$, $2\Psi_3$ maps to another symbol in the constellation map; and so on.

In addition to polarization coding or as an alternative coding scheme, a wireless communication device may use radiation pattern coding of a poly interwoven spiral antenna. For example, by using different combinations of enabling interwoven spiral antennas of the poly interwoven spiral antenna, various radiation patterns can be produced. Specific examples are shown in FIGS. 83-90, where various radiation patterns are produced based on various enabling patterns of the poly interwoven spiral antenna. For example, by providing a signal to only a first antenna of the antenna assembly, the antenna assembly produces a first radiation pattern (see FIG. 83). Similarly, by providing a single to only one of the antennas of the antenna assembly, other radiation patterns are produced (see FIGS. 84 and 85).

Figure 90:
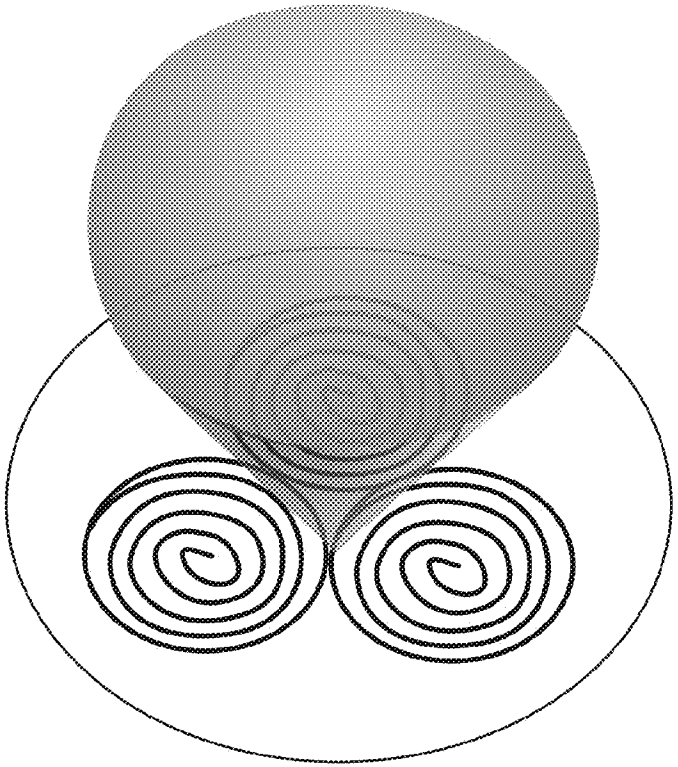
Figure 89:
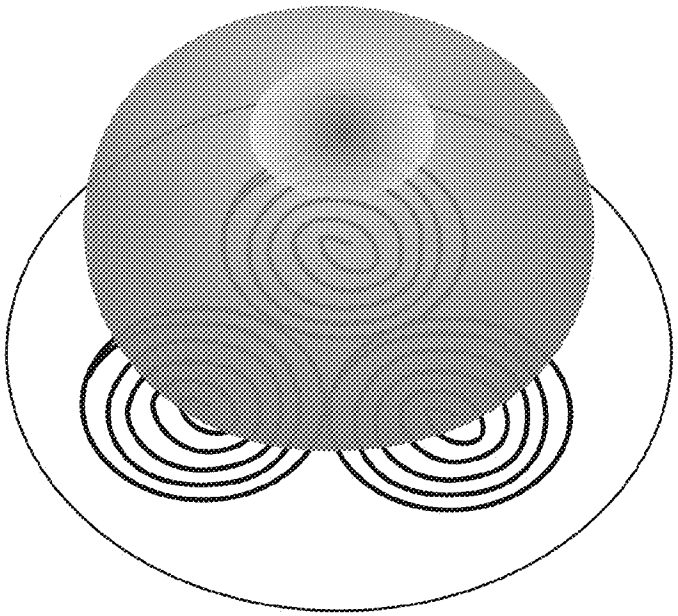

By providing the same phase signal to two of the three antennas, further radiation patterns are produced (see FIGS. 86-88). By providing the same phase signal to all three antennas, the radiation pattern of FIG. 89 is produced. By providing different phased signals to the three antennas, the radiation pattern of FIG. 90 is produced. Thus, with a three antennas, three bits of data may be represented by the various radiation patterns. Note that the poly interwoven spiral antennas may include more than three antennas to expand the number of bits that may be represented by the various radiation patterns.

Figure 91:
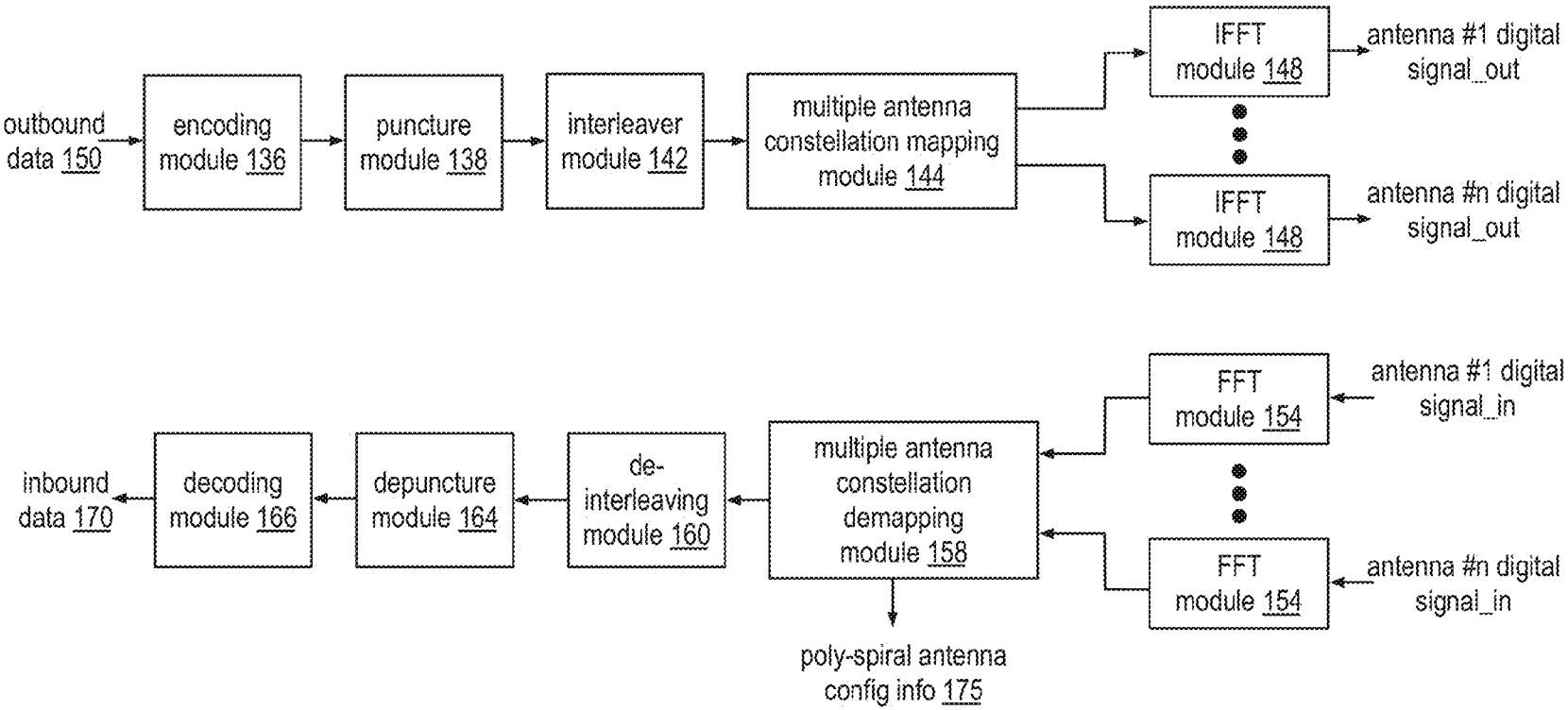
FIG. 91 is a schematic block diagram of an embodiment of baseband processing for a wireless communication device using a polarization and/or radiation pattern coding scheme in accordance with the present invention.

FIG. 91 is a schematic block diagram of an embodiment of baseband processing module 16 for a wireless communication device that is capable of encoded data using an antenna polarization coding scheme and/or an antenna radiation coding scheme. The baseband module includes a transmitter section and a receiver section. The transmitter section of the baseband processing module 16 includes an encoding module 136, a puncture module 138, an interleaver module 142, a multiple antenna constellation mapping module 144, and a plurality of inverse fast Fourier transform (IIFT) modules 148. The receiver section of the baseband processing module 16 includes a plurality of fast Fourier transform (FFT) modules 154, a multiple antenna constellation demapping module 158, a de-interleaving module 160, a depuncture module 164, and a decoding module 166.

In an example of operation of the polarization coding scheme, which may be referred to as a direct polarization antenna modulation or a polarization-coded modulation, the encoding module 136 is operably coupled to convert outbound data 150 into encoded data in accordance with one or more wireless communication standards. The puncture module 138 punctures the encoded data to produce punctured encoded data. The interleaver module 142 is operably coupled to interleave the punctured encoded data into an interleaved stream of data. The multiple antenna constellation mapping module 144 maps the interleaved stream of data into a stream of data symbols that corresponds to polarization states (e.g., one of the ones shown in FIGS. 73-82), where each data symbol is represented by a set of signals having coefficients based on a particular coordinate system (e.g., a particular transmit polarization state). For example, the multiple antenna constellation mapping module 144 maps a given set of interleaved data bits into a set of Poincare coefficients (e.g., $Ip_1$, $2\chi_1$, $2\Psi_1$; $Ip_2$, $2\chi_2$, $2\Psi_2$; and $Ip_3$, $2\chi_3$, $2\Psi_3$) and produces multiple signals in accordance with the coefficients ($Ip_1(t)*\cos((\omega_{RF}(t)+2\chi_1(t)+2\Psi_1(t))$, $Ip_2(t)*\cos((\omega_{RF}(t)+2\chi_2(t)+2\Psi_2(t))$, $Ip_3(t)*\cos((\omega_{RF}(t)+2\chi_3(t)+2\Psi_3(t))$); one signal for each antenna of the poly interwoven spiral antenna.

The plurality of IFFT modules 148 is operably coupled to convert the plurality of multiple antenna encoded signals into a plurality of outbound symbol streams. An RF transmit section (e.g., as shown in FIG. 98 or in FIG. 99) converts the plurality of outbound symbol streams into a plurality of outbound RF signals, which are provided to the antenna assembly. When the antenna assembly transmits the plurality of outbound RF signals, it generates a desired polarization states (e.g., one of the polarization states shown in FIGS. 73-82).

Figure 92:
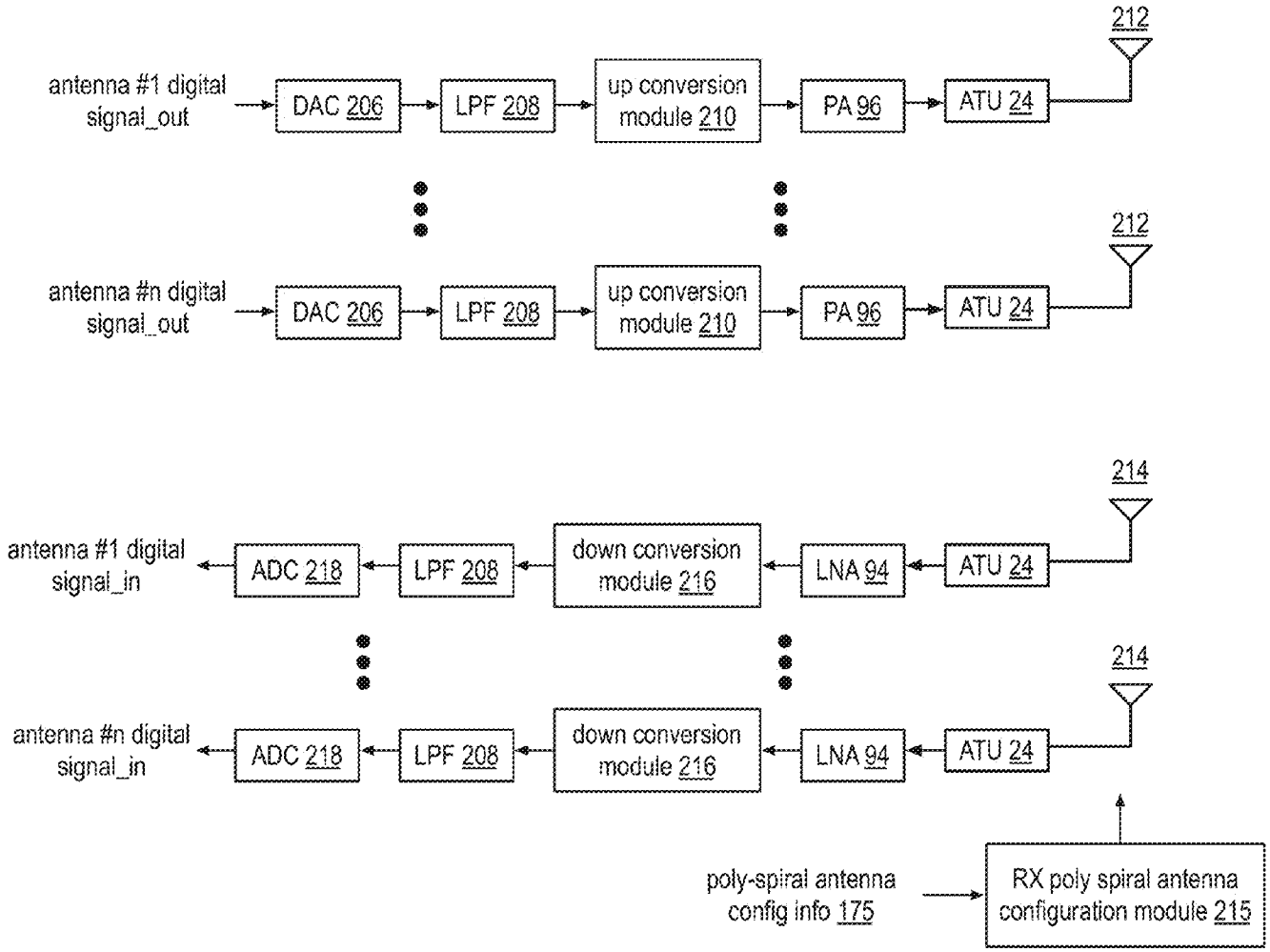
FIG. 92 is a schematic block diagram of an embodiment of RF processing for a wireless communication device using a polarization and/or radiation pattern coding scheme in accordance with the present invention.
Figure 93:
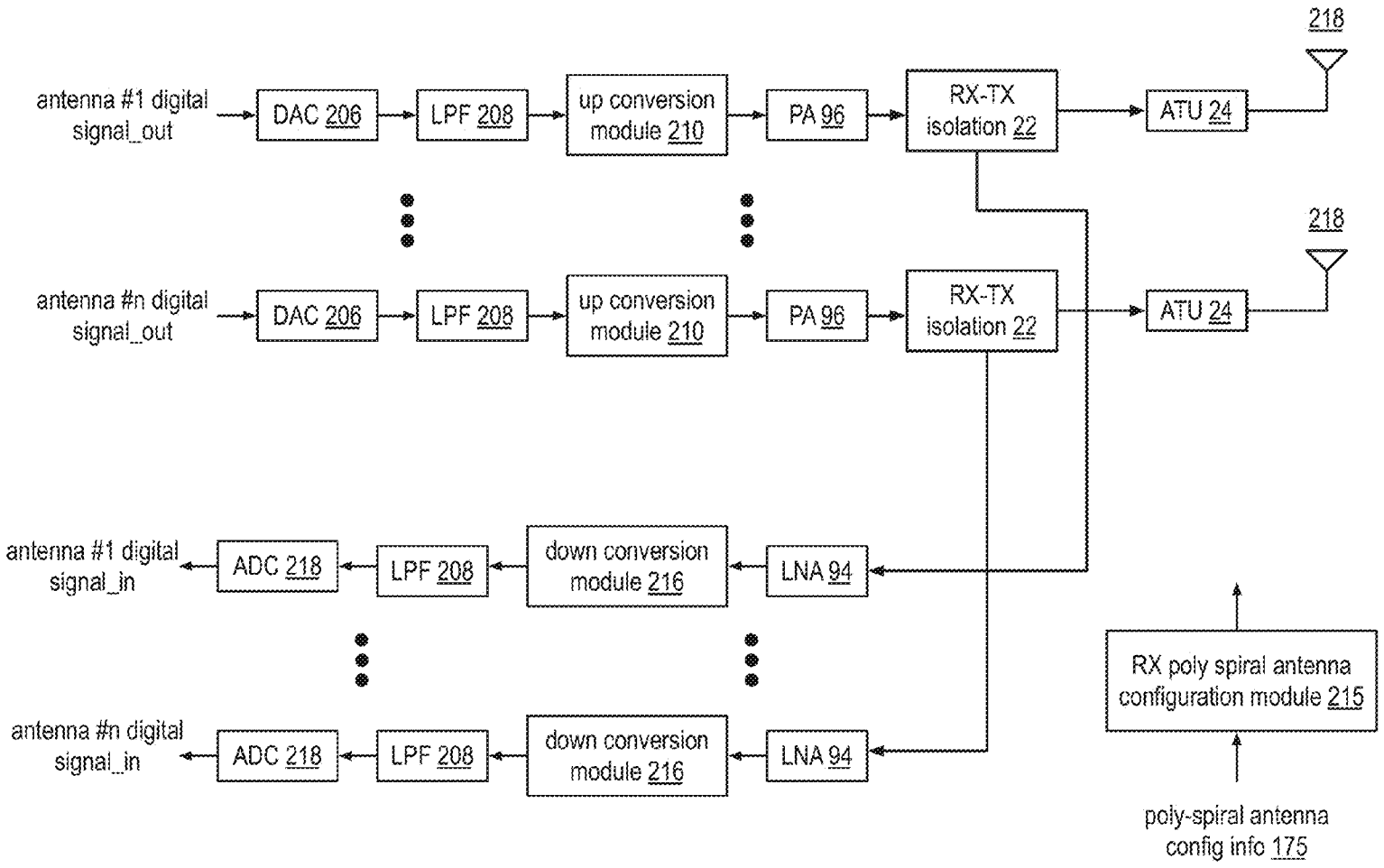
FIG. 93 is a schematic block diagram of another embodiment of RF processing for a wireless communication device using a polarization and/or radiation pattern coding scheme in accordance with the present invention.

For an incoming RF signal that is encoded in accordance with the polarization coding scheme, an RF receiver section (e.g., as shown in FIG. 92 or FIG. 93) receives an inbound RF signal having a particular polarization state. The RF receiver section converts the inbound RF signal into a plurality of inbound symbol streams and sends them to the receiver section of the baseband processing module 16.

The FFT modules 154 convert the plurality of inbound symbol streams into a plurality of signals having Poincare coefficients or other coordinate system coefficients (e.g., into a received polarization state). The multiple antenna constellation demapping module 158 interprets, in accordance with the polarization coding scheme, the coefficients of the signals to produce a stream of interleaved data. In addition, the demapping module 158 produces poly-spiral antenna configuration information 175 that it provides the RF receiver section to configures the receive portion of the poly interwoven spiral antenna. The de-interleaving module 160 de-interleaves the stream of interleaved data to produce encoded data. The decoding module 166 decodes the encoded data to produce inbound data 170.

As an example of receiving a polarization coded inbound RF signal, the RF receiver section includes a poly interwoven spiral antenna that can produce the various polarization states of the polarization coding scheme. With this capability, the RF receiver and baseband receiver section 'listen' to the incoming symbols (i.e. polarization states) and changes its own polarization settings (e.g., the poly-spiral antenna configuration information) based on the most likely polarization that was transmitted. The algorithm to determine the original transmitted polarization can be implemented in many ways, such as for example by monitoring the power of the received waves (symbols) on each of the selectable polarization states, and choosing the one which maximizes the power. In general, the algorithm should maximize, or minimize, the metric that is used to measure the distance between symbols (i.e. polarization states). Once the receiving end determines or estimates the polarization that was transmitted, it assigns a symbol to it. By repeating this process for each symbol, the transmitted message can be reconstructed. Note that the transmitter and receiver ends may or may not need to be synchronized.

In an example of operation of the radiation pattern coding scheme, the encoding module 136 is operably coupled to convert outbound data 150 into encoded data in accordance with one or more wireless communication standards. The puncture module 138 punctures the encoded data to produce punctured encoded data. The interleaver module 142 is operably coupled to interleave the punctured encoded data into an interleaved stream of data. The multiple antenna constellation mapping module 144 maps the interleaved stream of data into a stream of data symbols that corresponds to radiation patterns (e.g., one of the ones shown in FIGS. 83-90), where each data symbol is represented by a set of signals having coefficients based on a particular coordinate system (e.g., a particular transmit radiation pattern). For example, the multiple antenna constellation mapping module 144 maps a given set of interleaved data bits into a set of coefficients (e.g., $A_0$ & $\phi_0$, $A_1$ & $\phi_1$, $A_2$ & $\phi_2$, etc.) and produces multiple signals in accordance with the coefficients ($A_0(t)*\cos(\omega_{RF}(t)+\phi_0(t))$, $A_1(t)*\cos(\omega_{RF}(t)+\phi_1(t))$, $A_2(t)*\cos(\omega_{RF}(t)+\phi_2(t))$, etc.); one signal for each antenna of the poly interwoven spiral antenna. Note that one or more of $A_0$, $A_1$, and $A_2$, may be zero (i.e., no signal or a null signal) and that $\phi_0$, $\phi_1$, and/or $\phi_2$ may be the same phase shift or different phase shifts to achieve the desired radiation pattern.

The plurality of IFFT modules 148 is operably coupled to convert the plurality of multiple antenna encoded signals into a plurality of outbound symbol streams. An RF transmit section (e.g., as shown in FIG. 92 or in FIG. 93) converts the plurality of outbound symbol streams into a plurality of outbound RF signals, which are provided to the antenna assembly. When the antenna assembly transmits the plurality of outbound RF signals, it generates a desired radiation patterns (e.g., one of the radiation patterns shown in FIGS. 83-90).

For an incoming RF signal that is encoded in accordance with the radiation pattern coding scheme, an RF receiver section (e.g., as shown in FIG. 92 or FIG. 93) receives an inbound RF signal having a particular radiation pattern. The RF receiver section converts the inbound RF signal into a plurality of inbound symbol streams and sends them to the receiver section of the baseband processing module 16.

The FFT modules 154 convert the plurality of inbound symbol streams into a plurality of signals having coefficients ((e.g., $A_0$ & $\phi_0$, $A_1$ & $\phi_1$, $A_2$ & $\phi_2$, etc.). The multiple antenna constellation demapping module 158 interprets, in accordance with the radiation pattern coding scheme, the coefficients of the signals to produce a stream of interleaved data. In addition, the demapping module 158 produces poly-spiral antenna configuration information 175 that it provides the RF receiver section to configures the receive portion of the poly interwoven spiral antenna. The de-interleaving module 160 de-interleaves the stream of interleaved data to produce encoded data. The decoding module 166 decodes the encoded data to produce inbound data 170.

As an example of receiving a radiation pattern coded inbound RF signal, the RF receiver section includes a poly interwoven spiral antenna that can produce the various radiation patterns of the radiation pattern coding scheme. With this capability, the RF receiver and baseband receiver section 'listen' to the incoming symbols (i.e. radiation patterns) and changes its own radiation pattern settings (e.g., the poly-spiral antenna configuration information) based on the most likely radiation pattern that was transmitted. The algorithm to determine the original transmitted radiation pattern can be implemented in many ways, such as for example by monitoring the power of the received waves (symbols) on each of the selectable radiation patterns, and choosing the one which maximizes the power. In general, the algorithm should maximize, or minimize, the metric that is used to measure the distance between symbols (i.e. radiation patterns). Once the receiving end determines or estimates the radiation pattern that was transmitted, it assigns a symbol to it. By repeating this process for each symbol, the transmitted message can be reconstructed. Note that the transmitter and receiver ends may or may not need to be synchronized.

In a further embodiment of the baseband processing module, the constellation mapping may further include data constellation mapping such as binary phase shift keying (BPSK), quadrature phase shift keying (QPSK), quadrature amplitude modulation (QAM), amplitude shift keying (ASK), frequency shift keying (FSK), etc. The baseband processing module 16 may further include a space block encoding module and a space block decoding module to MIMO operation. Note that the RF receiver section and RF transmitter section may share an antenna assembly or have they may have separate antenna assemblies. In either case, the baseband processing is essentially the same.

The polarization modulation scheme and the radiation pattern module scheme are valid for any reconfigurable antenna capable of producing a subset of an arbitrary number of polarization states, or radiation patterns, with an arbitrary distance between them. The particular implementation discussed herein uses the interwoven spiral antenna assembly (also referred to as the poly interwoven spiral antenna), which may be in accordance with FIGS. 39-44, FIG. 45, FIGS. 46-47, FIGS. 48-49, FIGS. 50-51, FIGS. 52-53, FIG. 58, FIG. 59, FIG. 61, FIG. 63, FIG. 64, FIGS. 65-66, and/or FIGS. 67-68. By exciting each of the interwoven spiral antennas with a different combination of signals, various polarization states, and/or radiation patterns, may be obtained. Further note that more than three antennas may be used in the antenna assembly to achieve a greater variety of antenna polarization states.

FIG. 92 is a schematic block diagram of an embodiment of RF processing for a wireless communication device coupled to the baseband processing module of FIG. 91. The RF transmitter section includes a plurality of digital to analog converts (DAC) 206, a plurality of low pass filters (LPF) 208, a plurality of up conversion modules 210, a plurality of power amplifiers 96, and a plurality of antenna tuning units (ATU) 24 that is coupled to a plurality of antennas of a transmit antenna assembly 212. The RF receiver section includes a plurality of ATUs 24 that is coupled to a plurality of antennas of a receive antenna assembly 214, a plurality of low noise amplifiers (LNA) 94, a plurality of down conversion modules 216, a plurality of LPFs 208, and a plurality of analog to digital conversion (ADC) modules 218.

FIG. 93 is a schematic block diagram of another embodiment of RF processing for a wireless communication device coupled to the baseband processing module of FIG. 91. The RF transmitter section includes a plurality of digital to analog convertors (DAC) 206, a plurality of low pass filters (LPF) 208, a plurality of up conversion modules 210, and a plurality of power amplifiers 96. The RF receiver section includes a plurality of low noise amplifiers (LNA) 94, a plurality of down conversion modules 216, a plurality of LPFs 208, and a plurality of analog to digital conversion (ADC) modules 218. The RF transmitter section and RF receiver section share a plurality of RX-TX isolation modules 22 and a plurality of antenna tuning units (ATU) 24 that is coupled to a plurality of antennas of a shared antenna assembly 218.

Figures 94, 95:
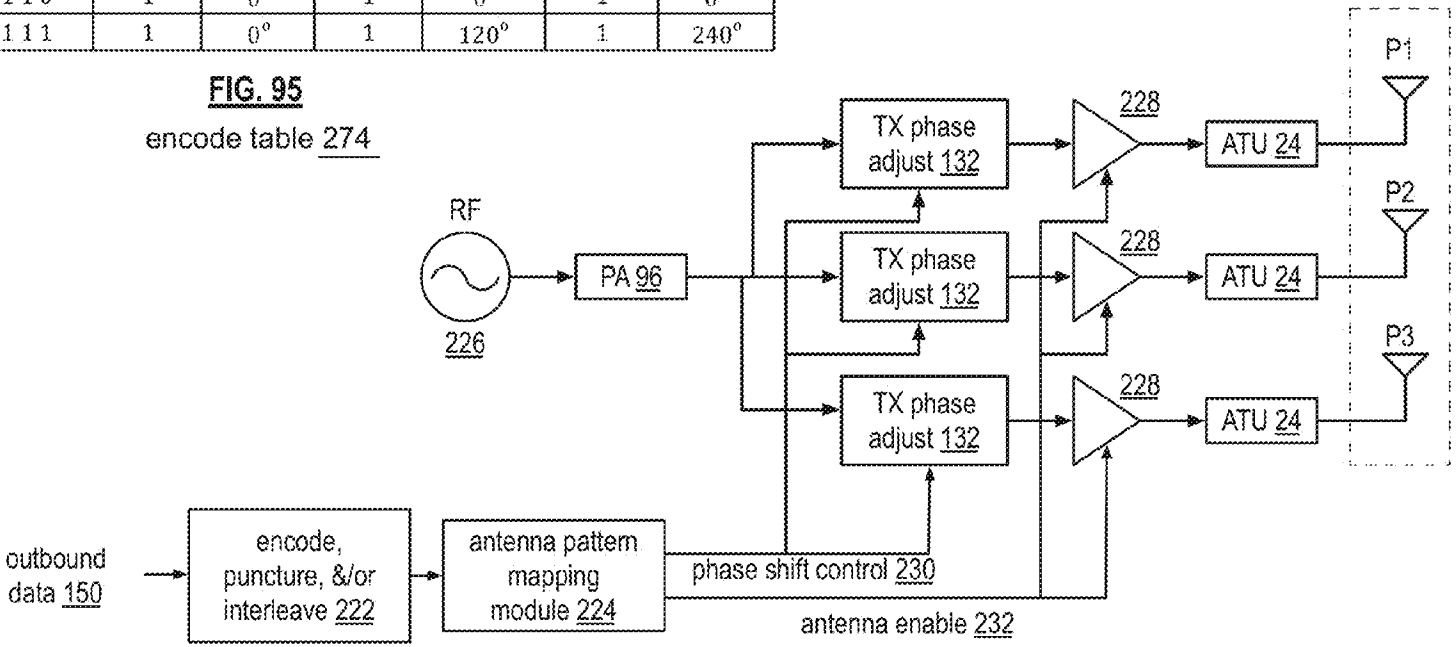
FIG. 94 is a schematic block diagram of an embodiment of a transmitter of a wireless communication device that utilizes a various excitation pattern encoding scheme in accordance with the present invention.
FIG. 95 is a diagram of an example of an encoding table for a various excitation pattern encoding scheme in accordance with the present invention.

FIG. 94 is a schematic block diagram of an embodiment of a transmitter 220 of a wireless communication device that utilizes a various radiation pattern encoding scheme (e.g., a multiple antenna constellation mapping protocol) and may further use polarization coding. The transmitter 220 includes an encoding module, a puncture module, and/or an interleaving module 222 that converts outbound data 150 into encoded data. The transmitter section further includes an antenna pattern mapping module 224 (which may be used for polarization coding and/or radiation pattern coding), an RF oscillator 226, a power amplifier (PA) 96, a plurality of transmit (TX) phase adjust modules 132, a plurality of gated buffers 228, and a plurality of antenna tuning units (ATU) 24 coupled to a plurality of antennas of an antenna assembly. The antenna assembly may be a separate antenna assembly for the transmitter 220 or it may be shared with a receiver of the wireless communication device. When the antenna is shared, the ATUs 24 are shared and the wireless communication device further includes RX-TX isolation modules coupled to the ATUs 24.

In an example of operation, the power amplifier 96 amplifies an RF oscillation of the RF oscillator 226 to produce an amplified RF signal. The TX phase adjust modules 132 adjust the phase of the amplified RF signal based on the phase shift control signal 230. The gated buffers, or drivers, 228 provide the corresponding phase shifted RF signal to their respective ATUs 24 based on the antenna enable signal 232.

The antenna pattern mapping module 224 generates the phase shift control signal 230 and the antenna enable signal 232 based a symbol of encoded data and in accordance with the encoding table 274 of FIG. 101 (e.g., based on polarization coding and/or radiation pattern coding). As an example of radiation pattern coding, if the symbol of the encoded data is 000, the phase shift control signal 230 for each antenna is set to zero degrees and the antenna enable signal enables P1 only (i.e., the first antenna only to achieve the radiation pattern of FIG. 83). If the symbol of the encoded data is 101, the phase shift control signal 230 for each antenna is set to zero degrees and the antenna enable signal 230 enables P1 and P2 (i.e., the first and second antennas to achieve the radiation pattern of FIG. 88). If the symbol of encoded data is 111, the antenna pattern mapping module 224 generates the phase shift control signal 230 to enable the TX phase shift adjust modules 132 to adjust the corresponding RF signal by 0°, 120°, and 240°, respectively. The antenna pattern mapping module 224 also generates antenna control signal to enable the gated buffers 228 to pass the respective phase shifted RF signals to the ATUs 24.

FIG. 96 is a schematic block diagram of an embodiment of a receiver 234 of a wireless communication device that utilizes polarization and/or radiation pattern coding schemes. The receiver 234 includes a decoding module, a de-puncture module, and/or a de-interleaving module 236 that converts encoded data into inbound data 170. The receiver section 234 further includes an antenna pattern demapping module 238 (for polarization coding demapping and/or radiation pattern coding demapping), a plurality of down conversion modules 216, a plurality of low noise amplifiers (LNA) 94, and a plurality of antenna tuning units (ATU) 24 coupled to a plurality of antennas of an antenna assembly 240. The antenna assembly 240 may be a separate antenna assembly for the receiver 234 or it may be shared with a transmitter of the wireless communication device. When the antenna 240 is shared, the ATUs 24 are shared and the wireless communication device further includes RX-TX isolation modules coupled to the ATUs 24.

In an example of operation of radiation pattern coding, each of the antennas 240 receives an inbound RF signal that it provides to a corresponding ATU 24. The ATU 24, which functions as previously discussed, provides the inbound RF signal to the corresponding LNA 94. The LNA 94 amplifies the inbound RF signal and provides it to the down conversion module 216. Each of the down conversion modules 216 converts the inbound RF signal into an inbound symbol stream, which is converted to digital symbols streams by ADCs (not shown).

The antenna pattern demapping module 238 receives the digital symbol streams and, for a corresponding set of symbols, demaps them based on the decoding table 242 of FIG. 97. For instance, if the received radiation pattern of the inbound RF signal indicated that P1 was the only active port, then the antenna pattern demapping module 238 converts the set of symbols into an encoded data value of 000. The decoding, depuncture, and/or de-interleaving 236 converts the encoded data value into a portion of the inbound data 170.

FIG. 98 is a schematic block diagram of an embodiment of a down conversion module 216 of a receiver 234 of FIG. 96. Each of the down conversion module 216 includes an RX phase adjust module 134, a mixer 244, an RF oscillator 226, and a low pass filter 246. The RX phase adjust module 134 adjusts the phase of the received inbound RF signal based on a control signal received from the antenna pattern demapping module 238 to produce a phase adjusted signal. The mixer 244 mixes the phase adjusted signal with the RF oscillator 226 to produce a mixed signal. The low pass filter 246 filters the mixed signal to produce a baseband signal, which is converted to a digital signal.

FIG. 99 is a schematic block diagram of an embodiment of a baseband transmitter 248 path of a wireless communication device that utilizes a various excitation pattern encoding scheme (e.g., multiple antenna constellation mapping protocol) and a constellation map (e.g., wireless communication protocol as previously mentioned). The baseband transmitter 248 path includes a data splitter 250, an encoding module 252, a puncture module 254, an interleaver 256, a constellation mapping module 258, an IFFT module 260, a second encoding module, a second puncture module, a second interleaving module 262, and an antenna pattern mapping module 264 (e.g., for polarization coding and/or for radiation pattern coding).

The data splitting module 250 splits outbound data 270 into two paths: one for the constellation encoding path (i.e., the top path in the figure) and the antenna polarization and/or radiation pattern mapping path (i.e., the bottom path in the figure). The data splitting may be equal (e.g., 50% to each path) or at another ratio based on the encoding capabilities of each path. For example, if the constellation path 276 uses a 16 QAM encoding scheme as shown in FIG. 101 and the antenna pattern mapping path uses the encoding table 274 of FIG. 100, then for every seven bits of outbound data 270: four bits would be processed by the constellation mapping path and three bits would be processed by the antenna polarization and/or radiation pattern mapping path. For a given set of bits, each path operates as previously discussed to produce an outbound symbol stream, a phase shift control signal 266, and an antenna enable signal 268.

FIG. 102 is a schematic block diagram of an embodiment of an RF transmitter 278 of a wireless communication device that utilizes an antenna polarization and/or radiation pattern encoding scheme and a constellation map encoding. The RF transmitter 278 includes a digital to analog converter (DAC) 206, a low pass filter (LPF) 208, an up conversion module 210, a power amplifier (PA) 96, a plurality of TX phase adjust modules 132, a plurality of gated RF buffers 228, and a plurality of ATUs 24 coupled to a plurality of antennas of an antenna assembly.

In an example of operation, the DAC 206, LPF 208, up conversion module 210, and PA 96 convert the outbound symbol stream 152 into an outbound RF signal, which is provided to the plurality of TX phase adjust modules 132. The TX phase adjust modules 132 adjust the phase of the outbound RF signals in accordance with the phase shift control signal 230. The gated RF buffers 228 pass the phase shifted RF signals to the ATUs 24 in accordance with the antenna enable control signal 232. The ATUs 24 provide the enabled phased shifted RF signals to the respective antennas for transmission in a given radiation pattern. In this manner, the RF signal included encoded data as does the radiation pattern in which the RF signal is transmitted.

FIG. 103 is a schematic block diagram of an embodiment of a receiver 234 of a wireless communication device that utilizes polarization and/or radiation pattern encoding scheme and a constellation map. The receiver 234 includes a plurality of ATUs 24, a plurality of LNAs 94, a plurality of down conversion modules 216, an antenna pattern demapping module 238, a de-interleaving module, a depuncture module, a decoding module, a data de-splitting module 280, a multiplexer 282, an ADC 218, an FFT 154, a constellation demapping module 258, a second de-interleaving module, a second depuncture module, and a second decoding module 236.

In an example of operation, the antennas receive an inbound RF signal that is provided to the respective ATUs 24. The LNAs 94 amplify the respective inbound RF signals, which are subsequently converted to baseband signals by the down conversion modules 216 as previously discussed. For an antenna pattern mapping receive path, the antenna pattern demapping module 238, the de-interleaving module, the depuncture module, and the decoding module function 236 as previously discussed to produce antenna pattern decoded data.

The multiplexer 282 selections one or more of the baseband signals, which is processed by the ADC 218, FFT module 154, constellation demapping module 258, the de-interleaving module, the depuncture module, and the decoding module 236 function as previously discussed to produce decoded data. The data de-splitting module 280 combines the antenna pattern decoded data and the decoded data to produce a portion of the inbound data 170.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As also may be used herein, the term "module", "processing module", "processing unit", or "unit" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The "module", "processing module", "processing unit", or "unit" may have an associated memory and/or internal memory, which may be a single memory device, a plurality of memory devices, and/or embedded circuitry of the "module", "processing module", "processing unit", or "unit". Such a memory device may be a read-only memory, random access memory, volatile memory, non-volatile memory, static memory, dynamic memory, flash memory, cache memory, and/or any device that stores digital information. Note that if the "module", "processing module", "processing unit", or "unit" includes more than one processing device, the processing devices may be centrally located (e.g., directly coupled together via a wired and/or wireless bus structure) or may be distributedly located (e.g., cloud computing via indirect coupling via a local area network and/or a wide area network). Further note that when the "module", "processing module", "processing unit", or "unit" implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that the memory element may store, and the "module", "processing module", "processing unit", or "unit" may execute, hard coded and/or operational instructions corresponding to at least some of the steps and/or functions illustrated in one or more the figures.

While the transistors in the above described figure(s) is/are shown as field effect transistors (FETs), as one of ordinary skill in the art will appreciate, the transistors may be implemented using any type of transistor structure including, but not limited to, bipolar, metal oxide semiconductor field effect transistors (MOSFET), N-well transistors, P-well transistors, enhancement mode, depletion mode, and zero voltage threshold (VT) transistors.

The present invention has also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

The present invention has been described above with the aid of functional building blocks illustrating the performance of certain significant functions. The boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The figures and corresponding text of the present patent application may individually and/or collectively illustrate one or more aspects of one or more embodiments that are in accordance with the present invention. The one or more aspects illustrated in one or more figures may be combined with one or more aspects illustrated in one or more other figures to provide a further embodiment in accordance with the invention. Such combination of different aspects may be explicitly expressed, implicitly expressed, or inferred by inclusion in the present patent application.

What is claimed is:

1. An interwoven spiral antenna assembly comprising:

a single transmission interwoven spiral antenna for transmission of RF communication signals comprising:

a first non-inverted spiral section having a spiral shape;

a first inverted spiral section having an inverted spiral shape, wherein the first non-inverted spiral section is coupled to the first inverted spiral section at a center point; and an excitation region coupled to the first non-inverted spiral section and the first inverted spiral section, wherein, when excited by a first phase shifted signal, the single transmission interwoven spiral antenna has a first circular polarization radiation pattern offset from perpendicular to the single transmission interwoven spiral antenna by phase of excitation of the first phase shifted signal; and a single reception interwoven spiral antenna for reception of RF communication signals comprising:

a second non-inverted spiral section having a spiral shape;

a second inverted spiral section having an inverted spiral shape, wherein the second non-inverted spiral section is coupled to the second inverted spiral section at a center point; and an excitation region coupled to the second non-inverted spiral section and the second inverted spiral section, wherein, when excited by a second phase shifted signal, the single reception interwoven spiral antenna has a second circular polarization radiation pattern offset from perpendicular to the single reception interwoven spiral antenna by phase of excitation of the second phase shifted signal.

2. The interwoven spiral antenna assembly of claim 1, wherein the first and second circular polarizations are of opposite circular polarity.

3. The interwoven spiral antenna assembly of claim 1, wherein patterns of the single transmission and reception interwoven spiral antennas are flipped 180 degrees.

4. The interwoven spiral antenna assembly of claim 1 further comprising at least one of the single transmission and reception interwoven spiral antennas being excited with zero-phase shifted signals producing a radiation pattern perpendicular to the at least one single transmission and reception interwoven spiral antennas.

5. The interwoven spiral antenna assembly of claim 1 further comprising, each of the single transmission and reception interwoven spiral antennas, when excited, having a bandwidth with a high frequency corner, a low frequency corner, and a band pass region, wherein the high frequency corner is substantially established by dimensions of the excitation region, the low frequency corner is substantially established by a circumference of the single transmission or reception interwoven spiral antenna, and wherein the band pass region has a substantially constant impedance.

6. The interwoven spiral antenna assembly of claim 1 further comprising for each of the single transmission and reception interwoven spiral antennas:

the non-inverting spiral section and the inverted spiral section collectively providing any of:

a Celtic spiral, Archimedes spiral and a Celtic logarithmic spiral.

7. The interwoven spiral antenna assembly of claim 1 further comprising for each of the single transmission and reception interwoven spiral antennas:

the excitation region includes an excitation point at the center point and a return connection.

8. The interwoven spiral antenna assembly of claim 1 further comprising:

each of the first and second non-inverting spiral sections and the first and second inverted spiral sections having a length of m*one-half wavelength, where m is an integer greater than or equal to one.

9. The interwoven spiral antenna assembly of claim 1 further comprising:

the excitation region including a first excitation point, a second excitation point, and a return excitation point, wherein the return excitation point is at the center point, the first excitation point is at a non-centered end of the non-inverted spiral section, and the second excitation point is at a non-centered end of the inverted spiral section, wherein the first and second excitation points are excited with a substantially similar signal.

10. The interwoven spiral antenna assembly of claim 1 further comprising:

the excitation region includes a non-inverting excitation point and an inverting excitation point, wherein the non-inverting excitation point is at a non-centered end of the non-inverted spiral section and the inverting excitation point is at a non-centered end of the inverted spiral section to provide a differential input antenna.

11. The interwoven spiral antenna assembly of claim 1 further comprising:

the coupling of the respective non-inverting and inverted spiral sections of the single transmission and reception interwoven spiral antennas includes separation by a distance at the center point; and the excitation region includes a first excitation point and a second excitation point, wherein the first excitation point is at a non-centered end of the non-inverted spiral section, and the second excitation point is at a non-centered end of the inverted spiral section to provide a dipole antenna.

12. A Celtic spiral antenna comprises:

an excitation region coupled to the electromagnetic conductive trace which, when excited by a phase shifted signal, produces a bandwidth having a high frequency comer, a low frequency comer, and a band pass region, wherein the high frequency corner is substantially established by dimensions of the excitation region, the low frequency corner is substantially established by a circumference of the electromagnetic conductive trace, and wherein the band pass region has a substantially constant impedance: and wherein the Celtic spiral antenna has a circular polarization radiation pattern offset from perpendicular to the Celtic spiral antenna by phase of excitation of the phase shifted signal.

13. The Celtic spiral antenna of claim 12 further comprising a first circular polarization used for transmission of first RF signals and a second circular polarization used for reception of second RF signals.

14. The Celtic spiral antenna of claim 12 further comprising:

the excitation region including an excitation point and a return connection, wherein the excitation point is located substantially at a center of the electromagnetic conductive trace.

15. The Celtic spiral antenna of claim 12 further comprising:

the electromagnetic conductive trace has a length of m*wavelength, where m is an integer greater than or equal to one.

16. The Celtic spiral antenna of claim 12 further comprising:

the excitation region including a non-inverting excitation point and an inverting excitation point, wherein the non-inverting excitation point is at a first end of the electromagnetic conductive trace and the inverting excitation point is at a second end of the electromagnetic conductive trace to provide a differential input antenna.

17. The Celtic spiral antenna of claim 12, wherein the Celtic spiral comprises a Celtic logarithmic spiral.

18. An interwoven Celtic spiral antenna comprising:

an excitation region coupled to at least one of the non-inverted spiral section and the inverted spiral section, wherein, when excited by a phase shifted signal, the interwoven Celtic spiral antenna has a circular polarization; and wherein the interwoven Celtic spiral antenna has a circular polarization radiation pattern offset from perpendicular to the interwoven Celtic spiral antenna by phase of excitation of the phase shifted signal.

19. The interwoven Celtic spiral antenna of claim 18 further comprising a first circular polarization used for transmission of first RF signals and a second circular polarization used for reception of second RF signals.

20. The interwoven Celtic spiral antenna of claim 18, wherein the interwoven Celtic spiral comprises an interwoven Celtic logarithmic spiral.

* * * * *